US010535357B2

(12) United States Patent
Chebiyyam et al.

(10) Patent No.: US 10,535,357 B2
(45) Date of Patent: Jan. 14, 2020

(54) ENCODING OR DECODING OF AUDIO SIGNALS

(71) Applicant: QUALCOMM Incorporated, San Diego, CA (US)

(72) Inventors: Venkata Subrahmanyam Chandra Sekhar Chebiyyam, Seattle, WA (US); Venkatraman Atti, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 16/147,124

(22) Filed: Sep. 28, 2018

(65) Prior Publication Data

US 2019/0108844 A1 Apr. 11, 2019

Related U.S. Application Data

(60) Provisional application No. 62/568,713, filed on Oct. 5, 2017.

(51) Int. Cl.
*G10L 19/008* (2013.01)
*G10L 19/22* (2013.01)

(52) U.S. Cl.
CPC ..... *G10L 19/008* (2013.01); *G10L 19/22* (2013.01)

(58) Field of Classification Search
CPC ..... G10L 19/008; G10L 19/02; G10L 19/022; G10L 19/04; G10L 25/18; G10L 19/0204; G10L 21/038; G10L 19/005; G10L 19/03; G10L 19/26; G10L 21/0388; G10L 19/06; G10L 19/083; G10L 19/20; H04S 2400/03; H04S 2420/03; H04S 3/008; H04S 2400/01; H04S 1/007; H04S 2400/13; H04S 2400/15; H04S 3/02; H04S 7/30; H04R 3/005; H04R 3/12
USPC ..... 381/17–23; 700/94
See application file for complete search history.

(56) References Cited

U.S. PATENT DOCUMENTS

2007/0258607 A1* 11/2007 Purnhagen ..... G10L 19/008 381/307
2009/0055194 A1* 2/2009 Hotho ..... G10L 19/008 704/500
2011/0106540 A1* 5/2011 Schuijers ..... G10L 19/008 704/500

(Continued)

FOREIGN PATENT DOCUMENTS

WO 2017222871 A1 12/2017
WO 2018136166 A1 7/2018

OTHER PUBLICATIONS

International Search Report and Written Opinion—PCT/US2018/053788—ISA/EPO—Jan. 16, 2019.

(Continued)

*Primary Examiner* — Lun-See Lao
(74) *Attorney, Agent, or Firm* — Toler Law Group

(57) ABSTRACT

A device includes a receiver and a decoder. The receiver is configured to receive bitstream parameters corresponding to at least an encoded mid signal. The decoder is configured to generate a synthesized mid signal based on the bitstream parameters. The decoder is also configured to generate a synthesized side signal selectively based on the bitstream parameters in response to determining whether the bitstream parameters correspond to an encoded side signal.

30 Claims, 25 Drawing Sheets

(56) References Cited

U.S. PATENT DOCUMENTS

| | | | | |
|---|---|---|---|---|
| 2015/0124974 | A1 | 5/2015 | Kim et al. | |
| 2016/0275958 | A1* | 9/2016 | Dick | G10L 19/008 |
| 2018/0197552 | A1* | 7/2018 | Fuchs | G10L 19/022 |
| 2018/0293992 | A1* | 10/2018 | Chebiyyam | G10L 19/008 |

OTHER PUBLICATIONS

Valin J.M., et al., "IETF, Definition of the Opus Audio Codec, Tech. Report RFC 6716", Sep. 1, 2012 (Sep. 1, 2012), XP055135479, pp. 1-326, Retrieved from the Internet: URL:http://www.rfc-editor.org/rfc/pdfrfc/rfc6716.txt.pdf [retrieved on Aug. 20, 2014].

* cited by examiner

ENCODING OR DECODING OF AUDIO SIGNALS

I. CROSS REFERENCE TO RELATED APPLICATIONS

The present application claims priority from U.S. Provisional Patent Application No. 62/568,713 entitled "ENCODING OR DECODING OF AUDIO SIGNALS," filed Oct. 5, 2017, which is incorporated herein by reference in its entirety.

II. FIELD

The present disclosure is generally related to encoding or decoding of audio signals.

III. DESCRIPTION OF RELATED ART

Advances in technology have resulted in smaller and more powerful computing devices. For example, there currently exist a variety of portable personal computing devices, including wireless telephones such as mobile and smart phones, tablets and laptop computers that are small, lightweight, and easily carried by users. These devices can communicate voice and data packets over wireless networks. Further, many such devices incorporate additional functionality such as a digital still camera, a digital video camera, a digital recorder, and an audio file player. Also, such devices can process executable instructions, including software applications, such as a web browser application, that can be used to access the Internet. As such, these devices can include significant computing capabilities.

A computing device may include multiple microphones to receive audio signals. In stereo-encoding, audio signals from the microphones are used to generate a mid signal and one or more side signals. The mid signal may correspond to a sum of the first audio signal and the second audio signal. A side signal may correspond to a difference between the first audio signal and the second audio signal. An encoder at a first device may generate an encoded mid signal corresponding to the mid signal and an encoded side signal corresponding to the side signal. The encoded mid signal and the encoded side signal may be transmitted from the first device to a second device.

The second device may generate a synthesized mid signal corresponding to the encoded mid signal and a synthesized side signal corresponding to the side signal. The second device may generate output signals based on the synthesized mid signal and the synthesized side signal. Communication bandwidth between the first device and the second device is limited. Reducing a difference between the output signals generated at the second device and the audio signals received at the first device in the presence of limited bandwidth is a challenge.

IV. SUMMARY

In a particular aspect, a device includes an encoder configured to generate a mid signal based on a first audio signal and a second audio signal. The mid signal includes a low-band mid signal and a high-band mid signal. The encoder is configured to generate a side signal based on the first audio signal and the second audio signal. The encoder is further configured to generate a plurality of inter-channel prediction gain parameters based on the low-band mid signal, the high-band mid signal, and the side signal. The device also includes a transmitter configured to send the plurality of inter-channel prediction gain parameters and an encoded audio signal to a second device.

In another particular aspect, a method includes generating, at a first device, a mid signal based on a first audio signal and a second audio signal. The mid signal includes a low-band mid signal and a high-band mid signal. The method includes generating a side signal based on the first audio signal and the second audio signal. The method includes generating a plurality of inter-channel prediction gain parameters based on the low-band mid signal, the high-band mid signal, and the side signal. The method further includes sending the plurality of inter-channel prediction gain parameters and an encoded audio signal to a second device.

In another particular aspect, an apparatus includes means for generating, at a first device, a mid signal based on a first audio signal and a second audio signal. The mid signal includes a low-band mid signal and a high-band mid signal. The apparatus includes means for generating a side signal based on the first audio signal and the second audio signal. The apparatus includes means for generating a plurality of inter-channel prediction gain parameters based on the low-band mid signal, the high-band mid signal and the side signal. The apparatus further includes means for sending the plurality of inter-channel prediction gain parameters and an encoded audio signal to a second device.

In another particular aspect, a computer-readable storage device stores instructions that, when executed by a processor, cause the processor to perform operations including generating, at a first device, a mid signal based on a first audio signal and a second audio signal. The mid signal includes a low-band mid signal and a high-band mid signal. The operations include generating a side signal based on the first audio signal and the second audio signal. The operations include generating an inter-channel prediction gain parameter based on the low-band mid signal, the high-band mid signal, and the side signal. The operations further include sending the plurality of inter-channel prediction gain parameters and an encoded audio signal to a second device.

In another particular aspect, a device includes a receiver configured to receive one or more upmix parameters, one or more inter-channel bandwidth extension parameters, one or more inter-channel prediction gain parameters, and an encoded audio signal. The encoded audio signal includes an encoded mid signal. The device also includes a decoder configured to generate a synthesized mid signal based on the encoded mid signal. The decoder is further configured to generate a synthesized side signal based on the synthesized mid signal and the one or more inter-channel prediction gain parameters. The decoder is also configured to generate one or more output signals based on the synthesized mid signal, the synthesized side signal, the one or more upmix parameters, and the one or more inter-channel bandwidth extension parameters.

In another particular aspect, a method includes receiving one or more upmix parameters, one or more inter-channel bandwidth extension parameters, one or more inter-channel prediction gain parameters, and an encoded audio signal at a first device from a second device. The encoded audio signal includes an encoded mid signal. The method includes generating, at the first device, a synthesized mid signal based on the encoded mid signal. The method further includes generating a synthesized side signal based on the synthesized mid signal and the one or more inter-channel prediction gain parameters. The method also includes generating one or more output signals based on the synthesized mid signal, the synthesized side signal, the one or more upmix parameters, and the one or more inter-channel bandwidth extension parameters.

In another particular aspect, an apparatus includes means for receiving one or more upmix parameters, one or more inter-channel bandwidth extension parameters, one or more inter-channel prediction gain parameters, and an encoded audio signal. The encoded audio signal includes an encoded mid signal. The apparatus includes means for generating a synthesized mid signal based on the encoded mid signal. The apparatus further includes means for generating a synthesized side signal based on the synthesized mid signal and the one or more inter-channel prediction gain parameters. The apparatus includes means for generating one or more output signals based on the synthesized mid signal, the synthesized side signal, the one or more upmix parameters, and the one or more inter-channel bandwidth extension parameters.

In another particular aspect, a computer-readable storage device stores instructions that, when executed by a processor, cause the processor to perform operations including receiving one or more upmix parameters, one or more inter-channel bandwidth extension parameters, one or more inter-channel prediction gain parameters, and an encoded audio signal at a first device from a second device. The encoded audio signal includes an encoded mid signal. The operations include generating, at the first device, a synthesized mid signal based on the encoded mid signal. The operations further include generating a synthesized side signal based on the synthesized mid signal and the one or more inter-channel prediction gain parameters. The operations include generating one or more output signals based on the synthesized mid signal, the synthesized side signal, the one or more upmix parameters, and the one or more inter-channel bandwidth extension parameters.

In another particular aspect, a device includes an encoder and a transmitter. The encoder is configured to generate a mid signal based on a first audio signal and a second audio signal. The encoder is also configured to generate a side signal based on the first audio signal and the second audio signal. The encoder is further configured to determine a plurality of parameters based on the first audio signal, the second audio signal, or both. The encoder is also configured to determine, based on the plurality of parameters, whether the side signal is to be encoded for transmission. The encoder is further configured to generate an encoded mid signal corresponding to the mid signal. The encoder is also configured to generate an encoded side signal corresponding to the side signal in response to determining that the side signal is to be encoded for transmission. The transmitter is configured to transmit bitstream parameters corresponding to the encoded mid signal, the encoded side signal, or both.

In another particular aspect, a device includes a receiver and a decoder. The receiver is configured to receive bitstream parameters corresponding to at least an encoded mid signal. The decoder is configured to generate a synthesized mid signal based on the bitstream parameters. The decoder is also configured to generate a synthesized side signal selectively based on the bitstream parameters in response to determining whether the bitstream parameters correspond to an encoded side signal.

In another particular aspect, a method includes generating, at a device, a mid signal based on a first audio signal and a second audio signal. The method also includes generating, at the device, a side signal based on the first audio signal and the second audio signal. The method further includes determining, at the device, a plurality of parameters based on the first audio signal, the second audio signal, or both. The method also includes determining, based on the plurality of parameters, whether the side signal is to be encoded for transmission. The method further includes generating, at the device, an encoded mid signal corresponding to the mid signal. The method also includes generating, at the device, an encoded side signal corresponding to the side signal in response to determining that the side signal is to be encoded for transmission. The method further includes initiating transmission, from the device, of bitstream parameters corresponding to the encoded mid signal, the encoded side signal, or both.

In another particular aspect, a method includes receiving, at a device, bitstream parameters corresponding to at least an encoded mid signal. The method also includes generating, at the device, a synthesized mid signal based on the bitstream parameters. The method further includes generating, at the device, a synthesized side signal selectively based on the bitstream parameters in response to determining whether the bitstream parameters correspond to an encoded side signal.

In another particular aspect, a computer-readable storage device stores instructions that, when executed by a processor, cause the processor to perform operations including generating a mid signal based on a first audio signal and a second audio signal. The operations also include generating a side signal based on the first audio signal and the second audio signal. The operations further include determining a plurality of parameters based on the first audio signal, the second audio signal, or both. The operations also include determining, based on the plurality of parameters, whether the side signal is to be encoded for transmission. The operations further include generating an encoded mid signal corresponding to the mid signal. The operations also include generating an encoded side signal corresponding to the side signal in response to determining that the side signal is to be encoded for transmission. The operations further include initiating transmission of bitstream parameters corresponding to the encoded mid signal, the encoded side signal, or both.

In another particular aspect, a computer-readable storage device stores instructions that, when executed by a processor, cause the processor to perform operations including receiving bitstream parameters corresponding to at least an encoded mid signal. The operations also include generating a synthesized mid signal based on the bitstream parameters. The operations further include generating a synthesized side signal selectively based on the bitstream parameters in response to determining whether the bitstream parameters correspond to an encoded side signal.

In another particular aspect, a device includes an encoder and a transmitter. The encoder is configured to generate a downmix parameter having a first value in response to determining that a coding or prediction parameter indicates that a side signal is to be encoded for transmission. The first value is based on an energy metric, a correlation metric, or both. The energy metric, the correlation metric, or both, are based on a first audio signal and a second audio signal. The encoder is also configured to generate the downmix parameter having a second value based at least in part on determining that the coding or prediction parameter indicates that the side signal is not to be encoded for transmission. The second value is based on a default downmix parameter value, the first value, or both. The encoder is further configured to generate a mid signal based on the first audio signal, the second audio signal, and the downmix parameter. The encoder is also configured to generate an encoded mid signal corresponding to the mid signal. The transmitter is configured to transmit bitstream parameters corresponding to at least the encoded mid signal.

In another particular aspect, a device includes a receiver and a decoder. The receiver is configured to receive bitstream parameters corresponding to at least an encoded mid signal. The decoder is configured to generate a synthesized mid signal based on the bitstream parameters. The decoder is also configured to generate one or more upmix parameters. An upmix parameter of the one or more upmix parameters has a first value or a second value based on determining whether the bitstream parameters correspond to an encoded side signal. The first value is based on a received downmix parameter. The second value is based at least in part on a default parameter value. The decoder is further configured to generate an output signal based on at least the synthesized mid signal and the one or more upmix parameters.

In another particular aspect, a method includes generating, at a device, a downmix parameter having a first value in response to determining that a coding or prediction parameter indicates that a side signal is to be encoded for transmission. The first value is based on an energy metric, a correlation metric, or both. The energy metric, the correlation metric, or both, are based on a first audio signal and a second audio signal. The method also includes generating, at the device, the downmix parameter having a second value based at least in part on determining that the coding or prediction parameter indicates that the side signal is not to be encoded for transmission. The second value is based on a default downmix parameter value, the first value, or both. The method further includes generating, at the device, a mid signal based on the first audio signal, the second audio signal, and the downmix parameter. The method also includes generating, at the device, an encoded mid signal corresponding to the mid signal. The method further includes initiating transmission, from the device, of bitstream parameters corresponding to at least the encoded mid signal.

In another particular aspect, a method includes receiving, at a device, bitstream parameters corresponding to at least an encoded mid signal. The method also includes generating, at the device, a synthesized mid signal based on the bitstream parameters. The method further includes generating, at the device, one or more upmix parameters. An upmix parameter of the one or more upmix parameters having a first value or a second value based on determining whether the bitstream parameters correspond to an encoded side signal. The first value is based on a received downmix parameter. The second value is based at least in part on a default parameter value. The method also includes generating, at the device, an output signal based on at least the synthesized mid signal and the one or more upmix parameters.

In another particular aspect, a computer-readable storage device stores instructions that, when executed by a processor, cause the processor to perform operations including generating a downmix parameter having a first value in response to determining that a coding or prediction parameter indicates that a side signal is to be encoded for transmission. The first value is based on an energy metric, a correlation metric, or both. The energy metric, the correlation metric, or both, are based on a first audio signal and a second audio signal. The operations also include generating the downmix parameter having a second value based at least in part on determining that the coding or prediction parameter indicates that the side signal is not to be encoded for transmission. The second value is based on a default downmix parameter value, the first value, or both. The operations further include generating a mid signal based on the first audio signal, the second audio signal, and the downmix parameter. The operations also include generating an encoded mid signal corresponding to the mid signal. The operations further include initiating transmission of bitstream parameters corresponding to at least the encoded mid signal.

In another particular aspect, a computer-readable storage device stores instructions that, when executed by a processor, cause the processor to perform operations including receiving bitstream parameters corresponding to at least an encoded mid signal. The operations also include generating a synthesized mid signal based on the bitstream parameters. The operations further include generating one or more upmix parameters. An upmix parameter of the one or more upmix parameters having a first value or a second value based on determining whether the bitstream parameters correspond to an encoded side signal. The first value is based on a received downmix parameter. The second value is based at least in part on a default parameter value. The operations also include generating an output signal based on at least the synthesized mid signal and the one or more upmix parameters.

In another particular aspect, a device includes a receiver configured to receive an inter-channel prediction gain parameter and an encoded audio signal. The encoded audio signal includes an encoded mid signal. The device also includes a decoder configured to generate a synthesized mid signal based on the encoded mid signal. The decoder is configured to generate an intermediate synthesized side signal based on the synthesized mid signal and the inter-channel prediction gain parameter. The decoder is further configured to filter the intermediate synthesized side signal to generate a synthesized side signal.

In another particular aspect, a method includes receiving an inter-channel prediction gain parameter and an encoded audio signal at a first device from a second device. The encoded audio signal includes an encoded mid signal. The method includes generating, at the first device, a synthesized mid signal based on the encoded mid signal. The method includes generating an intermediate synthesized side signal based on the synthesized mid signal and the inter-channel prediction gain parameter. The method further includes filtering the intermediate synthesized side signal to generate a synthesized side signal.

In another particular aspect, an apparatus includes means for receiving an inter-channel prediction gain parameter and an encoded audio signal. The encoded audio signal includes an encoded mid signal. The apparatus includes means for generating a synthesized mid signal based on the encoded mid signal. The apparatus includes means for generating an intermediate synthesized side signal based on the synthesized mid signal and the inter-channel prediction gain parameter. The apparatus further includes means for filtering the intermediate synthesized side signal to generate a synthesized side signal.

In another particular aspect, a computer-readable storage device stores instructions that, when executed by a processor, cause the processor to perform operations including receiving an inter-channel prediction gain parameter and an encoded audio signal from a device. The encoded audio signal includes an encoded mid signal. The operations include generating a synthesized mid signal based on the encoded mid signal. The operations include generating an intermediate synthesized side signal based on the synthesized mid signal and the inter-channel prediction gain parameter. The operations further include filtering the intermediate synthesized side signal to generate a synthesized side signal.

Other aspects, advantages, and features of the present disclosure will become apparent after review of the entire application, including the following sections: Brief Description of the Drawings, Detailed Description, and the Claims.

V. BRIEF DESCRIPTION OF THE DRAWINGS

VI.DETAILED DESCRIPTION

Figure 1:
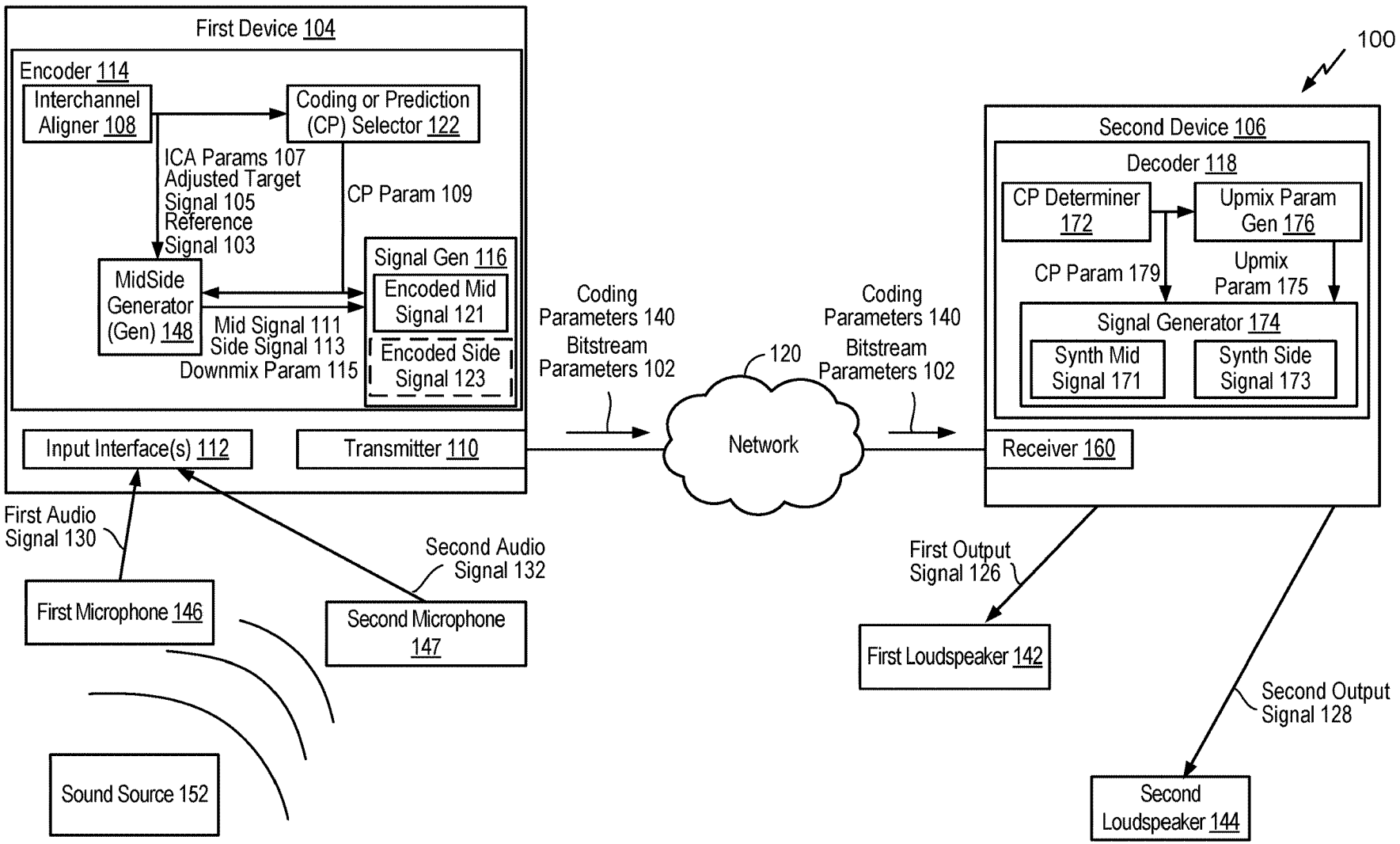
FIG. 1 is a block diagram of a particular illustrative example of a system operable to encode or decode audio signals.

Systems and devices operable to encode audio signals are disclosed. A device may include an encoder configured to encode the audio signals. The audio signals may be captured concurrently in time using multiple recording devices, e.g., multiple microphones. In some examples, the audio signals (or multi-channel audio) may be synthetically (e.g., artificially) generated by multiplexing several audio channels that are recorded at the same time or at different times. As illustrative examples, the concurrent recording or multiplexing of the audio channels may result in a 2-channel configuration (i.e., Stereo: Left and Right), a 5.1 channel configuration (Left, Right, Center, Left Surround, Right Surround, and the low frequency emphasis (LFE) channels), a 7.1 channel configuration, a 7.1+4 channel configuration, a 22.2 channel configuration, or a N-channel configuration.

Audio capture devices in teleconference rooms (or telepresence rooms) may include multiple microphones that acquire spatial audio. The spatial audio may include speech as well as background audio that is encoded and transmitted. The speech/audio from a given source (e.g., a talker) may arrive at the multiple microphones at different times depending on how the microphones are arranged as well as where the source (e.g., the talker) is located with respect to the microphones and room dimensions. For example, a sound source (e.g., a talker) may be closer to a first microphone associated with the device than to a second microphone associated with the device. Thus, a sound emitted from the sound source may reach the first microphone earlier in time than the second microphone. The device may receive a first audio signal via the first microphone and may receive a second audio signal via the second microphone.

An audio signal may be encoded in segments or frames. A frame may correspond to a number of samples (e.g., 1920 samples or 2000 samples). Mid-side (MS) coding and parametric stereo (PS) coding are stereo coding techniques that may provide improved efficiency over the dual-mono coding techniques. In dual-mono coding, the Left (L) channel (or signal) and the Right (R) channel (or signal) are independently coded without making use of inter-channel correlation. MS coding reduces the redundancy between a correlated L/R channel-pair by transforming the Left channel and the Right channel to a sum-channel and a difference-channel (e.g., a side channel) prior to coding. The sum signal and the difference signal are waveform coded in MS coding. Relatively more bits are spent on the sum signal than on the side signal. PS coding reduces redundancy in each sub-band by transforming the L/R signals into a sum signal and a set of side parameters. The side parameters may indicate an inter-channel intensity difference (IID), an inter-channel phase difference (IPD), an inter-channel time difference (ITD), etc. The sum signal is waveform coded and transmitted along with the side parameters. In a hybrid system, the side-channel may be waveform coded in the lower bands (e.g., less than 2 kilohertz (kHz)) and PS coded in the upper bands (e.g., greater than or equal to 2 kHz) where the inter-channel phase preservation is perceptually less critical.

The MS coding and the PS coding may be done in either the frequency-domain or in the sub-band domain. In some examples, the Left channel and the Right channel may be uncorrelated. For example, the Left channel and the Right channel may include uncorrelated synthetic signals. When the Left channel and the Right channel are uncorrelated, the coding efficiency of the MS coding, the PS coding, or both, may approach the coding efficiency of the dual-mono coding.

Depending on a recording configuration, there may be a temporal shift between a Left channel and a Right channel, as well as other spatial effects such as echo and room reverberation. If the temporal shift and phase mismatch between the channels are not compensated, the sum channel and the difference channel may contain comparable energies reducing the coding-gains associated with MS or PS techniques. The reduction in the coding-gains may be based on the amount of temporal (or phase) shift. The comparable energies of the sum signal and the difference signal may limit the usage of MS coding in certain frames where the channels are temporally shifted but are highly correlated. In stereo coding, a Mid channel (e.g., a sum channel) and a Side channel (e.g., a difference channel) may be generated based on the following Equation:

$$M=(L+R)/2,\ S=(L-R)/2, \qquad \text{Equation 1}$$

where M corresponds to the Mid channel, S corresponds to the Side channel, L corresponds to the Left channel, and R corresponds to the Right channel.

In some cases, the Mid channel and the Side channel may be generated based on the following Equation:

$$M=c(L+R), S=c(L-R), \qquad \text{Equation 2}$$

where c corresponds to a complex value or a real value which may vary from frame-to-frame, from one frequency or sub-band to another, or a combination thereof.

In some cases, the Mid channel and the Side channel may be generated based on the following Equation:

$$M=(c1*L+c2*R),\ S=(c3*L-c4*R), \qquad \text{Equation 3}$$

where c1, c2, c3 and c4 are complex values or real values which may vary from frame-to-frame, from one sub-band or frequency to another, or a combination thereof. Generating the Mid channel and the Side channel based on Equation 1, Equation 2, or Equation 3 may be referred to as performing a "downmixing" algorithm. A reverse process of generating the Left channel and the Right channel from the Mid channel and the Side channel based on Equation 1, Equation 2, or Equation 3 may be referred to as performing an "upmixing" algorithm.

In some cases, the Mid channel may be based on other equations such as:

$$M=(L+g_D R)/2, \text{ or} \qquad \text{Equation 4}$$

$$M=g_1 L+g_2 R \qquad \text{Equation 5}$$

where $g_1+g_2=1.0$, and where $g_D$ is a gain parameter. In other examples, the downmix may be performed in bands, where $mid(b)=c_1L(b)+c_2R(b)$, where $c_1$ and $c_2$ are complex numbers, where $side(b)=c_3L(b)-c_4R(b)$, and where $c_3$ and $c_4$ are complex numbers.

An ad-hoc approach used to choose between MS coding or dual-mono coding for a particular frame may include generating a mid signal and a side signal, calculating energies of the mid signal and the side signal, and determining whether to perform MS coding based on the energies. For example, MS coding may be performed in response to determining that the ratio of energies of the side signal and the mid signal is less than a threshold. To illustrate, if a Right channel is shifted by at least a first time (e.g., about 0.001 seconds or 48 samples at 48 kHz), a first energy of the mid signal (corresponding to a sum of the left signal and the right signal) may be comparable to a second energy of the side signal (corresponding to a difference between the left signal and the right signal) for voiced speech frames. When the first energy is comparable to the second energy, a higher number of bits may be used to encode the Side channel, thereby reducing coding efficiency of MS coding relative to dual-mono coding. Dual-mono coding may thus be used when the first energy is comparable to the second energy (e.g., when the ratio of the first energy and the second energy is greater than or equal to the threshold). In an alternative approach, the decision between MS coding and dual-mono coding for a particular frame may be made based on a comparison of a threshold and normalized cross-correlation values of the Left channel and the Right channel.

In some examples, the encoder may determine a mismatch value (e.g., a temporal mismatch value, a gain value, an energy value, an inter-channel prediction value) indicative of a temporal mismatch (e.g., a shift) of the first audio signal relative to the second audio signal. The temporal mismatch value (e.g., the mismatch value) may correspond to an amount of temporal delay between receipt of the first audio signal at the first microphone and receipt of the second audio signal at the second microphone. Furthermore, the encoder may determine the temporal mismatch value on a frame-by-frame basis, e.g., based on each 20 milliseconds (ms) speech/audio frame. For example, the temporal mismatch value may correspond to an amount of time that a second frame of the second audio signal is delayed with respect to a first frame of the first audio signal. Alternatively, the temporal mismatch value may correspond to an amount of time that the first frame of the first audio signal is delayed with respect to the second frame of the second audio signal.

When the sound source is closer to the first microphone than to the second microphone, frames of the second audio signal may be delayed relative to frames of the first audio signal. In this case, the first audio signal may be referred to as the "reference audio signal" or "reference channel" and the delayed second audio signal may be referred to as the "target audio signal" or "target channel". Alternatively, when the sound source is closer to the second microphone than to the first microphone, frames of the first audio signal may be delayed relative to frames of the second audio signal. In this case, the second audio signal may be referred to as the reference audio signal or reference channel and the delayed first audio signal may be referred to as the target audio signal or target channel.

Depending on where the sound sources (e.g., talkers) are located in a conference or telepresence room or how the sound source (e.g., talker) position changes relative to the microphones, the reference channel and the target channel may change from one frame to another; similarly, the temporal mismatch (e.g., shift) value may also change from one frame to another. However, in some implementations, the temporal mismatch value may always be positive to indicate an amount of delay of the "target" channel relative to the "reference" channel. Furthermore, the temporal mismatch value may correspond to a "non-causal shift" value by which the delayed target channel is "pulled back" in time such that the target channel is aligned (e.g., maximally aligned) with the "reference" channel. "Pulling back" the target channel may correspond to advancing the target channel in time. A "non-causal shift" may correspond to a shift of a delayed audio channel (e.g., a lagging audio channel) relative to a leading audio channel to temporally align the delayed audio channel with the leading audio channel. The downmix algorithm to determine the mid channel and the side channel may be performed on the reference channel and the non-causal shifted target channel.

The encoder may determine the temporal mismatch value based on the first audio channel and a plurality of temporal mismatch values applied to the second audio channel. For example, a first frame of the first audio channel, X, may be received at a first time ($m_1$). A first particular frame of the second audio channel, Y, may be received at a second time ($n_1$) corresponding to a first temporal mismatch value, e.g., shift1=$n_1-m_1$. Further, a second frame of the first audio channel may be received at a third time ($m_2$). A second particular frame of the second audio channel may be received at a fourth time ($n_2$) corresponding to a second temporal mismatch value, e.g., shift2=$n_2-m_2$.

The device may perform a framing or a buffering algorithm to generate a frame (e.g., 20 ms samples) at a first sampling rate (e.g., 32 kHz sampling rate (i.e., 640 samples per frame)). The encoder may, in response to determining that a first frame of the first audio signal and a second frame of the second audio signal arrive at the same time at the device, estimate a temporal mismatch value (e.g., shift1) as equal to zero samples. A Left channel (e.g., corresponding to the first audio signal) and a Right channel (e.g., corresponding to the second audio signal) may be temporally aligned. In some cases, the Left channel and the Right channel, even when aligned, may differ in energy due to various reasons (e.g., microphone calibration).

In some examples, the Left channel and the Right channel may be temporally mismatched (e.g., not aligned) due to various reasons (e.g., a sound source, such as a talker, may be closer to one of the microphones than another and the two microphones may be greater than a threshold (e.g., 1-20 centimeters) distance apart). A location of the sound source relative to the microphones may introduce different delays in the Left channel and the Right channel. In addition, there may be a gain difference, an energy difference, or a level difference between the Left channel and the Right channel.

In some examples, a time of arrival of audio signals at the microphones from multiple sound sources (e.g., talkers) may vary when the multiple talkers are alternatively talking (e.g., without overlap). In such a case, the encoder may dynamically adjust a temporal mismatch value based on the talker to identify the reference channel. In some other examples, the multiple talkers may be talking at the same time, which may result in varying temporal mismatch values depending on who is the loudest talker, closest to the microphone, etc.

In some examples, the first audio signal and second audio signal may be synthesized or artificially generated when the two signals potentially show less (e.g., no) correlation. It should be understood that the examples described herein are illustrative and may be instructive in determining a relationship between the first audio signal and the second audio signal in similar or different situations.

The encoder may generate comparison values (e.g., difference values or cross-correlation values) based on a comparison of a first frame of the first audio signal and a plurality of frames of the second audio signal. Each frame of the plurality of frames may correspond to a particular temporal mismatch value. The encoder may generate a first estimated temporal mismatch value (e.g., a first estimated mismatch value) based on the comparison values. For example, the first estimated temporal mismatch value may correspond to a comparison value indicating a higher temporal-similarity (or lower difference) between the first frame of the first audio signal and a corresponding first frame of the second audio signal. A positive temporal mismatch value (e.g., the first estimated temporal mismatch value) may indicate that the first audio signal is a leading audio signal (e.g., a temporally leading audio signal) and that the second audio signal is a lagging audio signal (e.g., a temporally lagging audio signal). A frame (e.g., samples) of the lagging audio signal may be temporally delayed relative to a frame (e.g., samples) of the leading audio signal.

The encoder may determine the final temporal mismatch value (e.g., the final mismatch value) by refining, in multiple stages, a series of estimated temporal mismatch values. For example, the encoder may first estimate a "tentative" temporal mismatch value based on comparison values generated from stereo pre-processed and re-sampled versions of the first audio signal and the second audio signal. The encoder may generate interpolated comparison values associated with temporal mismatch values proximate to the estimated "tentative" temporal mismatch value. The encoder may determine a second estimated "interpolated" temporal mismatch value based on the interpolated comparison values. For example, the second estimated "interpolated" temporal mismatch value may correspond to a particular interpolated comparison value that indicates a higher temporal-similarity (or lower difference) than the remaining interpolated comparison values and the first estimated "tentative" temporal mismatch value. If the second estimated "interpolated" temporal mismatch value of the current frame (e.g., the first frame of the first audio signal) is different than a final temporal mismatch value of a previous frame (e.g., a frame of the first audio signal that precedes the first frame), then the "interpolated" temporal mismatch value of the current frame is further "amended" to improve the temporal-similarity between the first audio signal and the shifted second audio signal. In particular, a third estimated "amended" temporal mismatch value may correspond to a more accurate measure of temporal-similarity by searching around the second estimated "interpolated" temporal mismatch value of the current frame and the final estimated temporal mismatch value of the previous frame. The third estimated "amended" temporal mismatch value is further conditioned to estimate the final temporal mismatch value by limiting any spurious changes in the temporal mismatch value between frames and further controlled to not switch from a negative temporal mismatch value to a positive temporal mismatch value (or vice versa) in two successive (or consecutive) frames as described herein.

In some examples, the encoder may refrain from switching between a positive temporal mismatch value and a negative temporal mismatch value or vice-versa in consecutive frames or in adjacent frames. For example, the encoder may set the final temporal mismatch value to a particular value (e.g., 0) indicating no temporal-shift based on the estimated "interpolated" or "amended" temporal mismatch value of the first frame and a corresponding estimated "interpolated" or "amended" or final temporal mismatch value in a particular frame that precedes the first frame. To illustrate, the encoder may set the final temporal mismatch value of the current frame (e.g., the first frame) to indicate no temporal-shift, i.e., shift1=0, in response to determining that one of the estimated "tentative" or "interpolated" or "amended" temporal mismatch value of the current frame is positive and the other of the estimated "tentative" or "interpolated" or "amended" or "final" estimated temporal mismatch value of the previous frame (e.g., the frame preceding the first frame) is negative. Alternatively, the encoder may also set the final temporal mismatch value of the current frame (e.g., the first frame) to indicate no temporal-shift, i.e., shift1=0, in response to determining that one of the estimated "tentative" or "interpolated" or "amended" temporal mismatch value of the current frame is negative and the other of the estimated "tentative" or "interpolated" or "amended" or "final" estimated temporal mismatch value of the previous frame (e.g., the frame preceding the first frame) is positive. As referred to herein, a "temporal-shift" may correspond to a time-shift, a time-offset, a sample shift, a sample offset, or an offset.

The encoder may select a frame of the first audio signal or the second audio signal as a "reference" or "target" based on the temporal mismatch value. For example, in response to determining that the final temporal mismatch value is positive, the encoder may generate a reference channel or signal indicator having a first value (e.g., 0) indicating that the first audio signal is a "reference" signal and that the second audio signal is the "target" signal. Alternatively, in response to determining that the final temporal mismatch value is negative, the encoder may generate the reference channel or signal indicator having a second value (e.g., 1) indicating that the second audio signal is the "reference" signal and that the first audio signal is the "target" signal.

The reference signal may correspond to a leading signal, whereas the target signal may correspond to a lagging signal. In a particular aspect, the reference signal may be the same signal that is indicated as a leading signal by the first estimated temporal mismatch value. In an alternate aspect, the reference signal may differ from the signal indicated as a leading signal by the first estimated temporal mismatch value. The reference signal may be treated as the leading signal regardless of whether the first estimated temporal mismatch value indicates that the reference signal corresponds to a leading signal. For example, the reference signal may be treated as the leading signal by shifting (e.g., adjusting) the other signal (e.g., the target signal) relative to the reference signal.

In some examples, the encoder may identify or determine at least one of the target signal or the reference signal based on a mismatch value (e.g., an estimated temporal mismatch value or the final temporal mismatch value) corresponding to a frame to be encoded and mismatch (e.g., shift) values corresponding to previously encoded frames. The encoder may store the mismatch values in a memory. The target channel may correspond to a temporally lagging audio channel of the two audio channels and the reference channel may correspond to a temporally leading audio channel of the two audio channels. In some examples, the encoder may identify the temporally lagging channel and may not maximally align the target channel with the reference channel based on the mismatch values from the memory. For example, the encoder may partially align the target channel with the reference channel based on one or more mismatch values. In some other examples, the encoder may progressively adjust the target channel over a series of frames by "non-causally" distributing the overall mismatch value (e.g., 100 samples) into smaller mismatch values (e.g., 25 samples, 25 samples, 25 samples, and 25 samples) over encoded of multiple frames (e.g., four frames).

The encoder may estimate a relative gain (e.g., a relative gain parameter) associated with the reference signal and the non-causal shifted target signal. For example, in response to determining that the final temporal mismatch value is positive, the encoder may estimate a gain value to normalize or equalize the energy or power levels of the first audio signal relative to the second audio signal that is offset by the non-causal temporal mismatch value (e.g., an absolute value of the final temporal mismatch value). Alternatively, in response to determining that the final temporal mismatch value is negative, the encoder may estimate a gain value to normalize or equalize the power levels of the non-causal shifted first audio signal relative to the second audio signal. In some examples, the encoder may estimate a gain value to normalize or equalize the energy or power levels of the "reference" signal relative to the non-causal shifted "target" signal. In other examples, the encoder may estimate the gain value (e.g., a relative gain value) based on the reference signal relative to the target signal (e.g., the unshifted target signal).

The encoder may generate at least one encoded signal (e.g., a mid signal, a side signal, or both) based on the reference signal, the target signal (e.g., the shifted target signal or the unshifted target signal), the non-causal temporal mismatch value, and the relative gain parameter. The side signal may correspond to a difference between first samples of the first frame of the first audio signal and selected samples of a selected frame of the second audio signal. The encoder may select the selected frame based on the final temporal mismatch value. Fewer bits may be used to encode the side signal because of reduced difference between the first samples and the selected samples as compared to other samples of the second audio signal that correspond to a frame of the second audio signal that is received by the device at the same time as the first frame. A transmitter of the device may transmit the at least one encoded signal, the non-causal temporal mismatch value, the relative gain parameter, the reference channel or signal indicator, or a combination thereof.

The encoder may generate at least one encoded signal (e.g., a mid signal, a side signal, or both) based on the reference signal, the target signal (e.g., the shifted target signal or the unshifted target signal), the non-causal temporal mismatch value, the relative gain parameter, low-band parameters of a particular frame of the first audio signal, high-band parameters of the particular frame, or a combination thereof. The particular frame may precede the first frame. Certain low-band parameters, high-band parameters, or a combination thereof, from one or more preceding frames may be used to encode a mid signal, a side signal, or both, of the first frame. Encoding the mid signal, the side signal, or both, based on the low-band parameters, the high-band parameters, or a combination thereof, may improve estimates of the non-causal temporal mismatch value and inter-channel relative gain parameter. The low-band parameters, the high-band parameters, or a combination thereof, may include a pitch parameter, a voicing parameter, a coder type parameter, a low-band energy parameter, a high-band energy parameter, a tilt parameter, a pitch gain parameter, a FCB gain parameter, a coding mode parameter, a voice activity parameter, a noise estimate parameter, a signal-to-noise ratio parameter, a formants parameter, a speech/music decision parameter, the non-causal shift, the inter-channel gain parameter, or a combination thereof. A transmitter of the device may transmit the at least one encoded signal, the non-causal temporal mismatch value, the relative gain parameter, the reference channel (or signal) indicator, or a combination thereof. As referred to herein, an audio "signal" corresponds to an audio "channel." As referred to herein, a "temporal mismatch value" corresponds to an offset value, a mismatch value, a time-offset value, a sample temporal mismatch value, or a sample offset value. As referred to herein, "shifting" a target signal may correspond to shifting location(s) of data representative of the target signal, copying the data to one or more memory buffers, moving one or more memory pointers associated with the target signal, or a combination thereof.

Particular aspects of the present disclosure are described below with reference to the drawings. In the description, common features are designated by common reference numbers. As used herein, various terminology is used for the purpose of describing particular implementations only and is not intended to be limiting of implementations. For example, the singular forms "a," "an," and "the" are intended to include the plural forms as well, unless the context clearly indicates otherwise. It may be further understood that the terms "comprise," "comprises," and "comprising" may be used interchangeably with "include," "includes," or "including." Additionally, it will be understood that the term "wherein" may be used interchangeably with "where." As used herein, "exemplary" may indicate an example, an implementation, and/or an aspect, and should not be construed as limiting or as indicating a preference or a preferred implementation. As used herein, an ordinal term (e.g., "first, " "second," "third," etc.) used to modify an element, such as a structure, a component, an operation, etc., does not by itself indicate any priority or order of the element with respect to another element, but rather merely distinguishes the element from another element having a same name (but for use of the ordinal term). As used herein, the term "set" refers to one or more of a particular element, and the term "plurality" refers to multiple (e.g., two or more) of a particular element.

In the present disclosure, terms such as "determining", "calculating", "estimating", "shifting", "adjusting", etc. may be used to describe how one or more operations are performed. It should be noted that such terms are not to be construed as limiting and other techniques may be utilized to perform similar operations. Additionally, as referred to herein, "generating", "calculating", "estimating", "using", "selecting", "accessing", and "determining" may be used interchangeably. For example, "generating", "calculating", "estimating", or "determining" a parameter (or a signal) may refer to actively generating, estimating, calculating, or determining the parameter (or the signal) or may refer to using, selecting, or accessing the parameter (or signal) that is already generated, such as by another component or device.

Referring to FIG. 1, a particular illustrative example of a system is disclosed and generally designated 100. The system 100 includes a first device 104 communicatively coupled, via a network 120, to a second device 106. The network 120 may include one or more wireless networks, one or more wired networks, or a combination thereof.

The first device 104 may include an encoder 114, a transmitter 110, one or more input interface(s) 112, or a combination thereof. A first input interface of the input interfaces 112 may be coupled to a first microphone 146. A second input interface of the input interface(s) 112 may be coupled to a second microphone 147. The encoder 114 may be configured to downmix and encode audio signals, as described herein. The encoder 114 includes an inter-channel aligner 108 coupled to a coding or prediction (CP) selector 122 and to a midside generator (gen) 148. The encoder 114 also includes a signal generator 116 coupled to the CP selector 122 and to the midside generator 148. In a particular aspect, the inter-channel aligner 108 may be referred to as a "temporal equalizer."

The second device 106 may include a decoder 118. The decoder 118 may include a CP determiner 172 coupled to an upmix parameter (param) generator 176 and to a signal generator 174. The signal generator 174 is configured to upmix and render audio signals. The second device 106 may be coupled to a first loudspeaker 142, a second loudspeaker 144, or both.

During operation, the first device 104 may receive a first audio signal 130 via the first input interface from the first microphone 146 and may receive a second audio signal 132 via the second input interface from the second microphone 147. The first audio signal 130 may correspond to one of a right channel signal or a left channel signal. The second audio signal 132 may correspond to the other of the right channel signal or the left channel signal. The first microphone 146 and the second microphone 147 may receive audio from a sound source 152 (e.g., a user, a speaker, ambient noise, a musical instrument, etc.). In a particular aspect, the first microphone 146, the second microphone 147, or both, may receive audio from multiple sound sources. The multiple sound sources may include a dominant (or most dominant) sound source (e.g., the sound source 152) and one or more secondary sound sources. The one or more secondary sound sources may correspond to traffic, background music, another talker, street noise, etc. The sound source 152 (e.g., the dominant sound source) may be closer to the first microphone 146 than to the second microphone 147. Accordingly, an audio signal from the sound source 152 may be received at the input interface(s) 112 via the first microphone 146 at an earlier time than via the second microphone 147. This natural delay in the multi-channel signal acquisition through the multiple microphones may introduce a temporal mismatch between the first audio signal 130 and the second audio signal 132.

The inter-channel aligner 108 may determine a temporal mismatch value indicative of a temporal mismatch (e.g., a non-causal shift) of the first audio signal 130 (e.g., "target") relative to the second audio signal 132 (e.g., "reference"), as further described with reference to FIG. 7. The temporal mismatch value may be indicative of an amount of temporal mismatch (e.g., time delay) between first samples of a first frame of the first audio signal 130 and second samples of a second frame of the second audio signal 132. As referred to herein, "time delay" may correspond to "temporal delay." The temporal mismatch may be indicative of a time delay between receipt, via the first microphone 146, of the first audio signal 130 and receipt, via the second microphone 147, of the second audio signal 132. For example, a first value (e.g., a positive value) of the temporal mismatch value may indicate that the second audio signal 132 is delayed relative to the first audio signal 130. In this example, the first audio signal 130 may correspond to a leading signal and the second audio signal 132 may correspond to a lagging signal. A second value (e.g., a negative value) of the temporal mismatch value may indicate that the first audio signal 130 is delayed relative to the second audio signal 132. In this example, the first audio signal 130 may correspond to a lagging signal and the second audio signal 132 may correspond to a leading signal. A third value (e.g., 0) of the temporal mismatch value may indicate no delay between the first audio signal 130 and the second audio signal 132.

In some implementations, the third value (e.g., 0) of the temporal mismatch value may indicate that delay between the first audio signal 130 and the second audio signal 132 has switched sign. For example, a first particular frame of the first audio signal 130 may precede the first frame. The first particular frame and a second particular frame of the second audio signal 132 may correspond to the same sound emitted by the sound source 152. The same sound may be detected earlier at the first microphone 146 than at the second microphone 147. The delay between the first audio signal 130 and the second audio signal 132 may switch from having the first particular frame delayed with respect to the second particular frame to having the second frame delayed with respect to the first frame. Alternatively, the delay between the first audio signal 130 and the second audio signal 132 may switch from having the second particular frame delayed with respect to the first particular frame to having the first frame delayed with respect to the second frame. The inter-channel aligner 108 may set the temporal mismatch value to indicate the third value (e.g., 0), as further described with reference to FIG. 7, in response to determining that the delay between the first audio signal 130 and the second audio signal 132 has switched sign.

The inter-channel aligner 108 selects, based on the temporal mismatch value, one of the first audio signal 130 or the second audio signal 132 as a reference signal 103 and the other of the first audio signal 130 or the second audio signal 132 as a target signal, as further described with reference to FIG. 7. The inter-channel aligner 108 generates an adjusted target signal 105 by adjusting the target signal based on the temporal mismatch value, as further described with reference to FIG. 7. The inter-channel aligner 108 generates one or more inter-channel alignment (ICA) parameters 107 based on the first audio signal 130, the second audio signal 132, or both, as further described with reference to FIG. 7. The inter-channel aligner 108 provides the reference signal 103 and the adjusted target signal 105 to the CP selector 122, the midside generator 148, or both. The inter-channel aligner 108 provides the ICA parameters 107 to the CP selector 122, the midside generator 148, or both.

The CP selector 122 generates a CP parameter 109 based on the ICA parameters 107, one or more additional parameters, or a combination thereof, as further described with reference to FIG. 9. The CP selector 122 may generate the CP parameter 109 based on determining whether the ICA parameters 107 indicate that a side signal 113 corresponding to the reference signal 103 and the adjusted target signal 105 is a candidate for prediction.

In a particular example, the CP selector 122 determines whether the side signal 113 is a candidate for prediction based on a change in the temporal mismatch value. The temporal mismatch value may change across frames when a location of a talker changes relative to locations of the first microphone 146 and the second microphone 147. The CP selector 122 may, based on determining that the temporal mismatch value is changing across frames by a value greater than a threshold, determine the side signal 113 is not a candidate for prediction. The greater than threshold change in the temporal mismatch value may indicate that a predicted side signal is likely to be relatively different from (e.g., not a close approximation of) the side signal 113. Alternatively, the CP selector 122 may determine that the side signal 113 is a candidate for prediction based at least in part on determining that the change in the temporal mismatch value is less than or equal to the threshold. A change in the temporal mismatch value that is less than or equal to the threshold may indicate that a predicted side signal is likely to be a relatively close approximation of the side signal 113. In some implementations, the threshold may be adaptively varied across frames to enable hysteresis and smoothing in determination of the CP parameter 109, as further described with reference to FIG. 9.

The CP selector 122 may generate the CP parameter 109 having a first value (e.g., 0) in response to determining that the side signal 113 is not a candidate for prediction. Alternatively, the CP selector 122 may generate the CP parameter 109 having a second value (e.g., 1) in response to determining that the side signal 113 is a candidate for prediction.

The first value (e.g., 0) of the CP parameter 109 indicates that the side signal 113 is to be encoded for transmission, that an encoded side signal 123 is to be transmitted to the second device 106, and that the decoder 118 is to generate a synthesized side signal 173 by decoding the encoded side signal 123. The second value (e.g., 1) of the CP parameter 109 indicates that the side signal 113 is not to be encoded for transmission, that the encoded side signal 123 is not to be transmitted to the second device 106, and that the decoder 118 is to predict the synthesized side signal 173 based on a synthesized mid signal 171. When the encoded side signal 123 is not transmitted, an inter-channel gain parameter (e.g., an inter-channel prediction gain parameter) may be transmitted instead, as further described with reference to FIGS. 2-4.

The CP selector 122 provides the CP parameter 109 to the midside generator 148. The midside generator 148 determines a downmix parameter 115 based on the CP parameter 109, as further described with reference to FIG. 8. For example, when the CP parameter 109 has a first value (e.g., 0), the downmix parameter 115 may be based on an energy metric, a correlation metric, or both. The energy metric may be based on first energy of the first audio signal 130 and second energy of the second audio signal 132. The correlation metric may indicate a correlation (e.g., a cross-correlation, a difference, or a similarity) between the first audio signal 130 and the second audio signal 132. The downmix parameter 115 has a value within a range from a first value (e.g., 0) to a second value (e.g., 1). In a particular aspect, the particular value (e.g., 0.5) of the downmix parameter 115 may indicate that the first audio signal 130 and the second audio signal 132 have similar energy (e.g., the first energy is approximately equal to the second energy). A value (e.g., less than 0.5) of the downmix parameter 115 that is closer to the first value (e.g., 0) than to the second value (e.g., 1) may indicate that the first energy of the first audio signal 130 is greater than the second energy of the second audio signal 132. A value (e.g., greater than 0.5) of the downmix parameter 115 that is closer to the second value (e.g., 1) than to the first value (e.g., 0) may indicate that the second energy of the second audio signal 132 is greater than the first energy of the first audio signal 130. In a particular aspect, the downmix parameter 115 may indicate relative energy of the reference signal 103 to the adjusted target signal 105. When the CP parameter 109 has a second value (e.g., 1), the downmix parameter 115 may be based on a default parameter value (e.g., 0.5).

The midside generator 148, based on the downmix parameter 115, performs downmix processing to generate a mid signal 111 and the side signal 113 corresponding to the reference signal 103 and the adjusted target signal 105, as further described with reference to FIG. 8. For example, the mid signal 111 may correspond to a sum of the reference signal 103 and the adjusted target signal 105. The side signal 113 may correspond to a difference between the reference signal 103 and the adjusted target signal 105. The midside generator 148 provides the mid signal 111, the side signal 113, the downmix parameter 115, or a combination thereof, to the signal generator 116.

The signal generator 116 may have a particular number of bits available for encoding the mid signal 111, the side signal 113, or both. The signal generator 116 may determine a bit allocation indicating that a first number of bits are allocated for encoding the mid signal 111 and that a second number of bits are allocated for encoding the side signal 113. The first number of bits may be greater than or equal to the second number of bits. The signal generator 116 may, in response to determining that the CP parameter 109 has a second value (e.g., 1) indicating that the encoded side signal 123 is not to be transmitted, determine that no bits (e.g., the second number of bits=zero) are allocated for encoding the side signal 113. The signal generator 116 may repurpose the bits that would have been used to encode the side signal 113. For example, the signal generator 116 may allocate some or all of the repurposed bits to encoding the mid signal 111 or to transmitting other parameters, such as one or more inter-channel gain parameters, as a non-limiting example.

In a particular example, the signal generator 116 may determine the bit allocation based on the downmix parameter 115 in response to determining that the CP parameter 109 has a first value (e.g., 0) indicating that the encoded side signal 123 is to be transmitted. A particular value (e.g., 0.5) of the downmix parameter 115 may indicate that the side signal 113 has less information and is likely to have less impact on an output signal at the second device 106. A value of the downmix parameter 115 further away from the particular value (e.g., 0.5), such as closer to a first value (e.g., 0) or to a second value (e.g., 1), may indicate that the side signal 113 has more energy. The signal generator 116 may allocate fewer bits for encoding the side signal 113 when the downmix parameter 115 is closer to the particular value (e.g., 0.5).

The signal generator 116 may generate an encoded mid signal 121 based on the mid signal 111. The encoded mid signal 121 may correspond to one or more first bitstream parameters representative of the mid signal 111. The first bitstream parameters may be generated based on the bit allocation. For example, a count of the first bitstream parameters, a precision of (e.g., a number of bits used to represent) a bitstream parameter of the first bitstream parameters, or both, may be based on the first number of bits allocated for encoding the mid signal 111.

The signal generator 116 may refrain from generating the encoded side signal 123 in response to determining that the CP parameter 109 has a second value (e.g., 1) indicating that the encoded side signal 123 is not to be transmitted, that the bit allocation indicates that zero bits are allocated for encoding the side signal 113, or both. Alternatively, the signal generator 116 may generate the encoded side signal 123 based on the side signal 113 in response to determining that the CP parameter 109 has a first value (e.g., 0) indicating that the encoded side signal 123 is to be transmitted and that the bit allocation indicates that a positive number of bits are allocated for encoding the side signal 113. The encoded side signal 123 may correspond to one or more second bitstream parameters representative of the side signal 113. The second bitstream parameters may be generated based on the bit allocation. For example, a count of the second bitstream parameters, a precision of a bitstream parameter of the second bitstream parameters, or both, may be based on the second number of bits allocated for encoding the side signal 113. The signal generator 116 may generate the encoded mid signal 121, the encoded side signal 123, or both, using various encoding techniques. For example, the signal generator 116 may generate the encoded mid signal 121, the encoded side signal 123, or both, using a time-domain technique, such as algebraic code-excited linear prediction (ACELP). In some implementations, the midside generator 148 may refrain from generating the side signal 113 in response to determining that the CP parameter 109 has a second value (e.g., 1) indicating that the side signal 113 is not to be encoded for transmission.

The transmitter 110 transmits bitstream parameters 102 corresponding to the encoded mid signal 121, the encoded side signal 123, or both. For example, the transmitter 110, in response to determining that the CP parameter 109 has a second value (e.g., 1) indicating that the encoded side signal 123 is not to be transmitted, that the bit allocation indicates that zero bits are allocated for encoding the side signal 113, or both, transmits the first bitstream parameters (corresponding to the encoded mid signal 121) as the bitstream parameters 102. The transmitter 110 refrains from transmitting the second bitstream parameters (corresponding to the encoded side signal 123) in response to determining that the CP parameter 109 has a second value (e.g., 1) indicating that the encoded side signal 123 is not to be transmitted, that the bit allocation indicates that zero bits are allocated for encoding the side signal 113, or both. The transmitter 110 may, in response to determining that the CP parameter 109 has a second value (e.g., 1) indicating that the encoded side signal 123 is not to be transmitted, transmit one or more inter-channel prediction gain parameters, as further described with reference to FIGS. 2-3. Alternatively, the transmitter 110 transmits the first bitstream parameters and the second bitstream parameters as the bitstream parameters 102 in response to determining that the CP parameter 109 has a first value (e.g., 0) indicating that the encoded side signal 123 is to be transmitted and that the bit allocation indicates that a positive number of bits are allocated for encoding the side signal 113.

The transmitter 110 may transmit one or more coding parameters 140 concurrently with the bitstream parameters 102, via the network 120, to the second device 106. The coding parameters 140 may include at least one of the ICA parameters 107, the downmix parameter 115, the CP parameter 109, the temporal mismatch value, or one or more additional parameters. For example, the encoder 114 may determine one or more inter-channel prediction gain parameters, as further described with reference to FIG. 2. The one or more inter-channel prediction gain parameters may be based on the mid signal 111 and the side signal 113. The coding parameters 140 may include the one or more inter-channel prediction gain parameters, as further described with reference to FIGS. 2-3. In some implementations, the transmitter 110 may store the bitstream parameters 102, the coding parameters 140, or a combination thereof, at a device of the network 120 or a local device for further processing or decoding later.

The decoder 118 of the second device 106 may decode the encoded mid signal 121, the encoded side signal 123, or both, based on the bitstream parameters 102, the coding parameters 140, or a combination thereof. The CP determiner 172 may determine a CP parameter 179 based on the coding parameters 140, as further described with reference to FIG. 10. A first value (e.g., 0) of the CP parameter 179 indicates that the bitstream parameters 102 correspond to the encoded side signal 123 (in addition to the encoded mid signal 121) and that the synthesized side signal 173 is to be generated based on (e.g., decoded from) the bitstream parameters 102 and independently of the synthesized mid signal 171. A second value (e.g., 1) of the CP parameter 179 indicates that the bitstream parameters 102 do not correspond to the encoded side signal 123 and that the synthesized side signal 173 is to be predicted based on the synthesized mid signal 171.

In some aspects, the transmitter 110 transmits the CP parameter 109 as one of the coding parameters 140 and the CP determiner 172 generates the CP parameter 179 having the same value as the CP parameter 109. In other aspects, the CP determiner 172 performs similar techniques to determine the CP parameter 179 as the CP selector 122 performed to determine the CP parameter 109. For example, the CP determiner 172 and the CP selector 122 may determine the CP parameter 109 and the CP parameter 179, respectively, based on information (e.g., a core type or a coder type) that is available both at the encoder 114 and at the decoder 118.

The CP determiner 172 provides the CP parameter 179 to the upmix parameter generator 176, the signal generator 174, or both. The upmix parameter generator 176 generates an upmix parameter 175 based on the CP parameter 179, the coding parameters 140, or a combination thereof, as further described with reference to FIGS. 11-12. The upmix parameter 175 may correspond to the downmix parameter 115. For example, the encoder 114 may use the downmix parameter 115 to perform downmix processing to generate the mid signal 111 and the side signal 113 from the reference signal 103 and the adjusted target signal 105. The signal generator 174 may use the upmix parameter 175 to perform upmix processing to generate a first output signal 126 and a second output signal 128 from the synthesized mid signal 171 and the synthesized side signal 173.

In some aspects, the transmitter 110 transmits the downmix parameter 115 as one of the coding parameters 140 and the upmix parameter generator 176 generates the upmix parameter 175 corresponding to the downmix parameter 115. In other aspects, the upmix parameter generator 176 performs similar techniques to determine the upmix parameter 175 as the midside generator 148 performed to determine the downmix parameter 115. For example, the midside generator 148 and the upmix parameter generator 176 may determine the downmix parameter 115 and the upmix parameter 175, respectively, based on information (e.g., voicing factor) that is available both at the encoder 114 and at the decoder 118.

In a particular aspect, the upmix parameter generator 176 generates multiple upmix parameters. For example, the upmix parameter generator 176 generates a first upmix parameter 175, as further described with reference to 1100 of FIG. 11, a second upmix parameter 175, as further described with reference to 1102 of FIG. 11, a third upmix parameter 175, as further described with reference to FIG. 12, or a combination thereof. In this aspect, the signal generator 174 uses the multiple upmix parameters to generate the first output signal 126 and the second output signal 128 from the synthesized mid signal 171 and the synthesized side signal 173. In a particular example, the upmix parameter 175 includes one or more of the ICA gain parameter 709, the ICA parameters 107 (e.g., the TMV 943), the ICP 208, or an upmix configuration. The upmix configuration indicates a configuration for mixing, based on the upmix parameter 175, the synthesized mid signal 171 and the synthesized side signal 173 to generate the first output signal 126 and the second output signal 128.

In a particular aspect, the encoder 114 may conserve network resources (e.g., bandwidth) by refraining from initiating transmission of parameters (e.g., one or more of the coding parameters 140) that have default parameter values. For example, the encoder 114, in response to determining that a first parameter matches a default parameter value (e.g., 0), refrains from transmitting the first parameter as one of the coding parameters 140. The decoder 118, in response to determining that the coding parameters 140 do not include the first parameter, determines a corresponding second parameter based on the default parameter value (e.g., 0). Alternatively, the encoder 114, in response to determining that the first parameter does not match the default parameter value (e.g., 1), initiates transmission (via the transmitter 110) of the first parameter as one of the coding parameters 140. The decoder 118 determines the corresponding second parameter based on the first parameter in response to determining that the coding parameters 140 include the first parameter.

In a particular example, the first parameter includes the CP parameter 109, the corresponding second parameter includes the CP parameter 179, and the default parameter value includes a first value (e.g., 0) or a second value (e.g., 1). In another example, the first parameter includes the downmix parameter 115, the corresponding second parameter includes the upmix parameter 175, and the default parameter value includes a particular value (e.g., 0.5).

The signal generator 174 determines, based on the CP parameter 179, whether the bitstream parameters 102 correspond to the encoded side signal 123. For example, the signal generator 174 determines, based on a second value (e.g., 1) of the CP parameter 179, that the bitstream parameters 102 represent the encoded mid signal 121 and do not correspond to the encoded side signal 123. In a particular aspect, the signal generator 174 may determine that all of the available bits for representing the encoded mid signal 121, the encoded side signal 123, or both, have been allocated to represent the encoded mid signal 121. The signal generator 174 generates the synthesized mid signal 171 by decoding the bitstream parameters 102. In a particular aspect, the synthesized mid signal 171 corresponds to a low-band synthesized mid signal or a high-band synthesized mid signal. The signal generator 174 generates (e.g., predicts) the synthesized side signal 173 based on the synthesized mid signal 171, as further described with reference to FIGS. 2 and 4. For example, the signal generator 174 generates the synthesized side signal 173 by applying an inter-channel prediction gain to the synthesized mid signal 171. In a particular aspect, the synthesized side signal 173 corresponds to a low-band synthesized side signal.

In a particular example, the signal generator 174 determines, based on a first value (e.g., 0) of the CP parameter 179, that the bitstream parameters 102 correspond to the encoded side signal 123 and the encoded mid signal 121. The signal generator 174 generates the synthesized mid signal 171 and the synthesized side signal 173 by decoding the bitstream parameters 102. The signal generator 174 generates the synthesized mid signal 171 by decoding a first set of the bitstream parameters 102 that correspond to the encoded mid signal 121. The signal generator 174 generates the synthesized side signal 173 by decoding a second set of the bitstream parameters 102 that correspond to the encoded side signal 123. Generating the synthesized side signal 173 by decoding the second set of the bitstream parameters 102 may correspond to generating the synthesized side signal 173 independently of or partially-based on the synthesized mid signal 171. In a particular aspect, the synthesized side signal 173 may be generated concurrently with generating the synthesized mid signal 171. In another particular example, the signal generator 174 determines, based on a second value (e.g., 1) of the CP parameter 179, that the bitstream parameters 102 do not correspond to the encoded side signal 123. The signal generator 174 generates the synthesized mid signal 171 by decoding the bitstream parameters 102, and the signal generator 174 generates the synthesized side signal 173 based on the synthesized mid signal 171 and one or more inter-channel prediction gain parameters received from the first device 104, as further described with reference to FIGS. 2 and 4.

The signal generator 174 may perform upmixing, based on the upmix parameter 175, to generate the first output signal 126 (e.g., corresponding to the first audio signal 130) and the second output signal 128 (e.g., corresponding to the second audio signal 132) from the synthesized mid signal 171 and the synthesized side signal 173. For example, the signal generator 174 may use upmixing algorithms that correspond to the downmixing algorithms used by the midside generator 148 to generate the mid signal 111 and the side signal 113. In a particular aspect, the synthesized mid signal 171 corresponds to a high-band synthesized mid signal. In this aspect, the signal generator 174 generates a first high-band output signal of the first output signal 126 by performing inter-channel bandwidth extension (BWE) on the high-band synthesized mid signal. For example, the bitstream parameters 102 may include one or more inter-channel BWE parameters. The inter-channel BWE parameters may include a set of adjustment gain parameters. In a particular implementation, the signal generator 174 may generate the first high-band output signal by scaling the high-band synthesized mid signal based on a first adjustment gain parameter. The signal generator 174 generates a second high-band output signal of the second output signal 128 based on performing inter-channel bandwidth extension on the high-band synthesized mid signal. For example, the signal generator 174 generates the second high-band output signal by scaling the high-band synthesized mid signal based on a second adjustment gain parameter. The signal generator 174 generates a first low-band output signal of the first output signal 126 by upmixing, based on the upmix parameter 175, a low-band synthesized mid signal and a low-band synthesized side signal. A second low-band output signal of the first output signal 126 is based on upmixing, based on the upmix parameter 175, the low-band synthesized mid signal and the low-band synthesized side signal. The signal generator 174 generates the first output signal 126 by combining the first low-band output signal and the first high-band output signal. The signal generator 174 generates the second output signal 128 by combining the second low-band output signal and the second high-band output signal.

In a particular aspect, the signal generator 174 adjusts, based on a particular temporal mismatch value, at least one of the first output signal 126 or the second output signal 128. The coding parameters 140 may indicate the particular temporal mismatch value. The particular temporal mismatch value may correspond to the temporal mismatch value used by the inter-channel aligner 108 to generate the adjusted target signal 105. The second device 106 may output the first output signal 126 (or the adjusted first output signal 126) via the first loudspeaker 142, the second output signal 128 (or the adjusted second output signal 128) via the second loudspeaker 144, or both.

The system 100 enables dynamic adjustment of network resources usage (e.g., bandwidth), quality of the output signals 126, 128 (e.g., in terms of approximating the audio signals 130, 132), or both. When the side signal 113 is not a candidate for prediction, bit allocation may be dynamically adjusted based on the downmix parameter 115. Fewer bits may be used to represent the encoded side signal 123 when the downmix parameter 115 indicates that the side signal 113 includes less information. Reducing the number of bits to represent the encoded side signal 123 may have a small (e.g., no perceptible) impact on the quality of the output signals 126, 128 when the side signal 113 includes less information. The bits that would have been used to represent the encoded side signal 123 may be repurposed to represent the encoded mid signal 121 (e.g., additional bits of the encoded mid signal 121 may be transmitted to the second device 106). The synthesized mid signal 171 may more closely approximate the mid signal 111 due to the additional bits.

When the side signal 113 is a candidate for prediction, the signal generator 116 refrains from transmitting bitstream parameters corresponding to the encoded side signal 123. In a particular aspect, the transmitter 110 uses fewer network resources by refraining from transmitting the bitstream parameters corresponding to the encoded side signal 123. The decoder 118 may generate the synthesized side signal 173 (e.g., a predicted side signal) based on the synthesized mid signal 171, as compared to generating the synthesized side signal 173 (e.g., a decoded side signal) by decoding bitstream parameters representing the encoded side signal 123.

When the side signal 113 is a candidate for prediction, a difference between output signals (e.g., the first output signal 126 and the second output signal 128) generated based on the synthesized side signal 173 (e.g., the predicted side signal) and output signals based on the decoded side signal may be relatively unnoticeable to a listener. The system 100 may thus enable the transmitter 110 to conserve network resources (e.g., bandwidth) with small (e.g., no perceptible) impact on audio quality of the output signals.

In a particular aspect, the encoder 114 repurposes the bits that would have been used to transmit the encoded side signal 123. For example, the signal generator 116 may allocate at least some of the repurposed bits to better represent the encoded mid signal 121, the coding parameters 140, or a combination thereof. To illustrate, more bits may be used to represent the bitstream parameters 102 corresponding to the encoded mid signal 121. Transmitting additional bits representing the encoded mid signal 121 may result in the synthesized mid signal 171 more closely approximating the mid signal 111. The synthesized side signal 173 predicted based on the synthesized mid signal 171 (e.g., including the additional bits) may more closely (as compared to the decoded side signal) approximate the side signal 113.

The system 100 may thus enable the decoder 118 to generate output signals 126, 128 that more closely approximate the audio signals 130, 132 by having the transmitter 110 use more bits for representing the encoded mid signal 121 when the side signal 113 is a candidate for prediction, when the side signal 113 includes less information, or both. In this manner, the system 100 may improve a listening experience associated with the output signals 126, 128.

Figure 2:
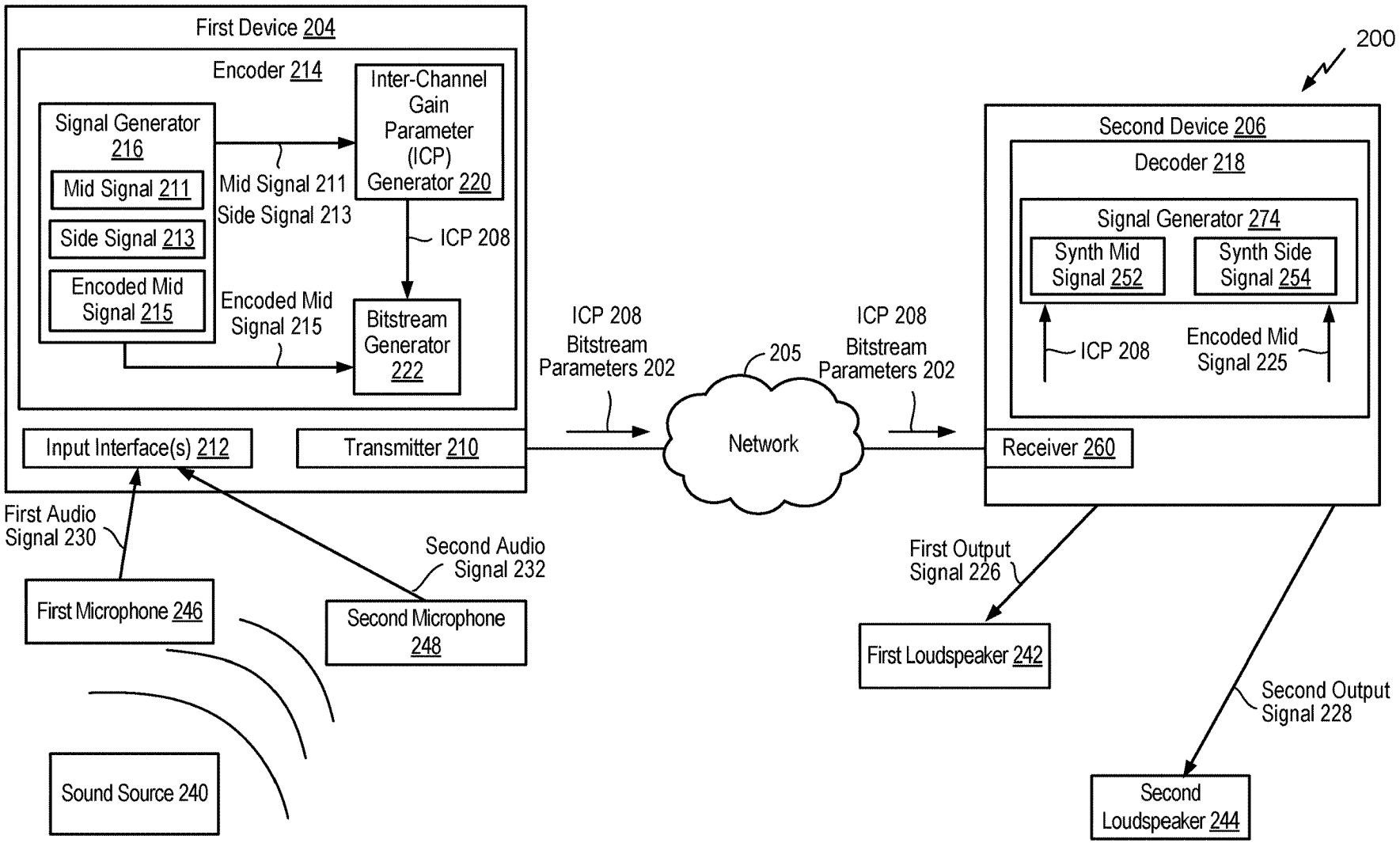
FIG. 2 is a block diagram of a particular illustrative example of a system operable to synthesize a side signal based on an inter-channel prediction gain parameter.

Referring to FIG. 2, a particular illustrative example of a system 200 that synthesizes a side signal based on an inter-channel prediction gain parameter is shown. In a particular implementation, the system 200 of FIG. 2 includes or corresponds to the system 100 of FIG. 1 after a determination to predict a synthesized side signal based on a synthesized mid signal. The system 200 includes a first device 204 communicatively coupled, via a network 205, to a second device 206. The network 205 may include one or more wireless networks, one or more wired networks, or a combination thereof. In a particular implementation, the first device 204, the network 205, and the second device 206 may include or correspond to the first device 104, the network 120, and the second device 106 of FIG. 1, respectively. In a particular implementation, the first device 204 includes or corresponds to a mobile device. In another particular implementation, the first device 204 includes or corresponds to a base station. In a particular implementation, the second device 206 includes or corresponds to a mobile device. In another particular implementation, the second device 206 includes or corresponds to a base station.

The first device 204 may include an encoder 214, a transmitter 210, one or more input interfaces 212, or a combination thereof. A first input interface of the input interfaces 212 may be coupled to a first microphone 246. A second input interface of the input interfaces 212 may be coupled to a second microphone 248. The first microphone 246 and the second microphone 248 may be configured to capture one or more audio inputs and to generate audio signals. For example, the first microphone 246 may be configured to capture one or more audio sounds generated by a sound source 240 and to output a first audio signal 230 based on the one or more audio sounds, and the second microphone 248 may be configured to capture the one or more audio sounds generated by the sound source 240 and to output a second audio signal 232 based on the one or more audio sounds.

The encoder 214 may be configured to downmix and encode audio signals, as described with reference to FIG. 1. In a particular implementation, the encoder 214 may be configured to perform one or more alignment operations on the first audio signal 230 and the second audio signal 232, as described with reference to FIG. 1. The encoder 214 includes a signal generator 216, an inter-channel prediction gain parameter (ICP) generator 220, and a bitstream generator 222. The signal generator 216 may be coupled to the ICP generator 220 and to the bitstream generator 222, and the ICP generator 220 may be coupled to the bitstream generator 222. The signal generator 216 is configured to generate audio signals based on input audio signals received via the input interfaces 212, as described with reference to FIG. 1. For example, the signal generator 216 may be configured to generate a mid signal 211 based on the first audio signal 230 and the second audio signal 232. As another example, the signal generator 216 may also be configured to generate a side signal 213 based on the first audio signal 230 and the second audio signal 232. The signal generator 216 is also be configured to encode one or more audio signals. For example, the signal generator 216 may be configured to generate an encoded mid signal 215 based on the mid signal 211. In a particular implementation, the mid signal 211, the side signal 213, and the encoded mid signal 215 include or correspond to the mid signal 111, the side signal 113, and the encoded mid signal 115, respectively, of FIG. 1. The signal generator 216 may be further configured to provide the mid signal 211 and the side signal 213 to the ICP generator 220 and to provide the encoded mid signal 215 to the bitstream generator 222. In a particular implementation, the encoder 214 may be configured to apply one or more filters to the mid signal 211 and the side signal 213 prior to providing the mid signal 211 and the side signal 213 to the ICP generator 220 (e.g., prior to generating an inter-channel prediction gain parameter).

The ICP generator 220 is configured to generate an inter-channel prediction gain parameter (ICP) 208 based on the mid signal 211 and the side signal 213. For example, the ICP generator 220 may be configured to generate the ICP 208 based on an energy of the side signal 213 or based on an energy of the mid signal 211 and the energy of the side signal 213, as further described with reference to FIG. 3. Alternatively, the ICP generator 220 may be configured to determine the ICP 208 based on an operation (e.g., a dot product operation) performed on the mid signal 211 and the side signal 213, as further described with reference to FIG. 3. The ICP 208 may represent a relationship between the mid signal 211 and the side signal 213, and the ICP 208 may be used by a decoder to synthesize a side signal from a synthesized mid signal, as further described herein. Although a single ICP 208 parameter is illustrated as being generated, in other implementations, multiple ICP parameters may be generated. As a particular example, the mid signal 211 and the side signal 213 may be filtered into multiple bands, and an ICP corresponding to each of the multiple bands may be generated, as further described with reference to FIG. 3. The ICP generator 220 may be further configured to provide the ICP 208 to the bitstream generator 222.

The bitstream generator 222 may be configured to receive the encoded mid signal 215 and to generate one or more bitstream parameters 202 that represent an encoded audio signal (in addition to other parameters). For example, the encoded audio signal may include or correspond to the encoded mid signal 215. The bitstream generator 222 may also be configured to include the ICP 208 in the one or more bitstream parameters 202. Alternatively, the bitstream generator 222 may be configured to generate the one or more bitstream parameters 202 such that the ICP 208 may be derived from the one or more bitstream parameters 202. In some implementations, one or more additional parameters, such as a correlation parameter, may be included in, indicated by, or sent in addition to the one or more bitstream parameters 202, as further described with reference to FIGS. 13 and 15. The transmitter 210 may be configured to send the one or more bitstream parameters 202 (e.g., the encoded mid signal 215) including (or in addition to) the ICP 208 to the second device 206 via the network 205. In a particular implementation, the one or more bitstream parameters 202 include or correspond to the one or more bitstream parameters 102 of FIG. 1, and the ICP 208 is included in the one or more coding parameters 140 that are included in (or sent in addition to) the one or more bitstream parameters 102 of FIG. 1.

The second device 206 may include a decoder 218 and a receiver 260. The receiver 260 may be configured to receive the ICP 208 and the one or more bitstream parameters 202 (e.g., the encoded mid signal 215) from the first device 204 via the network 205. The decoder 218 may be configured to upmix and decode audio signals. To illustrate, the decoder 218 may be configured to decode and upmix one or more audio signals based on the one or more bitstream parameters 202 (including the ICP 208).

The decoder 218 may include a signal generator 274. In a particular implementation, the signal generator 274 includes or corresponds to the signal generator 174 of FIG. 1. The signal generator 274 may be configured to generate a synthesized mid signal 252 based on an encoded mid signal 225. In a particular implementation, the second device 206 (or the decoder 218) includes additional circuitry configured to determine or generate the encoded mid signal 225 based on the one or more bitstream parameters 202. Alternatively, the signal generator 274 may be configured to generate the synthesized mid signal 252 directly from the one or more bitstream parameters 202.

The signal generator 274 may be further configured to generate a synthesized side signal 254 based on the synthesized mid signal 252 and the ICP 208. In a particular implementation, the signal generator 274 is configured to apply the ICP 208 to the synthesized mid signal 252 (e.g., multiply the synthesized mid signal 252 by the ICP 208) to generate the synthesized side signal 254. In other implementations, the synthesized side signal 254 is generated in other ways, as further described with reference to FIG. 4. In some implementations, applying the ICP 208 to the synthesized mid signal 252 generates an intermediate synthesized side signal, and additional processing is performed on the intermediate synthesized side signal to generate the synthesized side signal 254, as further described with reference to FIGS. 13-16. Additionally, or alternatively, one or more discontinuity reduction operations may selectively be performed on the synthesized side signal 254, as further described with reference to FIG. 14. The decoder 218 may be configured to further process and upmix the synthesized mid signal 252 and the synthesized side signal 254 to generate one or more output audio signals. In a particular implementation, the output audio signals include a left audio signal and a right audio signal.

The output audio signals may be rendered and output at one or more audio output devices. To illustrate, the second device 206 may be coupled to (or may include) a first loudspeaker 242, a second loudspeaker 244, or both. The first loudspeaker 242 may be configured to generate an audio output based on a first output signal 226, and the second loudspeaker 244 may be configured to generate an audio output based on a second output signal 228.

During operation, the first device 204 may receive the first audio signal 230 via the first input interface from the first microphone 246 and may receive the second audio signal 232 via the second input interface from the second microphone 248. The first audio signal 230 may correspond to one of a right channel signal or a left channel signal. The second audio signal 232 may correspond to the other of the right channel signal or the left channel signal. The first microphone 246 and the second microphone 248 may receive audio from the sound source 240 (e.g., a user, a speaker, ambient noise, a musical instrument, etc.). In a particular aspect, the first microphone 246, the second microphone 248, or both, may receive audio from multiple sound sources. The multiple sound sources may include a dominant (or most dominant) sound source (e.g., the sound source 240) and one or more secondary sound sources. The encoder 214 may perform one or more alignment operations to account for a temporal shift or temporal delay between the first audio signal 230 and the second audio signal 232, as described with reference to FIG. 1.

The encoder 214 may generate audio signals based on the first audio signal 230 and the second audio signal 232. For example, the signal generator 216 may generate the mid signal 211 based on the first audio signal 230 and the second audio signal 232. As another example, the signal generator 216 may generate the side signal 213 based on the first audio signal 230 and the second audio signal 232. The mid signal 211 may represent the first audio signal 230 superimposed with the second audio signal 232, and the side signal 213 may represent a difference between the first audio signal 230 and the second audio signal 232. The mid signal 211 and the side signal 213 may be provided to the ICP generator 220. The signal generator 216 may also encode the mid signal 211 to generate the encoded mid signal 215, which is provided to the bitstream generator 222. The encoded mid signal 215 may correspond to one or more bitstream parameters representative of the mid signal 211.

The ICP generator 220 may generate the ICP 208 based on the mid signal 211 and the side signal 213. The ICP 208 may represent a relationship between the mid signal 211 and the side signal 213 at the encoder 214 (or a relationship between the synthesized mid signal 252 and the synthesized side signal 254 at the decoder 218). The ICP 208 may be provided to the bitstream generator 222. In some implementations, the ICP 208 may be smoothed based on inter-channel prediction gain parameters associated with previous frames, as further described with reference to FIG. 3.

The bitstream generator 222 may receive the encoded mid signal 215 and the ICP 208 and generate the one or more bitstream parameters 202. For example, the encoded mid signal 215 may include bitstream parameters, and the one or more bitstream parameters may include the bitstream parameters. In a particular implementation, the one or more bitstream parameters 202 include the ICP 208. In an alternate implementation, the one or more bitstream parameters 202 include one or more parameters that enable the ICP 208 to be derived (e.g., the ICP 208 is derived from the one or more bitstream parameters 202). The bitstream parameters 202 (including or indicating the ICP 208) are sent by the transmitter 210 to the second device 206 via the network 205.

In a particular implementation, the ICP 208 is generated on a per-frame basis. For example, the ICP 208 may have a first value associated with a first audio frame of the encoded mid signal 215 and a second value associated with a second audio frame of the encoded mid signal 215. The ICP 208 is sent with (e.g., included in) the one or more bitstream parameters 202 for each frame associated with a determination that the synthesized side signal 254 is to be predicted (instead of encoded), as described with reference to FIG. 1. For these frames, the ICP 208 is sent and one or more audio frames of an encoded side signal are not sent. To illustrate, the bitstream generator 222 may refrain from including parameters indicative of the encoded side signal responsive to the ICP 208 being included (e.g., the first device 204 refrains from sending the encoded side signal for one or more frames responsive to sending the ICP 208 for the one or more frames). For frames that are associated with a determination to encode the side signal 213, the one or more bitstream parameters 202 include parameters indicating frames of an encoded side signal and do not include (or indicate) the ICP 208. Thus, either the ICP 208 or parameters indicative of the encoded side signal (e.g., not both) are included in the one or more bitstream parameters 202 for each frame of the mid signal 211 and the side signal 213. Because the ICP 208 uses fewer bits than the encoded side signal, bits that would otherwise be used to send the encoded side signal may instead be "repurposed" and used to send additional bits of the encoded mid signal 215, thereby improving the quality of the encoded mid signal 215 (which improves the quality of the synthesized mid signal 252 and the synthesized side signal 254, since the synthesized side signal 254 is predicted from the synthesized mid signal 252).

The second device 206 (e.g., the receiver 260) may receive the one or more bitstream parameters 202 (indicative of the encoded mid signal 215) that include (or indicate) the ICP 208. The decoder 218 may determine the encoded mid signal 225 based on the one or more bitstream parameters 202. The encoded mid signal 225 may be similar to the encoded mid signal 215, although with slight differences due to errors during transmission or due to the process of converting the one or more bitstream parameters 202 to the encoded mid signal 225. The signal generator 274 may generate the synthesized mid signal 252 based on the encoded mid signal 225 (e.g., the one or more bitstream parameters 202). The signal generator 274 may also generate the synthesized side signal 254 based on the synthesized mid signal 252 and the ICP 208. In a particular implementation, the signal generator 274 multiplies the synthesized side signal 254 by the ICP 208 to generate the synthesized side signal 254. In other implementations, the synthesized side signal 254 is based on the synthesized mid signal 252, the ICP 208, and one or more other values. Additional details of determining the synthesized side signal 254 are described with reference to FIG. 4. In some implementations, the synthesized mid signal 252 is filtered prior to generating the synthesized side signal 254, subsequent to generating the synthesized side signal 254, or both, as further described with reference to FIG. 4.

After generating the synthesized mid signal 252 and the synthesized side signal 254, the decoder 218 may perform further processing, filtering, upsampling, and upmixing on the synthesized mid signal 252 and the synthesized side signal 254 to generate a first audio signal and a second audio signal. In a particular implementation, the first audio signal corresponds to one of a left signal or a right signal, and the second audio signal corresponds to the other of the left signal or the right signal. The first audio signal and the second audio signal may be rendered and output as the first output signal 226 and the second output signal 228. In a particular implementation, the first loudspeaker 242 generates an audio output based on the first output signal 226, and the second loudspeaker 244 generates an audio output based on the second output signal 228.

The system 200 of FIG. 2 enables generation and sending of the ICP 208 for frames associated with a determination to predict a side signal (instead of encoding the side signal). The ICP 208 is generated at the encoder 214 to enable the decoder 218 to predict (e.g., generate) the synthesized side signal 254 based on the synthesized mid signal 252. Thus, the ICP 208 is sent instead of an encoded side signal for frames associated with the determination to predict the side signal. Because sending the ICP 208 uses fewer bits than sending the encoded side signal, network resources may be conserved while being relatively unnoticed by a listener. Alternatively, one or more bits that would otherwise be used to send the encoded side signal may instead be used to send additional bits of the encoded mid signal 215. Increasing the number of bits used to send the encoded mid signal 215 improves the quality of the synthesized mid signal 252 generated at the decoder 218. Additionally, because the synthesized side signal 254 is generated based on the synthesized mid signal 252, increasing the number of bits used to send the encoded mid signal 215 improves the quality of the synthesized side signal 254, which may reduce audio artifacts and improve overall user experience.

Figure 3:
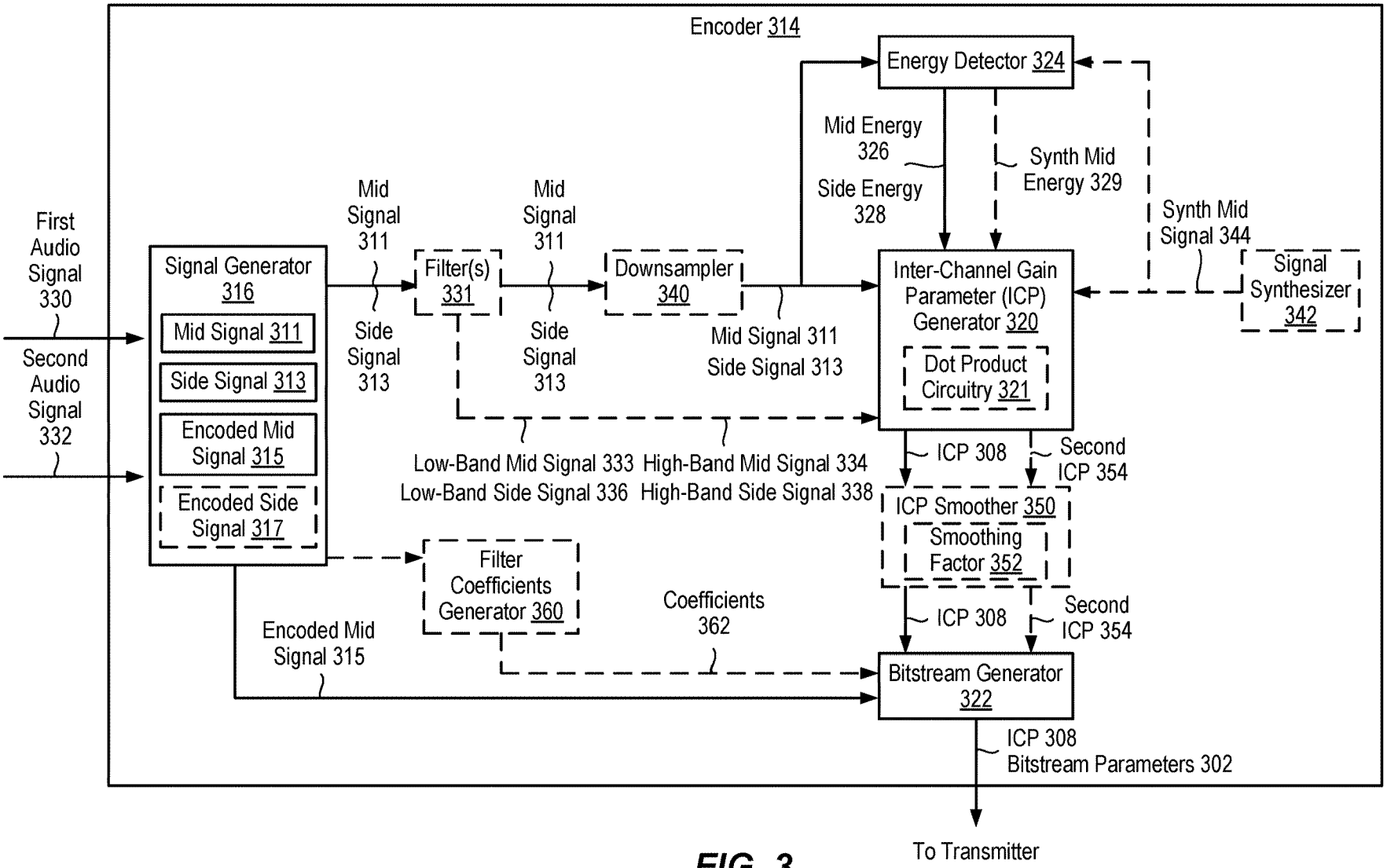
FIG. 3 is a block diagram of a particular illustrative example of an encoder of the system of FIG. 2.

FIG. 3 is a diagram illustrating a particular illustrative example of an encoder 314 of the system 200 of FIG. 2. For example, the encoder 314 may include or correspond to the encoder 214 of FIG. 2.

The encoder 314 includes a signal generator 316, an energy detector 324, an ICP generator 320, and a bitstream generator 322. The signal generator 316, the ICP generator 320, and the bitstream generator 322 may include or correspond to the signal generator 216, the ICP generator 220, and the bitstream generator 222 of FIG. 2, respectively. The signal generator 316 may be coupled to the ICP generator 320, the energy detector 324, and the bitstream generator 322. The energy detector 324 may be coupled to the ICP generator 320, and the ICP generator 320 may be coupled to the bitstream generator 322.

The encoder 314 may optionally include one or more filters 331, a downsampler 340, a signal synthesizer 342, an ICP smoother 350, a filter coefficients generator 360, or a combination thereof. The one or more filters 331 and the downsampler 340 may be coupled between the signal generator 316 and the ICP generator 320, the signal synthesizer 342 may be coupled to the energy detector 324 and the ICP generator 320, the ICP smoother 350 may be coupled between the ICP generator 320 and the bitstream generator 322, and the filter coefficients generator 360 may be coupled between the signal generator 316 and the bitstream generator 322. Each of the one or more filters 331, the downsampler 340, the signal synthesizer 342, the ICP smoother 350, and the filter coefficients generator 360 are optional and thus may not be included in some implementations of the encoder 314.

The signal generator 316 may be configured to generate audio signals based on input audio signals. For example, the signal generator 316 may be configured to generate a mid signal 311 based on a first audio signal 330 and a second audio signal 332. As another example, the signal generator 316 may be configured to generate a side signal 313 based on the first audio signal 330 and the second audio signal 332. The first audio signal 330 and the second audio signal 332 may include or correspond to the first audio signal 230 and the second audio signal 232 of FIG. 2, respectively. The signal generator 316 may also be configured to encode one or more audio signals. For example, the signal generator 316 may be configured to generate an encoded mid signal 315 based on the mid signal 311. In some implementations, the signal generator 316 is configured to generate an encoded side signal 317 based on the side signal 313, as further described herein.

In some implementations, the one or more filters 331 are configured to receive the mid signal 311 and the side signal 313 and to filter the mid signal 311 and the side signal 313. The one or more filters 331 may include one or more types of filters. For example, the one or more filters 331 may include pre-emphasis filters, bandpass filters, fast Fourier transform (FFT) filters (or transformations), inverse FFT (IFFT) filters (or transformations), time domain filters, frequency or sub-band domain filters, or a combination thereof. In a particular implementation, the one or more filters 331 include a fixed pre-emphasis filter and a 50 Hertz (Hz) high pass filter. In another particular implementation, the one or more filters 331 include a low pass filter and a high pass filter. In this implementation, the low pass filter of the one or more filters 331 is configured to generate a low-band mid signal 333 and a low-band side signal 336, and the high pass filter of the one or more filters 331 is configured to generate a high-band mid signal 334 and a high-band side signal 338. In this implementation, multiple inter-channel prediction gain parameters may be determined based on the low-band mid signal 333, the high-band mid signal 334, the low-band side signal 336, and the high-band side signal 338, as further described herein. In other implementations, the one or more filters 331 includes different bandpass filters (e.g., a low pass filter and a mid pass filter or a mid pass filter and a high pass filter, as non-limiting examples) or different numbers of bandpass filters (e.g., a low pass filter, a mid pass filter, and a high pass filter, as a non-limiting example).

In a particular implementation, the downsampler 340 is configured to downsample the mid signal 311 and the side signal 313. For example, the downsampler 340 may be configured to downsample the mid signal 311 and the side signal 313 from an input sampling rate (associated with the first audio signal 330 and the second audio signal 332). Downsampling the mid signal 311 and the side signal 313 enables generation of inter-channel prediction gain parameters at the downsampled rate (instead of the input sampling rate). Although illustrated in FIG. 3 as being coupled to the output of the one or more filters 331, in other implementations, the downsampler 340 may be coupled between the signal generator 316 and the one or more filters 331.

The energy detector 324 is configured to detect an energy level associated with one or more audio signals. For example, the energy detector 324 may be configured to detect an energy level associated with the mid signal 311 (e.g., a mid energy level 326) and an energy level associated with the side signal 313 (e.g., a side energy level 328). The energy detector 324 may be configured to provide the side energy level 328 (or both the side energy level 328 and the mid energy level 326) to the ICP generator 320.

In a particular implementation, the encoder 314 includes the signal synthesizer 342. The signal synthesizer 342 may be configured to generate one or more synthesized audio signals that may be used to generate bitstream parameters to be sent to another device (e.g., to a decoder). The signal synthesizer 342 (e.g., a local decoder) may be configured to generate a synthesized mid signal 344 in a similar manner to generation of a synthesized mid signal at a decoder. For example, the encoded mid signal 315 may correspond to bitstream parameters representative of the mid signal 311. The signal synthesizer 342 may generate the synthesized mid signal 344 by decoding the bitstream parameters. The synthesized mid signal 344 may be provided to the energy detector 324 and to the ICP generator 320. In a particular implementation, the energy detector 324 is further configured to detect an energy level associated with the synthesized mid signal 344 (e.g., a synthesized mid energy level 329). The synthesized mid energy level 329 may be provided to the ICP generator 320.

The ICP generator 320 is configured to generate one or more inter-channel prediction gain parameters based on audio signals and energy levels of audio signals. For example, the ICP generator 320 may be configured to generate an ICP 308 based on the mid signal 311, the side signal 313, and one or more energy levels. In a particular implementation, the ICP generator 320 and the ICP 308 include or correspond to the ICP generator 220 and the ICP 208 of FIG. 2, respectively. In some implementations, the ICP generator 320 includes dot product circuitry 321. The dot product circuitry 321 may be configured to generate a dot product of two audio signals, and the ICP generator 320 may be configured to determine the ICP 308 based on the dot product, as further described herein.

In a particular implementation, the ICP 308 is based on the mid energy level 326 and the side energy level 328. In this implementation, the ICP generator 320 (e.g., the encoder 314) is configured to determine a ratio of the side energy level 328 and the mid energy level 326, and the ICP 308 is based on the ratio. In another particular implementation, the ICP 308 is based on the side energy level 328 and the synthesized mid energy level 329. In this implementation, the ICP generator 320 (e.g., the encoder 314) is configured to determine a ratio of the side energy level 328 and the synthesized mid energy level 329, and the ICP 308 is based on the ratio. In another particular implementation, the ICP 308 is based on the side energy level 328 (and not the mid energy level 326 or the synthesized mid energy level 329). In another particular implementation, the ICP 308 is based on the mid signal 311, the side signal 313, and the mid energy level 326. In this implementation, the dot product circuitry 321 is configured to generate a dot product of the mid signal 311 and the side signal 313, the ICP generator 320 is configured to generate a ratio of the mid energy level 326 and the dot product, and the ICP 308 is based on the ratio. In another particular implementation, the ICP 308 is based on the synthesized mid signal 344, the side signal 313, and the synthesized mid energy level 329. In this implementation, the dot product circuitry 321 is configured to generate a dot product of the synthesized mid signal 344 and the side signal 313, the ICP generator 320 is configured to generate a ratio of the synthesized mid energy level 329 and the dot product, and the ICP 308 is based on the ratio. In another particular implementation, the ICP generator 320 is configured to generate multiple inter-channel prediction gain parameters corresponding to different signals or signal bands. For example, the ICP generator 320 may be configured to generate the ICP 308 based on the low-band mid signal 333 and the low-band side signal 336, and the ICP generator 320 may be configured to generate a second ICP 354 based on the high-band mid signal 334 and the high-band side signal 338. Additional details regarding determination of the ICP 308 are further described herein. The ICP generator 320 may be further configured to provide the ICP 308 (and the second ICP 354) to the bitstream generator 322.

In a particular implementation, the ICP smoother 350 is configured to perform a smoothing operation on the ICP 308 prior to the ICP 308 being provided to the bitstream generator 322. The smoothing operation may condition the ICP 308 to reduce (or eliminate) spurious values, such as at particular frame boundaries. The smoothing operation may be performed using a smoothing factor 352. In a particular implementation, the ICP smoother 350 may be configured to perform the smoothing operation in accordance with the following equation:

$$\text{gICP_smoothed}=\alpha*\text{gICP_smoothed(previous frame)}+(1-\alpha)*\text{gICP_instantaneous}$$

where gICP_smoothed is the smoothed value of the ICP 308 for a current frame, gICP_smoothed (previous frame) is the smoothed value of the ICP 308 for the previous frame, gICP_instantaneous is an instantaneous value of the ICP 308, and $\alpha$ is the smoothing factor 352.

In a particular implementation, the smoothing factor 352 is a fixed smoothing factor. For example, the smoothing factor 352 may be a particular value that is accessible to the ICP smoother 350. As a particular example, the smoothing factor may be 0.7. Alternatively, the smoothing factor 352 may be an adaptive smoothing factor. In a particular implementation, the adaptive smoothing factor may be based on signal energies of the mid signal 311. To illustrate, the value of the smoothing factor 352 may be based on a short-term signal level ($E_{ST}$) and a long-term signal level ($E_{LT}$) of the mid signal 311 and the side signal 313. As an example, the short-term signal level may be calculated for the frame (N) being processed ($E_{ST}(N)$) by summing the sum of the absolute values of downsampled reference samples of the mid signal 311 and the sum of the absolute values of downsampled samples of the side signal 313. The long-term signal level may be a smoothed version of the short-term signal level. For example, $E_{LT}(N)=0.6*E_{LT}(N-1)+0.4*E_{ST}(N)$. Further, the value of the smoothing factor 352 (e.g., $\alpha$) may be controlled according to pseudo-code described as follows:

Set $\alpha$ to an initial value (e.g., 0.95).

if $E_{ST}>4*E_{LT}$, modify the value of $\alpha$ (e.g., $\alpha=0.5$)

if $E_{ST}>2*E_{LT}$ and $E_{ST}\leq 4*E_{LT}$, modify the value of $\alpha$ (e.g., $\alpha=0.7$)

Although described as being determined based on the mid signal 311 and the side signal 313, in other implementations, the short-term signal level and the long-term signal level may be determined based on the synthesized mid signal 344 and the side signal 313. In another particular implementation, the smoothing factor 352 is an adaptive smoothing factor that is based on a voicing parameter associated with the mid signal 311. The voicing parameter may indicate an amount of stationary sound or strongly voiced segments in the mid signal 311 (or in the first audio signal 330 and the second audio signal 332). If the voicing parameter has a relatively high value, the signal(s) may include strongly voiced segments with relatively low noise, thus the smoothing factor 352 may be decreased to reduce (e.g., minimize) a rate at which the smoothing is performed. If the voicing parameter has a relatively low value, the signal(s) may include weakly voiced segments with relatively high noise, thus the smoothing factor 352 may be increased to increase (e.g., maximize) the rate at which the smoothing is performed. Accordingly, in some implementations, the smoothing factor 352 may be indirectly proportional to the voicing parameter. In other implementations, the smoothing factor 352 may be based on other parameters or values. Although smoothing of the ICP 308 has been described, in implementations in which the second ICP 354 is generated, the smoothing operation may also be applied to the second ICP 354.

In a particular implementation, predicting a synthesized side signal at a decoder includes applying an adaptive filter to a synthesized mid signal (or the predicted synthesized side signal), as further described with reference to FIG. 4. In this implementation, the encoder 314 includes the filter coefficients generator 360. The filter coefficients generator 360 may be configured to generate one or more filter coefficients 362 for the adaptive filter that is to be applied at the decoder. For example, the filter coefficients generator 360 may be configured to generate the one or more filter coefficients 362 based on the mid signal 311, the side signal 313, the encoded mid signal 315, the encoded side signal 317, one or more other parameters, or a combination thereof. The filter coefficients generator 360 may be further configured to provide the one or more filter coefficients 362 to the bitstream generator 322 for inclusion in bitstream parameters output by the encoder 314.

The bitstream generator 322 may be configured to generate one or more bitstream parameters indicative of an encoded audio signal (in addition to other parameters). For example, the bitstream generator 322 may be configured to generate one or more bitstream parameters 302 that include the encoded mid signal 315. The one or more bitstream parameters 302 may include other parameters, such as a pitch parameter, a voicing parameter, a coder type parameter, a low-band energy parameter, a high-band energy parameter, a tilt parameter, a pitch gain parameter, a fixed codebook (FCB) gain parameter, a coding mode parameter, a voice activity parameter, a noise estimate parameter, a signal-to-noise ratio parameter, a formants parameter, a speech/music description parameter, a non-causal shift parameter, or a combination thereof. In a particular implementation, the one or more bitstream parameters 302 include the ICP 308. Alternatively, the one or more bitstream parameters 302 may include one or more parameters that enable the ICP 308 to be derived (e.g., the ICP 308 is derived from the one or more bitstream parameters 302). In some implementations, the one or more bitstream parameters 302 also include (or indicate) the second ICP 354. In a particular implementation, the one or more bitstream parameters 302 include (or indicate) the one or more filter coefficients 362. The encoder 314 may be configured to output the one or more bitstream parameters 302 (including or indicating the ICP 308) to a transmitter for transmission to other devices.

During operation, the encoder 314 receives the first audio signal 330 and the second audio signal 332, such as from one or more input interfaces. The signal generator 316 may generate the mid signal 311 and the side signal 313 based on the first audio signal 330 and the second audio signal 332. The signal generator 316 may also generate the encoded mid signal 315 based on the mid signal 311. In some implementations, the signal generator 316 may generate the encoded side signal 317 based on the side signal 313. For example, the encoded side signal 317 may be generated for one or more frames that are associated with a determination not to predict a synthesized side signal at a decoder (e.g., a determination to encode the side signal 313). Additionally, or alternatively, the encoded side signal 317 may be generated to determine one or more parameters used in the generation of the one or more bitstream parameters 302 or to determine the one or more filter coefficients 362.

In some implementations, the one or more filters 331 may filter the mid signal 311 and the side signal 313. For example, the one or more filters 331 may perform pre-emphasis filtering on the mid signal 311 and the side signal 313. In some implementations, the downsampler 340 may downsample the mid signal 311 and the side signal 313. For example, the downsampler 340 may downsample the mid signal 311 and the side signal 313 from an input sampling frequency associated with the first audio signal 330 and the second audio signal 332 to a downsampled frequency. In a particular implementation, the downsampled frequency is within the range of 0-6.4 kHz. In a particular implementation, the downsampler 340 may downsample the mid signal 311 to generate a first downsampled audio signal (e.g., a downsampled mid signal) and may downsample the side signal 313 to generate a second downsampled audio signal (e.g., a downsampled side signal), and the ICP 308 may be generated based on the first downsampled audio signal and the second downsampled audio signal. In an alternate implementation, the downsampler 340 is not included in the encoder 314, and the ICP 308 is determined at the input sampling rate associated with the first audio signal 330 and the second audio signal 332. Although the filtering and downsampling is described with reference to FIG. 3 as being performed after generation of the mid signal 311 and the side signal 313, in other implementations, the filtering, the downsampling, or both may instead (or in addition) be performed on the first audio signal 330 and the second audio signal 332 prior to generation of the mid signal 311 and the side signal 313.

The energy detector 324 may detect one or more energy levels associated one or more audio signals and provide the detected energy levels to the ICP generator 320 for use in generating the ICP 308. For example, the energy detector 324 may detect the mid energy level 326, the side energy level 328, the synthesized mid energy level 329, or a combination thereof. The mid energy level 326 is based on the mid signal 311, the side energy level 328 is based on the side signal 313, and the synthesized mid energy level 329 is based on the synthesized mid signal 344, which is generated by the signal synthesizer 342. For example, in some implementations, the encoder 314 includes the signal synthesizer 342 that generates the synthesized mid signal 344 that is used to determine one or more parameters of the one or more bitstream parameters 302. In these implementations, the synthesized mid signal 344 may be used to generate inter-channel prediction gain parameter(s). In other implementations, the signal synthesizer 342 is not included in the encoder 314, and the encoder 314 does not have access to the synthesized mid signal 344.

The ICP generator 320 generates the ICP 308 based on one or more signals and one or more energy levels. The one or more signals may include the mid signal 311, the side signal 313, the synthesized mid signal 344, or a combination thereof, and the one or more energy levels may include the mid energy level 326, the side energy level 328, the synthesized mid energy level 329, or a combination thereof.

In some implementations, determination of the ICP 308 is "energy based." For example, the ICP 308 may be determined to preserve energy of a particular signal or a relationship between energies of two different signals. In a first particular implementation, the ICP 308 is a scale factor that preserves the relative energy between the mid signal 311 and the side signal 313 at the encoder 314. In the first implementation, the ICP 308 is based on a ratio of the mid energy level 326 and the side energy level 328, and the ICP 308 is determined according to the following equation:

ICP_Gain=sqrt(Energy(side_signal_unquantized)/Energy(mid_signal unquantized))

where ICP_Gain is the ICP 308, Energy(side_signal_unquantized) is the side energy level 328, and Energy(mid_signal_unquantized) is the mid energy level 326. In the first implementation, a predicted (e.g., mapped) synthesized side signal is determined at a decoder according to the following equation:

Side_Mapped=Mid_signal_quantized*ICP_Gain where Side_Mapped is the predicted (e.g., mapped) synthesized side signal, ICP_Gain is the ICP 308, and Mid_signal_quantized is a synthesized mid signal that is generated based on bitstream parameters (e.g., the one or more bitstream parameters 302). Although it is described as the Side_Mapped being the product of the Mid_signal_quantized with the ICP_Gain, in other implementations, the Side_Mapped may be an intermediate signal and may undergo further processing (e.g., all-pass filtering, de-emphasis filtering etc.) prior to being used in subsequent operations at the decoder (e.g., upmix operations).

In a second particular implementation, the ICP 308 is a scale factor that matches the energy of the synthesized side signal generated at a decoder to the side energy level 328 at the encoder 314. In the second implementation, the ICP 308 is based on a ratio of the synthesized mid energy level 329 and the side energy level 328, and the ICP 308 is determined according to the following equation:

ICP_Gain=sqrt(Energy(side_signal_unquantized)/Energy(mid_signal_quantized))

where Energy(side_signal_unquantized) is the side energy level 328, Energy(mid_signal_quantized) is the synthesized mid energy level 329, and ICP_Gain is the ICP 308. In the second implementation, a predicted (e.g., mapped) synthesized side signal is determined at a decoder according to the following equation:

Side_Mapped=Mid_signal_quantized*ICP_Gain where Side_Mapped is the predicted (e.g., mapped) synthesized side signal, ICP_Gain is the ICP 308, and Mid_signal_quantized is a synthesized mid signal that is generated based on bitstream parameters.

In a third particular implementation, the ICP 308 represents an absolute value of the side energy level 328 at the encoder 314. In the third implementation, the ICP 308 is determined according to the following equation:

ICP_Gain=sqrt(Energy(side_signal_unquantized))

where Energy(side_signal_unquantized) is the side energy level 328. In the third implementation, a predicted (e.g., mapped) synthesized side signal is determined at a decoder according to the following equation:

Side_Mapped=Mid_signal_quantized*ICP_Gain/sqrt(Energy(Mid_signal_quantized))

where Side_Mapped is the predicted (e.g., mapped) synthesized side signal, ICP_Gain is the ICP 308, and Mid_signal_quantized is a synthesized mid signal that is generated based on bitstream parameters.

In some implementations, determination of the ICP 308 is "mean square error (MSE) based." For example, the ICP 308 may be determined such that the MSE between a synthesized side signal at a decoder and the side signal 313 is reduced (e.g., minimized). In a fourth particular implementation, the ICP 308 is determined such that, when mapping (e.g., predicting) from the mid signal 311, the MSE between the side signal 313 at the encoder 314 and the synthesized side signal at the decoder is minimized (or reduced). In the fourth implementation, the ICP 308 is based on a ratio of the mid energy level 326 and a dot product of the mid signal 311 and the side signal 313, and the ICP 308 is determined according to the following equation:

ICP_Gain=|Mid_signal unquantized·Side_signal_unquantized|/Energy(mid_signal_unquantized)

where ICP_Gain is the ICP 308, |Mid_signal unquantized·Side_signal_unquantized| is the dot product of the mid signal 311 and the side signal 313 (generated by the dot product circuitry 321), and Energy(mid_signal_unquantized) is the mid energy level 326. In the fourth implementation, a predicted (e.g., mapped) synthesized side signal is determined at a decoder according to the following equation:

Side_Mapped=Mid_signal_quantized*ICP_Gain where Side_Mapped is the predicted (e.g., mapped) synthesized side signal, ICP_Gain is the ICP 308, and Mid_signal_quantized is a synthesized mid signal that is generated based on bitstream parameters.

In a fifth particular implementation, the ICP 308 is determined such that, when mapping (e.g., predicting) from the synthesized mid signal 344, the MSE between the side signal 313 at the encoder 314 and the synthesized side signal at the decoder is minimized (or reduced). In the fifth implementation, the ICP 308 is based on a ratio of the synthesized mid energy level 329 and a dot product of the synthesized mid signal 344 and the side signal 313, and the ICP 308 is determined according to the following equation:

ICP_Gain=|Mid_signal_quantized·Side_signal_unquantized|/Energy(mid_signal_quantized)

where ICP_Gain is the ICP 308, |Mid_signal_quantized·Side_signal unquantized| is the dot product of the synthesized mid signal 344 and the side signal 313 (generated by the dot product circuitry 321), and Energy(mid_signal_quantized) is the synthesized mid energy level 329. In the fifth implementation, a predicted (e.g., mapped) synthesized side signal is determined at a decoder according to the following equation:

Side_Mapped=Mid_signal_quantized*ICP_Gain where Side_Mapped is the predicted (e.g., mapped) synthesized side signal, ICP_Gain is the ICP 308, and Mid_signal_quantized is a synthesized mid signal that is generated based on bitstream parameters. In other implementations, the ICP 308 may be generated in using other techniques.

In some implementations, the ICP smoother 350 performs a smoothing operation on the ICP 308. The smoothing operation may be based on the smoothing factor 352. The smoothing factor 352 may be a fixed smoothing factor or an adaptive smoothing factor. In implementations in which the smoothing factor 352 is an adaptive smoothing factor, the smoothing factor 352 may be based on signal energy of the mid signal 311 (e.g., the short-term signal level and the long-term signal level) or based on a voicing parameter associated with the mid signal 311, as non-limiting examples. In a particular implementation, the ICP smoother 350 may restrict the value of the ICP 308 to be within a fixed range (e.g., between a lower limit and an upper limit). As a particular example, the ICP smoother 350 may perform a clipping operation on the ICP 308 according to the following pseudocode:

st_stereo->gICP_final=min(st_stereo->gICP_smoothed,0.6)

where gICP_final corresponds to a final value of the ICP 308 and gICP_smoothed corresponds to a smoothed value of the ICP 308 prior to performance of the clipping operation. In other implementations, the clipping operation may restrict the value of ICP 308 to be less than 0.6 or greater than 0.6.

In some implementations, the ICP generator 320 may also generate a correlation parameter based on the mid signal 311 and the side signal 313. The correlation parameter may represent a correlation between the mid signal 311 and the side signal 313. Details regarding generation of the correlation parameter are further described with reference to FIG. 15. The correlation parameter may be provided to the bitstream generator 322 for inclusion in the one or more bitstream parameters 302 (or for output in addition to the one or more bitstream parameters 302). In some implementations, the ICP smoother 350 performs a smoothing operation on the correlation parameter in a similar manner to performing the smoothing operation on the ICP 308.

The bitstream generator 322 may receive the ICP 308 and the encoded mid signal 315 and generate the one or more bitstream parameters 302. The one or more bitstream parameters 302 may indicate the encoded mid signal 315 (e.g., the one or more bitstream parameters 302 may enable generation of a synthesized mid signal at a decoder). The one or more bitstream parameters 302 may include (or indicate) the ICP 308 (or the ICP 308 may be output in addition to the one or more bitstream parameters 302). In a particular implementation, the bitstream generator 322 receives the one or more filter coefficients 362 (e.g., one or more adaptive filter coefficients) that are generated by the filter coefficients generator 360, and the bitstream generator 322 includes the one or more filter coefficients 362 (or values that enable derivation of the one or more filter coefficients 362) in the one or more bitstream parameters 302. The one or more bitstream parameters 302 (that include or indicate the ICP 308) may be output by the encoder 314 to a transmitter for transmission to another device, as described with reference to FIG. 2.

In a particular implementation, multiple inter-channel prediction gain parameters are generated. To illustrate, the one or more filters 331 may include bandpass filters or FFT filters configured to generate different signal bands. For example, the one or more filters 331 may process the mid signal 311 to generate the low-band mid signal 333 and the high-band mid signal 334. As another example, the one or more filters 331 may process the side signal 313 to generate the low-band side signal 336 and the high-band side signal 338. In other implementations, other signal bands may be generated or more than two signal bands may be generated. In a particular aspect, the one or more filters 331 generate a first filtered signal (e.g., the low-band mid signal 333 or the low-band side signal 336) corresponding to a first signal band that at least partially overlaps a second signal band corresponding to a second filtered signal (e.g., the high-band mid signal 334 or the high-band side signal 338). In an alternate aspect, the first signal band does not overlap the second signal band. The multiple signals 333-338 may be provided to the ICP generator 320, and the ICP generator 320 may generate multiple inter-channel prediction gain parameters based on the multiple signals. For example, the ICP generator 320 may generate the ICP 308 based on the low-band mid signal 333 and the low-band side signal 336, and the ICP generator 320 may generate the second ICP 354 based on the high-band mid signal 334 and the high-band side signal 338. The ICP 308 and the second ICP 354 may be optionally smoothed and provided to the bitstream generator 322 for inclusion in the one or more bitstream parameters 302 (or for output in addition to the one or more bitstream parameters 302). Generating multiple ICP values may enable different gains to be applied in different bands, which may improve the overall prediction of the synthesized side signal at a decoder. As a particular example, the side signal 313 may correspond to 20% of the total energy (e.g., a sum of the energy of the mid signal 311 and the energy of the side signal 313) in the low-band, but may correspond to 60% of the total energy in the high-band. Accordingly, synthesizing the low-band of the side signal based on the ICP 308 and synthesizing the high-band of the side signal based on the second ICP 354 may result in a more accurate synthesized side signal than synthesizing the side signal based on one inter-channel prediction gain parameter for all the signal bands.

The encoder 314 of FIG. 3 enables generation of inter-channel prediction gain parameters for frames associated with a determination to predict a side signal at a decoder (instead of encoding the side signal). The inter-channel prediction gain parameter (e.g., the ICP 308) is generated at the encoder 314 to enable a decoder to predict (e.g., generate) a synthesized side signal based on a synthesized mid signal that is generated based on one or more bitstream parameters generated at the encoder 314. Because the ICP 308 is output instead of a frame of the encoded side signal 317 and because the ICP 308 uses fewer bits than the encoded side signal 317, network resources may be conserved while being relatively unnoticed by a listener. Alternatively, one or more bits that would otherwise be used to output the encoded side signal 317 may instead be repurposed (e.g., used) to output additional bits of the encoded mid signal 315. Increasing the number of bits used to output the encoded mid signal 315 increases the amount of information associated with the encoded mid signal 315 that is output by the encoder 314. Increasing the number of bits of the encoded mid signal 315 that are output by the encoder 314 may improve the quality of a synthesized mid signal generated at a decoder, which may reduce (or eliminate) audio artifacts in the synthesized mid signal at the decoder (and in the synthesized side signal at the decoder since the synthesized side signal is predicted based on the synthesized mid signal).

Figure 4:
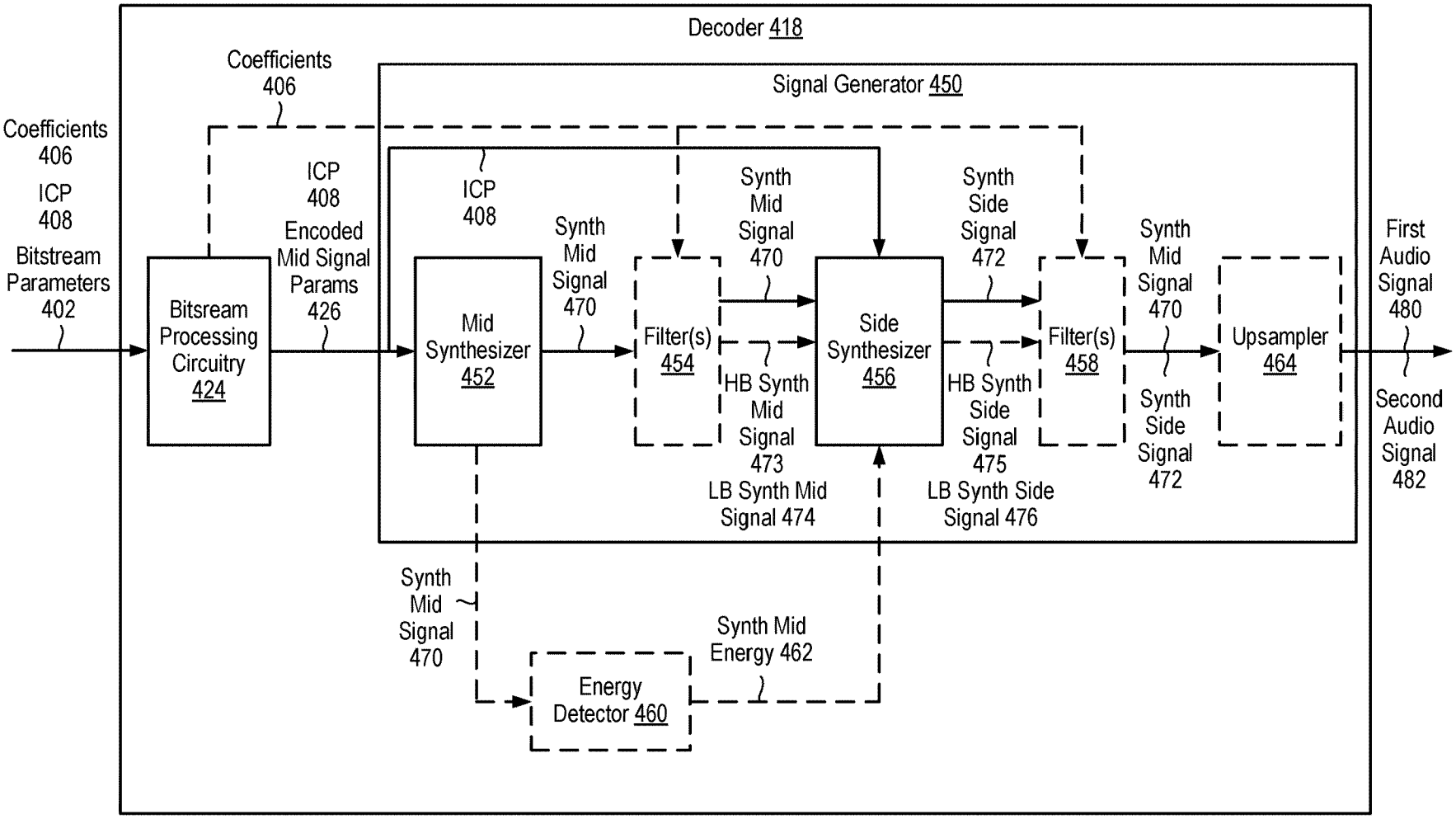
FIG. 4 is a block diagram of a particular illustrative example of a decoder of the system of FIG. 2.

FIG. 4 is a diagram illustrating a particular illustrative example of a decoder 418 of the system 200 of FIG. 2. For example, the decoder 418 may include or correspond to the decoder 218 of FIG. 2.

The decoder 418 includes bitstream processing circuitry 424 and a signal generator 450 that includes a mid synthesizer 452 and a side synthesizer 456. The signal generator 450 may include or correspond to the signal generator 274 of FIG. 2. The bitstream processing circuitry 424 may be coupled to the signal generator 450.

The decoder 418 may optionally include an energy detector 460 and an upsampler 464, and the signal generator 450 may optionally include one or more filters 454 and one or more filters 458. The one or more filters 454 may be coupled between the mid synthesizer 452 and the side synthesizer 456, the one or more filters 458 may be coupled to the side synthesizer 456, the upsampler 464 may be coupled to the signal generator 450 (e.g., to an output of the signal generator 450), and the energy detector 460 may be coupled to the mid synthesizer 452 and to the side synthesizer 456. Each of the one or more filters 454, the one or more filters 458, the upsampler 464, and the energy detector 460 are optional and thus may not be included in some implementations of the decoder 418.

The bitstream processing circuitry 424 may be configured to process bitstream parameters and extract particular parameters from the bitstream parameters. For example, the bitstream processing circuitry 424 may be configured to receive one or more bitstream parameters 402 (e.g., from a receiver). The one or more bitstream parameters 402 may include (or indicate) an inter-channel prediction gain parameter (ICP) 408. Alternatively, the ICP 408 may be received in addition to the one or more bitstream parameters 402. The one or more bitstream parameters 402 and the ICP 408 may include or correspond to the one or more bitstream parameters 302 and the ICP 308 of FIG. 3, respectively. In some implementations, the one or more bitstream parameters 402 may also include (or indicate) one or more coefficients 406. The one or more coefficients 406 may include one or more adaptive filter coefficients that are generated by an encoder (e.g., the encoder 314 of FIG. 3, as a non-limiting example).

The bitstream processing circuitry 424 may be configured to extract one or more particular parameters from the one or more bitstream parameters 402. For example, the bitstream processing circuitry 424 may be configured to extract (e.g., generate) the ICP 408 and one or more encoded mid signal parameters 426. The one or more encoded mid signal parameters 426 include parameters indicative of an encoded audio signal (e.g., an encoded mid signal) that is generated at an encoder. The one or more encoded mid signal parameters 426 may enable generation of a synthesized mid signal, as further described herein. The bitstream processing circuitry 424 may be configured to provide the ICP 408 and the one or more encoded mid signal parameters 426 to the signal generator 450 (e.g., to the mid synthesizer 452). In a particular implementation, the bitstream processing circuitry 424 is further configured to extract the one or more coefficients 406 and to provide the one or more coefficients 406 to the signal generator 450 (e.g., to the one or more filters 454, the one or more filters 458, or both).

The signal generator 450 may be configured to generate audio signals based on the encoded mid signal parameters 426 and the ICP 408. To illustrate, the mid synthesizer 452 may be configured to generate a synthesized mid signal 470 based on the encoded mid signal parameters 426 (e.g., based on an encoded mid signal). For example, the encoded mid signal parameters 426 may enable derivation of the synthesized mid signal 470, and the mid synthesizer 452 may be configured to derive the synthesized mid signal 470 from the encoded mid signal parameters 426. The synthesized mid signal 470 may represent a first audio signal superimposed on a second audio signal.

In a particular implementation, the one or more filters 454 are configured to receive the synthesized mid signal 470 and to filter the synthesized mid signal 470. The one or more filters 454 may include one or more types of filters. For example, the one or more filters 454 may include de-emphasis filters, bandpass filters, FFT filters (or transformations), IFFT filters (or transformations), time domain filters, frequency or sub-band domain filters, or a combination thereof. In a particular implementation, the one or more filters 454 include one or more fixed filters. Alternatively, the one or more filters 454 may include one or more adaptive filters configured to filter the synthesized mid signal 470 based on the coefficients 406 (e.g., one or more adaptive filter coefficients that are received from another device). In a particular implementation, the one or more filters 454 include a de-emphasis filter and a 50 Hz high pass filter. In another particular implementation, the one or more filters 454 include a low pass filter and a high pass filter In this implementation, the low pass filter of the one or more filters 454 is configured to generate a low-band synthesized mid signal 474, and the high pass filter of the one or more filters 454 is configured to generate a high-band synthesized mid signal 473. In this implementation, multiple inter-channel prediction gain parameters may be used to predict multiple synthesized side signals, as further described herein. In other implementations, the one or more filters 454 includes different bandpass filters (e.g., a low pass filter and a mid pass filter or a mid pass filter and a high pass filter, as non-limiting examples) or different numbers of bandpass filters (e.g., a low pass filter, a mid pass filter, and a high pass filter, as a non-limiting example).

The side synthesizer 456 may be configured to generate a synthesized side signal 472 based on the synthesized mid signal 470 and the ICP 408. For example, the side synthesizer 456 may be configured to apply the ICP 408 to the synthesized mid signal 470 to generate the synthesized side signal 472. The synthesized side signal 472 may represent a difference between a first audio signal and a second audio signal. In a particular implementation, the side synthesizer 456 may be configured to multiply the synthesized mid signal 470 by the ICP 408 to generate the synthesized side signal 472. In another particular implementation, the side synthesizer 456 may be configured to generate the synthesized side signal 472 based on the synthesized mid signal 470, the ICP 408, and an energy level of the synthesized mid signal 470 (e.g., a synthesized mid energy 462). The synthesized mid energy 462 may be received at the side synthesizer 456 from the energy detector 460. For example, the energy detector 460 may be configured to receive the synthesized mid signal 470 from the mid synthesizer 452, and the energy detector 460 may be configured to detect the synthesized mid energy 462 from the synthesized mid signal 470. In another particular implementation, the side synthesizer 456 may be configured to generate multiple side signals (or signal bands) based on multiple inter-channel prediction gain parameters. For example, the side synthesizer 456 may be configured to generate a low-band synthesized side signal 476 based on the low-band synthesized mid signal 474 and the ICP 408, and the side synthesizer 456 may be configured to generate a high-band synthesized side signal 475 based on the high-band synthesized mid signal 473 and a second ICP (e.g., the second ICP 354 of FIG. 3).

In a particular implementation, the one or more filters 458 are configured to receive the synthesized side signal 472 and to filter the synthesized side signal 472. The one or more filters 458 may include one or more types of filters. For example, the one or more filters 458 may include de-emphasis filters, bandpass filters, FFT filters (or transformations), IFFT filters (or transformations), time domain filters, frequency or sub-band domain filters, or a combination thereof. In a particular implementation, the one or more filters 458 include one or more fixed filters. Alternatively, the one or more filters 458 may include one or more adaptive filters configured to filter the synthesized side signal 472 based on the coefficients 406 (e.g., one or more adaptive filter coefficients that are received from another device). In a particular implementation, the one or more filters 458 include a de-emphasis filter and a 50 Hz high pass filter. In another particular implementation, the one or more filters 458 include a combining filter (or other signal combiner) configured to combine multiple signals (or signal bands) to generate a synthesized signal. For example, the one or more filters 458 may be configured to combine the high-band synthesized side signal 475 and the low-band synthesized side signal 476 to generate the synthesized side signal 472. Although described as performing filtering on synthesized side signal(s), in other implementations (e.g., implementations that do not include the one or more filters 454), the one or more filters 458 may also be configured to perform filtering on synthesized mid signal(s).

In a particular implementation, the upsampler 464 is configured to upsample the synthesized mid signal 470 and the synthesized side signal 472. For example, the upsampler 464 may be configured to upsample the synthesized mid signal 470 and the synthesized side signal 472 from a downsampled rate (at which the synthesized mid signal 470 and the synthesized side signal 472 are generated) to an upsampled rate (e.g., an input sampling rate of audio signals that are received at an encoder and used to generate the one or more bitstream parameters 402). Upsampling the synthesized mid signal 470 and the synthesized side signal 472 enables generation (e.g., by the decoder 418) of audio signals at an output sampling rate associated with playback of audio signals.

The decoder 418 may be configured to generate a first audio signal 480 and a second audio signal 482 based on the upsampled synthesized mid signal 470 and the upsampled synthesized side signal 472. For example, the decoder 418 may perform upmixing, as described with reference to the decoder 118 FIG. 1, of the synthesized mid signal 470 and the synthesized side signal 472 based on an upmixing parameter to generate the first audio signal 480 and the second audio signal 482.

During operation, the decoder 418 receives the one or more bitstream parameters 402 (e.g., from a receiver). The one or more bitstream parameters 402 include (or indicate) the ICP 408. In some implementations, the one or more bitstream parameters 402 also include (or indicate) the coefficients 406. The bitstream processing circuitry 424 may process the one or more bitstream parameters 402 and extract various parameters. For example, the bitstream processing circuitry 424 may extract the encoded mid signal parameters 426 from the one or more bitstream parameters 402, and the bitstream processing circuitry 424 may provide the encoded mid signal parameters 426 to the signal generator 450 (e.g., to the mid synthesizer 452). As another example, the bitstream processing circuitry 424 may extract the ICP 408 from the one or more bitstream parameters 402, and the bitstream processing circuitry 424 may provide the ICP 408 to the signal generator 450 (e.g., to the side synthesizer 456). In a particular implementation, the bitstream processing circuitry 424 may extract the one or more coefficients 406 from the one or more bitstream parameters 402, and the bitstream processing circuitry 424 may provide the one or more coefficients 406 to the signal generator 450 (e.g., to the one or more filters 454, to the one or more filters 458, or to both).

The mid synthesizer 452 may generate the synthesized mid signal 470 based on the encoded mid signal parameters 426. In some implementations, the one or more filters 454 may filter the synthesized mid signal 470. For example, the one or more filters 454 may perform de-emphasis filtering, high pass filtering, or both, on the synthesized mid signal 470. In a particular implementation, the one or more filters 454 applies a fixed filter to the synthesized mid signal 470 (prior to generation of the synthesized side signal 472). In another particular implementation, the one or more filters 454 applies an adaptive filter to the synthesized mid signal 470 (e.g., prior to generation of the synthesized side signal 472). The adaptive filter may be based on the one or more coefficients 406 received from another device (e.g., via inclusion in the one or more bitstream parameters 402).

The side synthesizer 456 may generate the synthesized side signal 472 based on the synthesized mid signal 470 and the ICP 408. Because the synthesized side signal 472 is generated based on the synthesized mid signal 470 (instead of based on encoded side signal parameters received from another device), generating the synthesized side signal 472 may be referred to as predicting (or mapping) the synthesized side signal 472 from the synthesized mid signal 470. In some implementations, the synthesized side signal 472 may be generated according to the following equation:

$$\text{Side_Mapped}=\text{Mid_signal_quantized}*\text{ICP_Gain}$$

where Side_Mapped is the synthesized side signal 472, ICP_Gain is the ICP 408, and Mid_signal_quantized is the synthesized mid signal 470. Generating the synthesized side signal 472 in this manner corresponds to the first, second, fourth, and fifth implementations of generating the ICP 308, as described with reference to FIG. 3.

In another particular implementation, the synthesized side signal 472 is generated according to the following equation:

$$\text{Side_Mapped}=\text{Mid_signal_quantized}*\text{ICP_Gain}/\text{sqrt}(\text{Energy}(\text{Mid_signal_quantized}))$$

where Side_Mapped is the synthesized side signal 472, ICP_Gain is the ICP 408, Mid_signal_quantized is the synthesized mid signal 470, and Energy(Mid_signal_quantized) is the synthesized mid energy 462 that is generated by the energy detector 460.

In a particular implementation, an encoder of another device may include one or more bits in the one or more bitstream parameters 402 to indicate which technique is to be used to generate the synthesized side signal 472. For example, if a particular bit has a first value (e.g., a logic "0" value), the synthesized side signal 472 may be generated based on the synthesized mid signal 470 and the ICP 408, and if the particular bit has a second value (e.g., a logic "1" value), the synthesized side signal 472 may be generated based on the synthesized mid signal 470, the ICP 408, and the synthesized mid energy 462. In other implementations, the decoder 418 may determine how to generate the synthesized side signal 472 based on other information, such as one or more other parameters included in the one or more bitstream parameters 402 or based on a value of the ICP 408.

In some implementation, the synthesized side signal 472 may include or correspond to an intermediate synthesized side signal, and additional processing (e.g., all-pass filtering, band-pass filtering, other filtering, upsampling, etc.) may be performed on the intermediate synthesized side signal to generate a final synthesized side signal that is used in upmixing. In a particular implementation, all-pass filtering performed on the intermediate synthesized side signal is controlled based on a correlation parameter that is included in (or received in addition to) the one or more bitstream parameters 402. Performing all-pass filtering based on the correlation parameter may decrease the correlation (e.g., increase the decorrelation) between the synthesized mid signal 470 and the final synthesized side signal. Details of filtering the intermediate synthesized side signal based on the correlation parameter are described with reference to FIG. 15.

In some implementations, the one or more filters 454 may filter the synthesized mid signal 470. For example, the one or more filters 454 may perform de-emphasis filtering, high pass filtering, or both, on the synthesized mid signal 470. In a particular implementation, the one or more filters 454 applies a fixed filter to the synthesized mid signal 470 (prior to generation of the synthesized side signal 472). In another particular implementation, the one or more filters 454 applies an adaptive filter to the synthesized mid signal 470 (e.g., prior to generation of the synthesized side signal 472). The adaptive filter may be based on the one or more coefficients 406 received from another device (e.g., via inclusion in the one or more bitstream parameters 402).

In some implementations, the one or more filters 458 may filter the synthesized side signal 472. For example, the one or more filters 458 may perform de-emphasis filtering, high pass filtering, or both, on the synthesized side signal 472. In a particular implementation, the one or more filters 458 applies a fixed filter to the synthesized side signal 472. In another particular implementation, the one or more filters 458 applies an adaptive filter to the synthesized side signal 472. The adaptive filter may be based on the one or more coefficients 406 received from another device (e.g., via inclusion in the one or more bitstream parameters 402). In some implementations, the one or more filters 454 are not included in the decoder 418, and the one or more filters 458 performs filtering on the synthesized side signal 472 and the synthesized mid signal 470.

In some implementations, the upsampler 464 may upsample the synthesized mid signal 470 and the synthesized side signal 472. For example, the upsampler 464 may upsample the synthesized mid signal 470 and the synthesized side signal 472 from a downsampled rate (e.g., approximately 0-6.4 kHz) to an output sampling rate. After upsampling, the decoder 418 may generate the first audio signal 480 and the second audio signal 482 based on the synthesized mid signal 470 and the synthesized side signal 472. The first audio signal 480 and the second audio signal 482 may be output to one or more output devices, such as one or more loudspeakers. In a particular implementation, the first audio signal 480 is one of a left audio signal and a right audio signal, and the second audio signal 482 is the other of the left audio signal and the right audio signal.

In a particular implementation, multiple inter-channel prediction gain parameters are used to generate multiple signals (or signal bands). To illustrate, the one or more filters 454 may include bandpass or FFT filters configured to generate different signal bands. For example, the one or more filters 454 may process the synthesized mid signal 470 to generate the low-band synthesized mid signal 474 and the high-band synthesized mid signal 473. In other implementations, other signal bands may be generated or more than two signal bands may be generated. The side synthesizer 456 may generate multiple synthesized signals (or signal bands) based on multiple inter-channel prediction gain parameters. For example, the side synthesizer 456 may generate the low-band synthesized side signal 476 based on the low-band synthesized mid signal 474 and the ICP 408. As another example, the side synthesizer 456 may generate the high-band synthesized side signal 475 based on the high-band synthesized mid signal 473 and a second ICP (e.g., that is included in or indicated by the one or more bitstream parameters 402). The one or more filters 458 (or another signal combiner) may combine the low-band synthesized side signal 476 and the high-band synthesized side signal 475 to generate the synthesized side signal 472. Applying different inter-channel prediction gain parameters to different signal bands may result in a synthesized side signal that more closely matches a side signal at an encoder than a synthesized side signal that is generated based on a single inter-channel prediction gain parameter associated with all signal bands.

The decoder 418 of FIG. 4 enables prediction (e.g., mapping) of the synthesized side signal 472 from the synthesized mid signal 470 using inter-channel prediction gain parameters (e.g., the ICP 408) for frames associated with a determination to predict a side signal at the decoder 418 (instead of receiving an encoded side signal). Because the ICP 408 is sent to the decoder 418 instead of a frame of an encoded side signal and because the ICP 408 uses fewer bits than the encoded side signal, network resources may be conserved while being relatively unnoticed by a listener. Alternatively, one or more bits that would otherwise be used to send the encoded side signal may instead be repurposed (e.g., used) to send additional bits of an encoded mid signal. Increasing the number of bits of the encoded mid signal that are received increases the amount of information associated with the encoded mid signal that is received by the decoder 418. Increasing the number of bits of the encoded mid signal that are received by the decoder 418 may improve the quality of the synthesized mid signal 470, which may reduce (or eliminate) audio artifacts in the synthesized mid signal 470 (and in the synthesized side signal 472 since the synthesized side signal 472 is predicted based on the synthesized mid signal 470).

Figure 5:
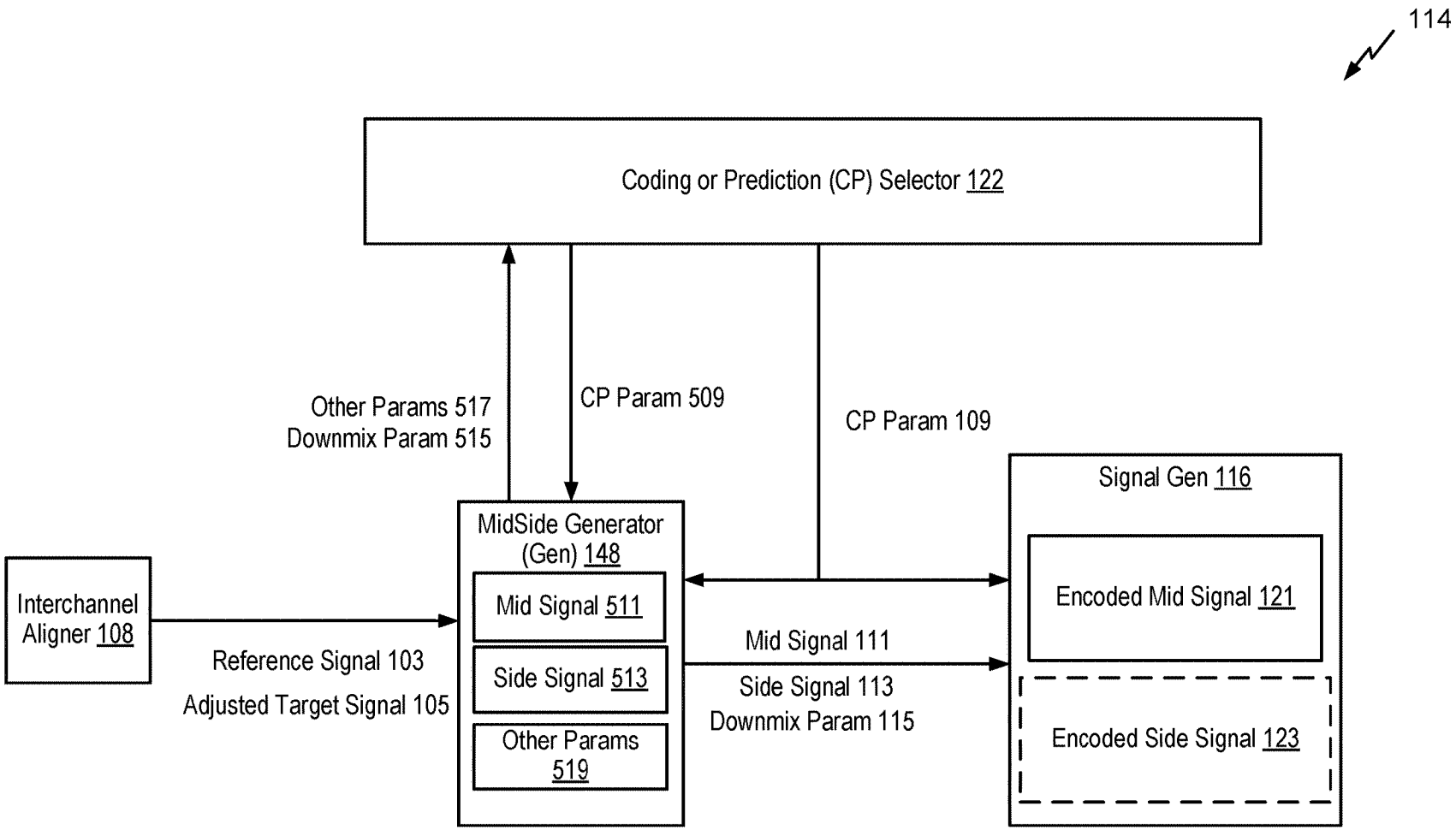
FIG. 5 is a diagram illustrating an example of an encoder of the system of FIG. 1.
Figure 6:
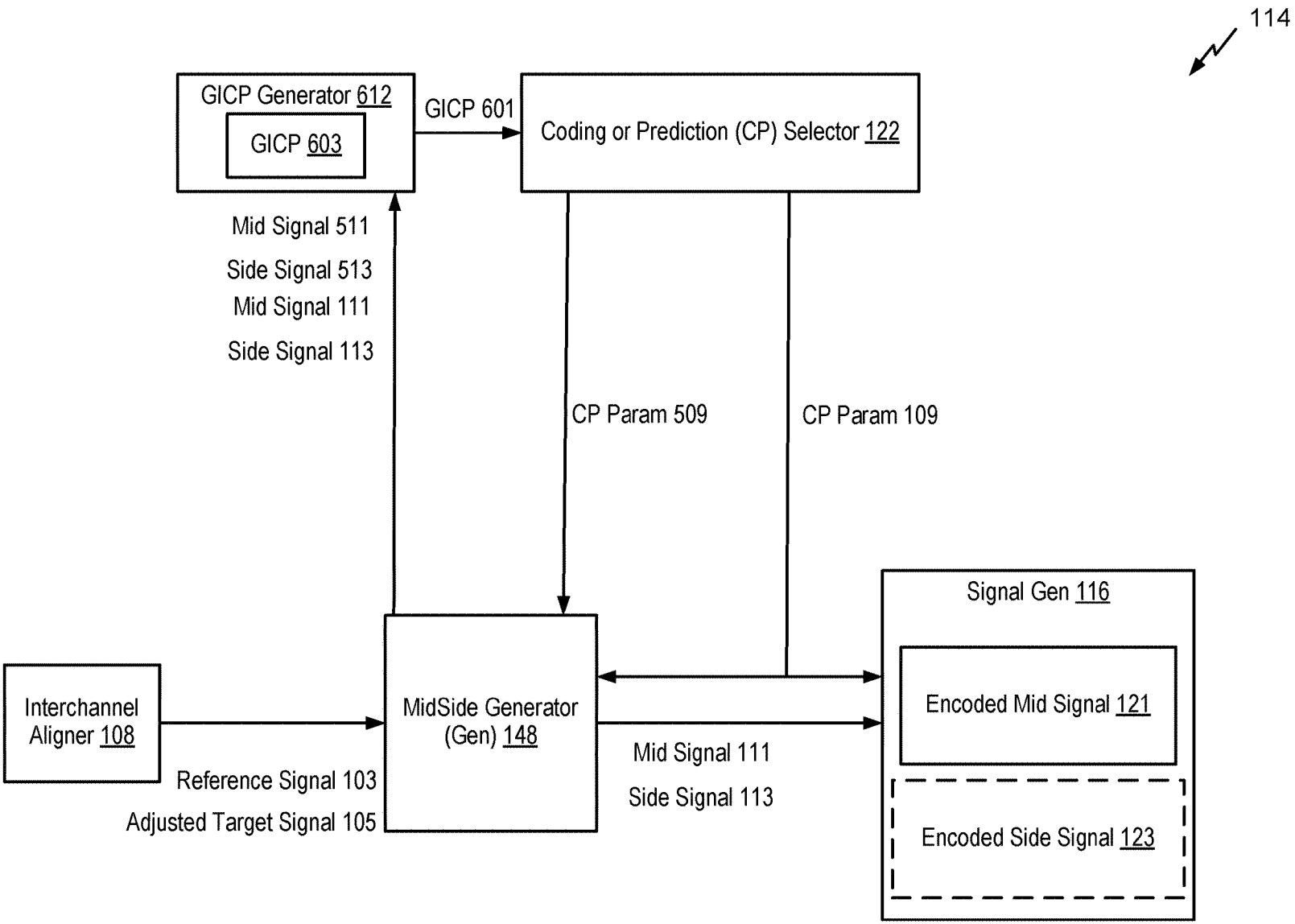
FIG. 6 is a diagram illustrating an example of an encoder of the system of FIG. 1.
Figure 9:
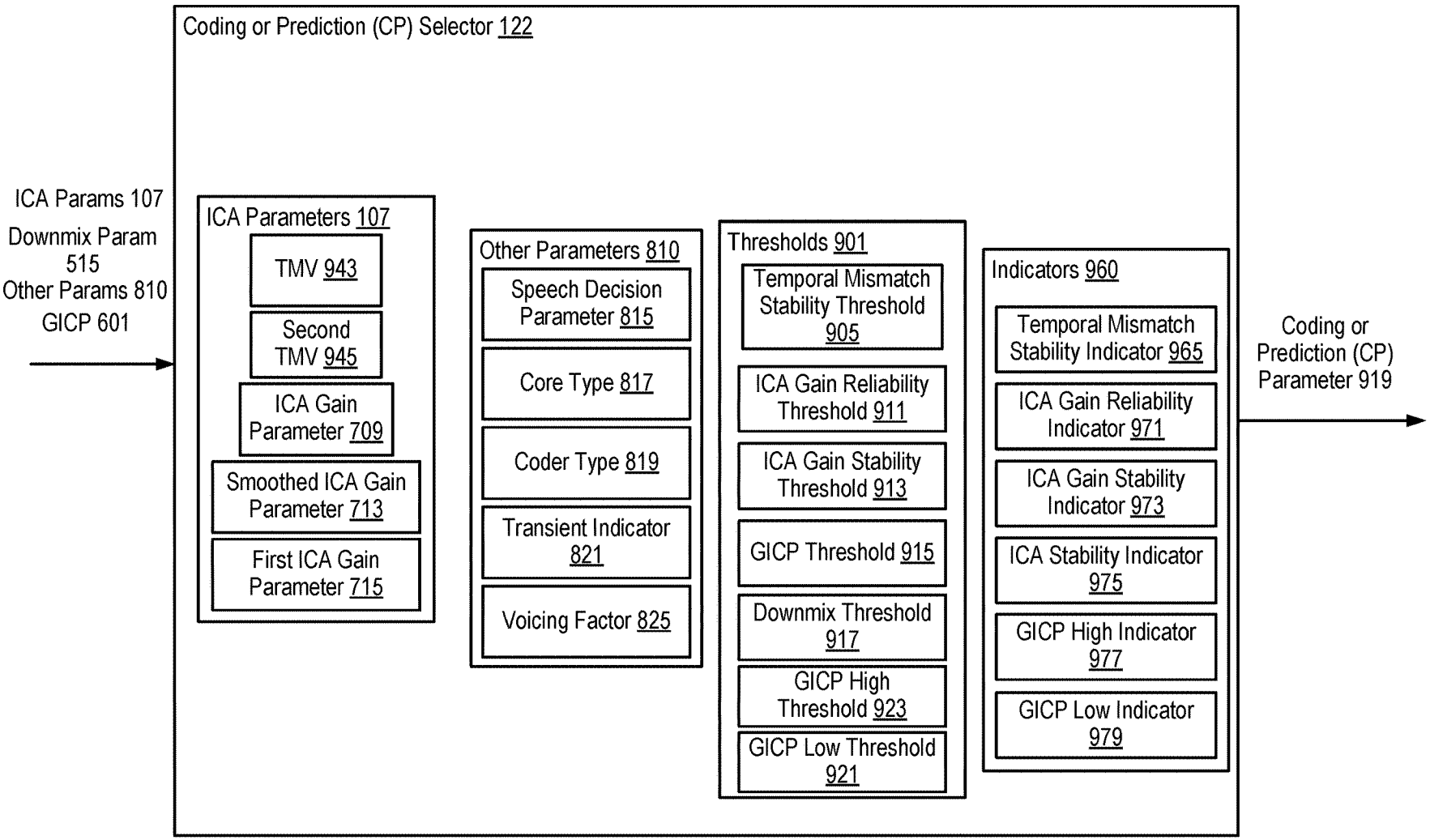
FIG. 9 is a diagram illustrating an example of a coding or prediction selector of the system of FIG. 1.

FIGS. 5-6 and 9 illustrate additional examples of generating the CP parameter 109. FIG. 1 illustrates an example in which the CP selector 122 is configured to determine the CP parameter 109 based on the ICA parameters 107. FIG. 5 illustrates an example in which the CP selector 122 is configured to determine the CP parameter 109 based on a downmix parameter, one or more other parameters, or a combination thereof. FIG. 6 illustrates an example in which the CP selector 122 is configured to determine the CP parameter 109 based on an inter-channel prediction gain parameter. FIG. 9 illustrates an example in which the CP selector 122 is configured to determine the CP parameter 109 based on the ICA parameters 107, a downmix parameter, an inter-channel prediction gain parameter, one or more other parameters, or a combination thereof.

Referring to FIG. 5, an example of the encoder 114 is shown. The CP selector 122 is configured to determine the CP parameter 109 based on a downmix parameter 515, one or more other parameters 517 (e.g., stereo parameters), or a combination thereof.

During operation, the inter-channel aligner 108 provides the reference signal 103 and the adjusted target signal 105 to the midside generator 148, as described with reference to FIG. 1. The midside generator 148 generates a mid signal 511 and a side signal 513 by downmixing the reference signal 103 and the adjusted target signal 105. The midside generator 148 downmixes the reference signal 103 and the adjusted target signal 105 based on the downmix parameter 515, as further described with reference to FIG. 8. In a particular aspect, the downmix parameter 515 corresponds to a default value (e.g., 0.5). In a particular aspect, the downmix parameter 515 is based on an energy metric, a correlation metric, or both, that are based on the reference signal 103 and the adjusted target signal 105. The midside generator 148 may generate the other parameters 517, as further described with reference to FIG. 8. For example, the other parameters 517 may include at least one of a speech decision parameter, a transient indicator, a core type, or a coder type.

In a particular aspect, the CP selector 122 provides a CP parameter 509 to the midside generator 148. In a particular aspect, the CP parameter 509 has a default value (e.g., 0) indicating that an encoded side signal is to be generated for transmission, that a synthesized side signal is to be generated by decoding the encoded side signal, or both. The CP parameter 509 may correspond to an intermediate parameter that is used to determine the downmix parameter 515. For example, as described herein, the downmix parameter 515 (e.g., an intermediate downmix parameter) may be used to determine the mid signal 511 (e.g., an intermediate mid signal), the side signal 513 (e.g., an intermediate side signal), other parameters 519 (e.g., intermediate parameters), or a combination thereof. The downmix parameter 515, the other parameters 519, or a combination thereof, may be used to determine the CP parameter 109 (e.g., the final CP parameter). The CP parameter 109 may be used to determine the downmix parameter 115 (e.g., the final downmix parameter). The downmix parameter 115 is used to determine the mid signal 111 (e.g., the final mid signal), the side signal 113 (e.g., the final side signal), or both.

The midside generator 148 provides the downmix parameter 515, the other parameters 517, or a combination thereof, to the CP selector 122. The CP selector 122 determines the CP parameter 109 based on the downmix parameter 515, the other parameters 517, or a combination thereof, as further described with reference to FIG. 9. The CP selector 122 provides the CP parameter 109 to the midside generator 148, the signal generator 116, or both. The midside generator 148 generates the downmix parameter 115 based on the CP parameter 109, as further described with reference to FIG. 8. The midside generator 148 generates the mid signal 111, the side signal 113, or both, based on the downmix parameter 115, as further described with reference to FIG. 8. The midside generator 148 determines the other parameters 519 (e.g., the intermediate parameters), as further described with reference to FIG. 8.

In a particular aspect, the midside generator 148, in response to determining that the CP parameter 109 matches (e.g., is equal to) the CP parameter 509, sets the downmix parameter 115 to have the same value as the downmix parameter 515, designates the mid signal 511 as the mid signal 111, designates the side signal 513 as the side signal 113, designates the other parameters 517 as the other parameters 519, or a combination thereof. The midside generator 148 provides the mid signal 111, the side signal 113, the downmix parameter 115, or a combination thereof, to the signal generator 116. The signal generator 116 generates the encoded mid signal 121, the encoded side signal 123, or both, based on the CP parameter 109, the downmix parameter 115, the mid signal 111, the side signal 113, or a combination thereof, as described with reference to FIG. 1. The transmitter 110 transmits the encoded mid signal 121, the encoded side signal 123, one or more of the other parameters 517, or a combination thereof, as described with reference to FIG. 1. The CP selector 122 thus enables determining the CP parameter 109 based on the downmix parameter 515, the other parameters 517, or a combination thereof.

Referring to FIG. 6, an example of the encoder 114 is shown. The encoder 114 includes an inter-channel prediction gain (GICP) generator 612. In a particular aspect, the GICP generator 612 corresponds to the ICP generator 220 of FIG. 2. For example, the GICP generator 612 is configured to perform one or more operations described with reference to the ICP generator 220. The CP selector 122 is configured to determine the CP parameter 109 based on a GICP 601 (e.g., an inter-channel prediction gain value).

During operation, the inter-channel aligner 108 provides the reference signal 103 and the adjusted target signal 105 to the midside generator 148, as described with reference to FIG. 1. The midside generator 148 generates, based on the CP parameter 509, the mid signal 511 and the side signal 513, as described with reference to FIG. 5. The midside generator 148 provides the mid signal 511 and the side signal 513 to the GICP generator 612. The GICP generator 612 generates the GICP 601 based on the mid signal 511 and the side signal 513, as described with reference to the ICP generator 220 of FIG. 2. For example, the mid signal 511 may correspond to the mid signal 211 of FIG. 2, the side signal 513 may correspond to the side signal 213 of FIG. 2, and the GICP 601 may correspond to the ICP 208 of FIG. 2. In some implementations, the GICP 601 may be based on energy of the mid signal 511 and energy of the side signal 513. The GICP 601 may correspond to an intermediate parameter that is used to determine the CP parameter 109 (e.g., the final CP parameter). For example, as described herein, the CP parameter 109 may be used to determine the downmix parameter 115 (e.g., the final downmix parameter). The downmix parameter 115 may be used to determine the mid signal 111 (e.g., the final mid signal), the side signal 113 (e.g., the final side signal), or both. The mid signal 111, the side signal 113, or both, may be used to determine a GICP 603 (e.g., the final GICP). The GICP 603 may be transmitted to the second device 106 of FIG. 1.

The GICP generator 612 provides the GICP 601 to the CP selector 122. The CP selector 122 determines the CP parameter 109 based on the GICP 601, as further described with reference to FIG. 9. The CP selector 122 provides the CP parameter 109 to the midside generator 148. The midside generator 148 generates the mid signal 111 and the side signal 113 based on the CP parameter 109, as described with reference to FIG. 8. The midside generator 148 provides the mid signal 111 and the side signal 113 to the GICP generator 612. The GICP generator 612 generates the GICP 603 based on the mid signal 111 and the side signal 113, as further described with reference to the ICP generator 220 of FIG. 2. For example, the mid signal 111 may correspond to the mid signal 211 of FIG. 2, the side signal 113 may correspond to the side signal 213 of FIG. 2, and the GICP 603 may correspond to the ICP 208 of FIG. 2. In some implementations, the GICP 603 may be based on energy of the mid signal 111 and energy of the side signal 113.

In a particular aspect, the midside generator 148, in response to determining that the CP parameter 109 matches (e.g., is equal to) the CP parameter 509, designates the mid signal 511 as the mid signal 111, designates the side signal 513 as the side signal 113, designates the GICP 601 as the GICP 603, or a combination thereof. The midside generator 148 provides the mid signal 111, the side signal 113, or both, to the signal generator 116. The signal generator 116 generates the encoded mid signal 121, the encoded side signal 123, or both, based on the CP parameter 109, as described with reference to FIG. 1. In a particular aspect, the transmitter 110 of FIG. 1 transmits the GICP 603, the encoded mid signal 121, the encoded side signal 123, or a combination thereof. For example, the coding parameters 140 of FIG. 1 may include the GICP 603. The bitstream parameters 102 of FIG. 1 may correspond to the encoded mid signal 121, the encoded side signal 123, or both.

In a particular aspect, the transmitter 210 of FIG. 2 transmits the GICP 603, the encoded mid signal 121, the encoded side signal 123, or a combination thereof. For example, the GICP 603 corresponds to the ICP 208 of FIG. 2. The bitstream parameters 202 of FIG. 2 may correspond to the encoded mid signal 121, the encoded side signal 123, or both. The CP selector 122 thus enables determining the CP parameter 109 based on the GICP 601.

Figure 7:
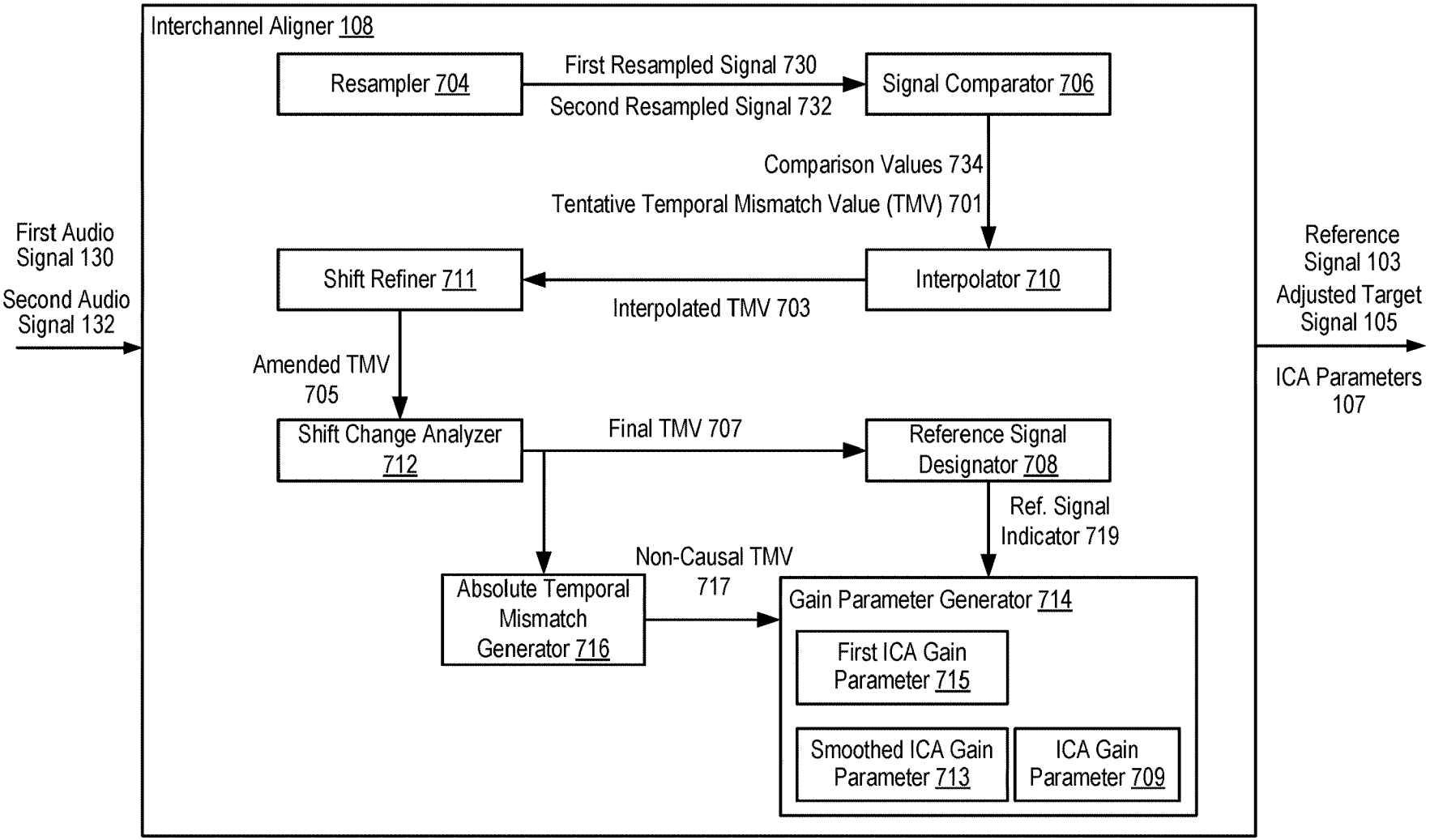
FIG. 7 is a diagram illustrating an example of an inter-channel aligner of the system of FIG. 1.

Referring to FIG. 7, an example of the inter-channel aligner 108 is shown. The inter-channel aligner 108 is configured to generate the reference signal 103, the adjusted target signal 105, the ICA parameters 107, or a combination thereof, based on the first audio signal 130 and the second audio signal 132. As used herein, an "inter-channel aligner" may be referred to as a "temporal equalizer." The inter-channel aligner 108 may include a resampler 704, a signal comparator 706, an interpolator 710, a shift refiner 711, a shift change analyzer 712, an absolute temporal mismatch generator 716, a reference signal designator 708, a gain parameter generator 714, or a combination thereof.

During operation, the resampler 704 may generate one or more resampled signals. For example, the resampler 704 may generate a first resampled signal 730 by resampling the first audio signal 130 based on a resampling factor (D), which may be greater than or equal to one. The resampler 704 may generate a second resampled signal 732 by resampling the second audio signal 132 based on the resampling factor (D). The resampler 704 may provide the first resampled signal 730, the second resampled signal 732, or both, to the signal comparator 706.

The signal comparator 706 may generate comparison values 734 (e.g., difference values, similarity values, coherence values, or cross-correlation values), a tentative temporal mismatch value 701, or a combination thereof. For example, the signal comparator 706 may generate the comparison values 734 based on the first resampled signal 730 and a plurality of temporal mismatch values applied to the second resampled signal 732. The signal comparator 706 may determine the tentative temporal mismatch value 701 based on the comparison values 734. For example, the tentative temporal mismatch value 701 may correspond to a selected comparison value that indicates a higher correlation (or lower difference) than other values of the comparison values 734. The signal comparator 706 may provide the comparison values 734, the tentative temporal mismatch value 701, or both, to the interpolator 710.

The interpolator 710 may extend the tentative temporal mismatch value 701. For example, the interpolator 710 may generate an interpolated temporal mismatch value 703. To illustrate, the interpolator 710 may generate interpolated comparison values corresponding to temporal mismatch values that are proximate to the tentative temporal mismatch value 701 by interpolating the comparison values 734. The interpolator 710 may determine the interpolated temporal mismatch value 703 based on the interpolated comparison values and the comparison values 734. The comparison values 734 may be based on a coarser granularity of the temporal mismatch values. For example, the comparison values 734 may be based on a first subset of a set of temporal mismatch values so that a difference between a first temporal mismatch value of the first subset and each second temporal mismatch value of the first subset is greater than or equal to a threshold (e.g., ≥1). The threshold may be based on the resampling factor (D).

The interpolated comparison values may be based on a finer granularity of temporal mismatch values that are proximate to the tentative temporal mismatch value 701. For example, the interpolated comparison values may be based on a second subset of the set of temporal mismatch values so that a difference between a highest temporal mismatch value of the second subset and the tentative temporal mismatch value 701 is less than the threshold (e.g., <1), and a difference between a lowest temporal mismatch value of the second subset and the tentative temporal mismatch value 701 is less than the threshold. The interpolator 710 may provide the interpolated temporal mismatch value 703 to the shift refiner 711.

The shift refiner 711 may generate an amended temporal mismatch value 705 by refining the interpolated temporal mismatch value 703. For example, the shift refiner 711 may determine whether the interpolated temporal mismatch value 703 indicates that a change in a temporal mismatch between the first audio signal 130 and the second audio signal 132 is greater than a temporal mismatch threshold. The change in the temporal mismatch may be indicated by a difference between the interpolated temporal mismatch value 703 and a first temporal mismatch value associated with a previously encoded frame. The shift refiner 711 may, in response to determining that the difference is less than or equal to the threshold, set the amended temporal mismatch value 705 to the interpolated temporal mismatch value 703. Alternatively, the shift refiner 711 may, in response to determining that the difference is greater than the threshold, determine a plurality of temporal mismatch values that correspond to a difference that is less than or equal to the temporal mismatch change threshold. The shift refiner 711 may determine comparison values based on the first audio signal 130 and the plurality of temporal mismatch values applied to the second audio signal 132. The shift refiner 711 may determine the amended temporal mismatch value 705 based on the comparison values. The shift refiner 711 may set the amended temporal mismatch value 705 to indicate the selected temporal mismatch value. The shift refiner 711 may provide the amended temporal mismatch value 705 to the shift change analyzer 712.

The shift change analyzer 712 may determine whether the amended temporal mismatch value 705 indicates a switch or reverse in timing between the first audio signal 130 and the second audio signal 132. In particular, a reverse or a switch in timing may indicate that, for a first frame (e.g., a previously encoded frame), the first audio signal 130 is received at the input interface(s) 112 prior to the second audio signal 132, and, for a subsequent frame, the second audio signal 132 is received at the input interface(s) 112 prior to the first audio signal 130. Alternatively, a reverse or a switch in timing may indicate that, for the first frame, the second audio signal 132 is received at the input interface(s) 112 prior to the first audio signal 130, and, for a subsequent frame, the first audio signal 130 is received at the input interface(s) 112 prior to the second audio signal 132. In other words, a switch or reverse in timing may be indicate that a first temporal mismatch value (e.g., a final temporal mismatch value) corresponding to the first frame has a first sign that is distinct from a second sign of the amended temporal mismatch value 705 corresponding to the subsequent frame (e.g., a positive to negative transition or vice-versa). The shift change analyzer 712 may determine whether delay between the first audio signal 130 and the second audio signal 132 has switched sign based on the amended temporal mismatch value 705 and the first temporal mismatch value associated with the first frame. The shift change analyzer 712 may, in response to determining that the delay between the first audio signal 130 and the second audio signal 132 has switched sign, set a final temporal mismatch value 707 to a value (e.g., 0) indicating no time shift. Alternatively, the shift change analyzer 712 may set the final temporal mismatch value 707 to the amended temporal mismatch value 705 in response to determining that the delay between the first audio signal 130 and the second audio signal 132 has not switched sign. The shift change analyzer 712 may generate an estimated temporal mismatch value by refining the amended temporal mismatch value 705. The shift change analyzer 712 may set the final temporal mismatch value 707 to the estimated temporal mismatch value. Setting the final temporal mismatch value 707 to indicate no time shift may reduce distortion at a decoder by refraining from time shifting the first audio signal 130 and the second audio signal 132 in opposite directions for consecutive (or adjacent) frames of the first audio signal 130. The shift change analyzer 712 may provide the final temporal mismatch value 707 to the absolute temporal mismatch generator 716 and to the reference signal designator 708.

The absolute temporal mismatch generator 716 may generate a non-causal temporal mismatch value 717 by applying an absolute function to the final temporal mismatch value 707. The absolute temporal mismatch generator 716 may provide the non-causal temporal mismatch value 162 to the gain parameter generator 714.

The reference signal designator 708 may generate a reference signal indicator 719. For example, the reference signal designator 708 may, in response to determining that the final temporal mismatch value 707 satisfies (e.g., is greater than) a particular threshold (e.g., 0), set the reference signal indicator 719 to have a first value (e.g., 1). Alternatively, the reference signal indicator 719 may, in response to determining that the final temporal mismatch value 707 fails to satisfy (e.g., is less than or equal to) the particular threshold (e.g., 0), set the reference signal indicator 719 to have a second value (e.g., 0). In a particular aspect, the reference signal designator 708 may, in response to determining that the final temporal mismatch value 707 has a particular value (e.g., 0) indicating no temporal mismatch, refrain from changing the reference signal indicator 719 from a value that corresponds to a previously encoded frame. The reference signal indicator 719 may have a first value indicating that the first audio signal 130 is designated as the reference signal 103 or a second value indicating that the second audio signal 132 is designated as the reference signal 103. The reference signal designator 708 may provide the reference signal indicator 719 to the gain parameter generator 714.

The gain parameter generator 714 may, in response to determining that the reference signal indicator 719 indicates that one of the first audio signal 130 or the second audio signal 132 corresponds to the reference signal 103, determine that the other of the first audio signal 130 or the second audio signal 132 corresponds to a target signal. The gain parameter generator 714 may select samples of the target signal (e.g., the second audio signal 132) based on the non-causal temporal mismatch value 717. As referred to herein, selecting samples of an audio signal based on a temporal mismatch value may correspond to generating an adjusted (e.g., time-shifted) audio signal by adjusting (e.g., shifting) the audio signal based on the temporal mismatch value and selecting samples of the adjusted audio signal. For example, the gain parameter generator 714 may generate the adjusted target signal 105 (e.g., a time-shifted second audio signal) by selecting samples of the target signal (e.g., the second audio signal 132) based on the non-causal temporal mismatch value 717.

The gain parameter generator 714 may generate an ICA gain parameter 709 (e.g., an inter-channel gain parameter) based on the samples of the reference signal 103 and the selected samples of the adjusted target signal. For example, the gain parameter generator 714 may generate the ICA gain parameter 709 based on one of the following Equations:

Equation 6a $$g_D = \frac{\sum_{n=0}^{N-N_1} Ref(n)Targ(n+N_1)}{\sum_{n=0}^{N-N_1} Targ^2(n+N_1)},$$

Equation 6b $$g_D = \frac{\sum_{n=0}^{N-N_1} |Ref(n)|}{\sum_{n=0}^{N-N_1} |Targ(n+N_1)|},$$

Equation 6c $$g_D = \frac{\sum_{n=0}^{N} Ref(n)Targ(n)}{\sum_{n=0}^{N} Targ^2(n)},$$

Equation 6d $$g_D = \frac{\sum_{n=0}^{N} |Ref(n)|}{\sum_{n=0}^{N} |Targ(n)|},$$

Equation 6e $$g_D = \frac{\sum_{n=0}^{N-N_1} Ref(n)Targ(n)}{\sum_{n=0}^{N} Ref^2(n)},$$

Equation 6f $$g_D = \frac{\sum_{n=0}^{N-N_1} |Targ(n)|}{\sum_{n=0}^{N} |Ref(n)|},$$

where $g_D$ corresponds to the ICA gain parameter 709 for downmix processing, Ref(n) corresponds to samples of the reference signal 103, $N_1$ corresponds to the non-causal temporal mismatch value 717, and Targ(n+$N_1$) corresponds to selected samples of the adjusted target signal 105. In some implementations, the gain parameter generator 714 may generate the ICA gain parameter 709 based on treating the first audio signal 130 as a reference signal and treating the second audio signal 132 as a target signal, irrespective of the reference signal indicator 719. The ICA gain parameter 709 may correspond to an energy ratio of first energy of first samples of the reference signal 104 and second energy of the selected samples of the adjusted target signal 105.

The ICA gain parameter 709 ($g_D$) may be modified to incorporate long term smoothing/hysteresis logic to avoid large jumps in gain between frames. For example, the gain parameter generator 714 may generate a smoothed ICA gain parameter 713 (e.g., a smoothed inter-channel gain parameter) based on the ICA gain parameter 709 and a first ICA gain parameter 715. The first ICA gain parameter 715 may correspond to a previously encoded frame. To illustrate, the gain parameter generator 714 may generate the smoothed ICA gain parameter 713 based on an average of the ICA gain parameter 709 and the first ICA gain parameter 715. The ICA parameters 107 may include at least one of the tentative temporal mismatch value 701, the interpolated temporal mismatch value 703, the amended temporal mismatch value 705, the final temporal mismatch value 707, the non-causal temporal mismatch value 717, the first ICA gain parameter 715, the smoothed ICA gain parameter 713, the ICA gain parameter 709, or a combination thereof.

Figure 8:
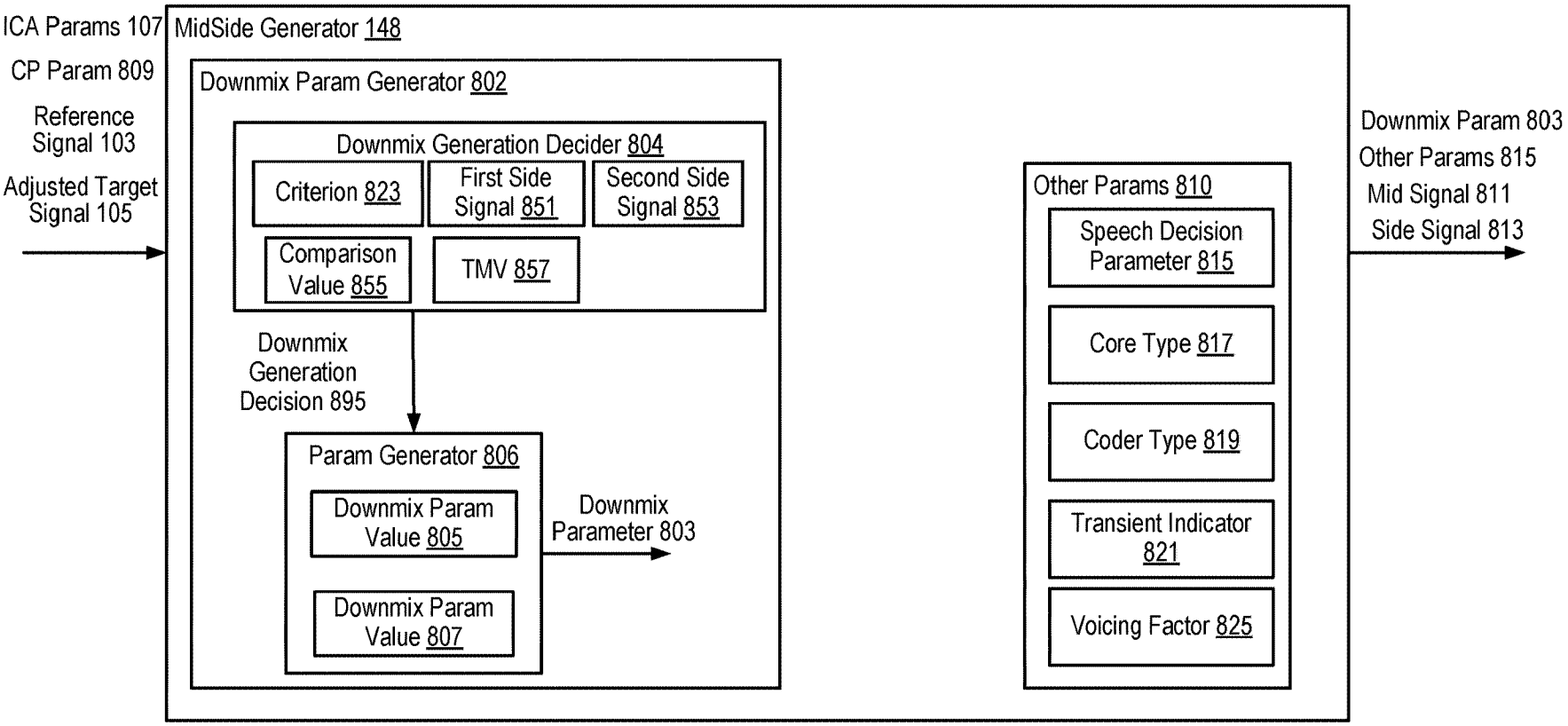
FIG. 8 is a diagram illustrating an example of a midside generator of the system of FIG. 1.

Referring to FIG. 8, an example of the midside generator 148 is shown. The midside generator 148 includes a downmix parameter generator 802. The downmix parameter generator 802 is configured to generate a downmix parameter 803 based on a CP parameter 809. In a particular aspect, the CP parameter 809 corresponds to the CP parameter 109 of FIG. 1 and the downmix parameter 803 corresponds to the downmix parameter 115 of FIG. 1. In a particular aspect, the CP parameter 809 corresponds to the CP parameter 509 of FIG. 5 and the downmix parameter 803 corresponds to the downmix parameter 515 of FIG. 5.

The downmix parameter generator 802 includes a downmix generation decider 804 coupled to a parameter generator 806. The downmix generation decider 804 is configured to generate a downmix generation decision 895 indicating whether a first technique or a second technique is to be used to generate the downmix parameter 803.

The parameter generator 806 is configured to generate a downmix parameter value 805 using the first technique. The parameter generator 806 is configured to generate a downmix parameter value 807 using the second technique. The parameter generator 806 is configured to designate, based on the downmix generation decision 895, the downmix parameter value 805 or the downmix parameter value 807 as the downmix parameter 803. Although described as generating two downmix parameter values 805 and 807, in other implementations, only the selected downmix parameter value (e.g., based on the downmix generation decision 895) is generated.

The midside generator 148 is configured to generate a mid signal 811 and a side signal 813 based on the downmix parameter 803. In a particular aspect, the mid signal 811 and the side signal 813 correspond to the mid signal 111 and the side signal 113 of FIG. 1, respectively. In a particular aspect, the mid signal 811 and the side signal 813 correspond to the mid signal 511 and the side signal 513 of FIG. 5, respectively.

During operation, the downmix generation decider 804, in response to determining that the CP parameter 809 has a second value (e.g., 1), sets the downmix generation decision 895 to a first value (e.g., 0) indicating that the first technique is to be used to generate the downmix parameter 803. The second value (e.g., 1) of the CP parameter 809 may indicate that the side signal 113 is not to be encoded for transmission and that the synthesized side signal 173 of FIG. 1 is to be predicted at the decoder 118 of FIG. 1. As another example, the downmix generation decider 804, in response to determining that the CP parameter 809 has a first value (e.g., 0), sets the downmix generation decision 895 to have a second value (e.g., 1) indicating that the second technique is to be used to generate the downmix parameter 803. The first value (e.g., 0) of the CP parameter 809 may indicate that the side signal 113 is to be encoded for transmission and that the synthesized side signal 173 of FIG. 1 is to be determined at the decoder 118 by decoding the encoded side signal 123. The downmix generation decider 804 provides the downmix generation decision 895 to the parameter generator 806.

The parameter generator 806, in response to determining that the downmix generation decision 895 has the first value (e.g., 0), generates the downmix parameter value 805 using the first technique. For example, the parameter generator 806 generates the downmix parameter value 805 as a default value (e.g., 0.5). The parameter generator 806 designates the downmix parameter value 805 as the downmix parameter 803. Alternatively, the parameter generator 806, in response to determining that the downmix generation decision 895 has the second value (e.g., 1), generates the downmix parameter value 807 using the second technique. For example, the parameter generator 806 generates the downmix parameter value 807 based on an energy metric, a correlation metric, or both, based on the reference signal 103 and the adjusted target signal 105. To illustrate, the parameter generator 806 may determine the downmix parameter value 807 based on a comparison of a first value of a first characteristic of the reference signal 103 and a second value of the first characteristic of the adjusted target signal 105. For example, the first characteristic may correspond to signal energy or signal correlation. The parameter generator 806 may determine the downmix parameter value 807 based on a characteristic comparison value (e.g., a difference) between the first value and the second value.

In a particular aspect, the parameter generator 806 is configured to generate the downmix parameter value 807 to be within a range from a first range value (e.g., 0) to a second range value (e.g., 1). For example, the parameter generator 806 maps the characteristic comparison value to a value within the range. In this aspect, the downmix parameter value 807 having a particular value (e.g., 0.5) may indicate that a first energy of the reference signal 103 is approximately equal to a second energy of the adjusted target signal 105. The parameter generator 806 may determine that the downmix parameter value 807 has the particular value (e.g., 0.5) in response to determining that the characteristic comparison value (e.g., the difference) satisfies (e.g., is less than) a threshold (e.g., a tolerance level). The greater the first energy of the reference signal 103 is than the second energy of the adjusted target signal 105, the closer the downmix parameter value 807 may be to the first range value (e.g., 0). The greater the second energy of the adjusted target signal 105 is than the first energy of the reference signal 103, the closer the downmix parameter value 807 may be to the second range value (e.g., 1). The parameter generator 806, in response to determining that the downmix generation decision 895 has the second value (e.g., 1), designates the downmix parameter value 807 as the downmix parameter 803.

In a particular aspect, the parameter generator 806 is configured to generate the downmix parameter value 805 based on a default value (e.g., 0.5), the downmix parameter value 807, or both. For example, the parameter generator 806 is configured to generate the downmix parameter value 805 by modifying the downmix parameter value 807 to be within a particular range of the default value (e.g., 0.5). In a particular aspect, the parameter generator 806 is configured to set the downmix parameter value 805 to a first particular value (e.g., 0.3) in response to determining that the downmix parameter value 807 is less than the first particular value. Alternatively, the parameter generator 806 is configured to set the downmix parameter value 805 to a second particular value (e.g., 0.7) in response to determining that the downmix parameter value 807 is greater than the second particular value. In a particular aspect, the parameter generator 806 generates the downmix parameter value 805 by applying a dynamic range reducing function (e.g., a modified sigmoid) to the downmix parameter value 807.

In a particular aspect, the parameter generator 806 is configured to generate the downmix parameter value 805 based on a default value (e.g., 0.5), the downmix parameter value 807, or one or more additional parameters. For example, the parameter generator 806 is configured to generate the downmix parameter value 805 by modifying the downmix parameter value 807 based on a voicing factor 825. To illustrate, the parameter generator 806 may generate the downmix parameter value 805 based on the following Equation:

$$\text{Ratio_}L=(vf)*0.5+(1-vf)*\text{original_Ratio_}L \qquad \text{Equation 7}$$

where Ratio_L corresponds to the downmix parameter value 805, vf corresponds to the voicing factor 825, and original_Ratio_L corresponds to the downmix parameter value 807. The voicing factor 825 may be within a particular range (e.g., 0.0 to 1.0). The voicing factor 825 may indicate a voiced/unvoiced nature (e.g., strongly voiced, weakly voiced, weakly unvoiced, or strongly unvoiced) of the reference signal 103, the adjusted target signal 105, or both. The voicing factor 825 may correspond to an average of voicing factors determined by an ACELP core.

In a particular example, the parameter generator 806 is configured to generate the downmix parameter value 805 by modifying the downmix parameter value 807 based on a comparison value 855. For example, the parameter generator 806 may generate the downmix parameter value 805 based on the following Equation:

$$\text{Ratio_}L=(\text{ica_crosscorrelation})*0.5+(1-\text{ica_crosscorrelation})*\text{original})_\text{Ratio_}L \quad \text{Equation 8}$$

where Ratio_L corresponds to the downmix parameter value 805, ica_crosscorrelation corresponds to the comparison value 855, and original_Ratio_L corresponds to the downmix parameter value 807. The mid side generator 148 may determine the comparison value 855 (e.g., difference value, similarity value, coherence value, or cross-correlation value) based on a comparison of samples of the reference signal 103 and selected samples of the adjusted target signal 105.

The midside generator 148 generates the mid signal 811 and the side signal 813 based on the downmix parameter 803. For example, the midside generator 148 generates the mid signal 811 and the side signal 813 based on the following pairs of Equations:

$$\text{Mid}(n)=\text{Ratio_}L*L(n)+(1-\text{Ratio_}L)*R(n) \quad \text{Equation 9(a)}$$

$$\text{Side}(n)=(1-\text{Ratio_}L)*L(n)-(\text{Ratio_}L)*R(n) \quad \text{Equation 9(b)}$$

$$\text{Mid}(n)=\text{Ratio_}L*L(n)+(1-\text{Ratio_}L)*R(n) \quad \text{Equation 10(a)}$$

$$\text{Side}(n)=0.5*L(n)-0.5*R(n) \quad \text{Equation 10(b)}$$

$$\text{Mid}(n)=0.5*L(n)+0.5*R(n) \quad \text{Equation 11(a)}$$

$$\text{Side}(n)=(1-\text{Ratio_}L)*L(n)-(\text{Ratio_}L)*R(n) \quad \text{Equation 11(b)}$$

where Mid(n) corresponds to the mid signal 811, Side(n) corresponds to the side signal 813, L(n) corresponds to samples of the first audio signal 130, R(n) corresponds to samples of the second audio signal 132, and Ratio_L corresponds to the downmix parameter 803. In a particular aspect, L(n) corresponds to samples of the reference signal 103 and R(n) corresponds to corresponding samples of the adjusted target signal 105. In an alternate aspect, R(n) corresponds to samples of the reference signal 103 and L(n) corresponds to corresponding samples of the adjusted target signal 105.

In a particular aspect, the midside generator 148 generates the mid signal 811 and the side signal 813 based on the following pairs of Equations:

$$\text{Mid}(n)=\text{Ratio_}L*\text{Ref}(n)+(1-\text{Ratio_}L)*\text{Targ}(n+N_1) \quad \text{Equation 12(a)}$$

$$\text{Side}(n)=(1-\text{Ratio_}L)*\text{Ref}(n)-(\text{Ratio_}L)*\text{Targ}(n+N_1) \quad \text{Equation 12(b)}$$

$$\text{Mid}(n)=\text{Ratio_}L*\text{Ref}(n)+(1-\text{Ratio }L)*\text{Targ}(n+N_1) \quad \text{Equation 13(a)}$$

$$\text{Side}(n)=0.5*\text{Ref}(n)-0.5*\text{Targ}(n+N_1) \quad \text{Equation 13(b)}$$

$$\text{Mid}(n)=0.5*\text{Ref}(n)+0.5*\text{Targ}(n+N_1) \quad \text{Equation 14(a)}$$

$$\text{Side}(n)=(1-\text{Ratio_}L)*\text{Ref}(n)-(\text{Ratio_}L)*\text{Targ}(n+N_1) \quad \text{Equation 14(b)}$$

where Mid(n) corresponds to the mid signal 811, Side(n) corresponds to the side signal 813, Ref(n) corresponds to samples of the reference signal 103, $N_1$ corresponds to the non-causal temporal mismatch value 717 of FIG. 7, Targ $(n+N_1)$ corresponds to samples of the adjusted target signal 105, and Ratio_L corresponds to the downmix parameter 803.

In a particular aspect, the downmix generation decider 804 determines the downmix generation decision 895 based on determining whether a criterion 823 is satisfied. For example, the downmix generation decider 804, in response to determining that the CP parameter 809 has the second value (e.g., 1) and that the criterion 823 is satisfied, generates the downmix generation decision 895 having the first value (e.g., 0) indicating that the first technique is to be used to generate the downmix parameter 803. Alternatively, the downmix generation decider 804, in response to determining that the CP parameter 809 has the first value (e.g., 0) or that the criterion 823 is not satisfied, generates the downmix generation decision 895 having the second value (e.g., 1) indicating that the second technique is to be used to generate the downmix parameter 803. In a particular aspect, satisfying the criterion 823 indicates that a side signal (e.g., the side signal 813) that corresponds to the reference signal 103 and the adjusted target signal 105 is a candidate for prediction.

The downmix generation decider 804 is configured to determine whether the criterion 823 is satisfied based on a first side signal 851, a second side signal 853, the ICA parameters 107, the comparison value 855, a temporal mismatch value 857, one or more other parameters 810, or a combination thereof. In a particular aspect, the downmix generation decider 804 determines whether the criterion 823 is satisfied based on a comparison of side signals corresponding to each of the downmix parameter values corresponding to the first technique and the second technique. For example, the parameter generator 806 uses the first technique to generate the downmix parameter value 805 and uses the second technique to generate the downmix parameter value 807. The midside generator 148 generates the first side signal 851 corresponding to the downmix parameter value 805 based on one of the Equations 9(b)-14(b). For example, Side(n) corresponds to the first side signal 851 and Ratio_L corresponds to the downmix parameter value 805. The midside generator 148 generates the second side signal 853 corresponding to the downmix parameter value 807 based on one of the Equations 9(b)-14(b). For example, Side(n) corresponds to the second side signal 853 and Ratio_L corresponds to the downmix parameter value 807.

The downmix generation decider 804 determines first energy of the first side signal 851 and determines second energy of the second side signal 853. The downmix generation decider 804 may generate an energy comparison value based on a comparison of the first energy and the second energy. The downmix generation decider 804 may determine that the criterion 823 is satisfied based on determining that the energy comparison value satisfies an energy threshold. For example, the downmix generation decider 804 may determine that the criterion 823 is satisfied based at least in part on determining that the first energy is lower than the second energy and that the energy comparison value satisfies the energy threshold. The downmix generation decider 804 may thus determine that the criterion 823 is satisfied in response to determining that the first energy of the first side signal 851 corresponding to the downmix parameter value 805 is sufficiently lower than the second energy of the second side signal 853 corresponding to the downmix parameter value 807.

The midside generator 148 may, in response to determining that the CP parameter 809 has the second value (e.g., 1) and that the criterion 823 is satisfied, designate the first side signal 851 as the side signal 813. Alternatively, the midside generator 148 may, in response to determining that the CP parameter 809 has the first value (e.g., 0) or that the criterion 823 is not satisfied, designate the second side signal 853 as the side signal 813.

In a particular aspect, the downmix generation decider 804 determines whether the criterion 823 is satisfied based on the ICA parameters 107. In a particular example, the downmix generation decider 804 determines that the criterion 823 is satisfied in response to determining that a temporal mismatch value 857 indicates a relatively small (e.g., no) temporal mismatch. To illustrate, the downmix generation decider 804 determines that the criterion 823 is satisfied in response to determining that a difference between the temporal mismatch value 857 and a particular value (e.g., 0) satisfies a temporal mismatch value threshold. The temporal mismatch value 857 may include the tentative temporal mismatch value 701, the interpolated temporal mismatch value 703, the amended temporal mismatch value 705, the final temporal mismatch value 707, or the non-causal temporal mismatch value 717 of the ICA parameters 107.

In a particular aspect, the downmix generation decider 804 determines whether the criterion 823 is satisfied based the comparison value 855. For example, the downmix generation decider 804 determines the comparison value 855 (e.g., difference value, similarity value, coherence value, or cross-correlation value) based on a comparison of samples of the reference signal 103 (e.g., Ref(n)) and corresponding samples of the adjusted target signal 105 (e.g., Targ($n+N_1$)). To illustrate, the downmix generation decider 804 determines that the criterion 823 is satisfied in response to determining that the comparison value 855 (e.g., difference value, similarity value, coherence value, or cross-correlation value) satisfies a threshold (e.g., a difference threshold, a similarity threshold, a coherence threshold, or a cross-correlation threshold). In a particular aspect, the downmix generation decider 804 determines that the criterion 823 is satisfied when the comparison value 855 indicates that higher decorrelation is possible. For example, the downmix generation decider 804 determines that the criterion 823 is satisfied in response to determining that the comparison value 855 corresponds to a higher than threshold cross-correlation.

The midside generator 148 may be configured to generate one or more other parameters 810 based on the reference signal 103, the adjusted target signal 105, or both. The other parameters 810 may include a speech decision parameter 815, a core type 817, a coder type 819, a transient indicator 821, the voicing factor 825, or a combination thereof. For example, the midside generator 148 may determine the speech decision parameter 815 using various speech/music classification techniques. The speech decision parameter 815 may indicate whether the reference signal 103, the adjusted target signal 105, or both, are classified as speech or non-speech (e.g., music or noise).

The midside generator 148 may be configured to determine the core type 817, the coder type 819, or both. For example, a previously encoded frame may have been encoded based on a previous core type, a previous coder type, or both. The core type 817 may correspond to the previous core type, the coder type 819 may correspond to the previous coder type, or both. In an alternative aspect, the midside generator 148 determines the core type 817, the coder type 819, or both, based on the speech decision parameter 815. For example, the midside generator 148 may, in response to determining that the speech decision parameter 815 has a first value (e.g., 0) indicating that the reference signal 103, the adjusted target signal 105, or both, correspond to speech, select an ACELP core type as the core type 817. Alternatively, the midside generator 148 may, in response to determining that the speech decision parameter 815 has a second value (e.g., 1) indicating that the reference signal 103, the adjusted target signal 105, or both, correspond to non-speech (e.g., music), select a transform coded excitation (TCX) core type as the core type 817.

The midside generator 148 may, in response to determining that the speech decision parameter 815 has a first value (e.g., 0) indicating that the reference signal 103, the adjusted target signal 105, or both, correspond to speech, select a general signal coding (GSC) coder type or a non-GSC coder type as the coder type 819. For example, the midside generator 148 may select the non-GSC coder type (e.g., modified discrete cosine transform (MDCT)) in response to determining that the reference signal 103, the adjusted target signal 105, or both, correspond to high spectral sparseness (e.g., higher than a sparseness threshold). Alternatively, the midside generator 148 may select the GSC coder type in response to determining that the reference signal 103, the adjusted target signal 105, or both, correspond to a non-sparse spectrum (e.g., lower than the sparseness threshold).

The midside generator 148 may be configured to determine the transient indicator 821 based on energy of the reference signal 103, energy of the adjusted target signal 105, or both. For example, the midside generator 148 may set the transient indicator 821 to a first value (e.g., 0) indicating that a transient is not detected in response to determining that the energy of the reference signal 103, the energy of the adjusted target signal 105, or both, do not indicate a higher than threshold spike. A spike may correspond to less than a threshold number of samples. Alternatively, the midside generator 148 may set the transient indicator 821 to a second value (e.g., 1) indicating that a transient is detected in response to determining that the energy of the reference signal 103, the energy of the adjusted target signal 105, or both, indicate a higher than threshold spike. The spike (e.g., increase) in energy may be associated with less than a threshold number of samples.

In a particular aspect, the downmix generation decider 804 determines whether the criterion 823 is satisfied based the speech decision parameter 815. For example, the downmix generation decider 804 determines that the criterion 823 is satisfied in response to determining that the speech decision parameter 815 has a first value (e.g., 0) indicating that the reference signal 103, the adjusted target signal 105, or both, correspond to speech.

In a particular aspect, the downmix generation decider 804 determines whether the criterion 823 is satisfied based the coder type 819. For example, the downmix generation decider 804 determines that the criterion 823 is satisfied in response to determining that the coder type 819 corresponds to voiced coder type (e.g., a GSC coder type).

In a particular aspect, the downmix generation decider 804 determines whether the criterion 823 is satisfied based the core type 817. For example, the downmix generation decider 804 determines that the criterion 823 is satisfied in response to determining that the core type 817 corresponds to speech coding core (e.g., an ACELP core type).

In a particular aspect, the transmitter 110 of FIG. 1 may transmit the downmix parameter 115 (e.g., the downmix parameter 803) in response to determining that the downmix parameter 115 differs from a default downmix parameter value (e.g., 0.5). In this aspect, the transmitter 110 may refrain from transmitting the downmix parameter 115 in response to determining that the downmix parameter 115 matches the default downmix parameter value (e.g., 0.5).

In a particular aspect, the transmitter 110 may transmit the downmix parameter 115 in response to determining that the downmix parameter 115 is based on one or more parameters that are unavailable at the decoder 118. In a particular example, at least one of energy of the first side signal 851, energy of the second side signal 853, the comparison value 855, or the speech decision parameter 815 are unavailable at the decoder 118. In this example, the midside generator 148 may initiate transmission, via the transmitter 110, of the downmix parameter 115 in response to determining that the downmix parameter 115 is based on at least one of energy of the first side signal 851, energy of the second side signal 853, the comparison value 855, or the speech decision parameter 815.

The further the downmix parameter 803 is from a particular value (e.g., 0), the more information the side signal 813 includes that is common to the mid signal 811. For example, the further downmix parameter 803 is from the particular value (e.g., 0), the higher the energy of the side signal 813 and the higher the correlation between the side signal 813 and the mid signal 811. When the side signal 813 has lower energy and the decorrelation between the side signal 813 and the mid signal 811 is higher, a predicted side signal may more closely approximate the side signal 813.

The side signal 813 may have lower energy when generated based on the downmix parameter 803 having the downmix parameter value 805 as compared to when generated based on the downmix parameter 803 having the downmix parameter value 807. The downmix parameter generator 802 enables the side signal 813 to be generated based on the downmix parameter value 805 when the CP parameter 809 has a second value (e.g., 1) indicating that the decoder 118 is to predict the synthesized side signal 173 based on the synthesized mid signal 171 of FIG. 1. In some implementations, the downmix parameter generator 802 enables the side signal 813 to be generated based on the downmix parameter value 805 when the CP parameter 809 has the second value (e.g., 1) and when the criterion 823 is satisfied indicating that a higher decorrelation of the side signal 813 is possible. Generating the side signal 813 based on the downmix parameter value 805 increases a likelihood that a predicted side signal at a decoder more closely approximates the side signal 813.

Referring to FIG. 9, an example of the CP selector 122 is shown. The CP selector 122 is configured to generate a CP parameter 919 based on at least one of the ICA parameters 107, the downmix parameter 515, the other parameters 517, or the GICP 601. In a particular aspect, the CP parameter 919 corresponds to the CP parameter 109 of FIG. 1, the CP parameter 509 of FIG. 5, or both.

During operation, the CP selector 122 may receive at least one of the ICA parameters 107, the downmix parameter 515, the other parameters 517, or the GICP 610. The CP selector 122 may determine one or more indicators 960 based on at least one of the ICA parameters 107, the downmix parameter 515, the other parameters 517, or the GICP 610. The CP selector 122 may determine the CP parameter 919 based on determining whether at least one of the ICA parameters 107, the downmix parameter 515, the other parameters 517, the GICP 610, or the indicators 960 satisfy one or more thresholds 901.

In a particular aspect, the CP selector 122 determines the CP parameter 919 based on the following pseudo code:

```
st_stereo->icpFlag = 1;
if (isICAStable == 0)
{
    /* Either the ICA shift or gain is not stable */
    if (isShiftStable)
    {
        /* Shift is stable, meaning gain is unstable */
        if (isGICPHigh)
        {
            /* gICP is high, meaning that side is high
                and prediction is risky */
            st_stereo->icpFlag = 0;
        }
    }
    else
    {
        /* ICA shift is not stable, meaning it is risky to predict */
        st_stereo->icpFlag = 0;
    }
}
```

where st_stereo->icpFlag corresponds to the CP parameter 919, isICAStable corresponds to an ICA stability indicator 975, isShiftStable corresponds to a temporal mismatch stability indicator 965, and isGICPHigh corresponds to a GICP high indicator 977.

The CP selector 122 may generate the GICP high indicator 977 based on the GICP 601. For example, the GICP high indicator 977 indicates whether the GICP 601 satisfies (e.g., is greater than) a GICP high threshold 923 (e.g., 0.7). For example, the CP selector 122 may set the GICP high indicator 977 to a first value (e.g., 0) in response to determining that the GICP 601 fails to satisfy (e.g., is less than or equal to) the GICP high threshold 923 (e.g., 0.7). Alternatively, the CP selector 122 may set the GICP high indicator 977 to a second value (e.g., 1) in response to determining that the GICP 601 satisfies (e.g., is greater than) the GICP high threshold 923 (e.g., 0.7).

The CP selector 122 may generate the temporal mismatch stability indicator 965 based on an evolution of temporal mismatch values (TMVs) across frames. For example, the CP selector 122 may generate the temporal mismatch stability indicator 965 based on a TMV 943 and a second TMV 945. The ICA parameters 107 may include the TMV 943 and the second TMV 945. The TMV 943 may include the tentative TMV 701, the interpolated TMV 703, the amended TMV 705, or the final TMV 707 of FIG. 7. The second TMV 945 may include a tentative TMV, an interpolated TMV, an amended TMV, or a final TMV corresponding to a previously encoded frame. For example, the TMV 943 may be based on first samples of the reference signal 103 and the second TMV 945 may be based on second samples of the reference signal 103. The first samples may be distinct from the second samples. For example, the first samples may include at least one sample that is not included in the second samples, the second samples may include at least one sample that is not included in the first samples, or both. As another example, the TMV 943 may be based on first particular samples of the target signal and the second TMV 945 may be based on second particular samples of the target signal. The first particular samples may be distinct from the second particular samples. For example, the first particular samples may include at least one sample that is not included in the second particular samples, the second particular samples may include at least one sample that is not included in the first particular samples, or both.

In a particular aspect, the CP selector 122 sets the temporal mismatch stability indicator 965 to a first value (e.g., 0) in response to determining that a difference between the TMV 943 and the second TMV 945 is greater than a temporal mismatch stability threshold 905, that one of the TMV 943 or the second TMV 945 is positive and the other of the TMV 943 or the second TMV 945 is negative, or both. The first value (e.g., 0) of the temporal mismatch stability indicator 965 may indicate that the temporal mismatch is unstable. The CP selector 122 sets the temporal mismatch stability indicator 965 to a second value (e.g., 1) in response to determining that a difference between the TMV 943 and the second TMV 945 is less than or equal to the temporal mismatch stability threshold 905, that the TMV 943 and the second TMV 945 are positive, that the TMV 943 and the second TMV 945 are negative, that one of the TMV 943 or the second TMV 945 is zero, or a combination thereof. The second value (e.g., 1) of the temporal mismatch stability indicator 965 may indicate that the temporal mismatch is stable.

The CP selector 122 may generate the ICA stability indicator 975 based on at least one of the temporal mismatch stability indicator 965, an ICA gain stability indicator 973 (e.g., an inter-channel gain stability indicator), or an ICA gain reliability indicator 971 (e.g., an inter-channel gain reliability indicator). For example, the CP selector 122 may set the ICA stability indicator 975 to a first value (e.g., 0) in response to determining that the temporal mismatch stability indicator 965 has a first value (e.g., 0) indicating that the temporal mismatch is unstable, that the ICA gain stability indicator 973 has a first value (e.g., 0) indicating that the ICA gain is unstable, or that the ICA gain reliability indicator 971 has a first value (e.g., 0) indicating that the ICA gain is unreliable. Alternatively, the CP selector 122 may set the ICA stability indicator 975 to a second value (e.g., 1) in response to determining that the temporal mismatch stability indicator 965 has a second value (e.g., 1) indicating that the temporal mismatch is stable, that the ICA gain stability indicator 973 has a second value (e.g., 1) indicating that the ICA gain is stable, and that the ICA gain reliability indicator 971 has a second value (e.g., 1) indicating that the ICA gain is reliable. The first value (e.g., 0) of the ICA stability indicator 975 may indicate that the ICA is unstable. The second value (e.g., 1) of the ICA stability indicator 975 may indicate that the ICA is stable.

The CP selector 122 may generate the ICA gain stability indicator 973 based on an evolution of ICA gains across frames. The CP selector 122 may determine the ICA gain stability indicator 973 based on the first ICA gain parameter 715, the ICA gain parameter 709, the smoothed ICA gain parameter 713, or a combination thereof. The ICA parameters 107 may include the ICA gain parameter 709, the first ICA gain parameter 715, and the smoothed ICA gain parameter 713. The CP selector 122 may determine a gain difference based on a difference between the ICA gain parameter 709 and the first ICA gain parameter 715. In an alternate aspect, the CP selector 122 may determine the gain difference based on a difference between the smoothed ICA gain parameter 713 and the first ICA gain parameter 715.

The CP selector 122 may set the ICA gain stability indicator 973 to a first value (e.g., 0) in response to determining that the gain difference fails to satisfy (e.g., is greater than) an ICA gain stability threshold 913. Alternatively, the CP selector 122 may set the ICA gain stability indicator 973 to a second value (e.g., 1) in response to determining that the gain difference satisfies (e.g., is less than or equal to) the ICA gain stability threshold 913. The first value (e.g., 0) of the ICA gain stability indicator 973 may indicate that the ICA gain is unstable. The second value (e.g., 1) of the ICA gain stability indicator 973 may indicate that the ICA gain is stable.

The CP selector 122 may determine the ICA gain reliability indicator 971 based on the ICA gain parameter 709 and the smoothed ICA gain parameter 713. The ICA parameters 107 may include the ICA gain parameter 709 and the smoothed ICA gain parameter 713. The CP selector 122 may set the ICA gain reliability indicator 971 to a first value (e.g., 0) in response to determining that a difference between the ICA gain parameter 709 and the smoothed ICA gain parameter 713 fails to satisfy (e.g., is greater than) a ICA gain reliability threshold 911. Alternatively, the CP selector 122 may set the ICA gain reliability indicator 971 to a second value (e.g., 1) in response to determining that the difference between the ICA gain parameter 709 and the smoothed ICA gain parameter 713 satisfies (e.g., is less than or equal to) the ICA gain reliability threshold 911. The first value (e.g., 0) of the ICA gain reliability indicator 971 may indicate that the ICA gain is unreliable. For example, the first value (e.g., 0) of the ICA gain reliability indicator 971 may indicate that the ICA gain is being smoothed too slowly such that stereo perception is changing. The second value (e.g., 1) of the ICA gain reliability indicator 971 may indicate that the ICA gain is reliable.

In a particular aspect, the CP selector 122 determines the CP parameter 919 based on the following pseudo code:

```
if (isGICPLow || st_stereo->sp_aud_decision0 ==
1 || (st[0]->last_core > ACELP_CORE))
{
        /* Enable ICP when gICP is low meaning side is insignificant to
code, or when speech/audio decision or mid coding mode points to the
mid signal having music content where prediction is desired rather
than coding */
        st_stereo->icpFlag = 1;
}
else if (isGICPHigh || (gICP > 0.6f &&
(!isICAStable || !isICAGainReliable)) || st_stereo->attackPresent)
{
        /* Disable ICP and code when gICP is high, meaning that the
side has high energy or when instantaneous icp_gain is high and either
ICA is unstable or ICA Gain is not reliable or when there is a transient
present in the input speech where prediction is not desired */
        st_stereo->icpFlag = 0;
}
```

where st_stereo->icpFlag corresponds to the CP parameter 919, isGICPLow corresponds to a GICP low indicator 979, st_stereo->sp_aud_decision0 corresponds to the speech decision parameter 815, st[0]->last_core corresponds to the core type 817, isGICPHigh corresponds to the GICP high indicator 977, gICP corresponds to the GICP 601, isICAStable corresponds to the ICA stability indicator 975, isICAGainReliable corresponds to the ICA gain reliability indicator 971, and st_stereo->attackPresent corresponds to the transient indicator 821.

The CP selector 122 may generate the GICP low indicator 979 based on the GICP 601. For example, the GICP low indicator 979 indicates whether the GICP 601 satisfies (e.g., is lower than or equal to) a GICP low threshold 921 (e.g., 0.5). For example, the CP selector 122 may set the GICP low indicator 979 to a first value (e.g., 0) in response to determining that the GICP 601 fails to satisfy (e.g., is greater than) the GICP low threshold 921 (e.g., 0.5). Alternatively, the CP selector 122 may set the GICP low indicator 979 to a second value (e.g., 1) in response to determining that the GICP 601 satisfies (e.g., is less than or equal to) the GICP low threshold 921 (e.g., 0.5). The GICP low threshold 921 may be the same as or different from the GICP high threshold 923.

In a particular aspect, the CP selector 122 may determine the CP parameter 919 based on determining whether one or more of the ICA parameters 107, the downmix parameter 515, the other parameters 810, or the GICP 601 satisfy a corresponding threshold. For example, the CP selector 122 may set the CP parameter 919 to a first value (e.g., 0) in response to determining that one or more of the ICA parameters 107, the downmix parameter 515, the other parameters 810, or the GICP 601 fail to satisfy a corresponding threshold. Alternatively, the CP selector 122 may set the CP parameter 919 to a second value (e.g., 1) in response to determining that one or more of the ICA parameters 107, the downmix parameter 515, the other parameters 810, or the GICP 601 satisfy a corresponding threshold.

In a particular aspect, the CP selector 122 may set the CP parameter 919 to a first value (e.g., 0) in response to determining that the GICP 610 fails to satisfy (e.g., is greater than) a GICP threshold 915 (e.g., an inter-channel prediction gain threshold). Alternatively, the CP selector 122 may set the CP parameter 919 to a second value (e.g., 1) in response to determining that the GICP 610 satisfies (e.g., is less than or equal to) the GICP threshold 915.

In a particular aspect, the CP selector 122 may set the CP parameter 919 to a first value (e.g., 0) based on determining the ICA gain parameter 709 fails to satisfy (e.g., is greater than) an ICA gain threshold (e.g., an inter-channel gain threshold). Alternatively, the CP selector 122 may set the CP parameter 919 to a second value (e.g., 1) based on determining that the ICA gain parameter 709 satisfies (e.g., is less than or equal to) the ICA gain threshold.

In a particular aspect, the CP selector 122 may set the CP parameter 919 to a first value (e.g., 0) based on determining the smoothed ICA gain parameter 713 fails to satisfy (e.g., is greater than) a smoothed inter-channel gain threshold. Alternatively, the CP selector 122 may set the CP parameter 919 to a second value (e.g., 1) based on determining that the smoothed ICA gain parameter 713 satisfies (e.g., is less than or equal to) the smoothed inter-channel gain threshold.

In a particular aspect, the CP selector 122 may set the CP parameter 919 to a first value (e.g., 0) in response to determining that a downmix difference between the downmix parameter 515 and a particular value (e.g., 0.5) fails to satisfy (e.g., is greater than) a downmix threshold 917. Alternatively, the CP selector 122 may set the CP parameter 919 to a second value (e.g., 1) in response to determining that the downmix difference satisfies (e.g., is less than or equal to) the downmix threshold 917.

In a particular aspect, the CP selector 122 may set the CP parameter 919 to a first value (e.g., 0) in response to determining that the coder type 819 corresponds to a particular coder type (e.g., a speech coder). Alternatively, the CP selector 122 may set the CP parameter 919 to a second value (e.g., 1) in response to determining that the coder type 819 does not corresponds to the particular coder type (e.g., a non-speech coder).

In a particular aspect, the CP selector 122 may set the CP parameter 919 to a first value (e.g., 0) in response to determining that the voicing factor 825 satisfies a threshold (e.g., strongly voiced or weakly voiced or weakly unvoiced). Alternatively, the CP selector 122 may set the CP parameter 919 to a second value (e.g., 1) in response to determining that the voicing factor 825 fails to satisfy the threshold (e.g., strongly unvoiced).

In a particular aspect, the CP selector 122 may set the CP parameter 919 to a default value (e.g., 1) indicating that a side signal is to be encoded for transmission, that an encoded side signal is to be transmitted, and that a decoder is to generate a synthesized side signal based on decoding the encoded side signal. For example, the CP selector 122 may set the CP parameter 919 to the default value (e.g., 1) in response to determining that the CP parameter 919 is to be generated independently of the ICA parameters 107, the downmix parameter 515, the other parameters 517, and the GICP 610. In this aspect, the CP parameter 919 may correspond to the CP parameter 509 of FIG. 5.

In a particular aspect, the CP selector 122 may apply hysteresis to modify one or more of the thresholds 901. For example, the CP selector 122 may modify the GICP high threshold 923 from a first value (e.g., 0.7) to a second value (e.g., 0.6) in response to determining that a GICP associated with a previously encoded frame satisfies (e.g., is greater than) a second GICP threshold (e.g., 0.9). The CP selector 122 may determine the GICP high indicator 977 based on the second value of the GICP high threshold 923. It should be understood that GICP high threshold 923 is used as an illustrative example, in other implementations the CP selector 122 may apply hysteresis to modify one or more additional thresholds. Applying hysteresis to one or more of the thresholds 901 may reduce variability in the CP parameter 919 across frames.

It should be understood that the ICA parameters 107, the downmix parameter 515, the other parameters 810, the GICP 601, the thresholds 901, and the indicators 960 are described herein as illustrative examples, in other implementations the CP selector 122 may use other parameters, indicators, thresholds, or a combination thereof, to determine the CP parameter 919. For example, the CP selector 122 may determine the CP parameter 919 based on pitch, tilt, mid-to-side cross correlation, absolute energy of side, or a combination thereof. It should be understood that determining the CP parameter 919 based on an evolution of ICA gain or temporal mismatch are described as illustrative examples, in other implementations the CP selector 122 may determine the CP parameter 919 based on evolution of one or more additional parameters across frames.

Figure 10:
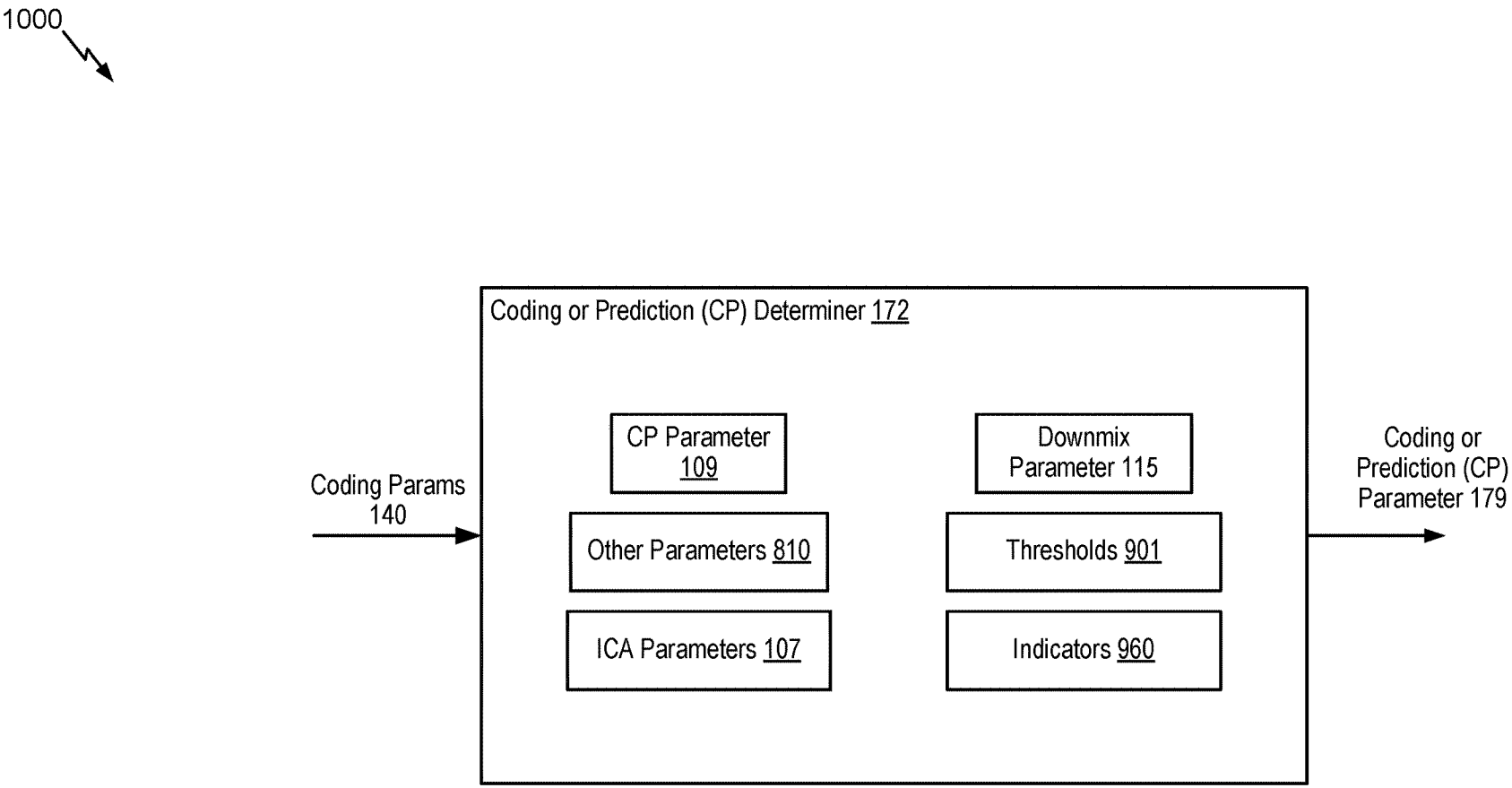
FIG. 10 is a diagram illustrating an example of a coding or prediction determiner of the system of FIG. 1.

Referring to FIG. 10, an example of the CP determiner 172 is shown. The CP determiner 172 is configured to generate the CP parameter 179. The CP parameter 179 may correspond to the CP parameter 109.

During operation, the CP determiner 172, in response to determining that the coding parameters 140 include the CP parameter 109, sets the CP parameter 179 to the same value as the CP parameter 109. Alternatively, the CP determiner 172, in response to determining that the coding parameters 140 do not include the CP parameter 109, determines the CP parameter 179 by performing one or more techniques described as performed by the CP selector 122 with reference to FIG. 9. For example, the CP determiner 172 may determine the CP parameter 179 based on at least one of the downmix parameter 115, the ICA parameters 107, the other parameters 810, the thresholds 901, or the indicators 960. A first value (e.g., 0) of the CP parameter 179 may indicate that the bitstream parameters 102 correspond to the encoded side signal 123. A second value (e.g., 1) of the CP parameter 179 may indicate that the bitstream parameters 102 do not correspond to the encoded side signal 123. The CP determiner 172 thus enables the decoder 118 to dynamically determine whether the synthesized side signal 173 is to be predicted based on the synthesized mid signal 171 or decoded based on the bitstream parameters 102.

Figure 11:
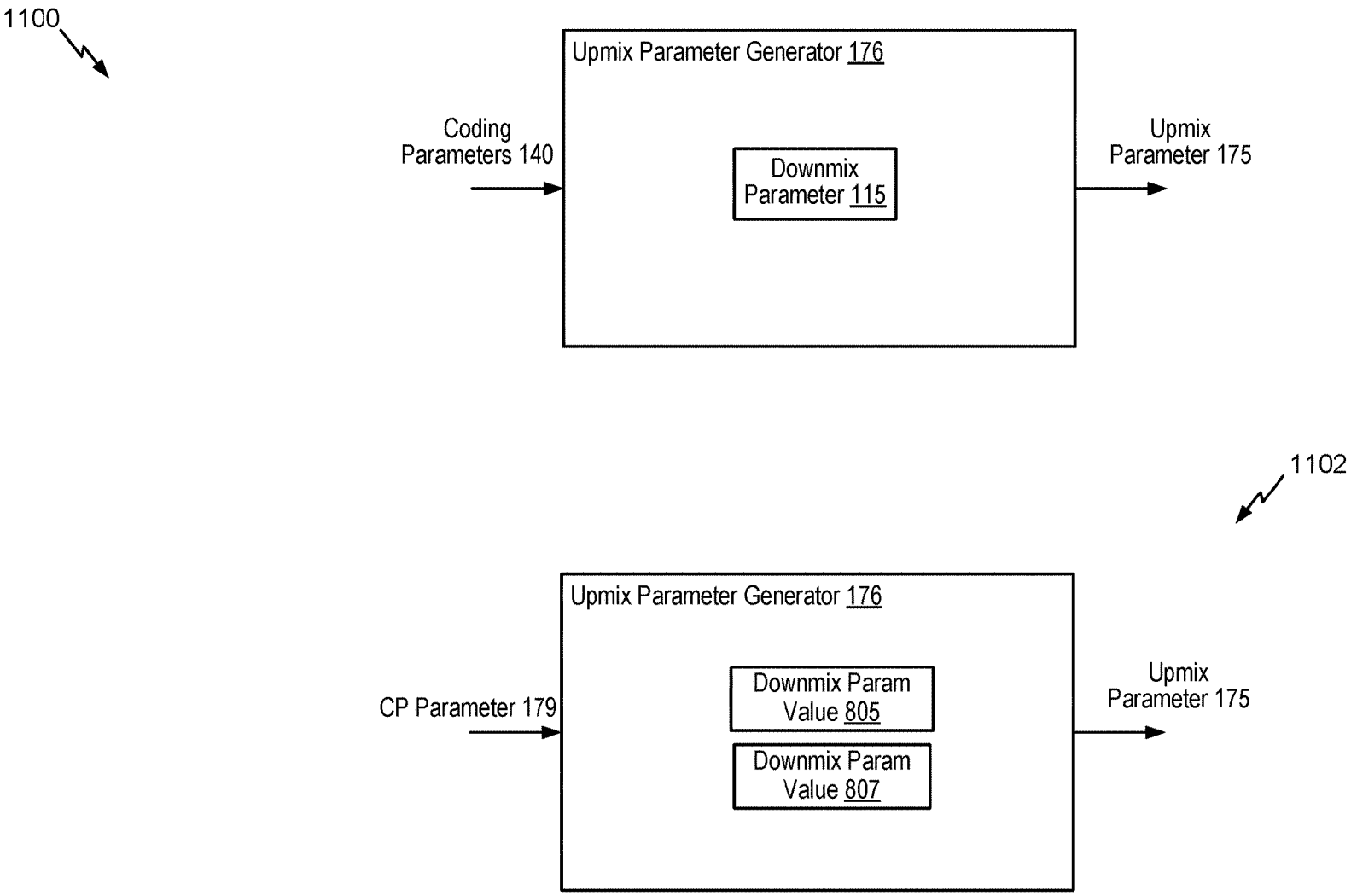
FIG. 11 is a diagram illustrating examples of an upmix parameter generator of the system of FIG. 1.

Referring to FIG. 11, an example of the upmix parameter generator 176 is shown and generally designated 1100. In the example 1100, the coding parameters 140 include the downmix parameter 115.

During operation, the upmix parameter generator 176, in response to determining that the coding parameters 140 include the downmix parameter 115, generates the upmix parameter 175 corresponding to the downmix parameter 115. For example, the upmix parameter 175 may have the same value as the downmix parameter 115. The downmix parameter 115 may have the downmix parameter value 805 or the downmix parameter value 807, as described with reference to FIG. 8. In a particular aspect, the downmix parameter value 805 may correspond to a default parameter value (e.g., 0.5). In a particular aspect, the upmix parameter generator 176 may, in response to determining that the coding parameters 140 do not include the downmix parameter 115, set the upmix parameter 175 to a default value (e.g., 0.5).

FIG. 11 also includes an example 1102 of the upmix parameter generator 176. In the example 1102, the upmix parameter generator 176 determines the upmix parameter 175 based on the CP parameter 179. For example, the upmix parameter generator 176 may, in response to determining that the CP parameter 179 has a first value (e.g., 0), set the upmix parameter 175 to the downmix parameter value 807. The coding parameters 140 may include the downmix parameter value 807. Alternatively, the upmix parameter generator 176 may, in response to determining that the CP parameter 179 has a second value (e.g., 1), set the upmix parameter 175 to the downmix parameter value 805. In a particular aspect, the downmix parameter value 805 may correspond to a default parameter value (e.g., 0.5). In an alternate aspect, the upmix parameter generator 176 may determine the downmix parameter value 805 based on the downmix parameter value 807, as described with reference to the parameter generator 806 of FIG. 8. For example, the upmix parameter generator 176 may determine the downmix parameter value 805 by applying a dynamic range reducing function (e.g., a modified sigmoid) to the downmix parameter value 807. As another example, the upmix parameter generator 176 may determine the downmix parameter value 805 based on the downmix parameter value 807, the voicing factor 825, or both, as described with reference to the parameter generator 806 of FIG. 8. The coding parameters 140 may include the downmix parameter value 807, the voicing factor 825, or both.

In a particular aspect, the upmix parameter generator 176, in response to determining that the coding parameters 140 do not include the downmix parameter 115, determines the upmix parameter 175 based on the CP parameter 179. In an alternate aspect, the upmix parameter generator 176, in response to determining that the CP parameter 179 has a first value (e.g., 0), determines that the coding parameters 140 include the downmix parameter 115 and determines the upmix parameter 175 corresponding to the downmix parameter 115. The upmix parameter 175 may be the same as the downmix parameter 115. The downmix parameter 115 may indicate the downmix parameter value 807. Alternatively, the upmix parameter generator 176, in response to determining that the CP parameter 179 has a second value (e.g., 1), determines that the coding parameters 140 do not include the downmix parameter 115 and sets the upmix parameter 175 to the downmix parameter value 805. The downmix parameter value 805 may be based on a default parameter value (e.g., 0.5), the downmix parameter value 807, or both, as described with reference to FIG. 8. The coding parameters 140 may include the downmix parameter value 807.

The upmix parameter generator 176 may thus enable determining the upmix parameter 175 based on the CP parameter 179. In a particular aspect, the transmitter 110 transmits a single bit indicating the second value (e.g., 1) of the CP parameter 109, the CP determiner 172 determines the CP parameter 179 based on the second value (e.g., 1) indicated by the single bit, and the upmix parameter generator 176 determines the upmix parameter 175 corresponding to the default value (e.g., 0) based on the CP parameter 179. In this aspect, the upmix parameter generator 176 generates the upmix parameter 175 based on a value of a single bit transmitted by the transmitter 110. The upmix parameter generator 176 conserves network resources (e.g., bandwidth) by refraining from transmitting the downmix parameter 115. The upmix parameter generator 176 may repurpose bits that would have been used to transmit the downmix parameter 115 to transmit another parameter (e.g., the GICP 603 of FIG. 6), the bitstream parameters 102, or a combination thereof.

Figure 12:
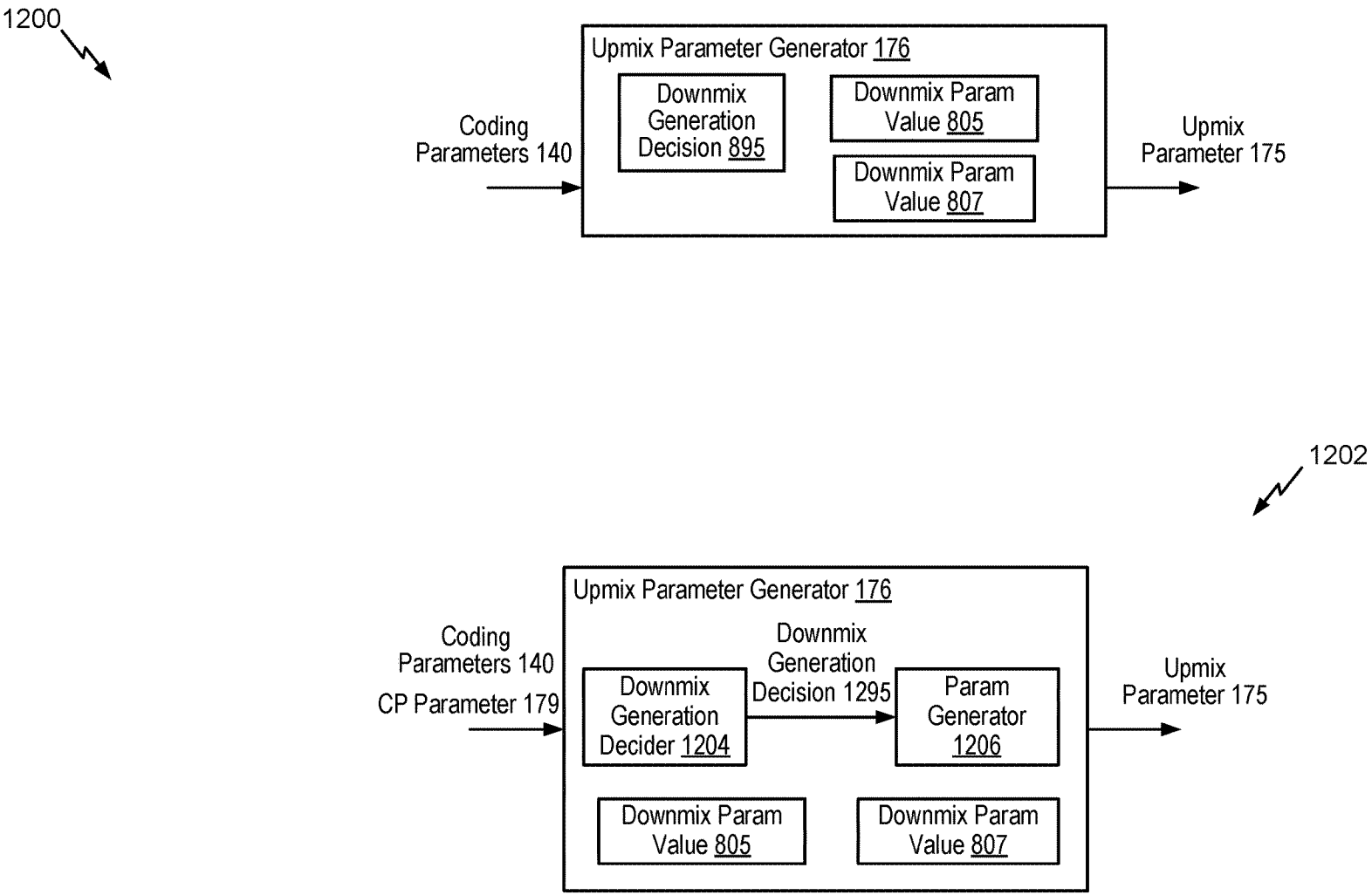
FIG. 12 is a diagram illustrating examples of an upmix parameter generator of the system of FIG. 1.

Referring to FIG. 12, an example of the upmix parameter generator 176 is shown and generally designated 1200. In the example 1200, the coding parameters 140 include the downmix generation decision 895.

The upmix parameter generator 176, in response to determining that the downmix generation decision 895 has a first value (e.g., 0), designates the downmix parameter value 805 as the upmix parameter 175. Alternatively, the upmix parameter generator 176, in response to determining that the downmix generation decision 895 has a second value (e.g., 1), designates the downmix parameter value 807 as the upmix parameter 175. In a particular aspect, the downmix parameter value 805 may correspond to a default value (e.g., 0.5). In an alternate aspect, the upmix parameter generator 176 may determine the downmix parameter value 805 based on the downmix parameter value 807, as described with reference to the parameter generator 806 of FIG. 8. The coding parameters 140 may include the downmix parameter value 807.

FIG. 12 also includes an example 1202 of the upmix parameter generator 176. In the example 1202, the upmix parameter generator 176 includes a downmix generation decider 1204 coupled to a parameter generator 1206. The downmix generation decider 1204 corresponds to the downmix generation decider 804 of FIG. 8. The parameter generator 1206 corresponds to the parameter generator 806 of FIG. 8.

The downmix generation decider 1204 may generate a downmix generation decision 1295 based on the CP parameter 179, the criterion 823 of FIG. 8, or both. For example, the downmix generation decider 1204 may perform one or more operations performed by the downmix generation decider 804 of FIG. 8 to generate the downmix generation decision 895. The CP parameter 179 may correspond to the CP parameter 809 of FIG. 8. The parameter generator 1206 may designate, based on the downmix generation decision 1295, the downmix parameter value 805 or the downmix parameter 807 as the upmix parameter 175.

The parameter generator 1206 may perform one or more operations performed by the parameter generator 806 of FIG. 8 to generate the downmix parameter 803. For example, the upmix parameter generator 176 may designate the downmix parameter value 805 as the upmix parameter 175 in response to determining that the downmix generation decision 1295 has a first value (e.g., 0). Alternatively, the upmix parameter generator 176 may designate the downmix parameter value 807 as the upmix parameter 175 in response to determining that the downmix generation decision 1295 has a second value (e.g., 1).

In a particular aspect, the upmix parameter generator 176 determines the upmix parameter 175 based on information that is available at the encoder 114 and at the decoder 118. For example, the downmix generation decider 1204 may determine whether the criterion 823 is satisfied based on the coder type 819, the core type 817 of FIG. 8, or both, as described with reference to the downmix generation decider 804 of FIG. 8. As another example, the parameter generator 1206 may generate the downmix parameter value 805 based on the downmix parameter value 807, the voicing factor 825, or both, as described with reference to the parameter generator 806 of FIG. 8. The coding parameters 140 may include the downmix parameter value 807, the voicing factor 825, the coder type 819, the core type 817, or a combination thereof.

In a particular aspect, the transmitter 110 of FIG. 1 may transmit a criterion satisfied indicator that indicates whether the criterion 823 is satisfied. The downmix generation decider 1204 may determine the downmix generation decision 1295 based on the CP parameter 179 and the criterion satisfied indicator. For example, the downmix generation decider 1204 may, in response to determining that the CP parameter 179 has a first value (e.g., 0) or the criterion satisfied indicator has a first value (e.g., 0), generate the downmix generation decision 1295 having a second value (e.g., 1). As another example, the downmix generation decider 1204 may, in response to determining that the CP parameter 179 has a second value (e.g., 1) or the criterion satisfied indicator has a second value (e.g., 1), generate the downmix generation decision 1295 having a first value (e.g., 0). The first value (e.g., 0) of the criterion satisfied indicator may indicate that downmix generation decider 804 determined that the criterion 823 is not satisfied. The second value (e.g., 1) of the criterion satisfied indicator may indicate that downmix generation decider 804 determined that the criterion 823 is satisfied.

In a particular aspect, the upmix parameter generator 176 may select one or more parameters based on a configuration setting and may determine the upmix parameter 175 based on the selected parameters. For example, the downmix generation decider 1204 may determine whether the criterion 823 is satisfied based on a first set of selected parameters. As another example, the parameter generator 1206 may determine the downmix parameter value 805 based on a second set of selected parameters. The upmix parameter generator 176 may thus enable various techniques of determining the upmix parameter 175 corresponding to the downmix parameter 115 of FIG. 1.

Figure 13:
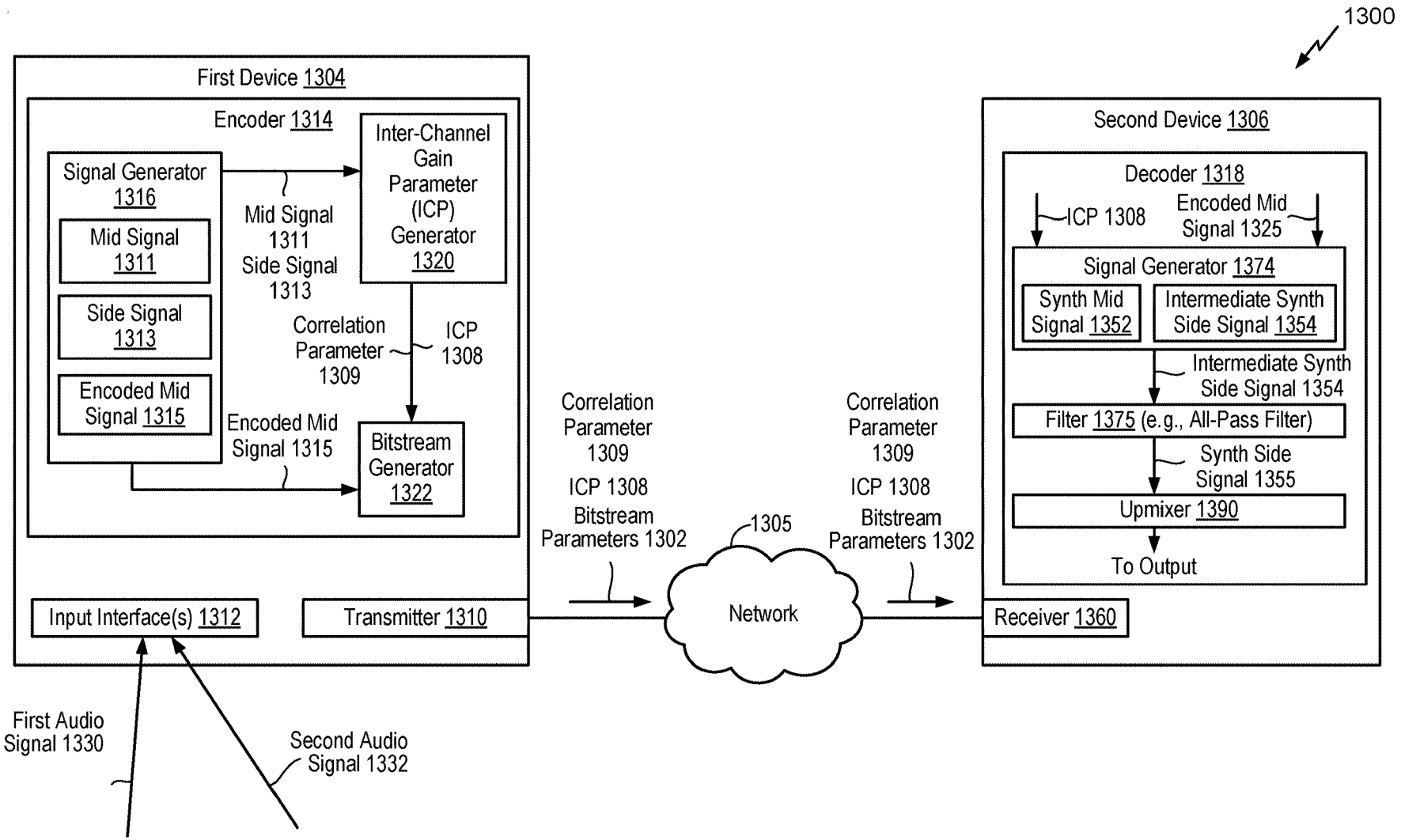
FIG. 13 is a block diagram of a particular illustrative example of a system operable to synthesize an intermediate side signal based on an inter-channel prediction gain parameter and to perform filtering on the intermediate side signal to synthesize a side signal.

Referring to FIG. 13, a particular illustrative example of a system 1300 that synthesizes an intermediate side signal based on an inter-channel prediction gain parameter and that filters (e.g., decorrelation filters) the intermediate side signal to synthesize a side signal is shown. In a particular implementation, the system 1300 of FIG. 13 includes or corresponds to the system 100 of FIG. 1 after a determination to predict a synthesized side signal based on a synthesized mid signal. In some implementations, the system 1300 includes or corresponds to the system 200 of FIG. 2. The system 1300 includes a first device 1304 communicatively coupled, via a network 1305, to a second device 1306. The network 1305 may include one or more wireless networks, one or more wired networks, or a combination thereof. In a particular implementation, the first device 1304, the network 1305, and the second device 1306 may include or correspond to the first device 104, the network 120, and the second device 106 of FIG. 1, or to the first device 204, the network 205, and the second device 206 of FIG. 2, respectively. In a particular implementation, the first device 1304 includes or corresponds to a mobile device. In another particular implementation, the first device 1304 includes or corresponds to a base station. In a particular implementation, the second device 1306 includes or corresponds to a mobile device. In another particular implementation, the second device 1306 includes or corresponds to a base station.

The first device 1304 may include an encoder 1314, a transmitter 1310, one or more input interfaces 1312, or a combination thereof. The one or more input interfaces 1312 may be configured to receive a first audio signal 1330 and a second audio signal 1332, such as from one or more microphones, as described with reference to FIGS. 1-2.

The encoder 1314 may be configured to downmix and encode audio signals, as described with reference to FIG. 1. In a particular implementation, the encoder 1314 may be configured to perform one or more alignment operations on the first audio signal 1330 and the second audio signal 1332, as described with reference to FIG. 1. The encoder 1314 includes a signal generator 1316, an inter-channel prediction gain parameter (ICP) generator 1320, and a bitstream generator 1322. The signal generator 1316 may be coupled to the ICP generator 1320 and to the bitstream generator 1322, and the ICP generator 1320 may be coupled to the bitstream generator 1322. The signal generator 1316 is configured to generate audio signals based on input audio signals received via the one or more input interfaces 1312, as described with reference to FIG. 1. For example, the signal generator 1316 may be configured to generate a mid signal 1311 based on the first audio signal 1330 and the second audio signal 1332. As another example, the signal generator 1316 may be configured to generate a side signal 1313 based on the first audio signal 1330 and the second audio signal 1332. The signal generator 1316 may also be configured to encode one or more audio signals. For example, the signal generator 1316 may be configured to generate an encoded mid signal 1315 based on the mid signal 1311. In a particular implementation, the mid signal 1311, the side signal 1313, and the encoded mid signal 1315 include or correspond to the mid signal 111, the side signal 113, and the encoded mid signal 115 of FIG. 1 or to the mid signal 211, the side signal 213, and the encoded mid signal 215 of FIG. 2, respectively. The signal generator 1316 may be further configured to provide the mid signal 1311 and the side signal 1313 to the ICP generator 1320 and to provide the encoded mid signal 1315 to the bitstream generator 1322. In a particular implementation, the encoder 1314 may be configured to apply one or more filters to the mid signal 1311 and the side signal 1313 prior to providing the mid signal 1311 and the side signal 1313 (e.g., prior to generating an inter-channel prediction gain parameter).

The ICP generator 1320 is configured to generate an inter-channel prediction gain parameter (ICP) 1308 based on the mid signal 1311 and the side signal 1313. For example, the ICP generator 1320 may be configured to generate the ICP 1308 based on an energy of the side signal 1313 or based on an energy of the mid signal 1311 and the energy of the side signal 1313, as described with reference to FIG. 3. Alternatively, the ICP generator 1320 may be configured to determine the ICP 1308 based on an operation (e.g., a dot product operation) performed on the mid signal 1311 and the side signal 1313, as described with reference to FIG. 3.

Although a single ICP 1308 parameter is illustrated as being generated, in other implementations, multiple ICP parameters may be generated. As a particular example, the mid signal 1311 and the side signal 1313 may be filtered into multiple bands, and an ICP corresponding to each of the multiple bands may be generated, as described with reference to FIG. 3. The ICP generator 1320 may be further configured to provide the ICP 1308 to the bitstream generator 1322.

The bitstream generator 1322 may be configured to receive the encoded mid signal 1315 and to generate one or more bitstream parameters 1302 that represent an encoded audio signal (in addition to other parameters). For example, the encoded audio signal may include or correspond to the encoded mid signal 1315. The bitstream generator 1322 may also be configured to include the ICP 1308 in the one or more bitstream parameters 1302. Alternatively, the bitstream generator 1322 may be configured to generate the one or more bitstream parameters 1302 such that the ICP 1308 may be derived from the one or more bitstream parameters 1302. In some implementations, a correlation parameter 1309 may be included in, indicated by, or sent in addition to the one or more bitstream parameters 1302, as further described with reference to FIG. 15. The transmitter 1310 may be configured to send the one or more bitstream parameters 1302 (e.g., the encoded mid signal 1315) including (or in addition to) the ICP 1308 (and optionally the correlation parameter 1309) to the second device 1306 via the network 1305. In a particular implementation, the one or more bitstream parameters 1302 include or correspond to the one or more bitstream parameters 102 of FIG. 1, and the ICP 1308 (and optionally the correlation parameter 1309) is included in the one or more coding parameters 140 that are included in (or sent in addition to) the one or more bitstream parameters 102 of FIG. 1.

The second device 1306 may include a decoder 1318 and a receiver 1360. The receiver 1360 may be configured to receive the ICP 1308 and the one or more bitstream parameters 1302 (e.g., the encoded mid signal 1315) from the first device 1304 via the network 1305. In some implementations, the receiver 1360 is configured to receive the correlation parameter 1309. The decoder 1318 may be configured to upmix and decode audio signals. To illustrate, the decoder 1318 may be configured to decode and upmix one or more audio signals based on the one or more bitstream parameters 1302 (including the ICP 1308 and optionally the correlation parameter 1309).

The decoder 1318 may include a signal generator 1374, a filter 1375, and an upmixer 1390. In a particular implementation, the signal generator 1374 includes or corresponds to the signal generator 174 of FIG. 1 or the signal generator 274 of FIG. 2. The signal generator 1374 may be configured to generate a synthesized mid signal 1352 based on an encoded mid signal 1325 (indicated by or corresponding to the one or more bitstream parameters 1302).

The signal generator 1374 may be further configured to generate an intermediate synthesized side signal 1354 based on the synthesized mid signal 1352 and the ICP 1308. As non-limiting examples, the signal generator 1374 may be configured to generate the intermediate synthesized side signal 1354 by applying the ICP 1308 to the synthesized mid signal 1352 (e.g., multiplying the synthesized mid signal 1352 by the ICP 1308) or based on the ICP 1308 and one or more energy levels, as described with reference to FIG. 4. The filter 1375 may be configured to filter the intermediate synthesized side signal 1354 to generate a synthesized side signal 1355. In a particular implementation, the filter 1375 includes an "all-pass" filter configured to perform phase adjustment (e.g., phase fuzzing, phase dispersion, phase diffusion, or phase decorrelation), reverb, and stereo extending, as further described with reference to FIG. 14. The decoder 1318 may be configured to further process and the upmixer 1390 may be configured to upmix the synthesized mid signal 1352 and the synthesized side signal 1355 to generate one or more output audio signals, which may be rendered and output, such as to one or more loudspeakers. In a particular implementation, the output audio signals include a left audio signal and a right audio signal. In some implementations, one or more discontinuity reduction operations may selectively be performed using the synthesized side signal 1355 prior to upmixing and additional processing, as further described with reference to FIG. 14.

During operation, the first device 1304 may receive the first audio signal 1330 via a first input interface of the one or more input interfaces 1312 and may receive the second audio signal 1332 via a second input interface of the one or more input interfaces 1312. The first audio signal 1330 may correspond to one of a right channel signal or a left channel signal. The second audio signal 1332 may correspond to the other of the right channel signal or the left channel signal. The encoder 1314 may perform one or more alignment operations to account for a temporal shift or temporal delay between the first audio signal 1330 and the second audio signal 1332, as described with reference to FIG. 1. The encoder 1314 may generate the mid signal 1311 and the side signal 1313 based on the first audio signal 1330 and the second audio signal 1332, as described with reference to FIG. 1. The mid signal 1311 and the side signal 1313 may be provided to the ICP generator 1320. The signal generator 1316 may also encode the mid signal 1311 to generate the encoded mid signal 1315, which is provided to the bitstream generator 1322.

The ICP generator 1320 may generate the ICP 1308 based on the mid signal 1311 and the side signal 1313, as described with reference to FIGS. 2-3. The ICP 1308 may be provided to the bitstream generator 1322. In some implementations, the ICP 1308 may be smoothed based on inter-channel prediction gain parameters associated with previous frames, as described with reference to FIG. 3. In some implementations, the ICP generator 1320 may also generate the correlation parameter 1309. The correlation parameter 1309 may represent the correlation between the mid signal 1311 and the side signal 1313.

The bitstream generator 1322 may receive the encoded mid signal 1315 and the ICP 1308 (and optionally the correlation parameter 1309) and generate the one or more bitstream parameters 1302. The one or more bitstream parameters 1302 include a bitstream (e.g., the encoded mid signal 1315) and the ICP 1308 (and optionally the correlation parameter 1309). Alternatively, the one or more bitstream parameters 1302 include one or more parameters that enable the ICP 1308 (and optionally the correlation parameter 1309) to be derived. The one or more bitstream parameters 1302 (including or indicating the ICP 1308 and optionally the correlation parameter 1309) are sent by the transmitter 1310 to the second device 1306 via the network 1305.

The second device 1306 (e.g., the receiver 1360) may receive the one or more bitstream parameters 1302 (indicative of the encoded mid signal 1315) that include (or indicate) the ICP 1308 (and optionally the correlation parameter 1309). The decoder 1318 may determine the encoded mid signal 1325 based on the one or more bitstream parameters 1302, as described with reference to FIG. 2. The signal generator 1374 may generate the synthesized mid signal 1352 based on the encoded mid signal 1325 (or directly from the one or more bitstream parameters 1302). The signal generator 1374 may also generate the intermediate synthesized side signal 1354 based on the synthesized mid signal 1352 and the ICP 1308. As non-limiting examples, the signal generator 1374 generates the intermediate synthesized side signal 1354 by multiplying the synthesized mid signal 1352 by the ICP 1308 or based on the synthesized mid signal 1352, the ICP 1308, and an energy level, as described with reference to FIG. 4.

After generating the intermediate synthesized side signal 1354, the intermediate synthesized side signal 1354 may be filtered using the filter 1375 (e.g., the all-pass filter) to generate the synthesized side signal 1355. Applying the filter 1375 may decrease correlation (e.g., increase decorrelation) between the synthesized mid signal 1352 and the synthesized side signal 1355. In some implementations, the correlation parameter 1309 is used to configure the filter 1375, as further described with reference to FIG. 15. In some implementations, multiple ICPs are received that correspond to different signal bands, and multiple bands of intermediate synthesized side signals may be filtered using the filter 1375, as further described with reference to FIG. 16. After generating the synthesized side signal 1355, the decoder 1318 may perform further processing, and filtering on the synthesized mid signal 1352 and the synthesized side signal 1355, and the upmixer 1390 may upmix the synthesized mid signal 1352 and the synthesized side signal 1355 to generate a first audio signal and a second audio signal. In some implementations, one or more discontinuity suppression operations may be performed using the synthesized side signal 1355 prior to generation of the first audio signal and the second audio signal, as further described with reference to FIG. 14.

In a particular implementation, the first audio signal corresponds to one of a left signal or a right signal, and the second audio signal corresponds to the other of the left signal or the right signal. In a particular implementation, the left signal may be generated based on a sum of the synthesized mid signal 1352 and the synthesized side signal 1355, and the right signal may be generated based on a difference between the synthesized mid signal 1352 and the synthesized side signal 1355. Decreasing the correlation between the synthesized mid signal 1352 and the synthesized side signal 1355 may improve spatial audio information represented by the left signal and the right signal. To illustrate, if the synthesized mid signal 1352 and the synthesized side signal 1355 are highly correlated, the left signal may approximate twice the synthesized mid signal 1352, and the right signal may approximate a null signal. Reducing the correlation between the synthesized mid signal 1352 and the synthesized side signal 1355 may increase the spatial differences between the signals, which may result in a left signal and a right signal that are spatially different, which may improve a listener's experience.

The system 1300 of FIG. 13 enables decorrelation, at a decoder, of a synthesized mid signal and a predicted synthesized side signal (e.g., a synthesized side signal based on the synthesized mid signal and an inter-channel prediction gain parameter). Decorrelating the synthesized mid signal and the synthesized side signal enables generation of audio signals (e.g., a left signal and a right signal) that have spatial differences. Left signals and right signals that have spatial differences may sound as though they are coming from two different locations, which improves listener experience as compared to signals that lack spatial differences (e.g., that are based on highly correlated signals) and thus sound like they are coming from a single location (e.g., one speaker).

Figure 14:
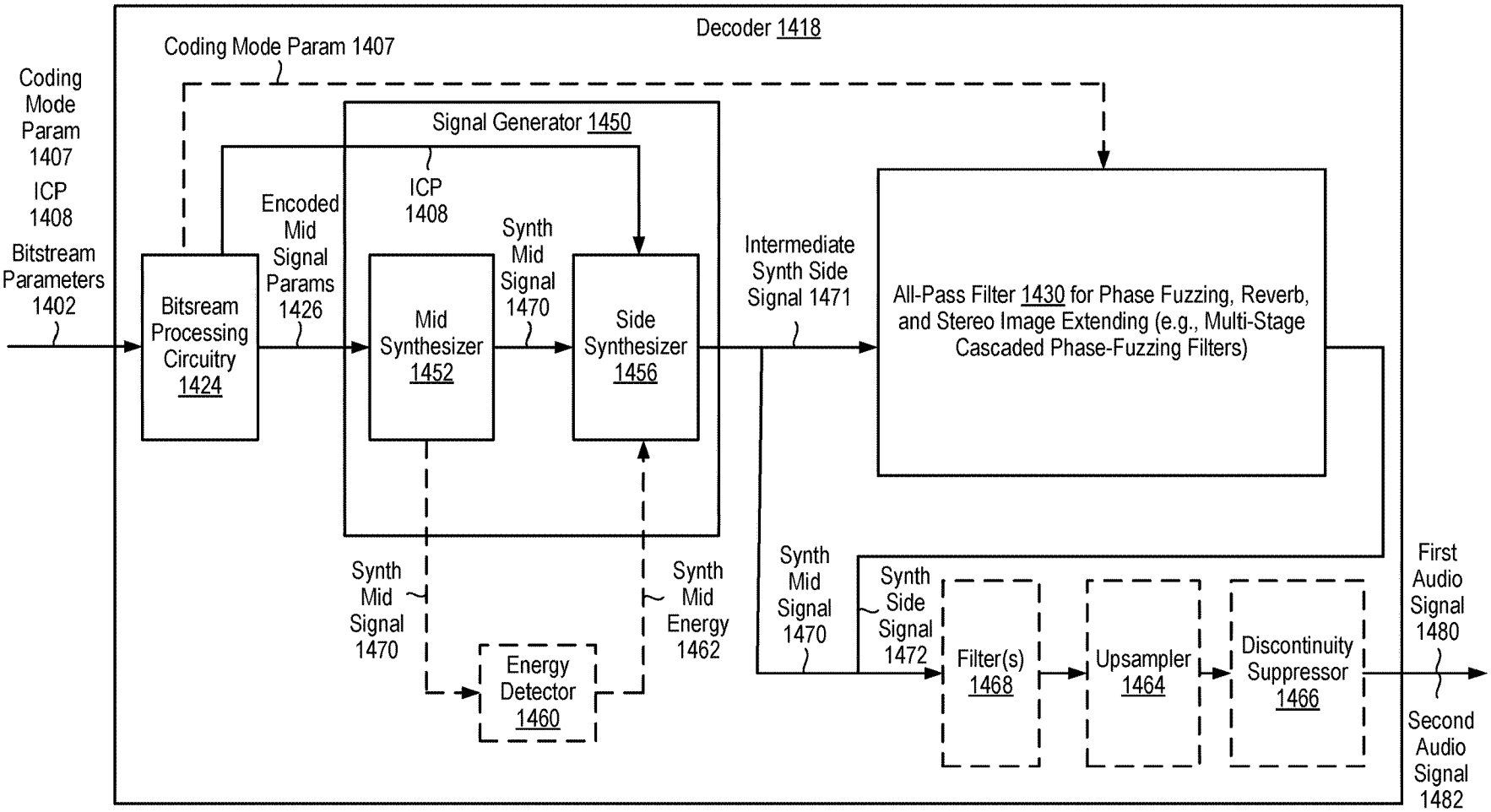
FIG. 14 is a block diagram of a first illustrative example of a decoder of the system of FIG. 13.

FIG. 14 is a diagram illustrating a first illustrative example of a decoder 1418 of the system 1300 of FIG. 13. For example, the decoder 1418 may include or correspond to the decoder 1318 of FIG. 13.

The decoder 1418 includes bitstream processing circuitry 1424, a signal generator 1450 that includes a mid synthesizer 1452 and a side synthesizer 1456, and an all-pass filter 1430. The bitstream processing circuitry 1424 may be coupled to the signal generator 1450, and the signal generator 1450 may be coupled to the all-pass filter 1430.

The decoder 1418 may optionally include an energy detector 1460, one or more filters 1468, an upsampler 1464, and a discontinuity suppressor 1466. The energy detector 1460 may be coupled to the signal generator 1450 (e.g., to the mid synthesizer 1452 and the side synthesizer 1456). The one or more filters 1468, the upsampler 1464, and the discontinuity suppressor 1466 may be coupled between the all-pass filter 1430 and an output of the decoder 1418. Each of the energy detector 1460, the one or more filters 1468, the upsampler 1464, and the discontinuity suppressor 1466 are optional and thus may not be included in some implementations of the decoder 1418.

The bitstream processing circuitry 1424 may be configured to process one or more bitstream parameters 1402 (including an ICP 1408) and extract particular parameters from the one or more bitstream parameters 1402. For example, the bitstream processing circuitry 1424 may be configured to extract the ICP 1408 and one or more encoded mid signal parameters 1426, as described with reference to FIG. 4. The bitstream processing circuitry 1424 may be configured to provide the ICP 1408 and the one or more encoded mid signal parameters 1426 to the signal generator 1450 (e.g., the ICP 1408 may be provided to the side synthesizer 1456 and the one or more encoded mid signal parameters 1426 may be provided to the mid synthesizer 1452). In some implementations, the decoder 1418 may receive a coding mode parameter 1407, and the bitstream processing circuitry 1424 may be configured to extract the coding mode parameter 1407 and provide the coding mode parameter 1407 to the all-pass filter 1430.

The signal generator 1450 may be configured to generate audio signals based on the one or more encoded mid signal parameters 1426 and the ICP 1408. To illustrate, the mid synthesizer 1452 may be configured to generate a synthesized mid signal 1470 based on the encoded mid signal parameters 1426 (e.g., based on an encoded mid signal), and the side synthesizer 1456 may be configured to generate an intermediate synthesized side signal 1471 based on the synthesized mid signal 1470 and the ICP 1408, as described with reference to FIG. 4. In a particular implementation, the energy detector 1460 is configured to detect a synthesized mid energy level 1462 based on the synthesized mid signal 1470, and the side synthesizer 1456 is configured to generate the intermediate synthesized side signal 1471 based on the synthesized mid signal 1470, the ICP 1408, and the synthesized mid energy level 1462, as described with reference to FIG. 4.

The all-pass filter 1430 may be configured to filter the intermediate synthesized side signal 1471 to generate a synthesized side signal 1472. For example, the all-pass filter 1430 may be configured to perform phase adjustment (e.g., phase fuzzing, phase dispersion, phase diffusion, or phase decorrelation), reverb, and stereo extending. To illustrate, the all-pass filter 1430 may perform phase adjustment or blurring for synthesizing the effects of stereo width estimated at an encoder (e.g., at the transmit side). In some implementations, the all-pass filter 1430 includes multi-stage cascaded phase adjustment (e.g., phase fuzzing, phase dispersion, phase diffusion, or phase decorrelation) filters. The all-pass filter 1430 may be configured to filter the intermediate synthesized side signal 1471 in the time domain to generate the synthesized side signal 1472. Performing phase adjustment in the time-domain at the decoder 1418 followed by temporal up-mixing and synthesis at low bit rates may help with balancing and may improve a trade-off between signal coding efficiency and stereo image widening. Such balancing of CP parameters may result in improved coding of both music and speech recordings from multiple microphones. The all-pass filter 1430 is referred to as an all-pass filter because the frequency response of the all-pass filter 1430 is (or approximates) unity, such that a magnitude of a filtered signal is the same (or approximately the same) across different frequencies. The all-pass filter 1430 may have a phase response that varies with frequency such that a phase of the filtered signal varies across different frequencies.

By changing the phase of the filtered signal (e.g., the synthesized side signal 1472) with respect to the input signal (e.g., the intermediate synthesized side signal 1471), such as by phase adjustment or blurring, adding reverb, and stereo image extending, the all-pass filter 1430 is configured to reduce correlation (e.g., increase decorrelation) between the synthesized side signal 1472 and the synthesized mid signal 1470. To illustrate, because the intermediate synthesized side signal 1471 is generated from the synthesized mid signal 1470, the intermediate synthesized side signal 1471 and the synthesized mid signal 1470 may be highly correlated, which can result in output audio signals that lack spatial differences. By changing the phase of the synthesized side signal 1472 relative to the phase of the intermediate synthesized side signal 1471, the all-pass filter 1430 may reduce correlation between the synthesized side signal 1472 and the synthesized mid signal 1470, which may increase the spatial difference between the output audio signals, thereby improving a listening experience.

In some implementations, the all-pass filter 1430 includes a single stage. In other implementations, the all-pass filter 1430 includes multiple stages coupled in series. To illustrate, the all-pass filter 1430 may include a first stage, a second stage, a third stage, and a fourth stage. In other implementations, the all-pass filter 1430 includes fewer than four or more than four stages. The stages may be coupled in series (e.g., cascading). Each stage of the stages may be associated with a delay parameter that controls an amount of delay (e.g., phase adjustment) provided by the stage and a gain parameter that controls an amount of gain (e.g., magnitude adjustment) that is provided by the stage. For example, the first stage may be associated with a first delay parameter and a first gain parameter, the second stage may be associated with a second delay parameter and a second gain parameter, the third stage may be associated with a third delay parameter and a third gain parameter, and the fourth stage may be associated with a fourth delay parameter and a fourth gain parameter. In some implementations, each of the stages are fixed. For example, values of the delay parameters and values of the gain parameters may be set to the same or different values, such as during a configuration or set-up phase of the decoder 1418. In other implementations, each stage of the stages may be individually configurable. For example, each stage may be individually enabled (or disabled), one or more of the parameters associated with the multiple stages may be individually set (or adjusted), or a combination thereof. For example, one or more of the parameters may be set (or adjusted) based on the ICP 1408, as further described herein.

In a particular implementation, the all-pass filter 1430 includes a stationary all-pass filter. For example, the parameters associated with the all-pass filter 1430 may be set (or adjusted) to fixed values. In another particular implementation, the all-pass filter 1430 includes a non-stationary all-pass filter. For example, the parameters associated with the all-pass filter 1430 may be set (or adjusted) to values that change over time.

In a particular implementation, the all-pass filter 1430 may be configured to filter the intermediate synthesized side signal 1471 based further on the coding mode parameter 1407. For example, one or more of the parameters associated with the all-pass filter 1430 may be set (or adjusted) based on a value of the coding mode parameter 1407, as further described herein. As another example, one or more of the stages of the all-pass filter 1430 may be enabled (or disabled) based on the coding mode parameter 1407, as further described herein.

In a particular implementation, the one or more filters 1468 are configured to receive the synthesized mid signal 1470 and the synthesized side signal 1472 and to filter the synthesized mid signal 1470, the synthesized side signal 1472, or both. The one or more filters 1468 may include one or more types of filters. For example, the one or more filters 1468 may include de-emphasis filters, bandpass filters, FFT filters (or transformations), IFFT filters (or transformations), time domain filters, frequency or sub-band domain filters, or a combination thereof. In a particular implementation, the one or more filters 1468 include one or more fixed filters. Alternatively, the one or more filters 1468 may include one or more adaptive filters configured to filter the synthesized mid signal 1470, the synthesized side signal 1472, or both based on one or more adaptive filter coefficients that are received from another device, as described with reference to FIG. 4. In a particular implementation, the one or more filters 1468 include a de-emphasis filter configured to perform de-emphasis filtering on the synthesized mid signal 1470, the synthesized side signal 1472, or both, and a 50 Hz high pass filter.

In a particular implementation, the upsampler 1464 is configured to upsample the synthesized mid signal 1470 and the synthesized side signal 1472. For example, the upsampler 1464 may be configured to upsample the synthesized mid signal 1470 and the synthesized side signal 1472 from a downsampled rate (at which the synthesized mid signal 1470 and the synthesized side signal 1472 are generated) to an upsampled rate (e.g., an input sampling rate of audio signals that are received at an encoder and used to generate the one or more bitstream parameters 1402). Upsampling the synthesized mid signal 1470 and the synthesized side signal 1472 enables generation (e.g., by the decoder 1418) of audio signals at an output sampling rate associated with playback of audio signals In a particular implementation, the discontinuity suppressor 1466 may be configured to reduce (or eliminate) a discontinuity between a first frame of the synthesized side signal 1472 and a second frame of a second synthesized side signal that is generated based on an encoded side signal received at a receiver (and provided to the decoder 1418. To illustrate, for a first set of frames including the first frame, another device (that includes an encoded) may send the ICP 1408 and the one or more bitstream parameters 1402 (e.g., an encoded mid signal). For example, the first set of frames may be associated with a determination that the decoder 1418 is to predict the synthesized side signal 1472 based on the ICP 1408. For a second set of frames including the second frame, the other device may send an encoded side signal instead of the ICP 1408. For example, the second set of frames may be associated with a determination that the decoder 1418 is to decode the encoded side signal to generate a second synthesized side signal. In some cases, a discontinuity may exist between the synthesized side signal 1472 and the decoded side signal (e.g., the first frame of the synthesized side signal 1472 may be relatively different in gain, pitch, or some other characteristic from the second frame of the decoded side signal. Discontinuities may exist when the decoder 1418 switches from predicting the synthesized side signal 1472 to decoding a received encoded side signal, or when the decoder 1418 switches from decoding the received encoded side signal to predicting the synthesized side signal 1472.

In some implementations, the discontinuity suppressor 1466 is configured to reduce discontinuities when switching from predicting the synthesized side signal 1472 to decoding to generate the second synthesized side signal (e.g., the decoded side signal). In a particular implementation, the discontinuity suppressor 1466 may be configured to cross-fade one or more frames of the synthesized side signal 1472 with one or more frames of the second synthesized side signal. For example, a first sliding window ranging from a first value (e.g., 1) to a second value (e.g., 0) may be applied to one or more frames of the synthesized side signal 1472, and a second sliding window ranging from the second value to the first value may be applied to one or more frames of the second synthesized side signal, and the frames may be combined to "taper out" the synthesized side signal 1472 and to "taper in" the second synthesized side signal. In another particular implementation, the discontinuity suppressor 1466 may be configured to postpone generation of the second synthesized side signal for one or more frames. For example, the discontinuity suppressor 1466 may identify one or more particular frames for which a discontinuity is to be avoided, and the discontinuity suppressor 1466 may predict the synthesized side signal 1472 for the one or more particular frames. As an example, the discontinuity suppressor 1466 may apply the last received inter-channel prediction gain parameter to the one or more particular frames of the synthesized mid signal 1470 to generate the synthesized side signal 1472 for the one or more particular frames. As another example, the discontinuity suppressor 1466 may estimate an inter-channel prediction gain parameter based on the synthesized mid signal 1470 and the second synthesized side signal (e.g., the decoded side signal), and the discontinuity suppressor may generate the synthesized side signal 1472 using the estimated inter-channel prediction gain parameter. In another particular implementation, the decoder 1418 may receive the ICP 1408 and the encoded side signal for one or more frames, and the discontinuity suppressor 1466 may cross-fade the synthesized side signal 1472 and the second synthesized side signal.

In some implementations, the discontinuity suppressor 1466 is configured to reduce discontinuities when switching from decoding to generating the second synthesized side signal (e.g., the decoded side signal) to predicting the synthesized side signal 1472. In a particular implementation, the discontinuity suppressor 1466 may be configured to generate mirrored samples of the second synthesized signal. The mirrored samples may be generated in reverse order (e.g., a first mirrored sample may be mirrored from a last sample of the second synthesized signal, a second mirrored sample may be mirrored from a second-to-last sample of the second synthesized signal, etc.). The discontinuity suppressor 1466 may be further configured to cross-fade the mirrored samples with the synthesized side signal 1472 for one or more frames. Thus, the discontinuity suppressor 1466 may be configured to reduce (or eliminate) discontinuities across frames for which the method of generating the side signal at the decoder 1418 is changed (e.g., from prediction to decoding or from decoding to prediction), which may improve a listening experience.

In a particular implementation, the decoder 1418 is further configured to perform upmixing on the synthesized mid signal 1470 and the synthesized side signal 1472 to generate output signals, as described with reference to FIG. 1. For example, the decoder 1418 may be configured to generate a first audio signal 1480 and a second audio signall 482 based on the upsampled synthesized mid signal 1470 and the upsampled synthesized side signal 1472.

During operation, the decoder 1418 receives the one or more bitstream parameters 1402 (e.g., from a receiver). The one or more bitstream parameters 1402 include (or indicate) the ICP 1408. In some implementations, the one or more bitstream parameters 1402 also include, or are received in addition to, the coding mode parameter 1407. The bitstream processing circuitry 1424 may process the one or more bitstream parameters 1402 and extract various parameters. For example, the bitstream processing circuitry 1424 may extract the encoded mid signal parameters 1426 from the one or more bitstream parameters 1402, and the bitstream processing circuitry 1424 may provide the encoded mid signal parameters 1426 to the signal generator 1450 (e.g., to the mid synthesizer 1452). As another example, the bitstream processing circuitry 1424 may extract the ICP 1408 from the one or more bitstream parameters 1402, and the bitstream processing circuitry 1424 may provide the ICP 1408 to the signal generator 1450 (e.g., to the side synthesizer 1456). In a particular implementation, the bitstream processing circuitry 1424 may extract the coding mode parameter 1407 and provide the coding mode parameter 1407 to the all-pass filter 1430.

The mid synthesizer 1452 may generate the synthesized mid signal 1470 based on the encoded mid signal parameters 1426. The side synthesizer 1456 may generate the intermediate synthesized side signal 1471 based on the synthesized mid signal 1470 and the ICP 1408. As a non-limiting example, the side synthesizer 1456 may generate the intermediate synthesized side signal 1471 according to techniques described with reference to FIG. 4.

The all-pass filter 1430 may filter the intermediate synthesized side signal 1471 to generate the synthesized side signal 1472. In some implementations, the synthesized side signal 1472 may be generated according to the following equation:

$$\text{Side_Mapped}(z)=H_{AP}(z)\text{Mid_signal_decoded}(z)*\text{ICP_Gain}$$

where Side_Mapped(z) is the synthesized side signal 1472, ICP_Gain is the ICP 1408, Mid_signal_decoded(z) is the synthesized mid signal 1470, and $H_{AP}(Z)$ is the filtering applied by the all-pass filter 1430.

In some implementations, $H_{AP}(z)$ may be determined according to the following equation:

$$H_{AP}(z)=\Pi_i \text{Hi}(z)$$

where $H_i(z)$ is the filtering applied by stage i of the all-pass filter 1430. Thus, the filtering applied by the all-pass filter 1430 may be equal to the product of the filtering applied by each of the stages of the all-pass filter 1430.

In some implementations, $H_i(z)$ may be determined according to the following equation:

$$H_i(z) = \frac{z^{-M_i} - g_i}{1 - g_i * z^{-M_i}}$$

where $g_i$ is the gain parameter associated with stage i of the all-pass filter 1430 and $M_i$ is the delay parameter associated with stage i of the all-pass filter 1430.

In some implementations, values of one or more parameters of the all-pass filter 1430 may be set based on the ICP 1408. For example, based on the ICP 1408 being relatively high (e.g., satisfying a first threshold), one or more of the parameters may be set (or adjusted) to values that increase the amount of decorrelation provided by the all-pass filter 1430. As another example, based on the ICP 1408 being relatively low (e.g., failing to satisfy a second threshold), one or more of the parameters may be set (or adjusted) to values that decrease the amount of decorrelation provided by the all-pass filter 1430. In other implementations, values of the parameters may be otherwise set or adjusted based on the ICP 1408.

In a particular implementation, one or more of the stages of the all-pass filter 1430 may be enabled (or disabled) based on the coding mode parameter 1407. For example, each of the stages may be enabled based on the coding mode parameter 1407 indicating a music coding mode (e.g., a Transform Coder (TCX) mode). As another example, the second stage and the fourth stage may be disabled based on the coding mode parameter 1407 indicating a speech coding mode (e.g., an algebraic code-excited linear prediction (ACELP) coder mode). Disabling one or more of the stages may reduce echo in filtered speech signals. In some implementations, disabling a particular stage of the all-pass filter 1430 may include setting the corresponding delay parameter and the corresponding gain parameter to a particular value (e.g., 0). In other implementations, the stages may be disabled (or enabled) in other ways. Although the coding mode parameter 1407 is described, in other implementations, the stages may be disabled (or enabled) based on other parameters, such as other parameters indicative of speech or music content.

In some implementations, the one or more filters 1468 may filter the synthesized mid signal 1470, the synthesized side signal 1472, or both. For example, the one or more filters 1468 may perform de-emphasis filtering, high pass filtering, or both, on the synthesized mid signal 1470, the synthesized side signal 1472, or both. In a particular implementation, the one or more filters 1468 applies a fixed filter to the synthesized mid signal 1470, the synthesized side signal 1472, or both. In another particular implementation, the one or more filters 1468 applies an adaptive filter to the synthesized mid signal 1470, the synthesized side signal 1472, or both.

In some implementations, the upsampler 1464 may upsample the synthesized mid signal 1470 and the synthesized side signal 1472. For example, the upsampler 1464 may upsample the synthesized mid signal 1470 and the synthesized side signal 1472 from a downsampled rate (e.g., approximately 0-6.4 kHz) to an output sampling rate. After upsampling, the decoder 1418 may generate the first audio signal 1480 and the second audio signal 1482 based on the synthesized mid signal 1470 and the synthesized side signal 1472. For example, the decoder 1418 may perform upmixing to generate the first audio signal 1480 and the second audio signal 1482, as described with reference to FIG. 1. The first audio signal 1480 and the second audio signal 1482 may be output to one or more output devices, such as one or more loudspeakers. In a particular implementation, the first audio signal 1480 is one of a left audio signal and a right audio signal, and the second audio signal 1482 is the other of the left audio signal and the right audio signal. In some implementations, the discontinuity suppressor 1466 may perform one or more discontinuity reduction operations prior to generation of the first audio signal 1480 and the second audio signal 1482.

The decoder 1418 of FIG. 14 enables prediction (e.g., mapping) of the synthesized side signal 1472 from the synthesized mid signal 1470 using inter-channel prediction gain parameters (e.g., the ICP 1408). Additionally, the decoder 1418 reduces correlation (e.g., increases decorrelation) between the synthesized mid signal 1470 and the synthesized side signal 1472, which may increase spatial difference between the first audio signal 1480 and the second audio signal 1482, which may improve a listening experience.

Figure 15:
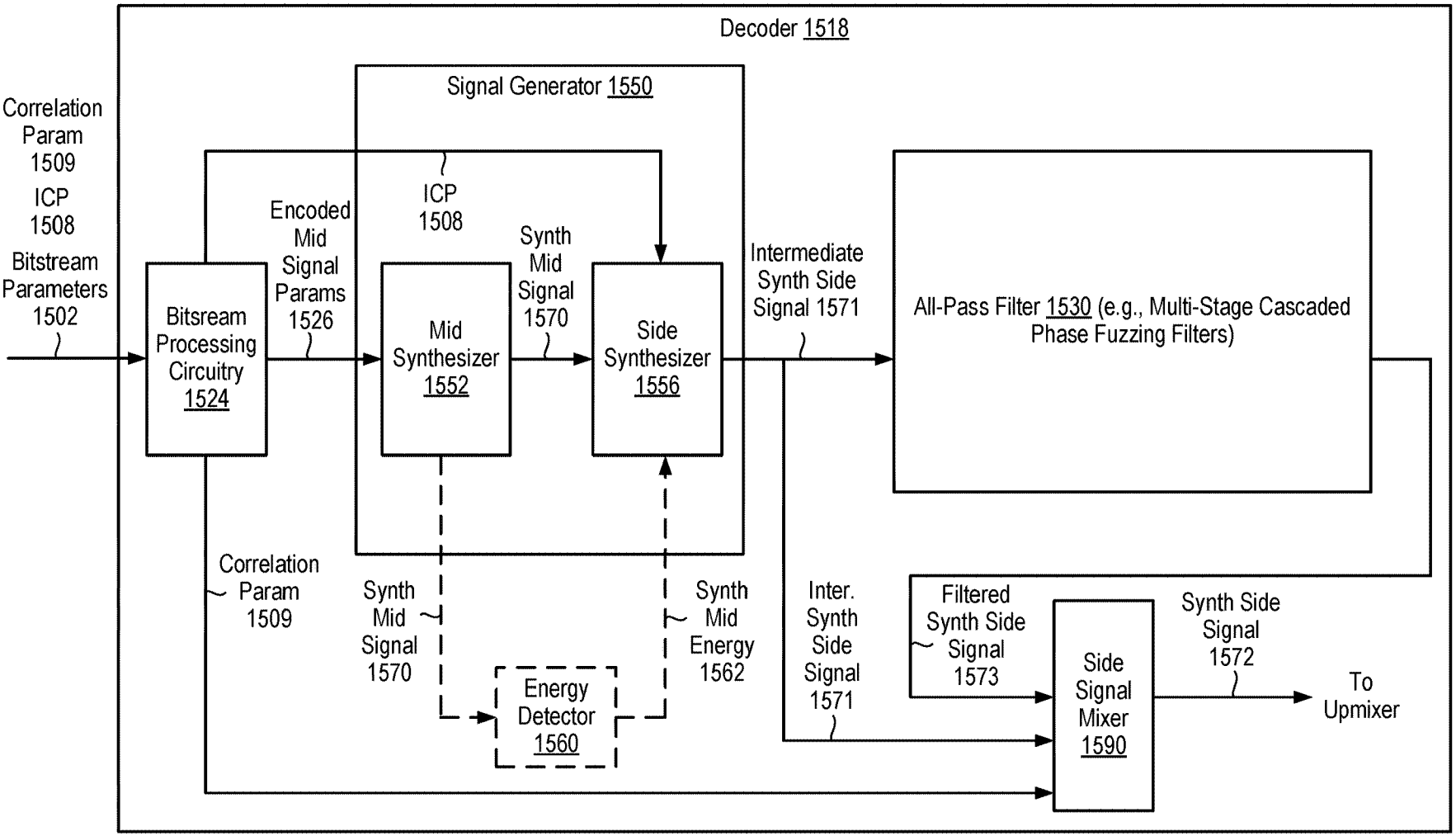
FIG. 15 is a block diagram of a second illustrative example of a decoder of the system of FIG. 13.

FIG. 15 is a diagram illustrating a second illustrative example of a decoder 1518 of the system 1300 of FIG. 13. For example, the decoder 1518 may include or correspond to the decoder 1318 of FIG. 13.

The decoder 1518 may include bitstream processing circuitry 1524, a signal generator 1550 (including a mid synthesizer 1552 and a side synthesizer 1556), an all-pass filter 1530, and optionally an energy detector 1560. In a particular implementation, the all-pass filter 1530 may include a first stage that is associated with a first delay parameter and a first gain parameter, a second stage that is associated with a second delay parameter and a second gain parameter, a third stage that is associated with a third delay parameter and a third gain parameter, and a fourth stage that is associated with a fourth delay parameter and a fourth gain parameter. The bitstream processing circuitry 1524, the signal generator 1550, the mid synthesizer 1552, the side synthesizer 1556, the energy detector 1560, and the all-pass filter 1530 may perform similar operations as described with reference to the bitstream processing circuitry 1424, the signal generator 1450, the mid synthesizer 1452, the side synthesizer 1456, the energy detector 1460, and the all-pass filter 1430 of FIG. 14, respectively. The decoder 1518 may also include a side signal mixer 1590. The side signal mixer 1590 may be configured to mix an intermediate synthesized side signal and a filtered synthesized side signal based on a correlation parameter, as further described herein.

During operation, the decoder 1518 receives one or more bitstream parameters 1502 (e.g., from a receiver). The one or more bitstream parameters 1502 include (or indicate) encoded mid signal parameters 1526, an inter-channel prediction gain parameter (ICP) 1508, and a correlation parameter 1509. The ICP 1508 may represent a relationship between energy levels of a mid signal and a side signal at an encoder, and the correlation parameter 1509 may represent a correlation between the mid signal and the side signal at the encoder. In a particular implementation, the ICP 1508 is determined at the encoder according to the following equation:

ICP_Gain=sqrt(Energy(side_signal_unquantized)/
Energy(mid_signal_unquantized))

where ICP_Gain is the ICP 1508, Energy(side_signal_unquantized) the side energy level of the side signal at the encoder, and Energy(mid_signal_unquantized) is the mid energy level of the mid signal at the encoder. The correlation parameter 1509 may be determined at the encoder according to the following equation:

$$\text{ICP_correlation}=|\text{Side_signal unquantized}\cdot\text{Mid_signal_unquantized}|/\text{Energy (mid_signal_unquantized)}$$

where ICP_Gain is the ICP 1508, |Side_signal_ unquantized· Mid_signal_unquantized| is the dot product of the side signal and the mid signal at the encoder, and Energy (mid_signal_unquantized) is the mid energy level of the mid signal at the encoder. In other implementations, the ICP 1508 and the correlation parameter 1509 may be determined based on other values.

The bitstream processing circuitry 1524 may process the one or more bitstream parameters 1502 and extract various parameters. For example, the bitstream processing circuitry 1524 may extract the encoded mid signal parameters 1526 from the one or more bitstream parameters 1502, and the bitstream processing circuitry 1524 may provide the encoded mid signal parameters 1526 to the signal generator 1550 (e.g., to the mid synthesizer 1552). As another example, the bitstream processing circuitry 1524 may extract the ICP 1508 from the one or more bitstream parameters 1502, and the bitstream processing circuitry 1524 may provide the ICP 1508 to the signal generator 1550 (e.g., to the side synthesizer 1556). As another example, the bitstream processing circuitry 1524 may extract the correlation parameter 1509 from the one or more bitstream parameters 1502, and the bitstream processing circuitry 1524 may provide the correlation parameter 1509 to the side signal mixer 1590.

The mid synthesizer 1552 may generate a synthesized mid signal 1570 based on the encoded mid signal parameters 1526. The side synthesizer 1556 may generate an intermediate synthesized side signal 1571 based on the synthesized mid signal 1570 and the ICP 1508. As a non-limiting example, the side synthesizer 1556 may generate the intermediate synthesized side signal 1571 according to techniques described with reference to FIG. 4.

The all-pass filter 1530 may filter the intermediate synthesized side signal 1571 to generate a filtered synthesized side signal 1573. The all-pass filter 1530 may be configured to perform phase adjustment (e.g., phase fuzzing, phase dispersion, phase diffusion, or phase decorrelation), reverb, and stereo extending. To illustrate, the all-pass filter 1530 may perform phase adjustment or blurring for synthesizing the effects of stereo width estimated at an encoder (e.g., at the transmit side). In some implementations, the all-pass filter 1530 includes multi-stage cascaded phase adjustment (e.g., phase fuzzing, phase dispersion, phase diffusion, or phase decorrelation) filters. To illustrate, the all-pass filter 1530 includes a phase dispersion filter that includes one or more stationary decorrelation filters, one or more non-stationary decorrelation filters, one or more non-linear all-pass resampling filters, or a combination thereof. The all-pass filter 1530 may filter the intermediate synthesized side signal 1571 as described with reference to FIG. 14.

In some implementations, values of one or more parameters of the all-pass filter 1530 may be set (or adjusted) based on the ICP 1508, as described with reference to FIG. 14. In some implementations, the values of the one or more parameters of the all-pass filter 1530 may be set (or adjusted) based on the correlation parameter 1509, one or more of the stages of the all-pass filter 1530 may be disabled (or enabled) based on the correlation parameter 1509, or both. For example, if the correlation parameter 1509 indicates a relatively high correlation, one or more of the parameters may be decreased, one or more of the stages may be disabled, or both, such that the filtered synthesized side signal 1573 and the synthesized mid signal 1570 also have relatively high correlation. As another example, if the correlation parameter 1509 indicates a relatively low correlation, one or more of the parameters may be increased, one or more of the stages may be enabled, or both, such that the filtered synthesized side signal 1573 and the synthesized mid signal 1570 also have relatively low correlation. Additionally, one or more of the parameters may be set (or adjusted), one or more of the stages may be enabled (or disabled), based further on a coding mode parameter (or other parameter), as described with reference to FIG. 14.

The intermediate synthesized side signal 1571 and the filtered synthesized side signal 1573 may be provided to the side signal mixer 1590. The side signal mixer 1590 may mix the intermediate synthesized side signal 1571 with the filtered synthesized side signal 1573 based on the correlation parameter 1509 to generate a synthesized side signal 1572. In alternative implementations, the synthesized mid signal 1570 may be provided to the all-pass filter 1530 for all-pass filtering to generate an all-pass filtered quantized mid signal (prior to application of the ICP 1508), and the side signal mixer 1590 may receive the synthesized mid signal 1570, the all-pass filtered quantized mid-signal, the ICP 1508, and the correlation parameter 1509. The side signal mixer 1590 may scale and mix the synthesized mid signal 1570 and the all-pass filtered quantized mid-signal based on the ICP 1508 and the correlation parameter 1509 to generate the synthesized side signal 1572.

In a particular implementation, the side signal mixer 1590 may generate the synthesized side signal 1572 according to the following equation:

$$\text{Mapped_side}(z)=\text{ICP_Gain}*[(\text{ICP_correlation})*\text{mid_quantized}(z)+(1-\text{ICP_correlation})*H_{AP}(z)*\text{mid_quantized}(z)]$$

where Mapped_side(z) is the synthesized side signal 1572, ICP_Gain is the ICP 1508, ICP_correlation is the correlation parameter 1509, mid_quantized(z) is the synthesized mid signal 1570, and $H_{AP}(Z)$ is the filtering applied by the all-pass filter 1530. Because ICP_Gain*mid_quantized(z) is equal to the intermediate synthesized side signal 1571, and ICP_Gain*$H_{AP}(z)$*mid_quantized(z) is equal to the filtered synthesized side signal 1573, the synthesized side signal 1572 may also be generated according to the following equation:

$$\text{synthesized side signal 1572}=\text{correlation parameter 1509}*\text{intermediate synthesized side signal 1571}+(1-\text{correlation parameter 1509})*\text{filtered synthesized side signal 1573}$$

In another particular implementation, the side signal mixer 1590 may generate the synthesized side signal 1572 according to the following equation:

$$\text{Mapped_side}(z)=[(\text{ICP_correlation})*\text{mid_quantized}(z)+\text{square_root}(\text{ICP_Gain}*\text{ICP_Gain}-\text{ICP_correlation}*\text{ICP_correlation})*H_{AP}(z)*\text{mid_quantized}(z)]$$

where Mapped_side(z) is the synthesized side signal 1572, ICP_Gain is the ICP 1508, ICP_correlation is the correlation parameter 1509, mid_quantized(z) is the synthesized mid signal 1570, and $H_{AP}(Z)$ is the filtering applied by the all-pass filter 1530. In this equation, $H_{AP}(z)$*mid_quantized (z) corresponds to (e.g., represents) the all-pass filtered quantized mid signal prior to ICP application.

In another particular implementation, the side signal mixer 1590 may generate the synthesized side signal 1572 according to the following equation:

$$\text{Mapped_side}(z)=\text{scale_factor1}*\text{mid_quantized}(z)+\text{scale_factor2}*H_{AP}(z)*\text{mid_quantized}(z).$$

where scale_factor1 and scale_factor2 are estimated at the decoder 1518 based on ICP_correlation and ICP_Gain such that the following two constraints are satisfied: 1.) the cross-correlation between Mapped_side and mid_quantized is the same as the ICP_correlation, and 2.) the ratio of the energies of the Mapped_side and the mid_quantized is equal to ICP_Gain^2. The values of scale_factor1 and scale_factor2 may be solved for by various analytical or iterative methods or other alternatives. In some implementations, scale_factor1 and scale_factor2 may be further processed prior to being used to generate Mapped_side.

Thus, an amount of the filtered synthesized side signal 1573 and an amount of the intermediate synthesized side signal 1571 that are mixed may be based on the correlation parameter 1509. For example, the amount of the filtered synthesized side signal 1573 may be increased (and the amount of the intermediate synthesized side signal 1571 may be decreased) based on a decrease in the correlation parameter 1509. As another example, the amount of the filtered synthesized side signal 1573 may be decreased (and the amount of the intermediate synthesized side signal 1571 may be increased) based on an increase in the correlation parameter 1509. Although both configuring the all-pass filter 1530 based on the correlation parameter 1509 and mixing signals based on the correlation parameter 1509 have been described, in other implementations, only one of configuring the all-pass filter 1530 or mixing the signals is performed.

The decoder 1518 may generate output audio signals based on the synthesized mid signal 1570 and the synthesized side signal 1572. In some implementations, one or more of additional filtering, upsampling, discontinuity reduction may be performed prior to upmixing to generate the output audio signals, as further described with reference to FIG. 14.

Thus, the decoder 1518 of FIG. 15 is configured to match a correlation between a synthesized side signal and a synthesized mid signal to a correlation between a mid signal and a side signal at an encoder. Matching the correlation may result in generation of output signals having spatial differences that substantially match spatial differences between input signals received at the encoder.

Figure 16:
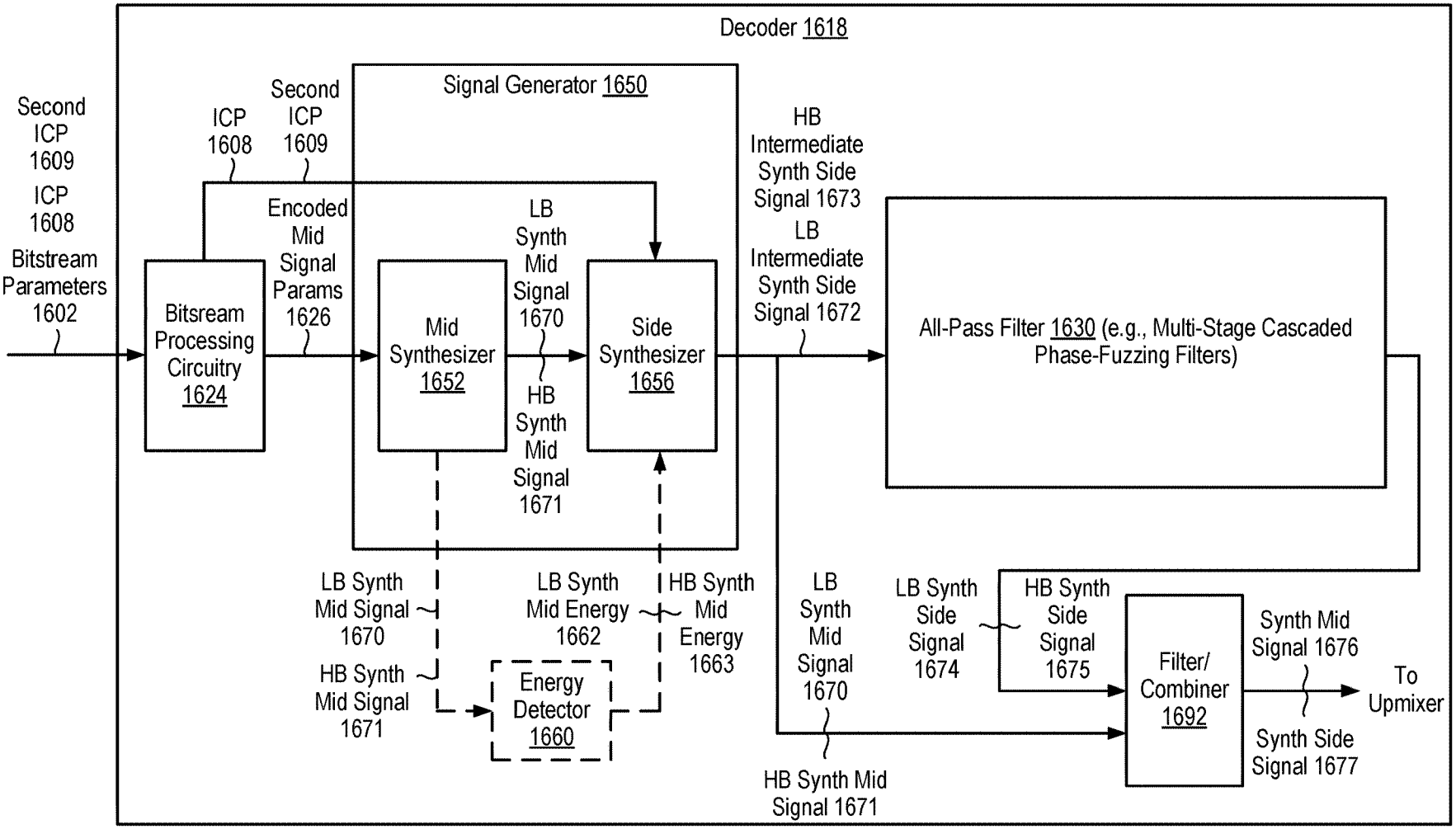
FIG. 16 is a block diagram of a third illustrative example of a decoder of the system of FIG. 13.

FIG. 16 is a diagram illustrating a third illustrative example of a decoder 1618 of the system 1300 of FIG. 13. For example, the decoder 1618 may include or correspond to the decoder 1318 of FIG. 13.

The decoder 1618 may include bitstream processing circuitry 1624, a signal generator 1650 (including a mid synthesizer 1652 and a side synthesizer 1656), an all-pass filter 1630, and optionally an energy detector 1660. In some implementations, the all-pass filter 1630 may include a first stage that is associated with a first delay parameter and a first gain parameter, a second stage that is associated with a second delay parameter and a second gain parameter, a third stage that is associated with a third delay parameter and a third gain parameter, and a fourth stage that is associated with a fourth delay parameter and a fourth gain parameter. The bitstream processing circuitry 1624, the signal generator 1650, the mid synthesizer 1652, the side synthesizer 1656, the energy detector 1660, and the all-pass filter 1630 may perform similar operations as described with reference to the bitstream processing circuitry 1424, the signal generator 1450, the mid synthesizer 1452, the side synthesizer 1456, the energy detector 1460, and the all-pass filter 1430 of FIG. 14, respectively. The decoder 1618 may also include a filter/combiner 1692. The filter/combiner 1692 may include one or more filters, one or more signal combiners, a combination thereof, or other circuitry configured to combine synthesized signals across multiple signal bands to generate synthesized signals, as further described herein.

During operation, the decoder 1618 receives one or more bitstream parameters 1602 (e.g., from a receiver). The one or more bitstream parameters 1602 include (or indicate) encoded mid signal parameters 1626, an inter-channel prediction gain parameter (ICP) 1608, and a second ICP 1609. The ICP 1608 may represent a relationship between energy levels of a mid signal and a side signal in a first signal band at an encoder, and the second ICP 1609 may represent a relationship between energy levels of the mid signal and the side signal in a second signal band at the encoder.

The bitstream processing circuitry 1624 may process the one or more bitstream parameters 1602 and extract various parameters. For example, the bitstream processing circuitry 1624 may extract the encoded mid signal parameters 1626 from the one or more bitstream parameters 1602, and the bitstream processing circuitry 1624 may provide the encoded mid signal parameters 1626 to the signal generator 1650 (e.g., to the mid synthesizer 1652). As another example, the bitstream processing circuitry 1624 may extract the ICP 1608 and the second ICP 1609 from the one or more bitstream parameters 1602, and the bitstream processing circuitry 1624 may provide the ICP 1608 and the second ICP 1609 to the signal generator 1650 (e.g., to the side synthesizer 1656).

The mid synthesizer 1652 may generate a synthesized mid signal based on the encoded mid signal parameters 1626. The signal generator 1650 may also include one or more filters that filter the synthesized mid signal into multiple bands to generate a low-band synthesized mid signal 1670 and a high-band synthesized mid signal 1671. The side synthesizer 1656 may generate multiple signal bands of intermediate synthesized side signals based on the low-band synthesized mid signal 1670, the high-band synthesized mid signal 1671, the ICP 1608, and the second ICP 1609. For example, the side synthesizer 1656 may generate a low-band intermediate synthesized side signal 1672 based on the low-band synthesized mid signal 1670 and the ICP 1608. As another example, the side synthesizer 1656 may generate a high-band intermediate synthesized side signal 1673 based on the high-band synthesized mid signal 1671 and the second ICP 1609.

The all-pass filter 1630 may filter the low-band intermediate synthesized side signal 1672 and the high-band intermediate synthesized side signal 1673 to generate a low-band synthesized side signal 1674 and a high-band synthesized side signal 1675. For example, the all-pass filter 1630 may filter the low-band intermediate synthesized side signal 1672 and the high-band synthesized side signal 1673 as described with reference to FIG. 14. Although the signals are described as being filtered into two bands (e.g., a low-band and a high-band), such description is not intended to be limiting. In other implementations, the signals may be filtered into different bands, such as a mid-band, or into more than two bands. Additionally, as described with reference to FIG. 14, the all-pass filter 1630 may perform phase adjustment (e.g., phase fuzzing, phase dispersion, phase diffusion, or phase decorrelation), reverb, and stereo extending. To illustrate, the all-pass filter 1630 may perform phase adjustment or blurring for synthesizing the effects of stereo width estimated at an encoder (e.g., at the transmit side). In some implementations, the all-pass filter 1630 includes multi-stage cascaded phase adjustment (e.g., phase fuzzing, phase dispersion, phase diffusion, or phase decorrelation) filters.

In some implementations, values of the parameters associated with the all-pass filter 1630, states (e.g., enabled or disabled) of the stages of the all-pass filter 1630, or both, may be the same for filtering both the low-band intermediate synthesized side signal 1672 and the high-band intermediate synthesized side signal 1673. In other implementations, values of the parameters, states (e.g., enabled or disabled) of the stages, or both, may be different when filtering the low-band intermediate synthesized side signal 1672 as compared to filtering the high-band intermediate synthesized side signal 1673. For example, the parameters may be set to a first set of values prior to filtering the low-band intermediate synthesized side signal 1672. After the low-band intermediate synthesized side signal 1672 is filtered, one or more of the values of the parameters may be adjusted, and the high-band intermediate synthesized side signal 1673 may be filtered based on the adjusted parameter values. As another example, the number of the stages of the all-pass filter 1630 that are enabled to filter the low-band intermediate synthesized side signal 1672 may be different than the number of the stages that are enabled to filter the high-band intermediate synthesized side signal 1673. In some implementations, the all-pass filter 1630 may additionally be configured based on correlation parameters corresponding to each of the signal bands, as described with reference to FIG. 15. Thus, the amount of decorrelation applied may be different in different signal bands.

The low-band synthesized mid signal 1670, the high-band synthesized mid signal 1671, the low-band synthesized side signal 1674, and the high-band synthesized side signal 1675 may be provided to the filter/combiner 1692. The filter/combiner 1692 may combine multiple signal bands to generate synthesized signals. For example, the filter/combiner 1692 may combine the low-band synthesized mid signal 1670 and the high-band synthesized mid signal 1671 to generate a synthesized mid signal 1676. As another example, the filter/combiner 1692 may combine the low-band synthesized side signal 1674 and the high-band synthesized side signal 1675 to generate a synthesized side signal 1677.

The decoder 1618 may generate output audio signals based on the synthesized mid signal 1676 and the synthesized side signal 1677. In some implementations, one or more of additional filtering, upsampling, and discontinuity reduction may be performed prior to upmixing to generate the output audio signals, as further described with reference to FIG. 14.

The decoder 1618 of FIG. 16 enables prediction (e.g., mapping) of the synthesized side signal 1677 from the synthesized mid signal 1676 using multiple inter-channel prediction gain parameters (e.g., the ICP 1608 and the second ICP 1609) for different bands. Additionally, the decoder 1618 reduces correlation (e.g., increases decorrelation) between the synthesized mid signal 1676 and the synthesized side signal 1677 for different amounts in different bands, which may result in generation of output audio signals having varying spatial diversity across different frequencies.

Figure 17:
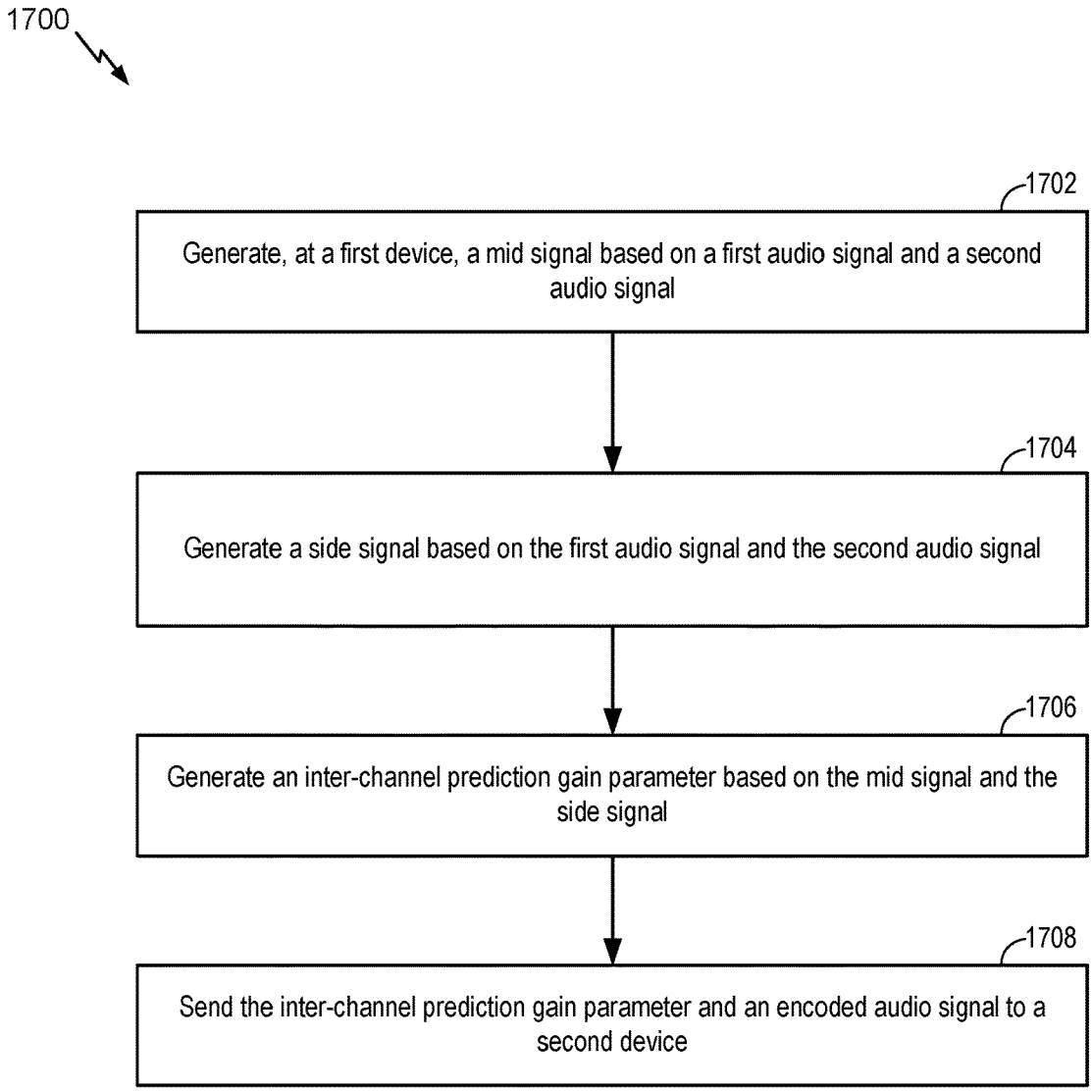
FIG. 17 is a flow chart illustrating a particular method of encoding audio signals.

FIG. 17 is a flow chart illustrating a particular method 1700 of encoding audio signals. In a particular implementation, the method 1700 may be performed at the first the first device 204 of FIG. 2 or the encoder 314 of FIG. 3.

The method 1700 includes generating, at a first device, a mid signal based on a first audio signal and a second audio signal, at 1702. For example, the first device may include or correspond to the first device 204 of FIG. 2 or a device that includes the encoder 314 of FIG. 3, the mid signal may include or correspond to the mid signal 211 of FIG. 2 or the mid signal 311 of FIG. 3, the first audio signal may include or correspond to the first audio signal 230 of FIG. 2 or the first audio signal 330 of FIG. 3, and the second audio signal may include or correspond to the second audio signal 232 of FIG. 2 or the second audio signal 332 of FIG. 3. In a particular implementation, the first device includes or corresponds to a mobile device. In another particular implementation, the first device includes or corresponds to a base station.

The method 1700 includes generating a side signal based on the first audio signal and the second audio signal, at 1704. For example, the side signal may include or correspond to the side signal 213 of FIG. 2 or the side signal 313 of FIG. 3.

The method 1700 includes generating an inter-channel prediction gain parameter based on the mid signal and the side signal, at 1706. For example, the inter-channel prediction gain parameter may include or correspond to the ICP 208 of FIG. 2 or the ICP 308 of FIG. 3.

The method 1700 further includes sending the inter-channel prediction gain parameter and an encoded audio signal to a second device, at 1708. For example, the ICP 208 may be included in the one or more bitstream parameters 202 (that are indicative of an encoded mid signal) and may be sent to the second device 206, as described with reference to FIG. 2.

In a particular implementation, the method 1700 further includes downsampling the first audio signal to generate a first downsampled audio signal and downsampling the second audio signal to generate a second downsampled audio signal. The inter-channel prediction gain parameter may be based on the first downsampled audio signal and the second downsampled audio signal. For example, the downsampler 340 may downsample the mid signal 311 and the side signal 313 prior to generation of the ICP 308 by the ICP generator 320, as described with reference to FIG. 3. In an alternate implementation, the inter-channel prediction gain parameter is determined at an input sampling rate associated with the first audio signal and the second audio signal. For example, in some implementations, the downsampler 340 is not included in the encoder 314, and the ICP 308 is generated at the input sampling rate, as further described with reference to FIG. 3.

In another particular implementation, the method 1700 further includes performing a smoothing operation on the inter-channel prediction gain parameter prior to sending the inter-channel prediction gain parameter to the second device. For example, the ICP smoother 350 may smooth the ICP 308 based on the smoothing factor 352. In a particular implementation, the smoothing operation is based on a fixed smoothing factor. In an alternate implementation, the smoothing operation is based on an adaptive smoothing factor. The adaptive smoothing factor may be based on a signal energy of the mid signal. For example, the smoothing factor 352 may be based on long-term signal energy and short-term signal energy, as described with reference to FIG. 3. Alternatively, the adaptive smoothing factor may be based on a voicing parameter associated with the mid signal. For example, the smoothing factor 352 may be based on a voicing parameter, as described with reference to FIG. 3.

In another particular implementation, the method 1700 includes processing the mid signal to generate a low-band mid signal and a high-band mid signal and processing the side signal to generate a low-band side signal and a high-band side signal. For example, the one or more filters 331 may process the mid signal 311 to generate the low-band mid signal 333 and the high-band mid signal 334, and the one or more filters 331 may process the side signal 313 to generate the low-band side signal 336 and the high-band side signal 338, as described with reference to FIG. 3. The method 1700 includes generating the inter-channel prediction gain parameter based on the low-band mid signal and the low-band side signal and generating a second inter-channel prediction gain parameter based on the high-band mid signal and the high-band side signal. For example, the ICP generator 320 may generate the ICP 308 based on the low-band mid signal 333 and the low-band side signal 336, and the ICP generator 320 may generate the second ICP 354 based on the high-band mid signal 334 and the high-band side signal 338, as described with reference to FIG. 3. The method 1700 further includes sending the second inter-channel prediction gain parameter with the inter-channel prediction gain parameter and the encoded audio signal to the second device. For example, the ICP 308 and the second ICP 354 may be included in (or indicated by) the one or more bitstream parameters 302 that are output by the encoder 314, as described with reference to FIG. 3.

In a particular implementation, the method 1700 further includes generating a correlation parameter based on the mid signal and the side signal and sending the correlation parameter with the inter-channel prediction gain parameter and the encoded audio signal to the second device. For example, the correlation parameter may include or correspond to the correlation parameter 1509 of FIG. 15. The inter-channel prediction gain parameter may be based on a ratio of an energy level of the side signal and an energy level of the mid signal, and the correlation parameter may be based on a ratio of the energy level of the mid signal and a dot product of the mid signal and the side signal. For example, the correlation parameter may be determined as described with reference to FIG. 15.

Thus, the method 1700 enables generation an inter-channel prediction gain parameter for frames of an audio signal that are associated with a determination to predict a side signal at a decoder. Sending the inter-channel prediction gain parameter may conserve network resources as compared to sending a frame of an encoded side signal. Alternatively, one or more bits that would otherwise be used to send the encoded side signal may instead be repurposed (e.g., used) to send additional bits of an encoded mid signal, which may improve the quality of a synthesized mid signal and a predicted side signal at a decoder.

Figure 18:
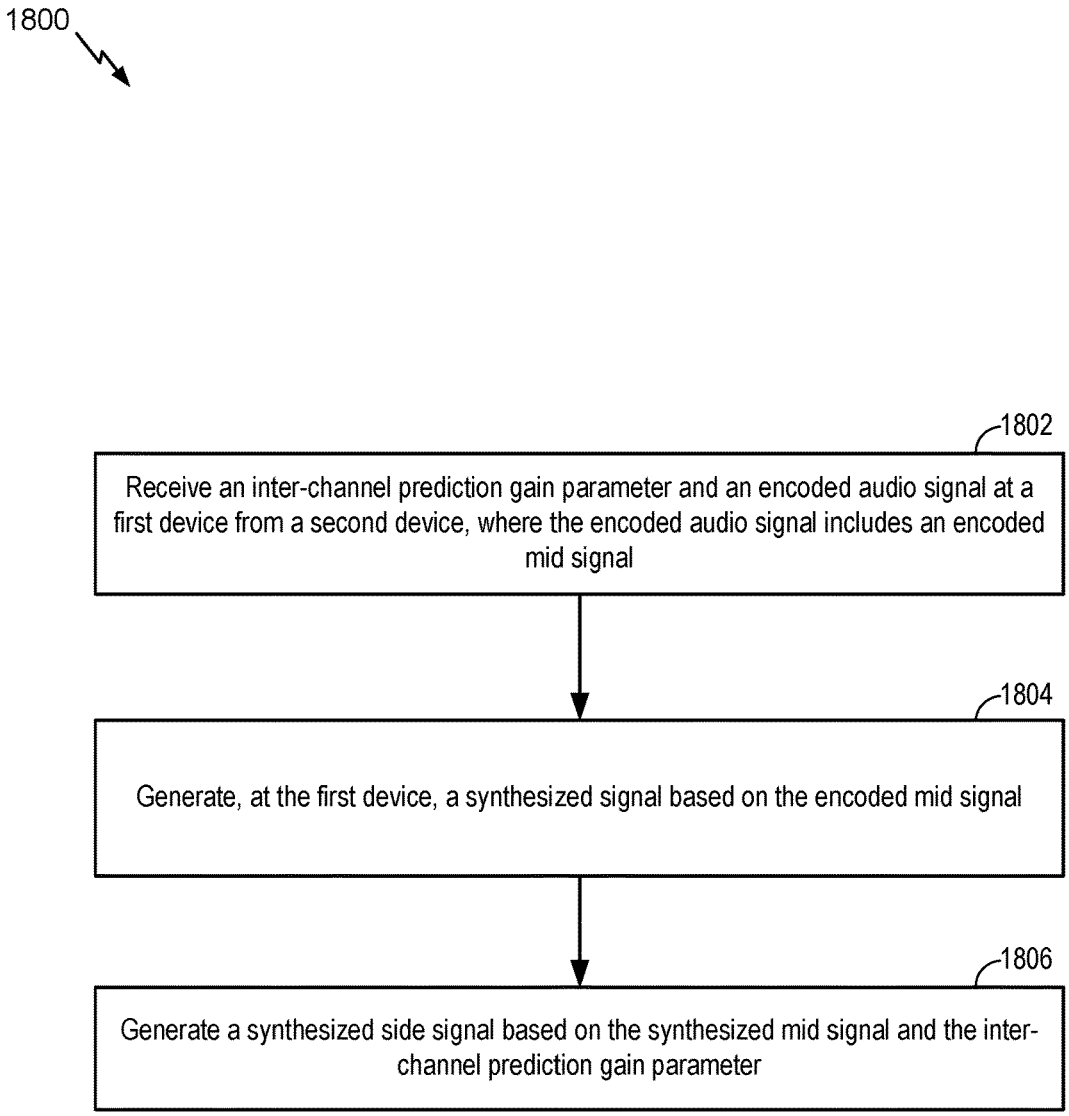
FIG. 18 is a flow chart illustrating a particular method of decoding audio signals.

FIG. 18 is a flow chart illustrating a particular method 1800 of decoding audio signals. In a particular implementation, the method 1800 may be performed at the second device 206 of FIG. 2 or the decoder 418 of FIG. 4.

The method 1800 includes receiving an inter-channel prediction gain parameter and an encoded audio signal at a first device from a second device, at 1802. The encoded audio signal may include an encoded mid signal. For example, the first device may include or correspond to the second device 206 of FIG. 2 or a device that includes the decoder 418 of FIG. 4, the inter-channel prediction gain parameter may include or correspond to the ICP 208 of FIG. 2 or the ICP 408 of FIG. 4, and the encoded audio signal may be indicated by the one or more bitstream parameters 202 of FIG. 2 or the one or more bitstream parameters 402 of FIG. 4. In a particular implementation, the encoded audio signal includes or corresponds to the encoded mid signal 225 of FIG. 2.

The method 1800 includes generating, at the first device, a synthesized mid signal based on the encoded mid signal, at 1804. For example, the synthesized mid signal may include or correspond to the synthesized mid signal 252 of FIG. 2 or the synthesized mid signal 470 of FIG. 4.

The method 1800 further includes generating a synthesized side signal based on the synthesized mid signal and the inter-channel prediction gain parameter, at 1806. For example, the synthesized side signal may include or correspond to the synthesized side signal 254 of FIG. 2 or the synthesized side signal 472 of FIG. 4.

In a particular implementation, the method 1800 further includes applying a fixed filter to the synthesized mid signal prior to generating the synthesized side signal. For example, the one or more filters 454 may include a fixed filter that is applied to the synthesized mid signal 470 prior to generation of the synthesized side signal 472, as described with reference to FIG. 4. In another particular implementation, the method 1800 further includes applying a fixed filter to the synthesized side signal. For example, the one or more filters 458 may include a fixed filter that is applied to the synthesized side signal 472, as described with reference to FIG. 4. In another particular implementation, the method 1800 includes applying an adaptive filter to the synthesized mid signal prior to generating the synthesized side signal. Adaptive filter coefficients associated with the adaptive filter may be received from the second device. For example, the one or more filters 454 may include an adaptive filter that is applied to the synthesized mid signal 470 based on the one or more coefficients 406 prior to generation of the synthesized side signal 472, as described with reference to FIG. 4. In another particular implementation, the method 1800 includes applying an adaptive filter to the synthesized side signal. Adaptive filter coefficients associated with the adaptive filter may be received from the second device. For example, the one or more filters 458 may include an adaptive filter that is applied to the synthesized side signal 472 based on the one or more coefficients 406, as described with reference to FIG. 4.

In another particular implementation, the method 1800 includes receiving a second inter-channel prediction gain parameter from the second device, processing the synthesized mid signal to generate a low-band synthesized mid signal, and processing the synthesized mid signal to generate a high-band synthesized mid signal. For example, the one or more filters 454 may process the synthesized mid signal 470 to generate the low-band synthesized mid signal 474 and the high-band synthesized mid signal 473. Generating the synthesized side signal includes generating a low-band synthesized side signal based on the low-band synthesized mid signal and the inter-channel prediction gain parameter, generating a high-band synthesized side signal based on the high-band synthesized mid signal and the second inter-channel prediction gain parameter, and processing the low-band synthesized side signal and the high-band synthesized side signal to generate the synthesized side signal. For example, the side synthesizer 456 may generate the low-band synthesized side signal 476 based on the low-band synthesized mid signal 474 and the ICP 408, and the side synthesizer 456 may generate the high-band synthesized side signal 475 based on the high-band synthesized mid signal 473 and a second ICP. The one or more filters 458 may process the low-band synthesized side signal 476 and the high-band synthesized side signal 475 to generate the synthesized side signal 472, as described with reference to FIG. 4.

Thus, the method 1800 enables prediction (e.g., mapping) of a synthesized side signal at a decoder using an encoded mid signal (or parameters indicative thereof) and an inter-channel prediction gain parameter. Receiving the inter-channel prediction gain parameter may conserve network resources as compared to receiving a frame of an encoded side signal from an encoder. Alternatively, one or more bits received that would otherwise be used to for sending the encoded side signal to the decoder may instead be repurposed (e.g., used) to send additional bits of an encoded mid signal to the decoder, which may improve the quality of a synthesized mid signal and the synthesized side signal at the decoder.

Figure 19:
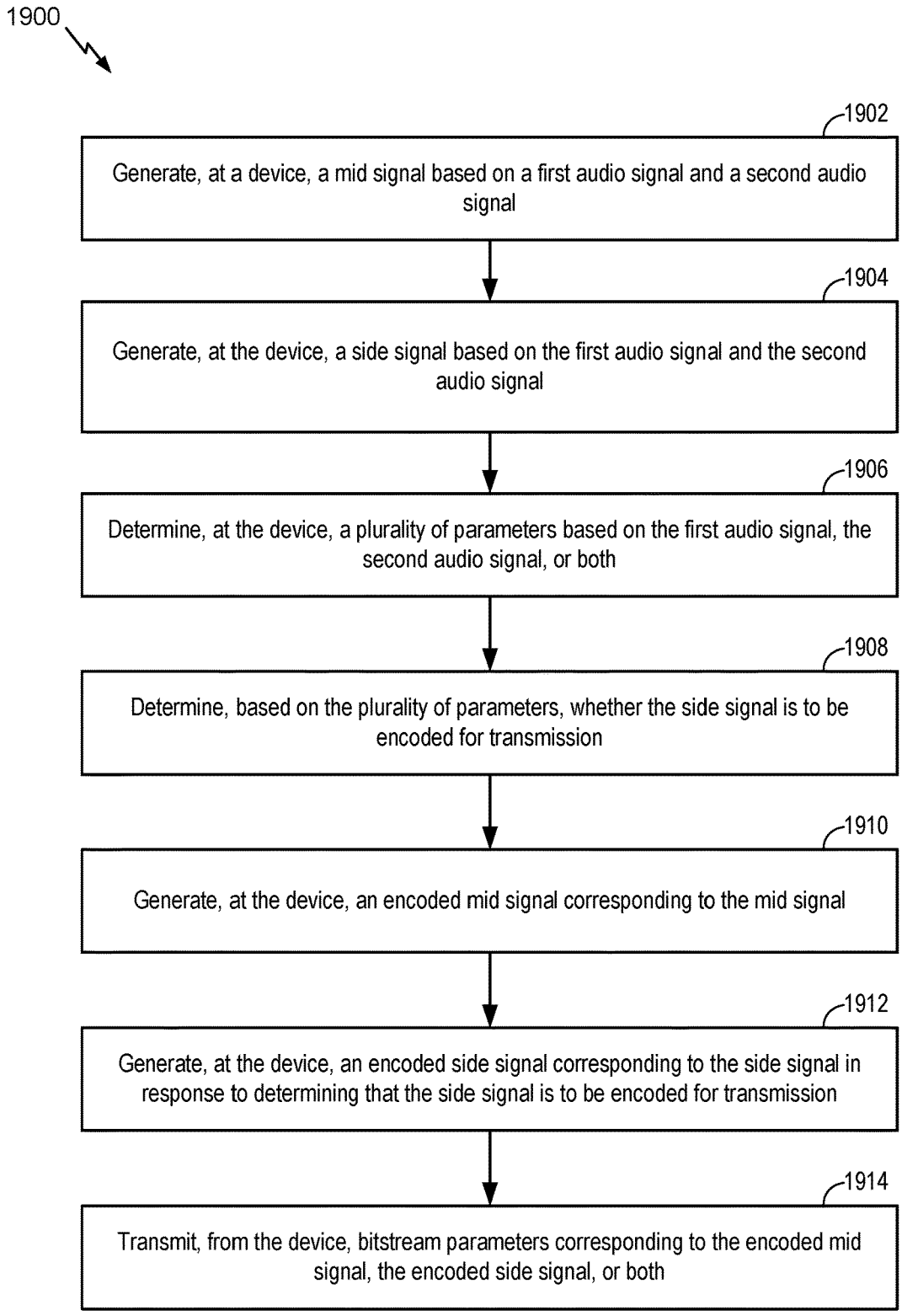
FIG. 19 is a flow chart illustrating a particular method of encoding audio signals.

Referring to FIG. 19, a method of operation is shown and generally designated 1900. The method 1900 may be performed by at least one of the midside generator 148, the inter-channel aligner 108, the signal generator 116, the transmitter 110, the encoder 114, the first device 104, the system 100 of FIG. 1, the signal generator 216, the transmitter 210, the encoder 214, the first device 204, or the system 200 of FIG. 2.

The method 1900 includes generating, at a device, a mid signal based on a first audio signal and a second audio signal, at 1902. For example, the midside generator 148 of FIG. 1 may generate the mid signal 111 based on the first audio signal 130 and the second audio signal 132, as described with reference to FIGS. 1 and 8.

The method 1900 also includes generating, at the device, a side signal based on the first audio signal and the second audio signal, at 1904. For example, the midside generator 148 of FIG. 1 may generate the side signal 113 based on the first audio signal 130 and the second audio signal 132, as described with reference to FIGS. 1 and 8.

The method 1900 further includes determining, at the device, a plurality of parameters based on the first audio signal, the second audio signal, or both, at 1906. For example, the inter-channel aligner 108 of FIG. 1 may determine the ICA parameters 107 based on the first audio signal 130, the second audio signal 132, or both, as described with reference to FIGS. 1 and 7.

The method 1900 also includes determining, based on the plurality of parameters, whether the side signal is to be encoded for transmission, at 1908. For example, the CP selector 122 of FIG. 1 may determine the CP parameter 109 based on the ICA parameters 107, as described with reference to FIGS. 1 and 9. The CP parameter 109 may indicate whether the side signal 113 is to be encoded for transmission.

The method 1900 further includes generating, at the device, an encoded mid signal corresponding to the mid signal, at 1910. For example, the signal generator 116 of FIG. 1 may generate the encoded mid signal 121 corresponding to the mid signal 111, as described with reference to FIG. 1.

The method 1900 also includes generating, at the device, an encoded side signal corresponding to the side signal in response to determining that the side signal is to be encoded for transmission, at 1912. For example, the signal generator 116 of FIG. 1 may generate the encoded side signal 123 in response to determining that the CP parameter 109 indicates that the side signal 113 is to be encoded for transmission.

The method 1900 further includes transmitting, from the device, bitstream parameters corresponding to the encoded mid signal, the encoded side signal, or both, at 1914. For example, the transmitter 110 of FIG. 1 may transmit the bitstream parameters 102 corresponding to the encoded mid signal 121, the encoded side signal 123, or both.

The method 1900 thus enables dynamically determining, based on the ICA parameters 107, whether the encoded side signal 123 is to be transmitted. The CP selector 122 may determine that the side signal 113 is not to be encoded for transmission when the ICA parameters 107 indicate that a predicted synthesized signal is likely to closely approximate the side signal 113. The encoder 114 may thus conserve network resources by refraining from transmitting the encoded side signal 123 when the predicted synthesized signal is likely to have little or no perceptible impact on corresponding output signals.

Figure 20:
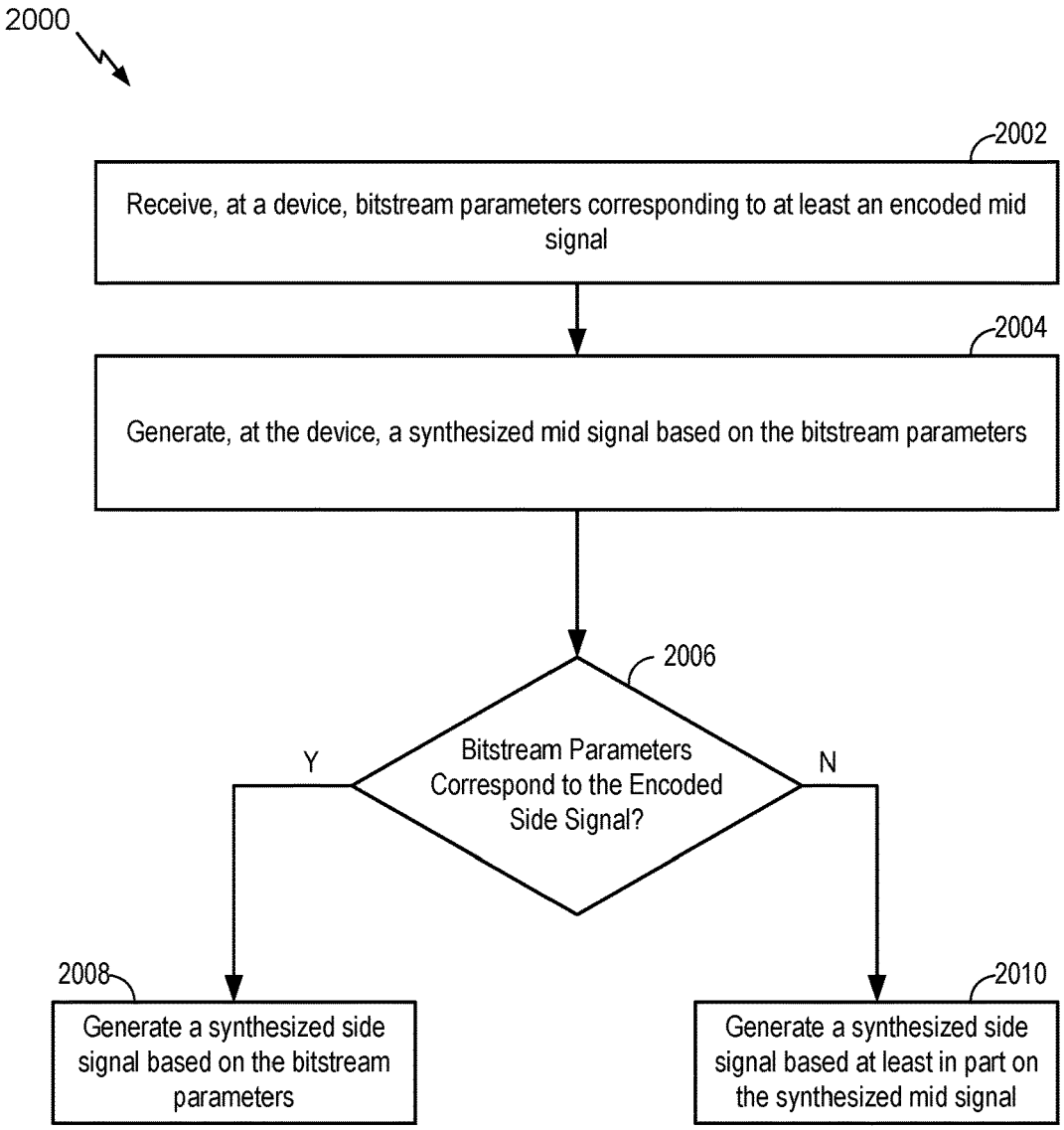
FIG. 20 is a flow chart illustrating a particular method of decoding audio signals.

Referring to FIG. 20, a method of operation is shown and generally designated 2000. The method 2000 may be performed by at least one of the receiver 160, the CP determiner 172, the upmix parameter generator 176, the signal generator 174, the decoder 118, the second device 106, the system 100 of FIG. 1, the signal generator 274, the decoder 218, or the second device 206 of FIG. 2.

The method 2000 includes receiving, at a device, bitstream parameters corresponding to at least an encoded mid signal, at 2002. For example, the receiver 160 of FIG. 1 may receive the bitstream parameters 102 corresponding to at least the encoded mid signal 121.

The method 2000 also includes generating, at the device, a synthesized mid signal based on the bitstream parameters, at 2004. For example, the signal generator 174 of FIG. 1 may generate the synthesized mid signal 171 based on the bitstream parameters 102, as described with reference to FIG. 1.

The method 2000 further includes determining, at the device, whether the bitstream parameters correspond to an encoded side signal, at 2006. For example, the CP determiner 172 of FIG. 1 may generate the CP parameter 179, as further described with reference to FIGS. 1 and 10. The CP parameter 179 may indicate whether the bitstream parameters 102 correspond to the encoded side signal 123.

The method 2000 includes, in response to determining that the bitstream parameters correspond to the encoded side signal, at 2006, generating a synthesized side signal based on the bitstream parameters, at 2008. For example, the signal generator 174 of FIG. 1 may, in response to determining that the bitstream parameters 102 correspond to the encoded side signal 123, generate the synthesized side signal 173 based on the bitstream parameters 102, as described with reference to FIG. 1.

The method 2000 includes, in response to determining that the bitstream parameters do not correspond to the encoded side signal, at 2006, generating a synthesized side signal based at least in part on the synthesized mid signal, at 2010. For example, the signal generator 174 of FIG. 1 may, in response to determining that the bitstream parameters 102 do not correspond to the encoded side signal 123, generate the synthesized side signal 173 based on at least in part on the synthesized mid signal 171, as described with reference to FIG. 1. The method 2000 thus enables the decoder 118 to dynamically predict the synthesized side signal 173 based on the synthesized mid signal 171 or decode the synthesized side signal 173 based on the bitstream parameters 102.

Figure 21:
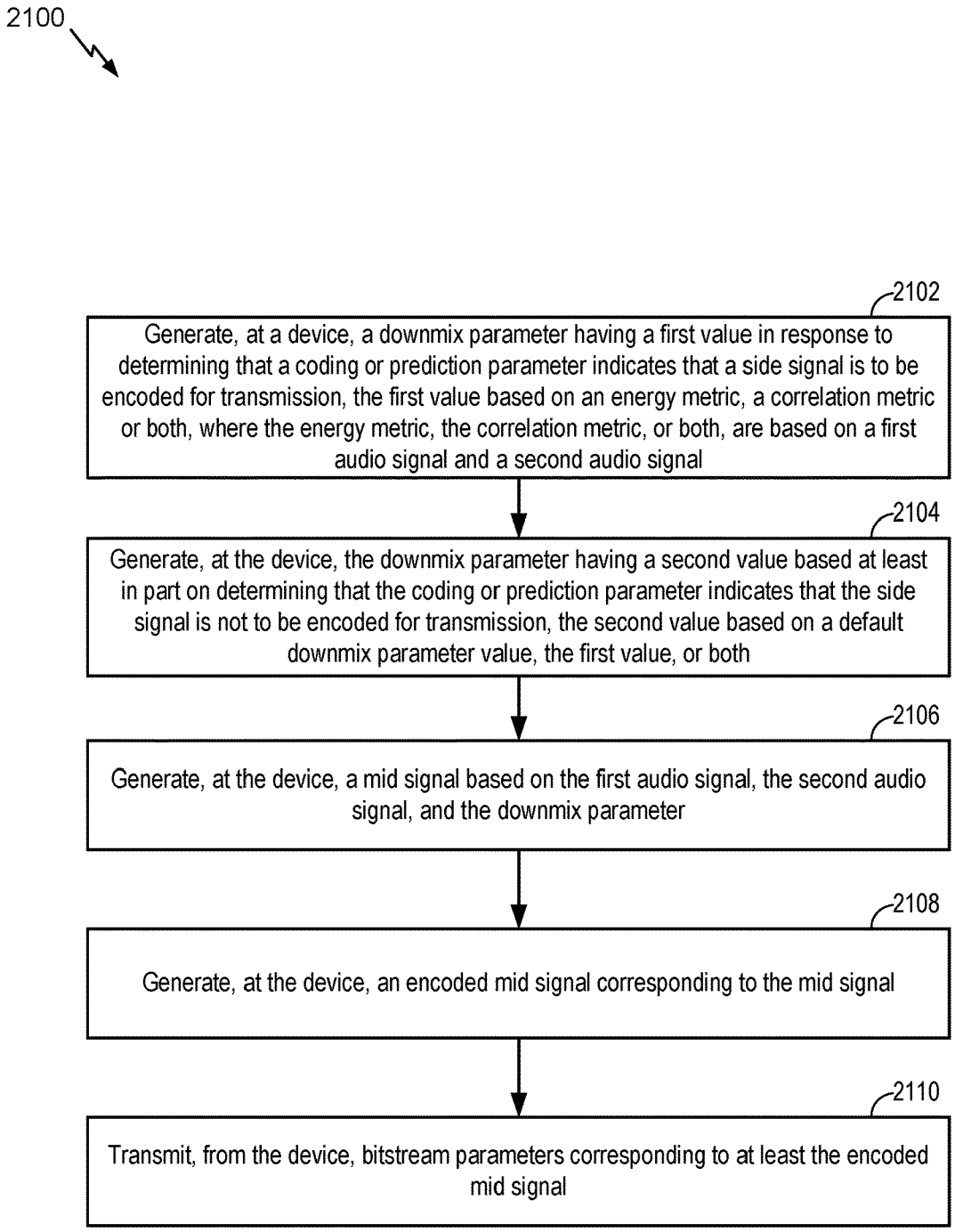
FIG. 21 is a flow chart illustrating a particular method of encoding audio signals.

Referring to FIG. 21, a method of operation is shown and generally designated 2100. The method 2100 may be performed by at least one of the midside generator 148, the inter-channel aligner 108, the signal generator 116, the transmitter 110, the encoder 114, the first device 104, the system 100 of FIG. 1, the signal generator 216, the transmitter 210, the encoder 214, the first device 204, or the system 200 of FIG. 2.

The method 2100 includes generating, at a device, a downmix parameter having a first value in response to determining that a prediction or coding parameter indicates that a side signal is to be encoded for transmission, at 2102. For example, the downmix parameter generator 802 of FIG. 8 may generate the downmix parameter 803 having the downmix parameter value 807 (e.g., the first value) in response to determining that the CP parameter 809 indicates that the side signal 113 is to be encoded for transmission, as described with reference to FIG. 8. The downmix parameter value 807 may be based on an energy metric, a correlation metric, or both. The energy metric, the correlation metric, or both, may be based on the reference signal 103 and the adjusted target signal 105.

The method 2100 also includes generating, at the device, the downmix parameter having a second value based at least in part on determining that the prediction or coding parameter indicates that the side signal is not to be encoded for transmission, at 2104. For example, the downmix parameter generator 802 of FIG. 8 may generate the downmix parameter 803 having the downmix parameter value 805 (e.g., the second value) in response to determining that the CP parameter 809 indicates that the side signal 113 is not to be encoded for transmission, as described with reference to FIG. 8. The downmix parameter value 805 may be based on a default downmix parameter value (e.g., 0.5), the downmix parameter value 807, or both, as described with reference to FIG. 8.

The method 2100 further includes generating, at the device, a mid signal based on the first audio signal, the second audio signal, and the downmix parameter, at 2106. For example, the midside generator 148 of FIG. 1 may generate the mid signal 111 based on the first audio signal 130, the second audio signal 132, and the downmix parameter 115, as described with reference to FIGS. 1 and 8.

The method 2100 also includes generating, at the device, an encoded mid signal corresponding to the mid signal, at 2108. For example, the signal generator 116 of FIG. 1 may generate the encoded mid signal 121 corresponding to the mid signal 111, as described with reference to FIG. 1.

The method 2100 further includes transmitting, from the device, bitstream parameters corresponding to at least the encoded mid signal, at 2110. For example, the transmitter 110 of FIG. 1 may transmit the bitstream parameters 102 correspond to at least the encoded mid signal 121.

The method 2100 thus enables dynamically setting the downmix parameter 115 to the downmix parameter value 805 or the downmix parameter value 807 based on whether the side signal 113 is to be encoded for transmission. The downmix parameter value 805 may reduce energy of the side signal 113. A predicted synthesized side signal may more closely approximate the side signal 113 with reduced energy.

Figure 22:
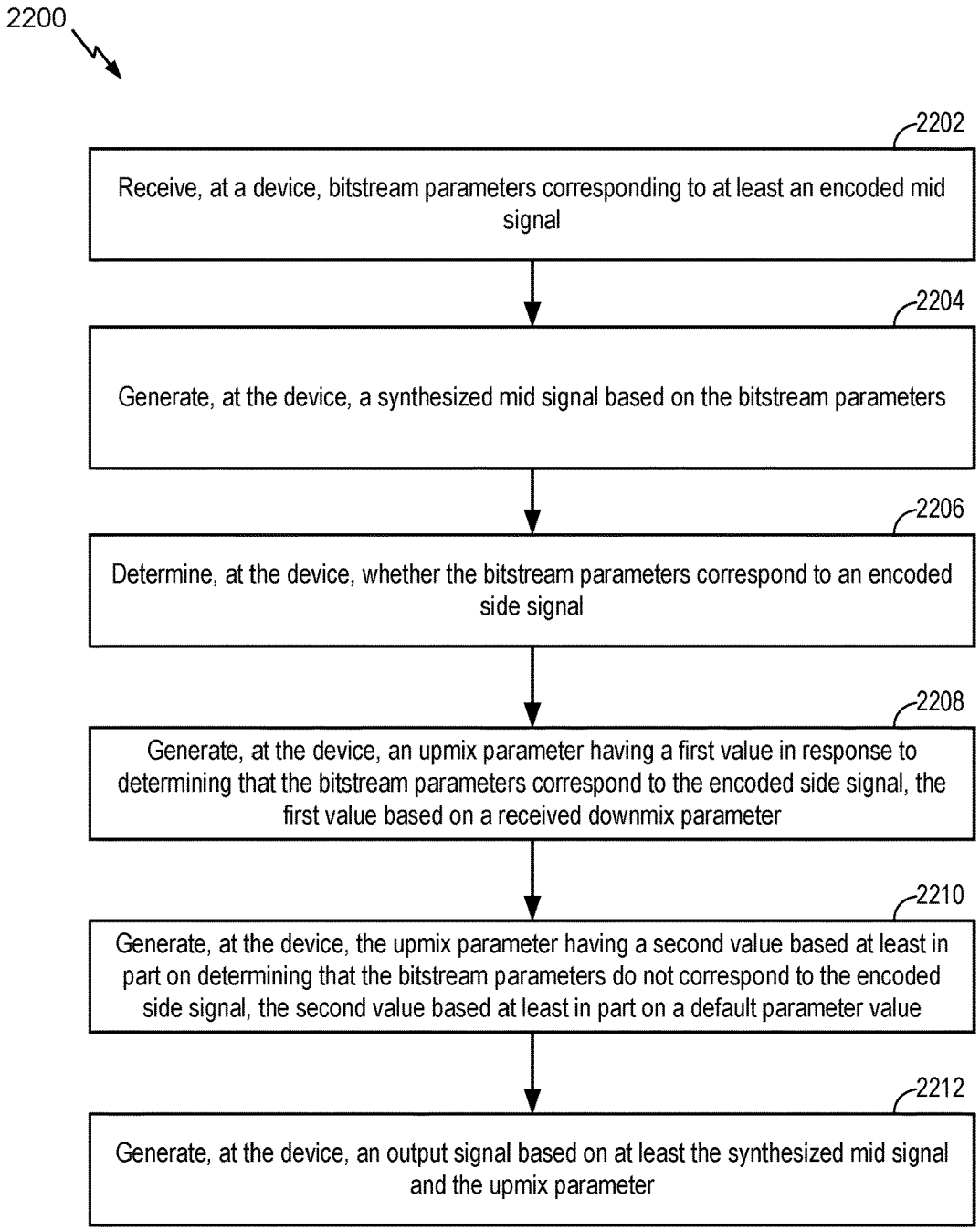
FIG. 22 is a flow chart illustrating a particular method of decoding audio signals.

Referring to FIG. 22, a method of operation is shown and generally designated 2200. The method 2200 may be performed by at least one of the receiver 160, the CP determiner 172, the upmix parameter generator 176, the signal generator 174, the decoder 118, the second device 106, the system 100 of FIG. 1, the signal generator 274, the decoder 218, or the second device 206 of FIG. 2.

The method 2200 includes receiving, at a device, bitstream parameters corresponding to at least an encoded mid signal, at 2202. For example, the receiver 160 of FIG. 1 may receive the bitstream parameters 102 corresponding to at least the encoded mid signal 121.

The method 2200 also includes generating, at the device, a synthesized mid signal based on the bitstream parameters, at 2204. For example, the signal generator 174 of FIG. 1 may generate the synthesized mid signal 171 based on the bitstream parameters 102, as described with reference to FIG. 1.

The method 2200 further includes determining, at the device, whether the bitstream parameters correspond to an encoded side signal, at 2206. For example, the CP determiner 172 of FIG. 1 may generate the CP parameter 179 indicating whether the bitstream parameters 102 correspond to the encoded side signal 123, as described with reference to FIGS. 1 and 10.

The method 2200 also includes generating, at the device, an upmix parameter having a first value in response to determining that the bitstream parameters correspond to the encoded side signal, at 2208. For example, the upmix parameter generator 176 may generate the upmix parameter 175 having the downmix parameter value 807 (e.g., the first value) in response to determining that the CP parameter 179 indicates that the bitstream parameters 102 correspond to the encoded side signal 123, as described with reference to FIGS. 1 and 11. The downmix parameter value 807 may be based on the downmix parameter 115 received from the first device 104, as described with reference to FIGS. 1 and 11.

The method 2200 further includes generating, at the device, the upmix parameter having a second value based at least in part on determining that the bitstream parameters do not correspond to the encoded side signal, at 2210. For example, the upmix parameter generator 176 may generate the upmix parameter 175 having the downmix parameter value 805 (e.g., the second value) based at least in part on determining that the CP parameter 179 indicates that the bitstream parameters 102 do not correspond to the encoded side signal 123, as described with reference to FIGS. 1 and 11. The downmix parameter value 805 may be based at least in part on a default parameter value (e.g., 0.5), as described with reference to FIGS. 8 and 11.

The method 2200 also includes generating, at the device, an output signal based on at least the synthesized mid signal and the upmix parameter, at 2212. For example, the signal generator 174 of FIG. 1 may generate the first output signal 126, the second output signal 128, or both, based on at least the synthesized mid signal 171 and the upmix parameter 175, as described with reference to FIG. 1.

The method 2200 thus enables the decoder 118 to determine the upmix parameter 175 based on the CP parameter 179. When the CP parameter 179 indicates that the bitstream parameters 102 do not correspond to the encoded side signal 123, the decoder 118 can determine the upmix parameter 175 independently of receiving the downmix parameter 115 from the encoder 114. Network resources (e.g., bandwidth) may be conserved when the downmix parameter 115 is not transmitted. In a particular implementation, the bits that would have been used to transmit the downmix parameter 115 may be repurposed to represent the bitstream parameters 102 or other parameters. Output signals based on the repurposed bits may have better audio quality, e.g., the output signals may more closely approximate the first audio signal 130, the second audio signal 132, or both.

Figure 23:
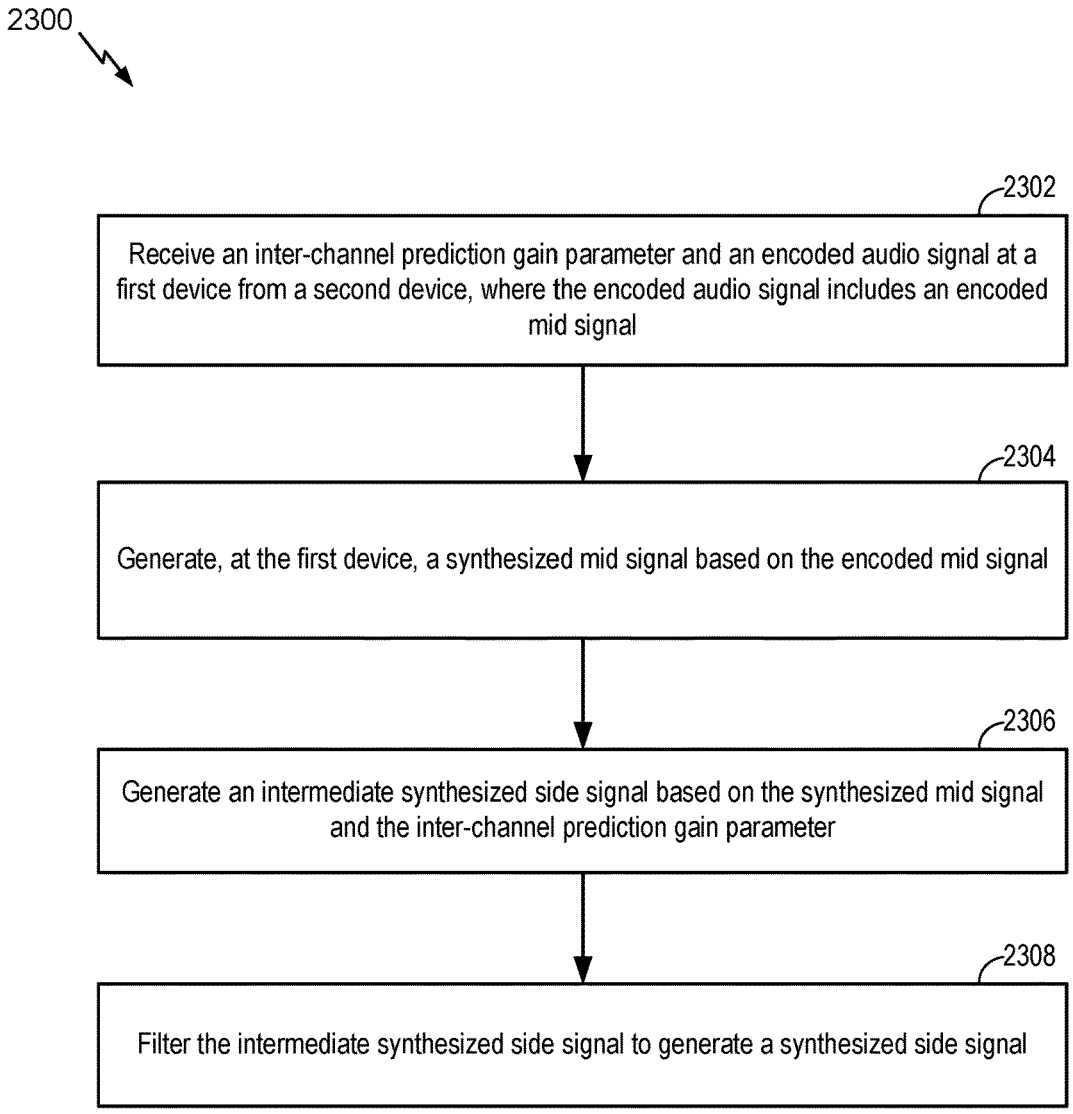
FIG. 23 is a flow chart illustrating a particular method of decoding audio signals.

FIG. 23 is a flow chart illustrating a particular method of decoding audio signals. In a particular implementation, the method 2300 may be performed at the second device 1306 of FIG. 13, the decoder 1418 of FIG. 14, the decoder 1518 of FIG. 15, or the decoder 1618 of FIG. 16.

The method 2300 may include receiving an inter-channel prediction gain parameter and an encoded audio signal at a first device from a second device, at 2302. For example, inter-channel prediction gain parameter may include or correspond to the ICP 1308 of FIG. 13, the ICP 1408 of FIG. 14, the ICP 1508 of FIG. 15, or the ICP 1608 of FIG. 16, the encoded audio signal may include or correspond to the one or more bitstream parameters 1302 of FIG. 13, the one or more bitstream parameters 1402 of FIG. 14, the one or more bitstream parameters 1502 of FIG. 15, or the one or more bitstream parameters 1602 of FIG. 16, the first device may include or correspond to the first device 1304 of FIG. 13, and the second device may include or correspond to the second device 1306 of FIG. 13, a device that includes the decoder 1418 of FIG. 14, a device that includes the decoder 1518 of FIG. 15, or a device that includes the decoder 1618 of FIG. 16. The encoded audio signal may include an encoded mid signal.

The method 2300 may include generating, at the first device, a synthesized mid signal based on the encoded mid signal, at 2304. For example, the synthesized mid signal may include or correspond to the synthesized mid signal 1352 of FIG. 13, the synthesized mid signal 1470 of FIG. 14, the synthesized mid signal 1570 of FIG. 15, or the synthesized mid signal 1676 of FIG. 16.

The method 2300 may include generating an intermediate synthesized side signal based on the synthesized mid signal and the inter-channel prediction gain parameter, at 2306. For example, the intermediate synthesized side signal may include or correspond to the intermediate synthesized side signal 1354 of FIG. 13, the intermediate synthesized side signal 1471 of FIG. 14, or the intermediate synthesized side signal 1571 of FIG. 15.

The method 2300 may further include filtering the intermediate synthesized side signal to generate a synthesized side signal, at 2308. For example, the synthesized side signal may include or correspond to the synthesized side signal 1355 of FIG. 13, the synthesized side signal 1472 of FIG. 14, the synthesized side signal 1572 of FIG. 15, or the synthesized side signal 1677 of FIG. 16.

In a particular implementation, the filtering may be performed by an all-pass filter, such as the filter 1375 of FIG. 13, the all-pass filter 1430 of FIG. 14, the all-pass filter 1530 of FIG. 15, or the all-pass filter 1630 of FIG. 16. The method 2300 may further include setting a value of at least one parameter of the all-pass filter based on the inter-channel prediction gain parameter. For example, values of one or more of the parameters associated with the all-pass filter 1430 may be set based on the ICP 1408, as described with reference to FIG. 14. The at least one parameter may include a delay parameter, a gain parameter, or both.

In a particular implementation, the all-pass filter includes multiple stages. For example, the all-pass filter may include multiple stages, as described with reference to FIGS. 14-16. The method 2300 may include receiving a coding mode parameter at the first device from the second device and enabling each of the multiple stages of the all-pass filter based on the coding mode parameter indicating a music coding mode. For example, each of the multiple stages may be enabled based on the coding mode parameter 1407 indicating a music coding mode, as described with reference to FIG. 14. The method 2300 may further include disabling at least one stage of the all-pass filter based on the coding mode parameter indicating a speech coding mode. For example, one or more of the multiple stages may be disabled based on the coding mode parameter 1407 indicating a speech coding mode, as described with reference to FIG. 14.

In another particular implementation, the method 2300 may include receiving a second inter-channel prediction gain parameter at the first device from the second device and processing the synthesized mid signal to generate a low-band synthesized mid signal and a high-band synthesized mid signal. For example, the second ICP 1609 and the ICP 1608 may be received at the decoder 1618, and a synthesized mid signal may be processed to generate the low-band synthesized mid signal 1670 and the high-band synthesized mid signal 1671, as described with reference to FIG. 16. Generating the intermediate synthesized side signal may include generating a low-band intermediate synthesized side signal based on the low-band synthesized mid signal and the inter-channel prediction gain parameter and generating a high-band intermediate synthesized side signal based on the high-band synthesized mid signal and the second inter-channel prediction gain parameter. For example, the low-band intermediate synthesized side signal 1672 may be generated based on the low-band synthesized mid signal 1670 and the ICP 1608, and the high-band intermediate synthesized side signal 1673 may be generated based on the high-band synthesized mid signal 1671 and the second ICP 1609. The method 2300 may include filtering the low-band intermediate synthesized side signal using the all-pass filter to generate a first synthesized side signal and adjusting at least one parameter of at least one of the multiple stages of the all-pass filter. For example, one or more of the parameters of the all-pass filter 1630 may be adjusted after generating the low-band synthesized side signal 1674, as described with reference to FIG. 16. The method 2300 may further include filtering the high-band intermediate synthesized side signal using the all-pass filter to generate a second synthesized side signal and combining the first synthesized side signal and the second synthesized side signal to generate the synthesized side signal. For example, the high-band synthesized side signal 1675 may be generated by filtering the high-band intermediate synthesized side signal 1673 using the adjusted parameter values, as described with reference to FIG. 16.

In another particular implementation, filtering the intermediate synthesized side signal using the all-pass filter generates a filtered intermediate synthesized side signal. In this implementation, the method 2300 includes receiving a correlation parameter at the first device from the second device and mixing, based on the correlation parameter, the intermediate synthesized side signal with the filtered intermediate synthesized side signal to generate the synthesized side signal. For example, the intermediate synthesized side signal 1571 and the filtered synthesized side signal 1573 may be mixed at the side signal mixer 1590 based on the correlation parameter 1509, as described with reference to FIG. 15. An amount of the filtered intermediate synthesized side signal that is mixed with the intermediate synthesized side signal may be increased based on a decrease in the correlation parameter, as described with reference to FIG. 15.

The method 2300 of FIG. 23 enables prediction (e.g., mapping) of a synthesized side signal from a synthesized mid signal using inter-channel prediction gain parameters at a decoder. Additionally, the method 2300 reduces correlation (e.g., increases decorrelation) between the synthesized mid signal and the synthesized side signal, which may increase spatial difference between the first audio signal and the second audio signal, which may improve a listening experience.

Figure 24:
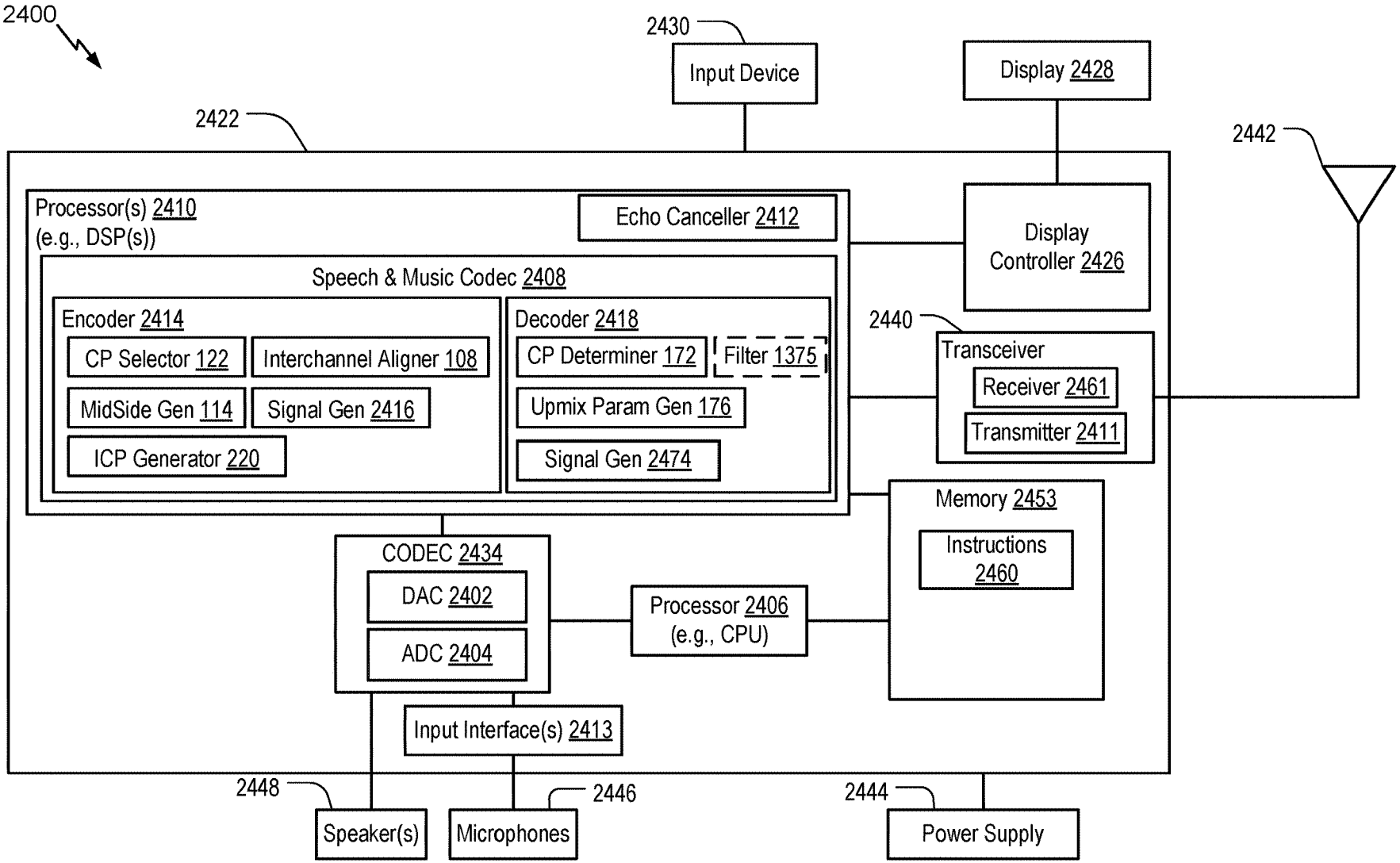
FIG. 24 is a block diagram of a particular illustrative example of a device that is operable to encode or decode audio signals.

Referring to FIG. 24, a block diagram of a particular illustrative example of a device (e.g., a wireless communication device) is depicted and generally designated 2400. In various aspects, the device 2400 may have fewer or more components than illustrated in FIG. 24. In an illustrative aspect, the device 2400 may correspond to the first device 104, the second device 106 of FIG. 1, the first device 204, the second device 206 of FIG. 2, the first device 1304, the second device 1306 of FIG. 13, or a combination thereof. In an illustrative aspect, the device 2400 may perform one or more operations described with reference to systems and methods of FIGS. 1-23.

In a particular aspect, the device 2400 includes a processor 2406 (e.g., a central processing unit (CPU)). The device 2400 may include one or more additional processors 2410 (e.g., one or more digital signal processors (DSPs)). The processors 2410 may include a media (e.g., speech and music) coder-decoder (CODEC) 2408, and an echo canceller 2412. The media CODEC 2408 may include a decoder 2418, an encoder 2414, or both. The encoder 2414 may include at least one of the encoder 114 of FIG. 1, the encoder 214 of FIG. 2, the encoder 314 of FIG. 3, or the encoder 1314 of FIG. 13. The decoder 2418 may include at least one of the decoder 118 of FIG. 1, the decoder 218 of FIG. 2, the decoder 418 of FIG. 4, the decoder 1318 of FIG. 13, the decoder 1418 of FIG. 14, the decoder 1518 of FIG. 15, or the decoder 1618 of FIG. 16.

The encoder 2414 may include at least one of the interchannel aligner 108, the CP selector 122, the midside generator 148, a signal generator 2416, or the ICP generator 220. The signal generator 2416 may include at least one of the signal generator 116 of FIG. 1, the signal generator 216 of FIG. 2, the signal generator 316 of FIG. 3, the signal generator 450 of FIG. 4, or the signal generator 1316 of FIG. 13.

The decoder 2418 may include at least one of the CP determiner 172, the upmix parameter generator 176, the filter 1375, or a signal generator 2474. The signal generator 2474 may include at least one of the signal generator 174 of FIG. 1, the signal generator 274 of FIG. 2, the signal generator 450 of FIG. 4, the signal generator 1374 of FIG. 13, the signal generator 1450 of FIG. 14, the signal generator 1550 of FIG. 15, or the signal generator 1650 of FIG. 16.

The device 2400 may include a memory 2453 and a CODEC 2434. Although the media CODEC 2408 is illustrated as a component of the processors 2410 (e.g., dedicated circuitry and/or executable programming code), in other aspects one or more components of the media CODEC 2408, such as the decoder 2418, the encoder 2414, or both, may be included in the processor 2406, the CODEC 2434, another processing component, or a combination thereof.

The device 2400 may include a transceiver 2440 coupled to an antenna 2442. The transceiver 2440 may include a receiver 2461, a transmitter 2411, or both. The receiver 2461 may include at least one of the receiver 160 of FIG. 1, the receiver 260 of FIG. 2, or the receiver 1360 of FIG. 13. The transmitter 2411 may include at least one of the transmitter 110 of FIG. 1, the transmitter 210 of FIG. 2, or the transmitter 1310 of FIG. 13.

The device 2400 may include a display 2428 coupled to a display controller 2426. One or more speakers 2448 may be coupled to the CODEC 2434. One or more microphones 2446 may be coupled, via one or more input interface(s) 2413, to the CODEC 2434. The input interface(s) 2413 may include the input interface(s) 112 of FIG. 1, the input interface(s) 212 of FIG. 2, or the input interface(s) 1312 of FIG. 13.

In a particular aspect, the speakers 2448 may include at least one of the first loudspeaker 142, the second loudspeaker 144 of FIG. 1, the first loudspeaker 242, or the second loudspeaker 244 of FIG. 2. In a particular aspect, the microphones 2446 may include at least one of the first microphone 146, the second microphone 147 of FIG. 1, the first microphone 246, or the second microphone 248 of FIG. 2. The CODEC 2434 may include a digital-to-analog converter (DAC) 2402 and an analog-to-digital converter (ADC) 2404.

The memory 2453 may include instructions 2460 executable by the processor 2406, the processors 2410, the CODEC 2434, another processing unit of the device 2400, or a combination thereof, to perform one or more operations described with reference to FIGS. 1-23. The memory 2453 may store one or more signals, one or more parameters, one or more thresholds, one or more indicators, or a combination thereof, described with reference to FIGS. 1-23.

One or more components of the device 2400 may be implemented via dedicated hardware (e.g., circuitry), by a processor executing instructions to perform one or more tasks, or a combination thereof. As an example, the memory 2453 or one or more components of the processor 2406, the processors 2410, and/or the CODEC 2434 may be a memory device (e.g., a computer-readable storage device), such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include (e.g., store) instructions (e.g., the instructions 2460) that, when executed by a computer (e.g., a processor in the CODEC 2434, the processor 2406, and/or the processors 2410), may cause the computer to perform one or more operations described with reference to FIGS. 1-23. As an example, the memory 2453 or the one or more components of the processor 2406, the processors 2410, and/or the CODEC 2434 may be a non-transitory computer-readable medium that includes instructions (e.g., the instructions 2460) that, when executed by a computer (e.g., a processor in the CODEC 2434, the processor 2406, and/or the processors 2410), cause the computer perform one or more operations described with reference to FIGS. 1-23.

In a particular aspect, the device 2400 may be included in a system-in-package or system-on-chip device (e.g., a mobile station modem (MSM)) 2422. In a particular aspect, the processor 2406, the processors 2410, the display controller 2426, the memory 2453, the CODEC 2434, and the transceiver 2440 are included in a system-in-package or the system-on-chip device 2422. In a particular aspect, an input device 2430, such as a touchscreen and/or keypad, and a power supply 2444 are coupled to the system-on-chip device 2422. Moreover, in a particular aspect, as illustrated in FIG. 24, the display 2428, the input device 2430, the speakers 2448, the microphones 2446, the antenna 2442, and the power supply 2444 are external to the system-on-chip device 2422. However, each of the display 2428, the input device 2430, the speakers 2448, the microphones 2446, the antenna 2442, and the power supply 2444 can be coupled to a component of the system-on-chip device 2422, such as an interface or a controller.

The device 2400 may include a wireless telephone, a mobile communication device, a mobile device, a mobile phone, a smart phone, a cellular phone, a laptop computer, a desktop computer, a computer, a tablet computer, a set top box, a personal digital assistant (PDA), a display device, a television, a gaming console, a music player, a radio, a video player, an entertainment unit, a communication device, a fixed location data unit, a personal media player, a digital video player, a digital video disc (DVD) player, a tuner, a camera, a navigation device, a decoder system, an encoder system, or any combination thereof.

In a particular aspect, one or more components of the systems described with reference to FIGS. 1-23 and the device 2400 may be integrated into a decoding system or apparatus (e.g., an electronic device, a CODEC, or a processor therein), into an encoding system or apparatus, or both. In other aspects, one or more components of the systems described with reference to FIGS. 1-23 and the device 2400 may be integrated into a mobile device, a wireless telephone, a tablet computer, a desktop computer, a laptop computer, a set top box, a music player, a video player, an entertainment unit, a television, a game console, a navigation device, a communication device, a personal digital assistant (PDA), a fixed location data unit, a personal media player, or another type of device.

It should be noted that various functions performed by the one or more components of the systems described with reference to FIGS. 1-23 and the device 2400 are described as being performed by certain components or modules. This division of components and modules is for illustration only. In an alternate aspect, a function performed by a particular component or module may be divided amongst multiple components or modules. Moreover, in an alternate aspect, two or more components or modules described with reference to FIGS. 1-23 may be integrated into a single component or module. Each component or module described with reference to FIGS. 1-23 may be implemented using hardware (e.g., a field-programmable gate array (FPGA) device, an application-specific integrated circuit (ASIC), a DSP, a controller, etc.), software (e.g., instructions executable by a processor), or any combination thereof.

In conjunction with the described aspects, an apparatus includes means for generating a mid signal based on a first audio signal and a second audio signal and a side signal based on the first audio signal and the second audio signal. For example, the means for generating the mid signal and the side signal may include the signal generator 116, the encoder 114, or the first device 104 of FIG. 1, the signal generator 216, the encoder 214, or the first device 204 of FIG. 2, the signal generator 316 or the encoder 314 of FIG. 3, the signal generator 2416, the encoder 2414, or the processor 2410 of FIG. 24, one or more structures, devices, or circuits configured to generate a mid signal based on a first audio signal and a second audio signal and a side signal based on the first audio signal and the second audio signal, or a combination thereof.

The apparatus includes means for generating an inter-channel prediction gain parameter based on the mid signal and the side signal. For example, the means for generating the inter-channel prediction gain parameter may include the ICP generator 220, the encoder 214, or the first device 204 of FIG. 2, the ICP generator 320 or the encoder 314 of FIG. 3, the ICP generator 220, the encoder 2414, or the processor 2410 of FIG. 24, one or more structures, devices, or circuits configured to generate the inter-channel prediction gain parameter based on the mid signal and the side signal, or a combination thereof.

The apparatus further includes means for sending the inter-channel prediction gain parameter and an encoded audio signal to a second device. For example, the means for generating the mid signal and the side signal may include the transmitter 110 or the first device 104 of FIG. 1, the transmitter 210 or the first device 204 of FIG. 2, the transmitter 2410, the transceiver 2440, or the antenna 2442 of FIG. 24, one or more structures, devices, or circuits configured to send the inter-channel prediction gain parameter and the encoded audio signal to the second device, or a combination thereof.

In conjunction with the described aspects, an apparatus includes means for receiving an inter-channel prediction gain parameter and an encoded audio signal at a first device from a second device. For example, the means for receiving may include the receiver 160 or the second device 106 of FIG. 1, the receiver 260 or the second device 206 of FIG. 2, the receiver 2461, the transceiver 2440, or the antenna 2442 of FIG. 24, one or more structures, devices, or circuits configured to send the inter-channel prediction gain parameter and the encoded audio signal to the second device, or a combination thereof. The encoded audio signal includes an encoded mid signal.

The apparatus includes means for generating a synthesized mid signal based on the encoded mid signal. For example, the means for generating the synthesized mid signal may include the signal generator 174, the decoder 118, or the second device 106 of FIG. 1, the signal generator 274, the decoder 218, or the second device 206 of FIG. 2, the signal generator 450, the mid synthesizer 452, or the decoder 418 of FIG. 4, the signal generator 2474, the decoder 2418, or the processor 2410 of FIG. 24, one or more structures, devices, or circuits configured to generate the synthesized mid signal based on the encoded mid signal, or a combination thereof.

The apparatus further includes means for generating a synthesized side signal based on the synthesized mid signal and the inter-channel prediction gain parameter. For example, the means for generating the synthesized side signal may include the signal generator 174, the decoder 118, or the second device 106 of FIG. 1, the signal generator 274, the decoder 218, or the second device 206 of FIG. 2, the signal generator 450, the side synthesizer 456, or the decoder 418 of FIG. 4, the signal generator 2474, the decoder 2418, or the processor 2410 of FIG. 24, one or more structures, devices, or circuits configured to generate the synthesized mid signal based on the encoded mid signal, or a combination thereof.

In conjunction with the described aspects, an apparatus includes means for generating a plurality of parameters based on a first audio signal, a second audio signal, or both. For example, the means for generating the plurality of parameters may include the inter-channel aligner 108, the midside generator 148, the encoder 114, the first device 104, the system 100 of FIG. 1, the GICP generator 612 of FIG. 6, the downmix parameter generator 802, the parameter generator 806 of FIG. 8, the encoder 2414, the media CODEC 2408, the processors 2410, the device 2400, one or more devices configured to generate the plurality of parameters (e.g., a processor executing instructions that are stored at a computer-readable storage device), or a combination thereof.

The apparatus also includes means for determining whether a side signal is to be encoded for transmission. For example, the means for determining whether a side signal is to be encoded for transmission may include the CP selector 122, the encoder 114, the first device 104, the system 100 of FIG. 1, the encoder 2414, the media CODEC 2408, the processors 2410, the device 2400, one or more devices configured to determine whether the side signal is to be encoded for transmission (e.g., a processor executing instructions that are stored at a computer-readable storage device), or a combination thereof. The determination may be based on the plurality of parameters (e.g., the ICA parameters 107, the downmix parameter 515, the GICP 601, the other parameters 810, or a combination thereof).

The apparatus further includes means for generating a mid signal and the side signal based on the first audio signal and the second audio signal. For example, the means for generating the mid signal and the side signal may include midside generator 148, the encoder 114, the first device 104, the system 100 of FIG. 1, the encoder 2414, the media CODEC 2408, the processors 2410, the device 2400, one or more devices configured to generate the mid signal and the side signal (e.g., a processor executing instructions that are stored at a computer-readable storage device), or a combination thereof.

The apparatus also includes means for generating at least one encoded signal. For example, the means for generating at least one encoded signal may include the signal generator 116, the encoder 114, the first device 104, the system 100 of FIG. 1, the encoder 2414, the media CODEC 2408, the processors 2410, the device 2400, one or more devices configured to generate at least one encoded signal (e.g., a processor executing instructions that are stored at a computer-readable storage device), or a combination thereof. The at least one encoded signal may include the encoded mid signal 121 corresponding to the mid signal 111. The at least one encoded signal may include, in response to a determination that the side signal 113 is to be encoded for transmission, the encoded side signal 123 corresponding to the side signal 113.

The apparatus further includes means for transmitting bitstream parameters corresponding to the at least one encoded signal. For example, the means for transmitting may include the transmitter 110, the first device 104, the system 100 of FIG. 1, the transmitter 2411, the transceiver 2440, the antenna 2442, the device 2400, one or more devices configured to transmit bitstream parameters (e.g., a processor executing instructions that are stored at a computer-readable storage device), or a combination thereof.

Also in conjunction with the described aspects, an apparatus includes means for receiving bitstream parameters corresponding to at least an encoded mid signal. For example, the means for receiving the bitstream parameters may include the receiver 160, the second device 106, the system 100 of FIG. 1, the receiver 2461, the transceiver 2440, the antenna 2442, the device 2400, one or more devices configured to receive the bitstream parameters (e.g., a processor executing instructions that are stored at a computer-readable storage device), or a combination thereof.

The apparatus also includes means for determining whether the bitstream parameters correspond to an encoded side signal. For example, the means for determining whether the bitstream parameters correspond to an encoded side signal may include the CP determiner 172, the decoder 118, the second device 106, the system 100 of FIG. 1, the decoder 2418, the media CODEC 2408, the processors 2410, the device 2400, one or more devices configured to determine whether the bitstream parameters correspond to an encoded side signal (e.g., a processor executing instructions that are stored at a computer-readable storage device), or a combination thereof.

The apparatus further includes means for generating a synthesized mid signal and a synthesized side signal. For example, the means for generating the synthesized mid signal and the synthesized side signal may include the signal generator 174 of FIG. 1, the decoder 118, the second device 106, the system 100 of FIG. 1, the decoder 2418, the media CODEC 2408, the processors 2410, the device 2400, one or more devices configured to generate the synthesized mid signal and the synthesized side signal (e.g., a processor executing instructions that are stored at a computer-readable storage device), or a combination thereof. The synthesized mid signal 171 may be based on the bitstream parameters 102. In a particular aspect, the synthesized side signal 173 is selectively based on the bitstream parameters 102 in response to a determination whether that the bitstream parameters 102 correspond to the encoded side signal 123. For example, the synthesized side signal 173 is based on the bitstream parameters 102 in response to a determination that the bitstream parameters 102 correspond to the encoded side signal 123. The synthesized side signal 173 is based at least in part on the synthesized mid signal 171 in response to a determination that the bitstream parameters 102 do not correspond to the encoded side signal 123.

Further in conjunction with the described aspects, an apparatus includes means for generating a downmix parameter and a mid signal. For example, the means for generating the downmix parameter and the mid signal may include the midside generator 148, the encoder 114, the first device 104, the system 100 of FIG. 1, the downmix parameter generator 802, the parameter generator 806 of FIG. 8, the encoder 2414, the media CODEC 2408, the processors 2410, the device 2400, one or more devices configured to generate the downmix parameter and the mid signal (e.g., a processor executing instructions that are stored at a computer-readable storage device), or a combination thereof. The downmix parameter 115 may have the downmix parameter value 807 (e.g., the first value) in response to a determination that the CP parameter 109 indicates that the side signal 113 is to be encoded for transmission. The downmix parameter 115 may have the downmix parameter value 805 (e.g., the second value) based at least in part on determining that the CP parameter 109 indicates that the side signal 113 is not to be encoded for transmission. The downmix parameter value 807 may be based on an energy metric, a correlation metric, or both. The energy metric, the correlation metric, or both, may be based on the first audio signal 130 and the second audio signal 132. The downmix parameter value 805 may be based on a default downmix parameter value (e.g., 0.5), the downmix parameter value 807, or both. The mid signal 111 may be based on the first audio signal 130, the second audio signal 132, and the downmix parameter 115.

The apparatus also includes means for generating an encoded mid signal corresponding to the mid signal. For example, the means for generating an encoded mid signal may include the signal generator 116, the encoder 114, the first device 104, the system 100 of FIG. 1, the encoder 2414, the media CODEC 2408, the processors 2410, the device 2400, one or more devices configured to generate the encoded mid signal (e.g., a processor executing instructions that are stored at a computer-readable storage device), or a combination thereof.

The apparatus further includes means for transmitting bitstream parameters corresponding to at least the encoded mid signal. For example, the means for transmitting may include the transmitter 110, the first device 104, the system 100 of FIG. 1, the transmitter 2411, the transceiver 2440, the antenna 2442, the device 2400, one or more devices configured to transmit bitstream parameters (e.g., a processor executing instructions that are stored at a computer-readable storage device), or a combination thereof.

Also in conjunction with the described aspects, an apparatus includes means for receiving bitstream parameters corresponding to at least an encoded mid signal. For example, the means for receiving the bitstream parameters may include the receiver 160, the second device 106, the system 100 of FIG. 1, the receiver 2461, the transceiver 2440, the antenna 2442, the device 2400, one or more devices configured to receive the bitstream parameters (e.g., a processor executing instructions that are stored at a computer-readable storage device), or a combination thereof.

The apparatus further includes means for generating one or more upmix parameters. For example, the means for generating the one or more upmix parameters may include the upmix parameter generator 176, the decoder 118, the second device 106, the system 100 of FIG. 1, the decoder 2418, the media CODEC 2408, the processors 2410, the device 2400, one or more devices configured to generate the upmix parameter (e.g., a processor executing instructions that are stored at a computer-readable storage device), or a combination thereof. The one or more upmix parameters may include the upmix parameter 175. The upmix parameter 175 may have the downmix parameter value 807 (e.g., a first value) or the downmix parameter value 805 (e.g., a second value) based on a determination of whether the bitstream parameters 102 correspond to the encoded side signal 123. For example, the upmix parameter 175 may have the downmix parameter value 807 (e.g., a first value) in response to a determination that the bitstream parameters 102 correspond to the encoded side signal 123. The downmix parameter value 807 may be based on the downmix parameter 115. The receiver 160 may receive the downmix parameter value 807. The upmix parameter 175 may have the downmix parameter value 805 (e.g., a second value) based at least in part on determining that the bitstream parameters 102 do not correspond to the encoded side signal 123. The downmix parameter value 805 may be based on at least in part on a default parameter value (e.g., 0.5).

The apparatus also includes means for generating a synthesized mid signal based on the bitstream parameters. For example, the means for generating the synthesized mid signal may include the signal generator 174 of FIG. 1, the decoder 118, the second device 106, the system 100 of FIG. 1, the decoder 2418, the media CODEC 2408, the processors 2410, the device 2400, one or more devices configured to generate the synthesized mid signal (e.g., a processor executing instructions that are stored at a computer-readable storage device), or a combination thereof.

The apparatus further includes means for generating an output signal based on at least the synthesized mid signal and the one or more upmix parameters. For example, the means for generating the output signal may include the signal generator 174 of FIG. 1, the decoder 118, the second device 106, the system 100 of FIG. 1, the decoder 2418, the media CODEC 2408, the processors 2410, the device 2400, one or more devices configured to generate the output signal (e.g., a processor executing instructions that are stored at a computer-readable storage device), or a combination thereof.

In conjunction with the described aspects, an apparatus includes means for receiving an inter-channel prediction gain parameter and an encoded audio signal at a first device from a second device. For example, the means for receiving may include the receiver 1360 or the second device 1306 of FIG. 13, the receiver 2461, the transceiver 2440, or the antenna 2442 of FIG. 24, one or more structures, devices, or circuits configured to send the inter-channel prediction gain parameter and the encoded audio signal to the second device, or a combination thereof. The encoded audio signal includes an encoded mid signal.

The apparatus includes means for generating a synthesized mid signal based on the encoded mid signal. For example, the means for generating the synthesized mid signal may include the signal generator 1374, the decoder 1318, or the second device 1306 of FIG. 13, the signal generator 1450, the mid synthesizer 1452, or the decoder 1418 of FIG. 14, the signal generator 1550, the mid synthesizer 1552, or the decoder 1518 of FIG. 15, the signal generator 1650, the mid synthesizer 1652, or the decoder 1618 of FIG. 16, the signal generator 2474, the decoder 2418, or the processor 2410 of FIG. 24, one or more structures, devices, or circuits configured to generate the synthesized mid signal based on the encoded mid signal, or a combination thereof.

The apparatus includes means for generating an intermediate synthesized side signal based on the synthesized mid signal and the inter-channel prediction gain parameter. For example, the means for generating the intermediate synthesized side signal may include the signal generator 1374, the decoder 1318, or the second device 1306 of FIG. 13, the signal generator 1450, the side synthesizer 1456, or the decoder 1418 of FIG. 4, the signal generator 1550, the side synthesizer 1556, or the decoder 1518 of FIG. 15, the signal generator 1650, the side synthesizer 1656, or the decoder 1618 of FIG. 16, the signal generator 2474, the decoder 2418, or the processor 2410 of FIG. 24, one or more structures, devices, or circuits configured to generate the intermediate synthesized mid signal based on the encoded mid signal, or a combination thereof.

The apparatus further includes means for filtering the intermediate synthesized side signal to generate a synthesized side signal. For example, the means for filtering may include filter 1375 of FIG. 13, the all-pass filter 1430 of FIG. 14, the all-pass filter 1530 of FIG. 15, the all-pass filter 1630 of FIG. 16, the filter 1375 of FIG. 24, one or more structures, devices, or circuits configured to filter the intermediate synthesized side signal to generate the synthesized side signal, or a combination thereof.

Figure 25:
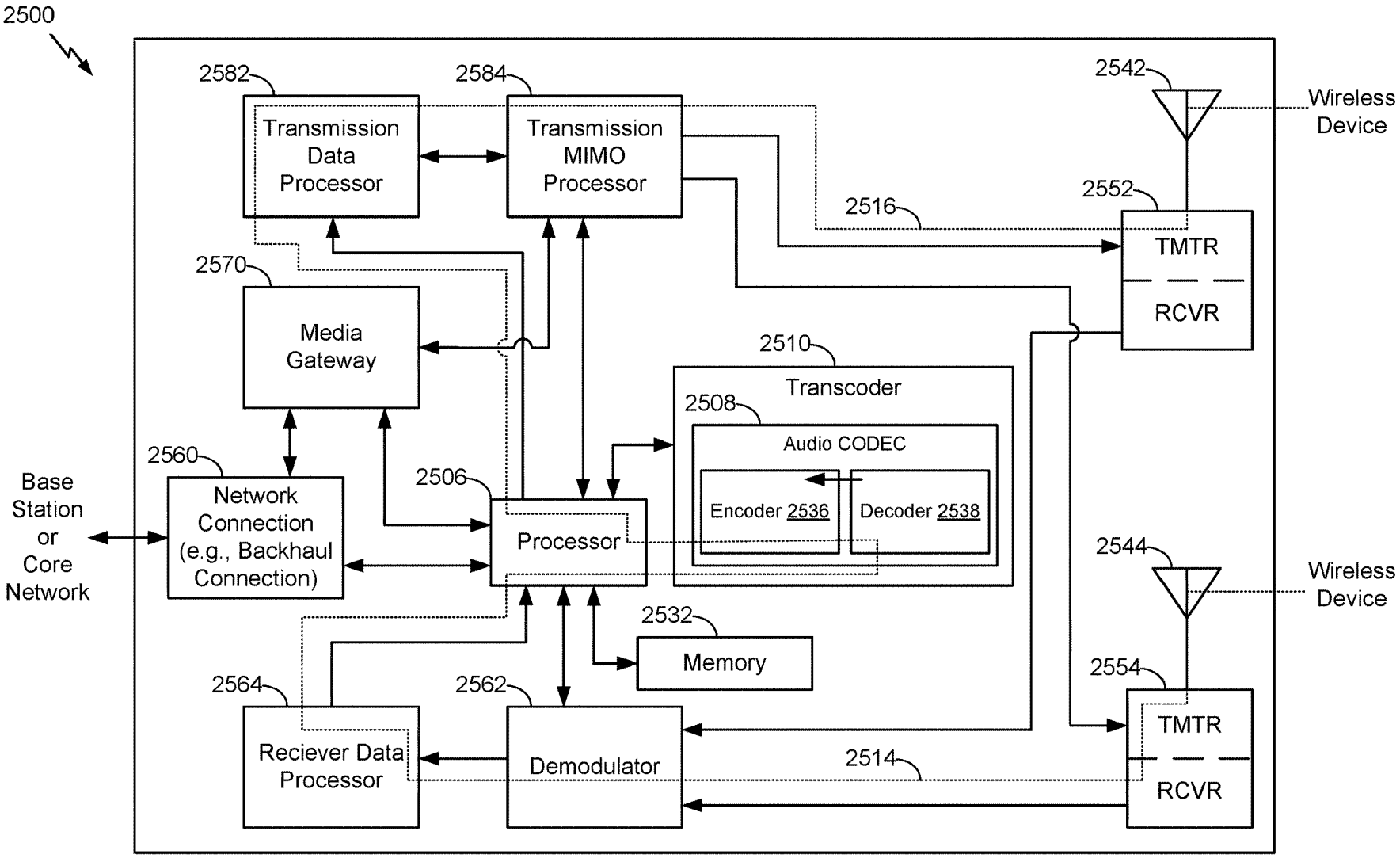
FIG. 25 is a block diagram of a base station that is operable to encode or decode audio signals.

Referring to FIG. 25, a block diagram of a particular illustrative example of a base station 2500 (e.g., a base station device) is depicted. In various implementations, the base station 2500 may have more components or fewer components than illustrated in FIG. 25. In an illustrative example, the base station 2500 may include the first device 104, the second device 106 of FIG. 1, the first device 204, the second device 206 of FIG. 2, the first device 1304, the second device 1306 of FIG. 13, or a combination thereof. In an illustrative example, the base station 2500 may operate according to one or more of the methods or systems described with reference to FIGS. 1-24.

The base station 2500 may be part of a wireless communication system. The wireless communication system may include multiple base stations and multiple wireless devices. The wireless communication system may be a Long Term Evolution (LTE) system, a Code Division Multiple Access (CDMA) system, a Global System for Mobile Communications (GSM) system, a wireless local area network (WLAN) system, or some other wireless system. A CDMA system may implement Wideband CDMA (WCDMA), CDMA 1X, Evolution-Data Optimized (EVDO), Time Division Synchronous CDMA (TD-SCDMA), or some other version of CDMA.

The wireless devices may also be referred to as user equipment (UE), a mobile station, a terminal, an access terminal, a subscriber unit, a station, etc. The wireless devices may include a cellular phone, a smartphone, a tablet, a wireless modem, a personal digital assistant (PDA), a handheld device, a laptop computer, a smartbook, a netbook, a tablet, a cordless phone, a wireless local loop (WLL)

station, a Bluetooth device, etc. The wireless devices may include or correspond to the device 2400 of FIG. 24.

Various functions may be performed by one or more components of the base station 2500 (and/or in other components not shown), such as sending and receiving messages and data (e.g., audio data). In a particular example, the base station 2500 includes a processor 2506 (e.g., a CPU). The base station 2500 may include a transcoder 2510. The transcoder 2510 may include an audio CODEC 2508. For example, the transcoder 2510 may include one or more components (e.g., circuitry) configured to perform operations of the audio CODEC 2508. As another example, the transcoder 2510 may be configured to execute one or more computer-readable instructions to perform the operations of the audio CODEC 2508. Although the audio CODEC 2508 is illustrated as a component of the transcoder 2510, in other examples one or more components of the audio CODEC 2508 may be included in the processor 2506, another processing component, or a combination thereof. For example, a decoder 2538 (e.g., a vocoder decoder) may be included in a receiver data processor 2564. As another example, an encoder 2536 (e.g., a vocoder encoder) may be included in a transmission data processor 2582.

The transcoder 2510 may function to transcode messages and data between two or more networks. The transcoder 2510 may be configured to convert message and audio data from a first format (e.g., a digital format) to a second format. To illustrate, the decoder 2538 may decode encoded signals having a first format and the encoder 2536 may encode the decoded signals into encoded signals having a second format. Additionally or alternatively, the transcoder 2510 may be configured to perform data rate adaptation. For example, the transcoder 2510 may downconvert a data rate or upconvert the data rate without changing a format the audio data. To illustrate, the transcoder 2510 may downconvert 64 kilobit per second (kbit/s) signals into 16 kbit/s signals.

The audio CODEC 2508 may include the encoder 2536 and the decoder 2538. The encoder 2536 may include at least one of the encoder 114 of FIG. 1, the encoder 214 of FIG. 2, the encoder 314 of FIG. 3, or the encoder 1314 of FIG. 13. The decoder 2538 may include at least one of the decoder 118 of FIG. 1, the decoder 218 of FIG. 2, the decoder 418 of FIG. 4, the decoder 1318 of FIG. 13, the decoder 1418 of FIG. 14, the decoder 1518 of FIG. 15, or the decoder 1618 of FIG. 16.

The base station 2500 may include a memory 2532. The memory 2532, such as a computer-readable storage device, may include instructions. The instructions may include one or more instructions that are executable by the processor 2506, the transcoder 2510, or a combination thereof, to perform one or more operations described with reference to the methods and systems of FIGS. 1-24. The base station 2500 may include multiple transmitters and receivers (e.g., transceivers), such as a first transceiver 2552 and a second transceiver 2554, coupled to an array of antennas. The array of antennas may include a first antenna 2542 and a second antenna 2544. The array of antennas may be configured to wirelessly communicate with one or more wireless devices, such as the device 2400 of FIG. 24. For example, the second antenna 2544 may receive a data stream 2514 (e.g., a bit stream) from a wireless device. The data stream 2514 may include messages, data (e.g., encoded speech data), or a combination thereof.

The base station 2500 may include a network connection 2560, such as backhaul connection. The network connection 2560 may be configured to communicate with a core network or one or more base stations of the wireless communication network. For example, the base station 2500 may receive a second data stream (e.g., messages or audio data) from a core network via the network connection 2560. The base station 2500 may process the second data stream to generate messages or audio data and provide the messages or the audio data to one or more wireless device via one or more antennas of the array of antennas or to another base station via the network connection 2560. In a particular implementation, the network connection 2560 may be a wide area network (WAN) connection, as an illustrative, non-limiting example. In some implementations, the core network may include or correspond to a Public Switched Telephone Network (PSTN), a packet backbone network, or both.

The base station 2500 may include a media gateway 2570 that is coupled to the network connection 2560 and the processor 2506. The media gateway 2570 may be configured to convert between media streams of different telecommunications technologies. For example, the media gateway 2570 may convert between different transmission protocols, different coding schemes, or both. To illustrate, the media gateway 2570 may convert from PCM signals to Real-Time Transport Protocol (RTP) signals, as an illustrative, non-limiting example. The media gateway 2570 may convert data between packet switched networks (e.g., a Voice Over Internet Protocol (VoIP) network, an IP Multimedia Subsystem (IMS), a fourth generation (4G) wireless network, such as LTE, WiMax, and UMB, etc.), circuit switched networks (e.g., a PSTN), and hybrid networks (e.g., a second generation (2G) wireless network, such as GSM, GPRS, and EDGE, a third generation (3G) wireless network, such as WCDMA, EV-DO, and HSPA, etc.).

Additionally, the media gateway 2570 may include a transcoder, such as the transcoder 2510, and may be configured to transcode data when codecs are incompatible. For example, the media gateway 2570 may transcode between an Adaptive Multi-Rate (AMR) codec and a G.711 codec, as an illustrative, non-limiting example. The media gateway 2570 may include a router and a plurality of physical interfaces. In some implementations, the media gateway 2570 may also include a controller (not shown). In a particular implementation, the media gateway controller may be external to the media gateway 2570, external to the base station 2500, or both. The media gateway controller may control and coordinate operations of multiple media gateways. The media gateway 2570 may receive control signals from the media gateway controller and may function to bridge between different transmission technologies and may add service to end-user capabilities and connections.

The base station 2500 may include a demodulator 2562 that is coupled to the transceivers 2552, 2554, the receiver data processor 2564, and the processor 2506, and the receiver data processor 2564 may be coupled to the processor 2506. The demodulator 2562 may be configured to demodulate modulated signals received from the transceivers 2552, 2554 and to provide demodulated data to the receiver data processor 2564. The receiver data processor 2564 may be configured to extract a message or audio data from the demodulated data and send the message or the audio data to the processor 2506.

The base station 2500 may include a transmission data processor 2582 and a transmission multiple input-multiple output (MIMO) processor 2584. The transmission data processor 2582 may be coupled to the processor 2506 and the transmission MIMO processor 2584. The transmission MIMO processor 2584 may be coupled to the transceivers 2552, 2554 and the processor 2506. In some implementations, the transmission MIMO processor 2584 may be coupled to the media gateway 2570. The transmission data processor 2582 may be configured to receive the messages or the audio data from the processor 2506 and to code the messages or the audio data based on a coding scheme, such as CDMA or orthogonal frequency-division multiplexing (OFDM), as an illustrative, non-limiting examples. The transmission data processor 2582 may provide the coded data to the transmission MIMO processor 2584.

The coded data may be multiplexed with other data, such as pilot data, using CDMA or OFDM techniques to generate multiplexed data. The multiplexed data may then be modulated (i.e., symbol mapped) by the transmission data processor 2582 based on a particular modulation scheme (e.g., Binary phase-shift keying ("BPSK"), Quadrature phase-shift keying ("QSPK"), M-ary phase-shift keying ("M-PSK"), M-ary Quadrature amplitude modulation ("M-QAM"), etc.) to generate modulation symbols. In a particular implementation, the coded data and other data may be modulated using different modulation schemes. The data rate, coding, and modulation for each data stream may be determined by instructions executed by processor 2506.

The transmission MIMO processor 2584 may be configured to receive the modulation symbols from the transmission data processor 2582 and may further process the modulation symbols and may perform beamforming on the data. For example, the transmission MIMO processor 2584 may apply beamforming weights to the modulation symbols. The beamforming weights may correspond to one or more antennas of the array of antennas from which the modulation symbols are transmitted.

During operation, the second antenna 2544 of the base station 2500 may receive a data stream 2514. The second transceiver 2554 may receive the data stream 2514 from the second antenna 2544 and may provide the data stream 2514 to the demodulator 2562. The demodulator 2562 may demodulate modulated signals of the data stream 2514 and provide demodulated data to the receiver data processor 2564. The receiver data processor 2564 may extract audio data from the demodulated data and provide the extracted audio data to the processor 2506.

The processor 2506 may provide the audio data to the transcoder 2510 for transcoding. The decoder 2538 of the transcoder 2510 may decode the audio data from a first format into decoded audio data and the encoder 2536 may encode the decoded audio data into a second format. In some implementations, the encoder 2536 may encode the audio data using a higher data rate (e.g., upconvert) or a lower data rate (e.g., downconvert) than received from the wireless device. In other implementations the audio data may not be transcoded. Although transcoding (e.g., decoding and encoding) is illustrated as being performed by a transcoder 2510, the transcoding operations (e.g., decoding and encoding) may be performed by multiple components of the base station 2500. For example, decoding may be performed by the receiver data processor 2564 and encoding may be performed by the transmission data processor 2582. In other implementations, the processor 2506 may provide the audio data to the media gateway 2570 for conversion to another transmission protocol, coding scheme, or both. The media gateway 2570 may provide the converted data to another base station or core network via the network connection 2560.

The encoder 2536 may generate the CP parameters 109 based on the first audio signal 130 and the second audio signal 132. The encoder 2536 may determine the downmix parameter 115. The encoder 2536 may generate the mid signal 111 and the side signal 113 based on the downmix parameter 115. The encoder 2536 may generate the bitstream parameters 102 corresponding to at least one encoded signal. For example, the bitstream parameters 102 correspond to the encoded mid signal 121. The bitstream parameters 102 may correspond to the encoded side signal 123 based on the CP parameter 109. The encoder 2536 may also generate the ICP 208 based on the CP parameter 109. Encoded audio data generated at the encoder 2536, such as transcoded data, may be provided to the transmission data processor 2582 or the network connection 2560 via the processor 2506.

The transcoded audio data from the transcoder 2510 may be provided to the transmission data processor 2582 for coding according to a modulation scheme, such as OFDM, to generate the modulation symbols. The transmission data processor 2582 may provide the modulation symbols to the transmission MIMO processor 2584 for further processing and beamforming. The transmission MIMO processor 2584 may apply beamforming weights and may provide the modulation symbols to one or more antennas of the array of antennas, such as the first antenna 2542 via the first transceiver 2552. Thus, the base station 2500 may provide a transcoded data stream 2516, that corresponds to the data stream 2514 received from the wireless device, to another wireless device. The transcoded data stream 2516 may have a different encoding format, data rate, or both, than the data stream 2514. In other implementations, the transcoded data stream 2516 may be provided to the network connection 2560 for transmission to another base station or a core network.

In a particular aspect, the decoder 2538 receives the bitstream parameters 102 and selectively the ICP 208. The decoder 2538 may determine the CP parameter 179 and the upmix parameter 175. The decoder 2538 may generate the synthesized mid signal 171. The decoder 2538 may generate the synthesized side signal 173 based on the CP parameter 179. For example, the decoder 2538 may, in response to determining that the CP parameter 179 has a first value (e.g., 0) generate the synthesized side signal 173 by decoding the bitstream parameters 102. As another example, the decoder 2538 may, in response to determining that the CP parameter 179 has a second value (e.g., 1), generate the synthesized side signal 173 based on the synthesized mid signal 171 and the ICP 208. In some implementations, the decoder 2538 may filter an intermediate synthesized side signal using an all-pass filter to generate the synthesized side signal 173, as described with reference to FIGS. 13-16. The decoder 2538 may generate the first output signal 126 and the second output signal 128 by upmixing, based on the upmix parameter 175, the synthesized mid signal 171 and the synthesized side signal 173.

The base station 2500 may include a computer-readable storage device (e.g., the memory 2532) storing instructions that, when executed by a processor (e.g., the processor 2506 or the transcoder 2510), cause the processor to perform operations including generating, at a first device, a mid signal based on a first audio signal and a second audio signal. The operations include generating a side signal based on the first audio signal and the second audio signal. The operations include generating an inter-channel prediction gain parameter based on the mid signal and the side signal. The operations further include sending the inter-channel prediction gain parameter and an encoded audio signal to a second device.

The base station 2500 may include a computer-readable storage device (e.g., the memory 2532) storing instructions that, when executed by a processor (e.g., the processor 2506 or the transcoder 2510), cause the processor to perform operations including receiving an inter-channel prediction gain parameter and an encoded audio signal at a first device from a second device. The encoded audio signal includes an encoded mid signal. The operations include generating, at the first device, a synthesized mid signal based on the encoded mid signal. The operations further include generating a synthesized side signal based on the synthesized mid signal and the inter-channel prediction gain parameter.

The base station 2500 may include a computer-readable storage device (e.g., the memory 2532) storing instructions that, when executed by a processor (e.g., the processor 2506 or the transcoder 2510), cause the processor to perform operations including generating a mid signal based on a first audio signal and a second audio signal. The operations also include generating a side signal based on the first audio signal and the second audio signal. The operations further include determining a plurality of parameters based on the first audio signal, the second audio signal, or both. The operations also include determining, based on the plurality of parameters, whether the side signal is to be encoded for transmission. The operations further include generating an encoded mid signal corresponding to the mid signal. The operations also include generating an encoded side signal corresponding to the side signal in response to determining that the side signal is to be encoded for transmission. The operations further include initiating transmission of bitstream parameters corresponding to the encoded mid signal, the encoded side signal, or both.

The base station 2500 may include a computer-readable storage device (e.g., the memory 2532) storing instructions that, when executed by a processor (e.g., the processor 2506 or the transcoder 2510), cause the processor to perform operations including generating a downmix parameter having a first value in response to determining that a coding or prediction parameter indicates that a side signal is to be encoded for transmission. The first value is based on an energy metric, a correlation metric, or both. The energy metric, the correlation metric, or both, are based on a first audio signal and a second audio signal. The operations also include generating the downmix parameter having a second value based at least in part on determining that the coding or prediction parameter indicates that the side signal is not to be encoded for transmission. The second value is based on a default downmix parameter value, the first value, or both. The operations further include generating a mid signal based on the first audio signal, the second audio signal, and the downmix parameter. The operations also include generating an encoded mid signal corresponding to the mid signal. The operations further include initiating transmission of bitstream parameters corresponding to at least the encoded mid signal.

The base station 2500 may include a computer-readable storage device (e.g., the memory 2532) storing instructions that, when executed by a processor (e.g., the processor 2506 or the transcoder 2510), cause the processor to perform operations including receiving bitstream parameters corresponding to at least an encoded mid signal. The operations also include generating a synthesized mid signal based on the bitstream parameters. The operations further include determining whether the bitstream parameters correspond to an encoded side signal. The operations also include generating a synthesized side signal based on the bitstream parameters in response to determining that the bitstream parameters correspond to the encoded side signal. The operations further include generating the synthesized side signal based at least in part on the synthesized mid signal in response to determining that the bitstream parameters do not correspond to the encoded side signal.

The base station 2500 may include a computer-readable storage device (e.g., the memory 2532) storing instructions that, when executed by a processor (e.g., the processor 2506 or the transcoder 2510), cause the processor to perform operations including receiving bitstream parameters corresponding to at least an encoded mid signal. The operations also include generating a synthesized mid signal based on the bitstream parameters. The operations further include determining whether the bitstream parameters correspond to an encoded side signal. The operations also include generating an upmix parameter having a first value in response to determining that the bitstream parameters correspond to the encoded side signal. The first value is based on a received downmix parameter. The operations further include generating the upmix parameter having a second value based at least in part on determining that the bitstream parameters do not correspond to the encoded side signal. The second value is based at least in part on a default parameter value. The operations also include generating an output signal based on at least the synthesized mid signal and the upmix parameter.

The base station 2500 may include a computer-readable storage device (e.g., the memory 2532) storing instructions that, when executed by a processor (e.g., the processor 2506 or the transcoder 2510), cause the processor to perform operations including receiving an inter-channel prediction gain parameter and an encoded audio signal at a first device from a second device. The encoded audio signal includes an encoded mid signal. The operations include generating, at the first device, a synthesized mid signal based on the encoded mid signal. The operations include generating an intermediate synthesized side signal based on the synthesized mid signal and the inter-channel prediction gain parameter. The operations further include filtering the intermediate synthesized side signal to generate a synthesized side signal.

In a particular aspect, a device includes an encoder configured to generate a mid signal based on a first audio signal and a second audio signal. The encoder is configured to generate a side signal based on the first audio signal and the second audio signal. The encoder is further configured to generate an inter-channel prediction gain parameter based on the mid signal and the side signal. The device also includes a transmitter configured to send the inter-channel prediction gain parameter and an encoded audio signal to a second device. The encoded audio signal includes an encoded mid signal. The transmitter is further configured to refrain from sending one or more audio frames of an encoded side signal responsive to sending the inter-channel prediction gain parameter. The inter-channel prediction gain parameter has a first value associated with a first audio frame of the encoded audio signal. The inter-channel prediction gain parameter had a second value associated with a second audio frame of the encoded audio signal.

In a particular implementation, the inter-channel prediction gain parameter is based on an energy level of the mid signal and an energy level of the side signal. The encoder is configured to determine a ratio of the energy level of the side signal and the energy level of the mid signal. The inter-channel prediction gain parameter is based on the ratio.

In a particular implementation, the inter-channel prediction gain parameter is based on an energy level of the side signal. In a particular implementation, the inter-channel prediction gain parameter is based on the mid signal, the side signal, and an energy level of the mid signal. The encoder is configured to generate a ratio of the energy level of the mid signal and a dot product of the mid signal and the side signal. The inter-channel prediction gain parameter is based on the ratio.

In a particular implementation, the inter-channel prediction gain parameter is based on a synthesized mid signal, the side signal, and an energy level of the synthesized mid signal. The encoder is configured to generate a ratio of the energy level of the synthesized mid signal and a dot product of the synthesized mid signal and the side signal. The inter-channel prediction gain parameter is based on the ratio. In a particular implementation, the encoder is configured to apply one or more filters to the mid signal and the side signal prior to generating the inter-channel prediction gain parameter. In a particular implementation, the encoder and the transmitter are integrated into a mobile device. In a particular implementation, the encoder and the transmitter are integrated into a base station.

In a particular aspect, a method includes generating, at a first device, a mid signal based on a first audio signal and a second audio signal. The method includes generating a side signal based on the first audio signal and the second audio signal. The method includes generating an inter-channel prediction gain parameter based on the mid signal and the side signal. The method further includes sending the inter-channel prediction gain parameter and an encoded audio signal to a second device. In a particular implementation, the first device includes a mobile device. In a particular implementation, the first device includes a base station.

The method includes downsampling the first audio signal to generate a first downsampled audio signal. The method also includes downsampling the second audio signal to generate a second downsampled audio signal. The inter-channel prediction gain parameter is based on the first downsampled audio signal and the second downsampled audio signal. The inter-channel prediction gain parameter is determined at an input sampling rate associated with the first audio signal and the second audio signal.

The method includes performing a smoothing operation on the inter-channel prediction gain parameter prior to sending the inter-channel prediction gain parameter to the second device. In a particular implementation, the smoothing operation is based on a fixed smoothing factor. In a particular implementation, the smoothing operation is based on an adaptive smoothing factor. In a particular implementation, the adaptive smoothing factor is based on a signal energy of the mid signal. In a particular implementation, the adaptive smoothing factor is based on a voicing parameter associated with the mid signal.

The method includes processing the mid signal to generate a low-band mid signal and a high-band mid signal. The method also includes processing the side signal to generate a low-band side signal and a high-band side signal. The method further includes generating the inter-channel prediction gain parameter based on the low-band mid signal and the low-band side signal. The method further includes generating a second inter-channel prediction gain parameter based on the high-band mid signal and the high-band side signal. The method also includes sending the second inter-channel prediction gain parameter with the inter-channel prediction gain parameter and the encoded audio signal to the second device.

The method includes generating a correlation parameter based on the mid signal and the side signal. The method also includes sending the correlation parameter with the inter-channel prediction gain parameter and the encoded audio signal to the second device. In a particular implementation, the inter-channel prediction gain parameter is based on a ratio of an energy level of the side signal and an energy level of the mid signal. In a particular implementation, the correlation parameter is based on a ratio of the energy level of the mid signal and a dot product of the mid signal and the side signal.

In a particular aspect, a device includes an encoder and a transmitter. The encoder is configured to generate a mid signal based on a first audio signal and a second audio signal. The encoder is also configured to generate a side signal based on the first audio signal and the second audio signal. The encoder is further configured to determine a plurality of parameters based on the first audio signal, the second audio signal, or both. The encoder is also configured to determine, based on the plurality of parameters, whether the side signal is to be encoded for transmission. The encoder is further configured to generate an encoded mid signal corresponding to the mid signal. The encoder is also configured to generate an encoded side signal corresponding to the side signal in response to determining that the side signal is to be encoded for transmission. The transmitter is configured to transmit bitstream parameters corresponding to the encoded mid signal, the encoded side signal, or both.

In a particular implementation, the encoder is further configured to, in response to determining that the side signal is to be encoded for transmission, generate a coding or prediction parameter having a first value. The transmitter is configured to transmit the coding or prediction parameter.

In a particular implementation, the encoder is further configured to determine a temporal mismatch value indicative of an amount of a temporal mismatch between first samples of the first audio signal and first particular samples of the second audio signal. The encoder is also configured to determine that the side signal is to be encoded for transmission based on determining that the temporal mismatch value satisfies a mismatch threshold. In a particular implementation, the encoder is further configured to determine a temporal mismatch stability indicator based on a comparison of the temporal mismatch value and a second temporal mismatch value. The second temporal mismatch value is based at least in part on second samples of the first audio signal. The encoder is also configured to determine that the side signal is to be encoded for transmission based on determining that the temporal mismatch stability indicator satisfies a temporal mismatch stability threshold. The plurality of parameters includes the temporal mismatch stability indicator.

In a particular implementation, the encoder is further configured to determine an inter-channel gain parameter corresponding to an energy ratio of first energy of first samples of the first audio signal and first particular energy of first particular samples of the second audio signal. The encoder is also configured to determine that the side signal is to be encoded for transmission based on determining that the inter-channel gain parameter satisfies an inter-channel gain threshold. The plurality of parameters includes the inter-channel gain parameter.

In a particular implementation, the encoder is further configured to determine an inter-channel gain parameter corresponding to an energy ratio of first energy of first samples of the first audio signal and first particular energy of first particular samples of the second audio signal. The encoder is also configured to determine a smoothed inter-channel gain parameter based on the inter-channel gain parameter and a second inter-channel gain parameter. The second inter-channel gain parameter is based at least in part on second energy of second samples of the first audio signal.

The encoder is further configured to determine that the side signal is to be encoded for transmission based on determining that the smoothed inter-channel gain parameter satisfies a smoothed inter-channel gain threshold. The plurality of parameters includes the smoothed inter-channel gain parameter.

In a particular implementation, the encoder is further configured to determine an inter-channel gain parameter corresponding to an energy ratio of first energy of first samples of the first audio signal and first particular energy of first particular samples of the second audio signal. The encoder is also configured to determine a smoothed inter-channel gain parameter based on the inter-channel gain parameter and a second inter-channel gain parameter. The second inter-channel gain parameter is based at least in part on second energy of second samples of the first audio signal. The encoder is further configured to determine an inter-channel gain reliability indicator based on a comparison of the inter-channel gain parameter and the smoothed inter-channel gain parameter. The encoder is also configured to determine that the side signal is to be encoded for transmission based on determining that the inter-channel gain reliability indicator satisfies an inter-channel gain reliability threshold. The plurality of parameters includes the inter-channel gain reliability indicator.

In a particular implementation, the encoder is further configured to determine an inter-channel gain parameter corresponding to an energy ratio of first energy of first samples of the first audio signal and first particular energy of first particular samples of the second audio signal. The encoder is also configured to determine an inter-channel gain stability indicator based on a comparison of the inter-channel gain parameter and a second inter-channel gain parameter. The second inter-channel gain parameter is based at least in part on second energy of second samples of the first audio signal. The encoder is further configured to determine that the side signal is to be encoded for transmission based on determining that the inter-channel gain stability indicator satisfies an inter-channel gain stability threshold. The plurality of parameters includes the inter-channel gain stability indicator. In a particular implementation, the plurality of parameters includes at least one of a speech decision parameter, a core type, or a transient indicator.

In a particular implementation, the encoder is further configured to determine an inter-channel prediction gain value based on energy of the side signal, energy of the mid signal, or both. The encoder is also configured to determine that the side signal is to be encoded for transmission based on determining that the inter-channel prediction gain value satisfies an inter-channel prediction gain threshold. The plurality of parameters includes the inter-channel prediction gain value.

In a particular implementation, the encoder is further configured to generate a synthesized mid signal based on the encoded mid signal. The encoder is also configured to determine an inter-channel prediction gain value based on energy of the side signal and energy of the synthesized mid signal. The encoder is further configured to determine that the side signal is to be encoded for transmission based on determining that the inter-channel prediction gain value satisfies an inter-channel prediction gain threshold. The plurality of parameters includes the inter-channel prediction gain value.

In a particular implementation, the encoder is further configured to generate the encoded side signal corresponding to the side signal. The encoder is also configured to generate a synthesized side signal based on the encoded side signal. The encoder is further configured to determine an inter-channel prediction gain value based on energy of the side signal and energy of the synthesized side signal. The encoder is also configured to determine that the side signal is to be encoded based on determining that the inter-channel prediction gain value satisfies an inter-channel prediction gain threshold. The plurality of parameters includes the inter-channel prediction gain value.

In a particular implementation, the encoder, the transmitter, and the antenna are integrated into a mobile device. In a particular implementation, the encoder, the transmitter, and the antenna are integrated into a base station device.

In a particular aspect, a method includes generating, at a device, a mid signal based on a first audio signal and a second audio signal. The method also includes generating, at the device, a side signal based on the first audio signal and the second audio signal. The method further includes determining, at the device, a plurality of parameters based on the first audio signal, the second audio signal, or both. The method also includes determining, based on the plurality of parameters, whether the side signal is to be encoded for transmission. The method further includes generating, at the device, an encoded mid signal corresponding to the mid signal. The method also includes generating, at the device, an encoded side signal corresponding to the side signal in response to determining that the side signal is to be encoded for transmission. The method further includes initiating transmission, from the device, of bitstream parameters corresponding to the encoded mid signal, the encoded side signal, or both.

In a particular implementation, the method includes generating, at the device, an coding or prediction parameter indicating whether the side signal is to be encoded for transmission. The method also includes transmitting the coding or prediction parameter from the device.

In a particular aspect, a computer-readable storage device stores instructions that, when executed by a processor, cause the processor to perform operations including generating a mid signal based on a first audio signal and a second audio signal. The operations also include generating a side signal based on the first audio signal and the second audio signal. The operations further include determining a plurality of parameters based on the first audio signal, the second audio signal, or both. The operations also include determining, based on the plurality of parameters, whether the side signal is to be encoded for transmission. The operations further include generating an encoded mid signal corresponding to the mid signal. The operations also include generating an encoded side signal corresponding to the side signal in response to determining that the side signal is to be encoded for transmission. The operations further include initiating transmission of bitstream parameters corresponding to the encoded mid signal, the encoded side signal, or both.

In a particular implementation, the plurality of parameters include at least one of a temporal mismatch value, a temporal mismatch stability indicator, an inter-channel gain parameter, a smoothed inter-channel gain parameter, an inter-channel gain reliability indicator, an inter-channel gain stability indicator, a speech decision parameter, a core type, a transient indicator, or an inter-channel predication gain value.

In a particular aspect, a device includes an encoder and a transmitter. The encoder is configured to generate a downmix parameter having a first value in response to determining that a coding or prediction parameter indicates that a side signal is to be encoded for transmission. The first value is based on an energy metric, a correlation metric, or both. The energy metric, the correlation metric, or both, are based on a first audio signal and a second audio signal. The encoder is also configured to generate the downmix parameter having a second value based at least in part on determining that the coding or prediction parameter indicates that the side signal is not to be encoded for transmission. The second value is based on a default downmix parameter value, the first value, or both. The encoder is further configured to generate a mid signal based on the first audio signal, the second audio signal, and the downmix parameter. The encoder is also configured to generate an encoded mid signal corresponding to the mid signal. The transmitter is configured to transmit bitstream parameters corresponding to at least the encoded mid signal.

In a particular implementation, the encoder is configured to determine first energy of the first audio signal, to determine second energy of the second audio signal, and to determine the first value based on a comparison of the first energy and the second energy. In a particular implementation, the encoder is configured to generate the side signal based on the first audio signal, the second audio signal, and the downmix parameter. The encoder is also configured to, in response to determining that the coding or prediction parameter indicates that the side signal is to be encoded for transmission, generate an encoded side signal corresponding to the side signal. The bitstream parameters also correspond to the encoded side signal.

In a particular implementation, the encoder is configured to generate the downmix parameter having the second value further conditioned upon a criterion being satisfied. The encoder is configured to generate the downmix parameter having the first value further conditioned upon the criterion not being satisfied.

In a particular implementation, the encoder is configured to generate a first side signal based on the first audio signal, the second audio signal, and the first value. The encoder is also configured to generate a second side signal based on the first audio signal, the second audio signal, and the second value. The encoder is further configured to determine an energy comparison value based on a comparison of first energy of the first side signal and second energy of the second side signal. The encoder is also configured to determine that the criterion is satisfied in response to determining that the energy comparison value satisfies an energy threshold.

In a particular implementation, the encoder is configured to select, based on a temporal mismatch value, first samples of the first audio signal and second samples of the second audio signal. The temporal mismatch value indicates an amount of temporal mismatch between the first audio signal and the second audio signal. The encoder is also configured to determine a cross-correlation value based on a comparison of the first samples and the second samples. The encoder is further configured to determine that the criterion is satisfied in response to determining that the cross-correlation value satisfies a cross-correlation threshold.

In a particular implementation, the encoder is configured to determine that the criterion is satisfied in response to determining that a temporal mismatch value satisfies a mismatch threshold. In a particular implementation, the encoder is configured to determine whether the criterion is satisfied based on at least one of a coder type, a core type, or a speech decision parameter.

In a particular implementation, the transmitter is configured to transmit the first value. In a particular implementation, the transmitter is configured to transmit the downmix parameter. For example, the transmitter is configured to transmit the downmix parameter in response to determining that a value of the downmix parameter differs from the default downmix parameter value. As another example, the transmitter is configured to transmit the downmix parameter in response to determining that the downmix parameter is based on one or more parameters that are unavailable at a decoder.

In a particular implementation, the encoder is configured to determine the second value further based on a voicing factor. In a particular implementation, the encoder is configured to select, based on a temporal mismatch value, first samples of the first audio signal and second samples of the second audio signal. The temporal mismatch value indicates an amount of temporal mismatch between the first audio signal and the second audio signal. The encoder is also configured to determine a cross-correlation value based on a comparison of the first samples and the second samples. The second value is based on the cross-correlation value.

In a particular implementation, the device includes an antenna coupled to the transmitter. In a particular implementation, the antenna, the encoder, and the transmitter are integrated into a mobile device. In a particular implementation, the antenna, the encoder, and the transmitter are integrated into a base station.

In a particular aspect, a method includes generating, at a device, a downmix parameter having a first value in response to determining that a coding or prediction parameter indicates that a side signal is to be encoded for transmission. The first value is based on an energy metric, a correlation metric, or both. The energy metric, the correlation metric, or both, are based on a first audio signal and a second audio signal. The method also includes generating, at the device, the downmix parameter having a second value based at least in part on determining that the coding or prediction parameter indicates that the side signal is not to be encoded for transmission. The second value is based on a default downmix parameter value, the first value, or both. The method further includes generating, at the device, a mid signal based on the first audio signal, the second audio signal, and the downmix parameter. The method also includes generating, at the device, an encoded mid signal corresponding to the mid signal. The method further includes initiating transmission, from the device, of bitstream parameters corresponding to at least the encoded mid signal.

In a particular implementation, the method includes generating, at the device, the side signal based on the first audio signal, the second audio signal, and the downmix parameter. The method also includes generating, at the device, an encoded side signal corresponding to the side signal in response to determining that the coding or prediction parameter indicates that the side signal is to be encoded for transmission. The bitstream parameters also correspond to the encoded side signal.

In a particular aspect, a computer-readable storage device stores instructions that, when executed by a processor, cause the processor to perform operations including generating a downmix parameter having a first value in response to determining that a coding or prediction parameter indicates that a side signal is to be encoded for transmission. The first value is based on an energy metric, a correlation metric, or both. The energy metric, the correlation metric, or both, are based on a first audio signal and a second audio signal. The operations also include generating the downmix parameter having a second value based at least in part on determining that the coding or prediction parameter indicates that the side signal is not to be encoded for transmission. The second value is based on a default downmix parameter value, the first value, or both. The operations further include generating a mid signal based on the first audio signal, the second audio signal, and the downmix parameter. The operations also include generating an encoded mid signal corresponding to the mid signal. The operations further include initiating transmission of bitstream parameters corresponding to at least the encoded mid signal.

In a particular implementation, the operations include determining whether a criterion is satisfied based on at least one of temporal mismatch value, a coder type, a core type, or a speech decision parameter. The downmix parameter has the second value further conditioned upon the criterion being satisfied.

Those of skill would further appreciate that the various illustrative logical blocks, configurations, modules, circuits, and algorithm steps described in connection with the aspects disclosed herein may be implemented as electronic hardware, computer software executed by a processing device such as a hardware processor, or combinations of both. Various illustrative components, blocks, configurations, modules, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the aspects disclosed herein may be embodied directly in hardware, in a software module executed by a processor, or in a combination of the two. A software module may reside in a memory device, such as random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). An exemplary memory device is coupled to the processor such that the processor can read information from, and write information to, the memory device. In the alternative, the memory device may be integral to the processor. The processor and the storage medium may reside in an application-specific integrated circuit (ASIC). The ASIC may reside in a computing device or a user terminal. In the alternative, the processor and the storage medium may reside as discrete components in a computing device or a user terminal.

The previous description of the disclosed aspects is provided to enable a person skilled in the art to make or use the disclosed aspects. Various modifications to these aspects will be readily apparent to those skilled in the art, and the principles defined herein may be applied to other aspects without departing from the scope of the disclosure. Thus, the present disclosure is not intended to be limited to the aspects shown herein but is to be accorded the widest scope possible consistent with the principles and novel features as defined by the following claims.

What is claimed is:

1. A device comprising:

a receiver configured to receive bitstream parameters corresponding to at least an encoded mid signal; and a decoder configured to:

generate a synthesized mid signal based on the bitstream parameters; and generate a synthesized side signal selectively based on the bitstream parameters in response to determining whether the bitstream parameters correspond to an encoded side signal.

2. The device of claim 1, wherein the decoder is configured to generate the synthesized side signal based on the bitstream parameters in response to determining that the bitstream parameters correspond to the encoded side signal.

3. The device of claim 1, wherein the decoder is configured to generate the synthesized side signal based at least in part on the synthesized mid signal in response to determining that the bitstream parameters do not correspond to the encoded side signal.

4. The device of claim 1, wherein the receiver is further configured to receive a coding or prediction parameter, and wherein the decoder is configured to determine whether the bitstream parameters correspond to the encoded side signal based on the coding or prediction parameter having a first value or a second value.

5. The device of claim 1, wherein the decoder is further configured to determine whether the bitstream parameters correspond to the encoded side signal based on a plurality of coding parameters and independently of receiving a coding or prediction parameter.

6. The device of claim 5, wherein the plurality of coding parameters includes at least one of a temporal mismatch value, an inter-channel gain parameter, an inter-channel prediction gain value, a speech decision parameter, a core type, or a transient indicator.

7. The device of claim 5, wherein the receiver is further configured to receive one or more of the plurality of coding parameters.

8. The device of claim 5, wherein the decoder is further configured to determine one or more of the plurality of coding parameters based on the synthesized mid signal.

9. The device of claim 1, further comprising an antenna coupled to the receiver.

10. The device of claim 9, wherein the decoder, the receiver, and the antenna are integrated into a mobile device.

11. The device of claim 9, wherein the decoder, the receiver, and the antenna are integrated into a base station device.

12. A method of communication comprising:

receiving, at a device, bitstream parameters corresponding to at least an encoded mid signal;

generating, at the device, a synthesized mid signal based on the bitstream parameters; and generating, at the device, a synthesized side signal selectively based on the bitstream parameters in response to determining whether the bitstream parameters correspond to an encoded side signal.

13. The method of claim 12, further comprising generating, at the device, the synthesized side signal based on the bitstream parameters in response to determining that the bitstream parameters correspond to the encoded side signal.

14. The method of claim 12, further comprising generating, at the device, the synthesized side signal based at least in part on the synthesized mid signal in response to determining that the bitstream parameters do not correspond to the encoded side signal.

15. The method of claim 12, further comprising:

receiving, at the device, a coding or prediction parameter; and determining, based on the coding or prediction parameter, whether the bitstream parameters correspond to the encoded side signal.

16. The method of claim 15, further comprising determining that the bitstream parameters correspond to the encoded side signal based on determining that the coding or prediction parameter has a first value.

17. The method of claim 15, further comprising determining that the bitstream parameters do not correspond to the encoded side signal based on determining that the coding or prediction parameter has a second value.

18. The method of claim 12, further comprising determining whether the bitstream parameters correspond to the encoded side signal based on at least one of a coding or prediction parameter, a temporal mismatch value, a temporal mismatch stability indicator, an inter-channel gain parameter, a smoothed inter-channel gain parameter, an inter-channel gain reliability indicator, an inter-channel gain stability indicator, a speech decision parameter, a core type, a transient indicator, or an inter-channel predication gain value.

19. The method of claim 12, further comprising:

receiving an inter-channel gain parameter at the device; and determining that the bitstream parameters correspond to the encoded side signal based on determining that the inter-channel gain parameter satisfies an inter-channel gain threshold.

20. A non-transitory computer-readable storage medium storing instructions that, when executed by a processor, cause the processor to perform operations comprising:

receiving bitstream parameters corresponding to at least an encoded mid signal;

generating a synthesized mid signal based on the bitstream parameters; and generating a synthesized side signal selectively based on the bitstream parameters in response to determining whether the bitstream parameters correspond to an encoded side signal.

21. The non-transitory computer-readable storage medium of claim 20, wherein the operations further comprise generating the synthesized side signal based on the bitstream parameters in response to determining that the bitstream parameters correspond to the encoded side signal.

22. The non-transitory computer-readable storage medium of claim 20, wherein the operations further comprise generating the synthesized side signal based at least in part on the synthesized mid signal in response to determining that the bitstream parameters do not correspond to the encoded side signal.

23. The non-transitory computer-readable storage medium of claim 20, wherein the operations further comprise determining whether the bitstream parameters correspond to an encoded side signal based on at least one of a coding or prediction parameter, a temporal mismatch value, a temporal mismatch stability indicator, an inter-channel gain parameter, a smoothed inter-channel gain parameter, an inter-channel gain reliability indicator, an inter-channel gain stability indicator, a speech decision parameter, a core type, a transient indicator, or an inter-channel predication gain value.

24. The non-transitory computer-readable storage medium of claim 20, wherein the operations further comprise:

receiving a coding or prediction parameter; and determining whether the bitstream parameters correspond to the encoded side signal based on the coding or prediction parameter having a first value or a second value.

25. The non-transitory computer-readable storage medium of claim 20, wherein the operations further comprise determining whether the bitstream parameters correspond to the encoded side signal based on a plurality of coding parameters and independently of receiving a coding or prediction parameter.

26. The non-transitory computer-readable storage medium of claim 25, wherein the plurality of coding parameters includes at least one of a temporal mismatch value, an inter-channel gain parameter, an inter-channel prediction gain value, a speech decision parameter, a core type, or a transient indicator.

27. The non-transitory computer-readable storage medium of claim 20, wherein the operations further comprise:

receiving an inter-channel gain parameter; and determining that the bitstream parameters correspond to the encoded side signal based on determining that the inter-channel gain parameter satisfies an inter-channel gain threshold.

28. The non-transitory computer-readable storage medium of claim 20, wherein the operations further comprise:

receiving a temporal mismatch value; and determining that the bitstream parameters correspond to the encoded side signal based on determining that the temporal mismatch value satisfies a threshold.

29. A device comprising:

means for receiving bitstream parameters corresponding to at least an encoded mid signal; and means for generating a synthesized mid signal and a synthesized side signal, wherein the synthesized mid signal is based on the bitstream parameters, and wherein the synthesized side signal is selectively based on the bitstream parameters in response to a determination whether the bitstream parameters correspond to an encoded side signal.

30. The device of claim 29, wherein the means for receiving and the means for generating are integrated into at least one of a mobile phone, base station, a communication device, a computer, a music player, a video player, an entertainment unit, a navigation device, a personal digital assistant (PDA), a decoder, or a set top box.

* * * * *